US009898899B2

(12) United States Patent
Kojima et al.

(10) Patent No.: US 9,898,899 B2
(45) Date of Patent: Feb. 20, 2018

(54) GAMING MACHINE

(71) Applicants: Universal Entertainment Corporation, Koto-ku, Tokyo (JP); Aruze Gaming America, Inc., Las Vegas, NV (US)

(72) Inventors: Keiichi Kojima, Tokyo (JP); Hiroshi Takahashi, Tokyo (JP); Tetsuya Yokota, Tokyo (JP); Yukinori Inamura, Tokyo (JP); Takeshi Narita, Tokyo (JP); Yuji Miyagawa, Tokyo (JP); Takuto Nakayama, Tokyo (JP); Atsuya Takano, Tokyo (JP); Erika Turchi, Tokyo (JP); Toshihiko Honda, Tokyo (JP); Keisuke Kajino, Tokyo (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 102 days.

(21) Appl. No.: 14/820,042

(22) Filed: Aug. 6, 2015

(65) Prior Publication Data

US 2016/0042614 A1 Feb. 11, 2016

(30) Foreign Application Priority Data

Aug. 7, 2014 (JP) ..... 2014-161678
Feb. 24, 2015 (JP) ..... 2015-033812

(51) Int. Cl.
*G07F 17/00* (2006.01)
*G07F 17/34* (2006.01)
*G07F 17/32* (2006.01)

(52) U.S. Cl.
CPC ..... *G07F 17/34* (2013.01); *G07F 17/326* (2013.01); *G07F 17/3213* (2013.01)

(58) Field of Classification Search
CPC ..... G07F 17/34
See application file for complete search history.

(56) References Cited

U.S. PATENT DOCUMENTS 9,640,026 B2 * 5/2017 Mizue ..... G07F 17/3213
2005/0239540 A1 10/2005 Inamura
2008/0032776 A1 * 2/2008 Okada ..... G07F 17/34 463/20
2008/0182650 A1 * 7/2008 Randall ..... G07F 17/32 463/25

* cited by examiner

*Primary Examiner* — Reginald Renwick
(74) *Attorney, Agent, or Firm* — Simpson & Simpson, PLLC; S. Peter Konzel

(57) ABSTRACT

Probability of prize occurrence is easily controlled without provision of a blank between symbols on a reel. A gaming machine comprises: a lower image display panel configured to variably display a plurality of symbol arrays with a plurality of symbols including normal symbols and specific symbols more advantageous than the normal symbols, and then display a game result by rearranging the symbols in a symbol display region containing a matrix of cells; bet buttons capable of receiving a bet; and a controller configured to run a normal game which rearranges symbols on the symbol display device on condition that a bet is placed, the controller is configured to modify the symbols arrayed in the plurality of symbol arrays, so that the ratios of the specific symbols to the total number of the symbols in all the symbol arrays increases with an increase in the bet amount.

8 Claims, 78 Drawing Sheets

FIG.3

| | | SYMBOL | 1 | 2 | 3 | 4 | 5 |
|---|---|---|---|---|---|---|---|
| 501 | 505 505a | WILD | 0 | 0 | 0 | 0 | 0 |
| | 505 505b | 2xWILD | 0 | 0 | 0 | 0 | 0 |
| | 503 503a | DRAGON | 0 | 0 | 58 | 188 | 688 |
| | 503 503b | POT | 0 | 0 | 25 | 60 | 300 |
| | 503 503c | FISH | 0 | 0 | 20 | 45 | 125 |
| | 503 503d | GOURD | 0 | 0 | 15 | 30 | 100 |
| | 503 503e | BAT | 0 | 0 | 10 | 15 | 60 |
| | 502 | ACE | 0 | 0 | 5 | 10 | 25 |
| | 502 | KING | 0 | 0 | 5 | 10 | 25 |
| | 502 | QUEEN | 0 | 0 | 5 | 10 | 25 |
| | 502 | JACK | 0 | 0 | 5 | 10 | 25 |
| | 502 | TEN | 0 | 0 | 5 | 10 | 25 |
| | 502 | NINE | 0 | 0 | 5 | 10 | 25 |
| | 504 | TRIGGER | 0 | 0 | 3 | 8 | 58 |

FIG.4

| NO. | REEL 1 | REEL 2 | REEL 3 | REEL 4 | REEL 5 |
|---|---|---|---|---|---|
| 0 | ACE | TRIGGER | TRIGGER | TRIGGER | TRIGGER |
| 1 | ACE | BAT | BAT | BAT | JACK |
| 2 | ACE | BAT | QUEEN | BAT | TEN |
| 3 | TRIGGER | BAT | TRIGGER | NINE | TEN |
| 4 | BAT | TRIGGER | NINE | TRIGGER | QUEEN |
| 5 | BAT | KING | QUEEN | BAT | ACE |
| 6 | BAT | KING | QUEEN | KING | NINE |
| 7 | TRIGGER | BAT | NINE | NINE | ACE |
| 8 | ACE | KING | QUEEN | NINE | ACE |
| 9 | ACE | KING | KING | QUEEN | JACK |
| 10 | KING | TEN | NINE | NINE | ACE |
| 11 | ACE | WILD | QUEEN | NINE | ACE |
| 12 | ACE | KING | BAT | QUEEN | ACE |
| 13 | JACK | TEN | NINE | NINE | ACE |
| 14 | ACE | QUEEN | QUEEN | NINE | ACE |
| 15 | ACE | TEN | 2WILD | QUEEN | ACE |
| 16 | ACE | KING | QUEEN | NINE | ACE |
| 17 | JACK | TRIGGER | QUEEN | NINE | ACE |
| 18 | ACE | KING | NINE | QUEEN | ACE |
| 19 | ACE | TEN | QUEEN | NINE | TEN |
| 20 | JACK | TEN | QUEEN | NINE | ACE |
| 21 | JACK | KING | NINE | QUEEN | ACE |
| 22 | ACE | TEN | QUEEN | NINE | TEN |
| 23 | ACE | TEN | QUEEN | NINE | ACE |
| 24 | JACK | KING | JACK | QUEEN | TEN |
| 25 | ACE | KING | TEN | NINE | TEN |
| 26 | ACE | TEN | QUEEN | QUEEN | JACK |
| 27 | JACK | TEN | QUEEN | NINE | ACE |
| 28 | ACE | KING | NINE | NINE | TEN |
| 29 | ACE | TEN | NINE | QUEEN | TEN |
| 30 | BAT | TEN | QUEEN | NINE | KING |
| 31 | JACK | NINE | NINE | QUEEN | ACE |
| 32 | JACK | TEN | NINE | NINE | ACE |
| 33 | ACE | KING | QUEEN | NINE | JACK |
| 34 | NINE | TEN | QUEEN | QUEEN | JACK |
| 35 | ACE | TEN | ACE | QUEEN | TEN |
| 36 | JACK | KING | NINE | WILD | JACK |
| 37 | JACK | TEN | NINE | QUEEN | JACK |
| 38 | ACE | KING | QUEEN | QUEEN | ACE |
| 39 | JACK | KING | NINE | NINE | BAT |

| NO. | REEL 1 | REEL 2 | REEL 3 | REEL 4 | REEL 5 |
|---|---|---|---|---|---|
| 40 | JACK | TEN | NINE | QUEEN | JACK |
| 41 | ACE | KING | QUEEN | QUEEN | TEN |
| 42 | JACK | ACE | NINE | NINE | ACE |
| 43 | BAT | KING | NINE | JACK | TEN |
| 44 | ACE | TRIGGER | QUEEN | QUEEN | ACE |
| 45 | JACK | KING | TRIGGER | QUEEN | ACE |
| 46 | ACE | TEN | NINE | NINE | ACE |
| 47 | TRIGGER | TEN | NINE | QUEEN | TEN |
| 48 | JACK | KING | QUEEN | QUEEN | ACE |
| 49 | TEN | JACK | NINE | NINE | ACE |
| 50 | ACE | KING | NINE | QUEEN | ACE |
| 51 | ACE | KING | QUEEN | TRIGGER | BAT |
| 52 | JACK | TEN | NINE | QUEEN | ACE |
| 53 | ACE | TEN | NINE | QUEEN | ACE |
| 54 | ACE | KING | TRIGGER | NINE | BAT |
| 55 | ACE | TEN | NINE | QUEEN | TEN |
| 56 | JACK | KING | NINE | QUEEN | TEN |
| 57 | GOURD | TEN | TRIGGER | NINE | BAT |
| 58 | JACK | KING | NINE | ACE | BAT |
| 59 | ACE | TEN | NINE | TEN | BAT |
| 60 | QUEEN | GOURD | GOURD | GOURD | GOURD |
| 61 | JACK | FISH | FISH | FISH | FISH |
| 62 | ACE | POT | POT | POT | POT |
| 63 | ACE | DRAGON | DRAGON | DRAGON | DRAGON |
| 64 | FISH | KING | | | |
| 65 | POT | KING | | | |
| 66 | DRAGON | TEN | | | |
| 67 | ACE | TEN | | | |
| 68 | ACE | | | | |
| 69 | JACK | | | | |
| 70 | ACE | | | | |
| 71 | ACE | | | | |
| 72 | JACK | | | | |
| 73 | ACE | | | | |
| 74 | ACE | | | | |
| 75 | JACK | | | | |
| 76 | ACE | | | | |
| 77 | ACE | | | | |
| 78 | JACK | | | | |

FIG.5

| NO. | REEL 1 | REEL 2 | REEL 3 | REEL 4 | REEL 5 |
|---|---|---|---|---|---|
| 0 | TRIGGER | TRIGGER | TRIGGER | TRIGGER | TRIGGER |
| 1 | GOURD | GOURD | GOURD | GOURD | JACK |
| 2 | GOURD | GOURD | ACE | GOURD | GOURD |
| 3 | GOURD | GOURD | TRIGGER | ACE | TEN |
| 4 | TRIGGER | TRIGGER | NINE | TRIGGER | QUEEN |
| 5 | ACE | KING | ACE | GOURD | ACE |
| 6 | BAT | KING | GOURD | ACE | NINE |
| 7 | BAT | QUEEN | KING | JACK | ACE |
| 8 | ACE | KING | QUEEN | NINE | BAT |
| 9 | ACE | KING | KING | BAT | JACK |
| 10 | BAT | QUEEN | QUEEN | ACE | ACE |
| 11 | ACE | WILD | JACK | KING | KING |
| 12 | TEN | KING | BAT | ACE | TEN |
| 13 | BAT | JACK | KING | JACK | QUEEN |
| 14 | TEN | JACK | QUEEN | ACE | BAT |
| 15 | ACE | TEN | 2xWILD | BAT | KING |
| 16 | ACE | KING | KING | JACK | QUEEN |
| 17 | TEN | TRIGGER | TEN | NINE | BAT |
| 18 | TEN | GOURD | TEN | KING | ACE |
| 19 | BAT | JACK | NINE | QUEEN | NINE |
| 20 | TEN | KING | TEN | NINE | BAT |
| 21 | ACE | QUEEN | NINE | KING | TEN |
| 22 | BAT | QUEEN | ACE | QUEEN | QUEEN |
| 23 | ACE | BAT | QUEEN | JACK | BAT |
| 24 | NINE | BAT | JACK | QUEEN | KING |
| 25 | ACE | KING | TEN | TEN | QUEEN |
| 26 | ACE | JACK | JACK | KING | JACK |
| 27 | GOURD | JACK | BAT | JACK | TEN |
| 28 | TEN | KING | BAT | ACE | ACE |
| 29 | TEN | JACK | NINE | JACK | ACE |
| 30 | GOURD | NINE | ACE | BAT | KING |
| 31 | JACK | QUEEN | TEN | KING | QUEEN |

| NO. | REEL 1 | REEL 2 | REEL 3 | REEL 4 | REEL 5 |
|---|---|---|---|---|---|
| 32 | ACE | TEN | ACE | TEN | ACE |
| 33 | TEN | KING | KING | TEN | NINE |
| 34 | TEN | NINE | KING | ACE | NINE |
| 35 | ACE | JACK | ACE | QUEEN | JACK |
| 36 | NINE | NINE | QUEEN | WILD | ACE |
| 37 | BAT | JACK | NINE | TEN | JACK |
| 38 | ACE | KING | KING | ACE | ACE |
| 39 | TEN | KING | BAT | NINE | GOURD |
| 40 | GOURD | QUEEN | ACE | KING | JACK |
| 41 | KING | KING | QUEEN | NINE | NINE |
| 42 | NINE | ACE | KING | QUEEN | NINE |
| 43 | ACE | KING | TEN | JACK | NINE |
| 44 | TEN | TRIGGER | QUEEN | TEN | JACK |
| 45 | TEN | KING | TRIGGER | NINE | QUEEN |
| 46 | BAT | KING | JACK | ACE | KING |
| 47 | BAT | KING | NINE | TEN | TEN |
| 48 | BAT | QUEEN | QUEEN | ACE | QUEEN |
| 49 | TEN | NINE | QUEEN | BAT | ACE |
| 50 | NINE | KING | BAT | NINE | JACK |
| 51 | ACE | QUEEN | BAT | TRIGGER | GOURD |
| 52 | TEN | NINE | QUEEN | KING | QUEEN |
| 53 | TEN | JACK | QUEEN | TEN | NINE |
| 54 | FISH | JACK | TRIGGER | NINE | GOURD |
| 55 | NINE | JACK | QUEEN | KING | TEN |
| 56 | ACE | QUEEN | TEN | BAT | NINE |
| 57 | QUEEN | JACK | TRIGGER | BAT | GOURD |
| 58 | JACK | JACK | JACK | BAT | GOURD |
| 59 | KING | JACK | QUEEN | NINE | GOURD |
| 60 | QUEEN | FISH | FISH | FISH | FISH |
| 61 | POT | POT | POT | POT | POT |
| 62 | DRAGON | DRAGON | DRAGON | DRAGON | DRAGON |

FIG.6

| NO. | REEL 1 | REEL 2 | REEL 3 | REEL 4 | REEL 5 |
|---|---|---|---|---|---|
| 0 | TRIGGER | TRIGGER | TRIGGER | TRIGGER | TRIGGER |
| 1 | FISH | FISH | FISH | FISH | JACK |
| 2 | FISH | FISH | ACE | FISH | FISH |
| 3 | FISH | FISH | TRIGGER | ACE | TEN |
| 4 | TRIGGER | TRIGGER | NINE | TRIGGER | QUEEN |
| 5 | ACE | BAT | ACE | FISH | ACE |
| 6 | FISH | BAT | BAT | BAT | NINE |
| 7 | GOURD | BAT | KING | JACK | ACE |
| 8 | ACE | ACE | QUEEN | NINE | GOURD |
| 9 | KING | KING | KING | GOURD | JACK |
| 10 | GOURD | QUEEN | QUEEN | ACE | ACE |
| 11 | KING | WILD | JACK | KING | KING |
| 12 | QUEEN | FISH | GOURD | ACE | TEN |
| 13 | GOURD | JACK | BAT | JACK | QUEEN |
| 14 | QUEEN | BAT | JACK | ACE | GOURD |
| 15 | ACE | BAT | 2xWILD | GOURD | KING |
| 16 | KING | ACE | KING | JACK | QUEEN |
| 17 | JACK | TRIGGER | TEN | NINE | GOURD |
| 18 | TEN | FISH | TEN | BAT | ACE |
| 19 | GOURD | JACK | NINE | QUEEN | NINE |
| 20 | TEN | KING | TEN | NINE | GOURD |
| 21 | ACE | QUEEN | NINE | KING | TEN |
| 22 | FISH | GOURD | ACE | QUEEN | QUEEN |
| 23 | QUEEN | GOURD | BAT | JACK | GOURD |
| 24 | NINE | GOURD | BAT | QUEEN | KING |
| 25 | ACE | KING | BAT | TEN | QUEEN |
| 26 | KING | JACK | JACK | KING | JACK |
| 27 | FISH | TEN | GOURD | JACK | TEN |
| 28 | JACK | ACE | GOURD | ACE | ACE |
| 29 | TEN | TEN | BAT | JACK | BAT |
| 30 | FISH | NINE | BAT | GOURD | BAT |

| NO. | REEL 1 | REEL 2 | REEL 3 | REEL 4 | REEL 5 |
|---|---|---|---|---|---|
| 31 | JACK | QUEEN | TEN | KING | BAT |
| 32 | QUEEN | TEN | ACE | TEN | ACE |
| 33 | JACK | ACE | KING | TEN | NINE |
| 34 | TEN | NINE | KING | ACE | KING |
| 35 | ACE | TEN | ACE | QUEEN | BAT |
| 36 | NINE | BAT | QUEEN | WILD | ACE |
| 37 | GOURD | JACK | NINE | TEN | JACK |
| 38 | ACE | ACE | KING | ACE | ACE |
| 39 | JACK | KING | GOURD | NINE | FISH |
| 40 | FISH | QUEEN | ACE | KING | JACK |
| 41 | KING | FISH | QUEEN | NINE | NINE |
| 42 | NINE | ACE | BAT | BAT | KING |
| 43 | POT | KING | TEN | BAT | KING |
| 44 | TEN | WILD | QUEEN | BAT | JACK |
| 45 | QUEEN | BAT | 2xWILD | NINE | QUEEN |
| 46 | GOURD | BAT | JACK | ACE | KING |
| 47 | GOURD | KING | NINE | TEN | BAT |
| 48 | GOURD | QUEEN | BAT | ACE | QUEEN |
| 49 | TEN | NINE | BAT | GOURD | ACE |
| 50 | NINE | KING | GOURD | NINE | JACK |
| 51 | BAT | BAT | GOURD | WILD | FISH |
| 52 | JACK | NINE | FISH | KING | QUEEN |
| 53 | TEN | JACK | FISH | TEN | NINE |
| 54 | POT | ACE | TRIGGER | BAT | FISH |
| 55 | NINE | BAT | QUEEN | KING | TEN |
| 56 | BAT | QUEEN | BAT | GOURD | NINE |
| 57 | BAT | JACK | TRIGGER | GOURD | FISH |
| 58 | BAT | TEN | JACK | GOURD | FISH |
| 59 | KING | TEN | JACK | NINE | FISH |
| 60 | QUEEN | POT | POT | POT | POT |
| 61 | DRAGON | DRAGON | DRAGON | DRAGON | DRAGON |

FIG.7

| NO. | REEL 1 | REEL 2 | REEL 3 | REEL 4 | REEL 5 |
|---|---|---|---|---|---|
| 0 | TRIGGER | TRIGGER | TRIGGER | TRIGGER | TRIGGER |
| 1 | POT | POT | POT | POT | JACK |
| 2 | POT | POT | BAT | POT | POT |
| 3 | POT | POT | TRIGGER | ACE | TEN |
| 4 | TRIGGER | TRIGGER | NINE | TRIGGER | QUEEN |
| 5 | BAT | GOURD | ACE | POT | BAT |
| 6 | POT | GOURD | GOURD | GOURD | NINE |
| 7 | FISH | GOURD | KING | JACK | ACE |
| 8 | ACE | BAT | QUEEN | NINE | FISH |
| 9 | KING | BAT | BAT | FISH | JACK |
| 10 | FISH | BAT | BAT | ACE | ACE |
| 11 | BAT | WILD | BAT | KING | BAT |
| 12 | QUEEN | POT | FISH | BAT | TEN |
| 13 | FISH | JACK | GOURD | JACK | QUEEN |
| 14 | BAT | GOURD | JACK | ACE | FISH |
| 15 | ACE | GOURD | 2xWILD | FISH | KING |
| 16 | KING | ACE | KING | JACK | QUEEN |
| 17 | BAT | TRIGGER | TEN | NINE | FISH |
| 18 | TEN | POT | BAT | GOURD | ACE |
| 19 | FISH | BAT | NINE | QUEEN | NINE |
| 20 | BAT | KING | TEN | NINE | FISH |
| 21 | ACE | QUEEN | BAT | BAT | TEN |
| 22 | GOURD | FISH | BAT | QUEEN | QUEEN |
| 23 | QUEEN | FISH | GOURD | JACK | FISH |
| 24 | BAT | FISH | GOURD | BAT | KING |
| 25 | BAT | KING | GOURD | TEN | BAT |
| 26 | BAT | JACK | JACK | KING | BAT |
| 27 | GOURD | BAT | FISH | BAT | BAT |
| 28 | JACK | ACE | FISH | ACE | ACE |
| 29 | TEN | TEN | GOURD | JACK | GOURD |
| 30 | GOURD | BAT | GOURD | FISH | GOURD |

| NO. | REEL 1 | REEL 2 | REEL 3 | REEL 4 | REEL 5 |
|---|---|---|---|---|---|
| 31 | JACK | QUEEN | TEN | KING | GOURD |
| 32 | BAT | TEN | ACE | TEN | ACE |
| 33 | BAT | BAT | BAT | BAT | BAT |
| 34 | BAT | NINE | KING | ACE | KING |
| 35 | ACE | TEN | ACE | QUEEN | GOURD |
| 36 | NINE | GOURD | BAT | WILD | ACE |
| 37 | FISH | JACK | NINE | TEN | JACK |
| 38 | ACE | ACE | KING | ACE | BAT |
| 39 | JACK | BAT | FISH | BAT | POT |
| 40 | GOURD | QUEEN | ACE | KING | JACK |
| 41 | KING | POT | QUEEN | NINE | NINE |
| 42 | NINE | ACE | GOURD | GOURD | BAT |
| 43 | GOURD | KING | TEN | GOURD | KING |
| 44 | TEN | WILD | QUEEN | GOURD | JACK |
| 45 | QUEEN | GOURD | 2xWILD | NINE | BAT |
| 46 | FISH | GOURD | JACK | BAT | KING |
| 47 | FISH | KING | NINE | TEN | GOURD |
| 48 | FISH | BAT | GOURD | ACE | QUEEN |
| 49 | TEN | NINE | GOURD | FISH | ACE |
| 50 | NINE | KING | FISH | NINE | BAT |
| 51 | GOURD | GOURD | FISH | WILD | POT |
| 52 | JACK | NINE | POT | KING | QUEEN |
| 53 | TEN | BAT | POT | TEN | NINE |
| 54 | DRAGON | ACE | TRIGGER | GOURD | POT |
| 55 | NINE | GOURD | QUEEN | KING | TEN |
| 56 | GOURD | QUEEN | POT | FISH | NINE |
| 57 | GOURD | JACK | TRIGGER | FISH | POT |
| 58 | GOURD | BAT | BAT | FISH | POT |
| 59 | KING | TEN | JACK | NINE | POT |
| 60 | QUEEN | DRAGON | DRAGON | DRAGON | DRAGON |

FIG.8

| NO. | REEL 1 | REEL 2 | REEL 3 | REEL 4 | REEL 5 |
|---|---|---|---|---|---|
| 0 | TRIGGER | TRIGGER | TRIGGER | TRIGGER | TRIGGER |
| 1 | DRAGON | DRAGON | DRAGON | DRAGON | JACK |
| 2 | DRAGON | DRAGON | GOURD | DRAGON | DRAGON |
| 3 | DRAGON | DRAGON | TRIGGER | ACE | TEN |
| 4 | TRIGGER | TRIGGER | NINE | TRIGGER | QUEEN |
| 5 | GOURD | FISH | FISH | DRAGON | GOURD |
| 6 | DRAGON | FISH | BAT | FISH | NINE |
| 7 | POT | FISH | BAT | JACK | ACE |
| 8 | ACE | GOURD | BAT | NINE | POT |
| 9 | BAT | GOURD | GOURD | POT | JACK |
| 10 | POT | GOURD | GOURD | ACE | ACE |
| 11 | GOURD | WILD | GOURD | KING | GOURD |
| 12 | QUEEN | DRAGON | POT | BAT | TEN |
| 13 | POT | JACK | FISH | JACK | QUEEN |
| 14 | GOURD | FISH | BAT | GOURD | BAT |
| 15 | KING | FISH | 2xWILD | NINE | BAT |
| 16 | BAT | BAT | KING | JACK | BAT |
| 17 | GOURD | TRIGGER | GOURD | POT | NINE |
| 18 | TEN | DRAGON | BAT | NINE | POT |
| 19 | POT | GOURD | BAT | QUEEN | POT |
| 20 | GOURD | KING | TEN | FISH | POT |
| 21 | ACE | POT | GOURD | BAT | TEN |
| 22 | FISH | POT | GOURD | BAT | QUEEN |
| 23 | BAT | POT | FISH | BAT | POT |
| 24 | GOURD | BAT | FISH | ACE | KING |
| 25 | GOURD | BAT | FISH | TEN | GOURD |
| 26 | GOURD | BAT | JACK | GOURD | GOURD |
| 27 | FISH | ACE | POT | GOURD | GOURD |
| 28 | BAT | GOURD | POT | GOURD | ACE |
| 29 | BAT | QUEEN | FISH | JACK | FISH |

| NO. | REEL 1 | REEL 2 | REEL 3 | REEL 4 | REEL 5 |
|---|---|---|---|---|---|
| 30 | FISH | BAT | FISH | POT | FISH |
| 31 | JACK | TEN | TEN | KING | FISH |
| 32 | GOURD | GOURD | GOURD | BAT | ACE |
| 33 | GOURD | QUEEN | KING | BAT | GOURD |
| 34 | GOURD | BAT | BAT | BAT | KING |
| 35 | QUEEN | TEN | ACE | ACE | FISH |
| 36 | POT | GOURD | GOURD | WILD | ACE |
| 37 | BAT | JACK | NINE | TEN | JACK |
| 38 | BAT | FISH | BAT | QUEEN | GOURD |
| 39 | FISH | KING | ACE | GOURD | DRAGON |
| 40 | JACK | BAT | POT | KING | JACK |
| 41 | BAT | GOURD | BAT | FISH | NINE |
| 42 | NINE | ACE | BAT | FISH | GOURD |
| 43 | GOURD | DRAGON | BAT | FISH | KING |
| 44 | TEN | WILD | QUEEN | NINE | JACK |
| 45 | BAT | FISH | FISH | GOURD | GOURD |
| 46 | POT | FISH | 2xWILD | GOURD | KING |
| 47 | POT | KING | BAT | TEN | FISH |
| 48 | POT | GOURD | JACK | ACE | QUEEN |
| 49 | TEN | NINE | FISH | POT | ACE |
| 50 | FISH | BAT | FISH | NINE | GOURD |
| 51 | NINE | FISH | POT | WILD | DRAGON |
| 52 | BAT | NINE | TRIGGER | BAT | QUEEN |
| 53 | BAT | GOURD | DRAGON | KING | NINE |
| 54 | BAT | ACE | DRAGON | FISH | DRAGON |
| 55 | QUEEN | FISH | TRIGGER | TEN | TEN |
| 56 | FISH | BAT | QUEEN | POT | NINE |
| 57 | FISH | BAT | DRAGON | POT | DRAGON |
| 58 | FISH | BAT | ACE | POT | DRAGON |
| 59 | KING | GOURD | GOURD | NINE | DRAGON |

FIG.9

| NO. | REEL 1 | REEL 2 | REEL 3 | REEL 4 | REEL 5 |
|---|---|---|---|---|---|
| 0 | DRAGON | DRAGON | DRAGON | DRAGON | DRAGON |
| 1 | POT | POT | POT | POT | POT |
| 2 | FISH | FISH | FISH | FISH | FISH |
| 3 | GOURD | BAT | GOURD | WILD | TRIGGER |
| 4 | TRIGGER | GOURD | BAT | TRIGGER | GOURD |
| 5 | BAT | WILD | FISH | BAT | BAT |
| 6 | BAT | GOURD | FISH | GOURD | DRAGON |
| 7 | BAT | GOURD | FISH | TRIGGER | DRAGON |
| 8 | BAT | GOURD | FISH | POT | DRAGON |
| 9 | BAT | GOURD | FISH | POT | DRAGON |
| 10 | BAT | TRIGGER | TRIGGER | POT | DRAGON |
| 11 | BAT | GOURD | FISH | POT | DRAGON |
| 12 | BAT | GOURD | FISH | POT | DRAGON |
| 13 | BAT | GOURD | FISH | POT | DRAGON |
| 14 | BAT | GOURD | FISH | POT | DRAGON |
| 15 | BAT | GOURD | 2xWILD | POT | DRAGON |
| 16 | BAT | GOURD | FISH | POT | DRAGON |
| 17 | BAT | GOURD | FISH | POT | DRAGON |
| 18 | BAT | GOURD | FISH | POT | DRAGON |
| 19 | BAT | GOURD | FISH | POT | DRAGON |
| 20 | BAT | GOURD | FISH | POT | DRAGON |
| 21 | BAT | GOURD | FISH | POT | DRAGON |

| NO. | REEL 1 | REEL 2 | REEL 3 | REEL 4 | REEL 5 |
|---|---|---|---|---|---|
| 22 | BAT | GOURD | FISH | POT | DRAGON |
| 23 | BAT | GOURD | FISH | POT | DRAGON |
| 24 | BAT | GOURD | FISH | POT | DRAGON |
| 25 | BAT | GOURD | FISH | POT | DRAGON |
| 26 | BAT | GOURD | FISH | POT | DRAGON |
| 27 | BAT | GOURD | FISH | POT | DRAGON |
| 28 | BAT | GOURD | FISH | POT | DRAGON |
| 29 | BAT | GOURD | FISH | POT | DRAGON |
| 30 | BAT | GOURD | FISH | POT | DRAGON |
| 31 | BAT | GOURD | FISH | POT | DRAGON |
| 32 | BAT | GOURD | FISH | POT | DRAGON |
| 33 | BAT | GOURD | FISH | POT | DRAGON |
| 34 | BAT | GOURD | FISH | POT | DRAGON |
| 35 | BAT | GOURD | FISH | POT | DRAGON |
| 36 | BAT | GOURD | FISH | POT | DRAGON |
| 37 | BAT | GOURD | FISH | POT | DRAGON |
| 38 | BAT | GOURD | FISH | POT | DRAGON |
| 39 | BAT | GOURD | FISH | POT | DRAGON |
| 40 | BAT | GOURD | FISH | POT | DRAGON |
| 41 | BAT | GOURD | FISH | POT | DRAGON |
| 42 | BAT | GOURD | FISH | POT | DRAGON |
| 43 | BAT | GOURD | FISH | | |

FIG.10

| NO. | REEL 1 | REEL 2 | REEL 3 | REEL 4 | REEL 5 |
|---|---|---|---|---|---|
| 0 | DRAGON | DRAGON | DRAGON | DRAGON | DRAGON |
| 1 | POT | POT | POT | POT | POT |
| 2 | FISH | FISH | FISH | FISH | FISH |
| 3 | GOURD | BAT | GOURD | WILD | TRIGGER |
| 4 | TRIGGER | GOURD | BAT | TRIGGER | GOURD |
| 5 | GOURD | BAT | BAT | BAT | BAT |
| 6 | GOURD | BAT | BAT | GOURD | BAT |
| 7 | GOURD | BAT | BAT | TRIGGER | |
| 8 | TRIGGER | BAT | TRIGGER | GOURD | |
| 9 | BAT | BAT | BAT | GOURD | |
| 10 | GOURD | BAT | BAT | GOURD | |
| 11 | GOURD | BAT | BAT | TRIGGER | |
| 12 | GOURD | WILD | BAT | GOURD | |
| 13 | GOURD | BAT | TRIGGER | GOURD | |
| 14 | GOURD | BAT | BAT | GOURD | |
| 15 | GOURD | BAT | BAT | | |
| 16 | GOURD | BAT | BAT | | |
| 17 | GOURD | TRIGGER | BAT | | |
| 18 | GOURD | BAT | 2xWILD | | |
| 19 | GOURD | BAT | BAT | | |
| 20 | GOURD | BAT | BAT | | |
| 21 | GOURD | TRIGGER | BAT | | |
| 22 | GOURD | BAT | BAT | | |
| 23 | GOURD | BAT | TRIGGER | | |
| 24 | GOURD | BAT | BAT | | |

| NO. | REEL 1 | REEL 2 | REEL 3 | REEL 4 | REEL 5 |
|---|---|---|---|---|---|
| 25 | GOURD | BAT | BAT | | |
| 26 | GOURD | BAT | BAT | | |
| 27 | GOURD | BAT | BAT | | |
| 28 | GOURD | BAT | BAT | | |
| 29 | GOURD | BAT | BAT | | |
| 30 | GOURD | FISH | BAT | | |
| 31 | GOURD | BAT | BAT | | |
| 32 | GOURD | BAT | BAT | | |
| 33 | GOURD | BAT | BAT | | |
| 34 | GOURD | BAT | BAT | | |
| 35 | GOURD | BAT | BAT | | |
| 36 | GOURD | BAT | BAT | | |
| 37 | GOURD | BAT | BAT | | |
| 38 | GOURD | BAT | BAT | | |
| 39 | GOURD | BAT | BAT | | |
| 40 | GOURD | BAT | BAT | | |
| 41 | GOURD | BAT | BAT | | |
| 42 | GOURD | BAT | BAT | | |
| 43 | GOURD | BAT | BAT | | |
| 44 | GOURD | BAT | BAT | | |
| 45 | GOURD | BAT | BAT | | |
| 46 | GOURD | BAT | BAT | | |
| 47 | GOURD | BAT | BAT | | |
| 48 | GOURD | BAT | BAT | | |
| 49 | GOURD | BAT | | | |

FIG.11

| NO. | REEL 1 | REEL 2 | REEL 3 | REEL 4 | REEL 5 |
|---|---|---|---|---|---|
| 0 | DRAGON | DRAGON | DRAGON | DRAGON | DRAGON |
| 1 | POT | POT | POT | POT | POT |
| 2 | FISH | GOURD | FISH | GOURD | BAT |
| 3 | BAT | BAT | FISH | FISH | GOURD |
| 4 | BAT | FISH | GOURD | BAT | BAT |
| 5 | TRIGGER | GOURD | FISH | GOURD | BAT |
| 6 | BAT | GOURD | GOURD | GOURD | GOURD |
| 7 | BAT | GOURD | FISH | BAT | FISH |
| 8 | BAT | GOURD | GOURD | BAT | FISH |
| 9 | BAT | GOURD | BAT | BAT | FISH |
| 10 | BAT | GOURD | FISH | FISH | GOURD |
| 11 | BAT | BAT | TRIGGER | GOURD | GOURD |
| 12 | BAT | GOURD | BAT | GOURD | FISH |
| 13 | BAT | WILD | BAT | FISH | GOURD |
| 14 | BAT | GOURD | BAT | BAT | GOURD |
| 15 | BAT | GOURD | FISH | POT | BAT |
| 16 | BAT | GOURD | TRIGGER | FISH | BAT |
| 17 | BAT | GOURD | BAT | BAT | FISH |
| 18 | BAT | TRIGGER | BAT | FISH | BAT |
| 19 | FISH | FISH | 2xWILD | FISH | GOURD |
| 20 | FISH | FISH | BAT | FISH | FISH |
| 21 | FISH | FISH | GOURD | BAT | FISH |
| 22 | BAT | TRIGGER | GOURD | BAT | GOURD |
| 23 | BAT | GOURD | GOURD | WILD | BAT |
| 24 | BAT | GOURD | GOURD | BAT | BAT |
| 25 | BAT | GOURD | GOURD | TRIGGER | GOURD |

| NO. | REEL 1 | REEL 2 | REEL 3 | REEL 4 | REEL 5 |
|---|---|---|---|---|---|
| 26 | BAT | GOURD | GOURD | POT | FISH |
| 27 | BAT | GOURD | FISH | FISH | FISH |
| 28 | TRIGGER | GOURD | FISH | TRIGGER | GOURD |
| 29 | BAT | GOURD | TRIGGER | BAT | BAT |
| 30 | BAT | GOURD | FISH | FISH | FISH |
| 31 | BAT | POT | FISH | FISH | FISH |
| 32 | POT | GOURD | FISH | FISH | TRIGGER |
| 33 | BAT | GOURD | FISH | BAT | BAT |
| 34 | BAT | GOURD | FISH | TRIGGER | BAT |
| 35 | GOURD | BAT | POT | GOURD | BAT |
| 36 | GOURD | GOURD | FISH | GOURD | GOURD |
| 37 | GOURD | GOURD | FISH | GOURD | BAT |
| 38 | BAT | GOURD | FISH | FISH | GOURD |
| 39 | BAT | GOURD | FISH | FISH | FISH |
| 40 | BAT | GOURD | FISH | FISH | BAT |
| 41 | BAT | GOURD | FISH | BAT | GOURD |
| 42 | BAT | GOURD | FISH | BAT | BAT |
| 43 | BAT | GOURD | FISH | BAT | |
| 44 | BAT | GOURD | FISH | BAT | |
| 45 | BAT | GOURD | FISH | BAT | |
| 46 | BAT | GOURD | FISH | BAT | |
| 47 | BAT | GOURD | FISH | BAT | |
| 48 | BAT | GOURD | FISH | BAT | |
| 49 | BAT | GOURD | FISH | BAT | |
| 50 | BAT | GOURD | FISH | BAT | |

FIG.12

| NO. | REEL 1 | REEL 2 | REEL 3 | REEL 4 | REEL 5 |
|---|---|---|---|---|---|
| 0 | DRAGON | DRAGON | DRAGON | DRAGON | DRAGON |
| 1 | BAT | BAT | BAT | FISH | BAT |
| 2 | FISH | FISH | GOURD | POT | GOURD |
| 3 | BAT | GOURD | GOURD | GOURD | FISH |
| 4 | POT | BAT | FISH | FISH | BAT |
| 5 | GOURD | POT | BAT | FISH | GOURD |
| 6 | TRIGGER | GOURD | BAT | GOURD | BAT |
| 7 | POT | BAT | GOURD | GOURD | GOURD |
| 8 | BAT | FISH | FISH | GOURD | FISH |
| 9 | BAT | POT | BAT | BAT | POT |
| 10 | FISH | GOURD | POT | POT | POT |
| 11 | GOURD | BAT | FISH | FISH | POT |
| 12 | GOURD | GOURD | GOURD | FISH | FISH |
| 13 | GOURD | FISH | BAT | POT | BAT |
| 14 | GOURD | BAT | BAT | GOURD | BAT |
| 15 | GOURD | GOURD | POT | DRAGON | BAT |
| 16 | GOURD | POT | TRIGGER | BAT | FISH |
| 17 | GOURD | BAT | GOURD | POT | POT |
| 18 | GOURD | WILD | GOURD | BAT | BAT |
| 19 | GOURD | BAT | GOURD | GOURD | FISH |
| 20 | BAT | GOURD | BAT | POT | FISH |
| 21 | BAT | GOURD | POT | POT | GOURD |
| 22 | FISH | GOURD | TRIGGER | POT | GOURD |
| 23 | GOURD | GOURD | BAT | GOURD | POT |
| 24 | BAT | GOURD | GOURD | BAT | GOURD |
| 25 | POT | GOURD | GOURD | GOURD | FISH |
| 26 | POT | GOURD | BAT | WILD | POT |
| 27 | POT | GOURD | 2xWILD | GOURD | BAT |
| 28 | FISH | GOURD | GOURD | BAT | POT |
| 29 | BAT | TRIGGER | BAT | BAT | FISH |
| 30 | GOURD | POT | FISH | TRIGGER | BAT |
| 31 | FISH | POT | FISH | DRAGON | GOURD |
| 32 | BAT | POT | FISH | POT | GOURD |
| 33 | BAT | TRIGGER | FISH | BAT | FISH |

| NO. | REEL 1 | REEL 2 | REEL 3 | REEL 4 | REEL 5 |
|---|---|---|---|---|---|
| 34 | FISH | FISH | FISH | BAT | POT |
| 35 | BAT | GOURD | FISH | BAT | BAT |
| 36 | POT | BAT | POT | TRIGGER | POT |
| 37 | GOURD | POT | BAT | GOURD | FISH |
| 38 | TRIGGER | BAT | BAT | POT | BAT |
| 39 | POT | FISH | POT | POT | GOURD |
| 40 | GOURD | BAT | TRIGGER | POT | POT |
| 41 | BAT | FISH | FISH | GOURD | BAT |
| 42 | BAT | GOURD | POT | BAT | POT |
| 43 | BAT | BAT | POT | TRIGGER | TRIGGER |
| 44 | POT | FISH | BAT | FISH | GOURD |
| 45 | BAT | TRIGGER | TRIGGER | FISH | GOURD |
| 46 | DRAGON | BAT | FISH | FISH | GOURD |
| 47 | GOURD | DRAGON | DRAGON | POT | FISH |
| 48 | BAT | BAT | BAT | POT | BAT |
| 49 | BAT | BAT | BAT | POT | GOURD |
| 50 | POT | GOURD | BAT | | FISH |
| 51 | BAT | FISH | POT | | POT |
| 52 | FISH | BAT | BAT | | BAT |
| 53 | FISH | BAT | BAT | | GOURD |
| 54 | FISH | BAT | TRIGGER | | FISH |
| 55 | BAT | TRIGGER | FISH | | GOURD |
| 56 | GOURD | FISH | BAT | | |
| 57 | POT | FISH | FISH | | |
| 58 | BAT | FISH | FISH | | |
| 59 | | FISH | BAT | | |
| 60 | | FISH | FISH | | |
| 61 | | | FISH | | |
| 62 | | | BAT | | |
| 63 | | | FISH | | |
| 64 | | | FISH | | |
| 65 | | | BAT | | |
| 66 | | | FISH | | |

FIG.13

| NO. | REEL 1 | REEL 2 | REEL 3 | REEL 4 | REEL 5 |
|---|---|---|---|---|---|
| 0 | GOURD | GOURD | BAT | POT | BAT |
| 1 | BAT | POT | BAT | BAT | GOURD |
| 2 | POT | FISH | GOURD | DRAGON | FISH |
| 3 | GOURD | GOURD | FISH | FISH | POT |
| 4 | DRAGON | DRAGON | FISH | BAT | GOURD |
| 5 | FISH | FISH | POT | POT | FISH |
| 6 | TRIGGER | GOURD | GOURD | POT | BAT |
| 7 | DRAGON | POT | GOURD | BAT | GOURD |
| 8 | GOURD | DRAGON | FISH | FISH | DRAGON |
| 9 | GOURD | FISH | POT | FISH | FISH |
| 10 | POT | BAT | GOURD | FISH | POT |
| 11 | FISH | GOURD | DRAGON | GOURD | DRAGON |
| 12 | FISH | FISH | POT | DRAGON | DRAGON |
| 13 | FISH | POT | FISH | POT | BAT |
| 14 | GOURD | GOURD | GOURD | POT | POT |
| 15 | GOURD | FISH | GOURD | DRAGON | GOURD |
| 16 | POT | DRAGON | DRAGON | FISH | GOURD |
| 17 | FISH | GOURD | TRIGGER | BAT | GOURD |
| 18 | GOURD | BAT | FISH | BAT | POT |
| 19 | DRAGON | WILD | FISH | BAT | DRAGON |
| 20 | DRAGON | FISH | FISH | POT | GOURD |
| 21 | DRAGON | FISH | GOURD | GOURD | BAT |
| 22 | POT | FISH | DRAGON | DRAGON | POT |
| 23 | GOURD | GOURD | TRIGGER | GOURD | POT |
| 24 | FISH | TRIGGER | BAT | FISH | BAT |
| 25 | POT | DRAGON | GOURD | DRAGON | BAT |
| 26 | GOURD | DRAGON | FISH | BAT | BAT |
| 27 | GOURD | DRAGON | FISH | BAT | FISH |
| 28 | BAT | TRIGGER | GOURD | BAT | FISH |
| 29 | POT | POT | BAT | DRAGON | DRAGON |
| 30 | GOURD | FISH | 2xWILD | DRAGON | FISH |
| 31 | DRAGON | GOURD | FISH | FISH | POT |
| 32 | FISH | DRAGON | GOURD | GOURD | DRAGON |
| 33 | TRIGGER | BAT | POT | FISH | BAT |
| 34 | DRAGON | GOURD | POT | WILD | GOURD |

| NO. | REEL 1 | REEL 2 | REEL 3 | REEL 4 | REEL 5 |
|---|---|---|---|---|---|
| 35 | FISH | POT | DRAGON | GOURD | DRAGON |
| 36 | GOURD | BAT | GOURD | GOURD | POT |
| 37 | GOURD | BAT | BAT | FISH | GOURD |
| 38 | GOURD | BAT | GOURD | TRIGGER | FISH |
| 39 | DRAGON | GOURD | DRAGON | POT | FISH |
| 40 | BAT | POT | TRIGGER | DRAGON | POT |
| 41 | GOURD | FISH | POT | BAT | DRAGON |
| 42 | DRAGON | GOURD | DRAGON | GOURD | BAT |
| 43 | FISH | POT | DRAGON | GOURD | GOURD |
| 44 | GOURD | TRIGGER | GOURD | GOURD | DRAGON |
| 45 | GOURD | GOURD | TRIGGER | DRAGON | POT |
| 46 | DRAGON | DRAGON | POT | TRIGGER | GOURD |
| 47 | BAT | WILD | DRAGON | FISH | FISH |
| 48 | BAT | GOURD | GOURD | DRAGON | DRAGON |
| 49 | BAT | GOURD | GOURD | DRAGON | BAT |
| 50 | GOURD | FISH | GOURD | FISH | GOURD |
| 51 | POT | POT | BAT | GOURD | DRAGON |
| 52 | POT | GOURD | BAT | WILD | TRIGGER |
| 53 | POT | GOURD | DRAGON | POT | FISH |
| 54 | GOURD | GOURD | 2xWILD | POT | FISH |
| 55 | FISH | DRAGON | DRAGON | POT | FISH |
| 56 | POT | POT | GOURD | GOURD | BAT |
| 57 | GOURD | POT | BAT | DRAGON | POT |
| 58 | | POT | DRAGON | BAT | GOURD |
| 59 | | DRAGON | GOURD | GOURD | FISH |
| 60 | | | | | POT |
| 61 | | | | | DRAGON |
| 62 | | | | | GOURD |
| 63 | | | | | FISH |
| 64 | | | | | POT |
| 65 | | | | | BAT |
| 66 | | | | | FISH |
| 67 | | | | | GOURD |
| 68 | | | | | DRAGON |

FIG.14

| | SYMBOL | REEL 1 | REEL 2 | REEL 3 | REEL 4 | REEL 5 | TOTAL | PERCENTAGE |
|---|---|---|---|---|---|---|---|---|
| SBB1 | DRAGON | 1 | 1 | 1 | 1 | 1 | 5 | 1.5% |
| | POT | 1 | 1 | 1 | 1 | 1 | 5 | 1.5% |
| | FISH | 1 | 1 | 1 | 1 | 1 | 5 | 1.5% |
| | GOURD | 1 | 1 | 1 | 1 | 1 | 5 | 1.5% |
| | BAT | 5 | 4 | 2 | 3 | 6 | 20 | 5.9% |
| | TOTAL NUMBER OF SYMBOLS | 79 | 68 | 64 | 64 | 64 | 339 | |
| SBB5 | DRAGON | 1 | 1 | 1 | 1 | 1 | 5 | 1.6% |
| | POT | 1 | 1 | 1 | 1 | 1 | 5 | 1.6% |
| | FISH | 1 | 1 | 1 | 1 | 1 | 5 | 1.6% |
| | GOURD | 6 | 4 | 2 | 3 | 7 | 22 | 7.0% |
| | BAT | 10 | 2 | 6 | 7 | 5 | 30 | 9.5% |
| | TOTAL NUMBER OF SYMBOLS | 63 | 63 | 63 | 63 | 63 | 315 | |
| SBB15 | DRAGON | 1 | 1 | 1 | 1 | 1 | 5 | 1.6% |
| | POT | 2 | 1 | 1 | 1 | 1 | 6 | 1.9% |
| | FISH | 8 | 6 | 3 | 3 | 7 | 27 | 8.7% |
| | GOURD | 8 | 3 | 6 | 7 | 5 | 29 | 9.4% |
| | BAT | 4 | 10 | 11 | 6 | 5 | 36 | 11.6% |
| | TOTAL NUMBER OF SYMBOLS | 62 | 62 | 62 | 62 | 62 | 310 | |
| SBB30 | DRAGON | 1 | 1 | 1 | 1 | 1 | 5 | 1.6% |
| | POT | 4 | 6 | 4 | 3 | 7 | 24 | 7.9% |
| | FISH | 8 | 3 | 6 | 7 | 5 | 29 | 9.5% |
| | GOURD | 9 | 10 | 10 | 6 | 5 | 40 | 13.1% |
| | BAT | 11 | 11 | 10 | 7 | 10 | 49 | 16.1% |
| | TOTAL NUMBER OF SYMBOLS | 61 | 61 | 61 | 61 | 61 | 305 | |
| SBB60 | DRAGON | 4 | 6 | 4 | 3 | 7 | 24 | 8.0% |
| | POT | 8 | 3 | 5 | 7 | 5 | 28 | 9.3% |
| | FISH | 8 | 10 | 10 | 6 | 5 | 39 | 13.0% |
| | GOURD | 12 | 11 | 10 | 7 | 10 | 50 | 16.7% |
| | BAT | 12 | 11 | 12 | 8 | 3 | 46 | 15.3% |
| | TOTAL NUMBER OF SYMBOLS | 60 | 60 | 60 | 60 | 60 | 300 | |

FIG.15

| | SYMBOL | REEL 1 | REEL 2 | REEL 3 | REEL 4 | REEL 5 | TOTAL | PERCENTAGE |
|---|---|---|---|---|---|---|---|---|
| SBB1 | DRAGON | 1 | 1 | 1 | 1 | 38 | 42 | 19.3% |
| | POT | 1 | 1 | 1 | 38 | 1 | 40 | 18.3% |
| | FISH | 1 | 1 | 38 | 1 | 1 | 42 | 19.3% |
| | GOURD | 1 | 38 | 1 | 1 | 1 | 42 | 19.3% |
| | BAT | 39 | 1 | 1 | 1 | 1 | 43 | 19.7% |
| | TOTAL NUMBER OF SYMBOLS | 44 | 44 | 44 | 43 | 43 | 218 | |
| SBB5 | DRAGON | 1 | 1 | 1 | 1 | 1 | 5 | 3.0% |
| | POT | 1 | 1 | 1 | 1 | 1 | 5 | 3.0% |
| | FISH | 1 | 2 | 1 | 1 | 1 | 6 | 3.6% |
| | GOURD | 44 | 1 | 1 | 7 | 1 | 54 | 32.1% |
| | BAT | 1 | 42 | 41 | 1 | 2 | 87 | 51.8% |
| | TOTAL NUMBER OF SYMBOLS | 49 | 49 | 48 | 15 | 7 | 168 | |
| SBB15 | DRAGON | 1 | 1 | 1 | 1 | 1 | 5 | 2.0% |
| | POT | 2 | 2 | 2 | 3 | 1 | 10 | 4.0% |
| | FISH | 4 | 4 | 28 | 14 | 12 | 62 | 25.1% |
| | GOURD | 3 | 38 | 9 | 8 | 13 | 71 | 28.7% |
| | BAT | 39 | 3 | 7 | 21 | 15 | 85 | 34.4% |
| | TOTAL NUMBER OF SYMBOLS | 51 | 51 | 51 | 51 | 43 | 247 | |
| SBB30 | DRAGON | 2 | 2 | 2 | 3 | 1 | 10 | 3.4% |
| | POT | 10 | 7 | 8 | 14 | 12 | 51 | 17.4% |
| | FISH | 9 | 13 | 19 | 8 | 13 | 62 | 21.2% |
| | GOURD | 16 | 17 | 10 | 11 | 15 | 69 | 23.5% |
| | BAT | 20 | 17 | 22 | 10 | 14 | 83 | 28.3% |
| | TOTAL NUMBER OF SYMBOLS | 59 | 61 | 67 | 50 | 56 | 293 | |
| SBB60 | DRAGON | 2 | 2 | 2 | 3 | 1 | 10 | 3.3% |
| | POT | 10 | 7 | 8 | 14 | 12 | 51 | 16.6% |
| | FISH | 9 | 13 | 19 | 8 | 13 | 62 | 20.2% |
| | GOURD | 16 | 17 | 10 | 11 | 15 | 69 | 22.5% |
| | BAT | 20 | 17 | 22 | 10 | 14 | 83 | 27.0% |
| | TOTAL NUMBER OF SYMBOLS | 58 | 60 | 60 | 60 | 69 | 307 | |

FIG.30

| SCENARIO | WEIGHT | FIRST PICK | SECOND PICK | THIRD PICK | FOURTH PICK | FIFTH PICK |
|---|---|---|---|---|---|---|
| 1 | 1 | GRAND ×2 | GRAND | MAJOR ×2 | MAJOR | RANDOM |
| 2 | 1 | GRAND ×2 | GRAND | MAJOR | MAJOR ×2 | |
| 3 | 1 | GRAND ×2 | MAJOR ×2 | GRAND | MAJOR | |
| 4 | 1 | GRAND ×2 | MAJOR | GRAND | MAJOR ×2 | |
| 5 | 1 | GRAND ×2 | MAJOR ×2 | MAJOR | GRAND | |
| 6 | 1 | GRAND ×2 | MAJOR | MAJOR ×2 | GRAND | |
| 7 | 1 | GRAND | GRAND ×2 | MAJOR ×2 | MAJOR | |
| 8 | 1 | GRAND | GRAND ×2 | MAJOR | MAJOR ×2 | |
| 9 | 1 | GRAND | MAJOR ×2 | GRAND ×2 | MAJOR | |
| 10 | 1 | GRAND | MAJOR | GRAND ×2 | MAJOR ×2 | |
| 11 | 1 | GRAND | MAJOR ×2 | MAJOR | GRAND ×2 | |
| 12 | 1 | GRAND | MAJOR | MAJOR ×2 | GRAND ×2 | |
| 13 | 1 | MAJOR ×2 | GRAND | GRAND ×2 | MAJOR | |
| 14 | 1 | MAJOR ×2 | GRAND | MAJOR | GRAND ×2 | |
| 15 | 1 | MAJOR ×2 | GRAND ×2 | GRAND | MAJOR | |
| 16 | 1 | MAJOR ×2 | MAJOR | GRAND | GRAND ×2 | |
| 17 | 1 | MAJOR ×2 | GRAND ×2 | MAJOR | GRAND | |
| 18 | 1 | MAJOR ×2 | MAJOR | GRAND ×2 | GRAND | |
| 19 | 1 | MAJOR | MAJOR ×2 | GRAND ×2 | GRAND | |
| 20 | 1 | MAJOR | MAJOR ×2 | GRAND | GRAND ×2 | |
| 21 | 1 | MAJOR | GRAND ×2 | MAJOR ×2 | GRAND | |
| 22 | 1 | MAJOR | GRAND | MAJOR ×2 | GRAND ×2 | |
| 23 | 1 | MAJOR | GRAND ×2 | GRAND | MAJOR ×2 | |
| 24 | 1 | MAJOR | GRAND | GRAND ×2 | MAJOR ×2 | |

FIG.36

| | V1 | V2 | V3 | V4 | V5 | V6 | V7 |
|---|---|---|---|---|---|---|---|
| SBB1 | 8257.416901 | 8257.416901 | 8257.416901 | 8257.416901 | 8213.316125 | 8191.265737 | 8169.215350 |
| SBB2 | 1752.022190 | 1752.022190 | 1752.022190 | 1752.022190 | 1740.190269 | 1734.274309 | 1728.358348 |
| SBB3 | 1087.915233 | 1087.915233 | 1087.915233 | 1087.915233 | 1085.396645 | 1084.137351 | 1082.878057 |
| SBB4 | 550.312679 | 550.312679 | 550.312679 | 550.312679 | 549.175090 | 548.606295 | 548.037500 |
| SBB5 | 291.232399 | 291.232399 | 291.232399 | 291.232399 | 290.015784 | 289.407477 | 288.799169 |

FIG.38

| | V1–V7 |
|---|---|
| SC01 | 4,040,000 |
| SC02 | 4,040,000 |
| SC03 | 3,535,000 |
| SC04 | 2,020,000 |
| SC05 | 2,020,000 |
| SC06 | 3,535,000 |
| SC07 | 4,040,000 |
| SC08 | 4,040,000 |

FIG.39

| No | LEVEL | WEIGHT |
|---|---|---|
| 0 | GRAND BONUS | 150 |
| 1 | MAJOR BONUS | 500 |
| 2 | MINOR BONUS | 83200 |
| 3 | MINI BONUS | 999900 |
| | TOTAL | 1083750 |

FIG.46

| | TOTAL BET X N | | |
|---|---|---|---|
| WIN CLASS | NOT LESS THAN | LESS THAN | SECONDS |
| WIN1 | | 0.1 | 0.50 |
| WIN2 | 0.1 | 0.2 | 0.60 |
| WIN3 | 0.2 | 0.3 | 0.70 |
| WIN4 | 0.3 | 0.4 | 0.90 |
| WIN5 | 0.4 | 0.5 | 0.90 |
| WIN6 | 0.5 | 0.75 | 0.50 |
| WIN7 | 0.75 | 1 | 2.00 |
| WIN8 | 1 | 1.25 | 2.50 |
| WIN9 | 1.25 | 1.5 | 2.70 |
| WIN10 | 1.5 | 2 | 3.90 |
| WIN11 | 2 | 3 | 5.60 |
| WIN12 | 3 | 4 | 6.10 |
| WIN13 | 4 | 5 | 9.90 |
| WIN14 | 5 | 6 | 9.90 |
| WIN15 | 6 | 7 | 9.90 |
| WIN16 | 7 | 8 | 11.90 |
| WIN17 | 8 | 10 | 19.60 |
| WIN18 | 10 | 12 | 19.70 |
| WIN19 | 12 | 15 | 23.80 |
| WIN20 | 15 | 20 | 30.30 |
| WIN21 | 20 | 30 | 34.60 |
| WIN22 | 30 | 40 | 43.00 |
| WIN23 | 40 | 50 | 50.00 |
| WIN24 | 50 | | 72.00 |

FIG.57

| NO. | REEL 1 | REEL 2 | REEL 3 | REEL 4 | REEL 5 |
|---|---|---|---|---|---|
| 0 | TRIGGER | TRIGGER | TRIGGER | TRIGGER | TRIGGER |
| 1 | PHOENIX | PHOENIX | PHOENIX | PHOENIX | PHOENIX |
| 2 | ACE | KING | QUEEN | ACE | ACE |
| 3 | ACE | KING | QUEEN | ACE | ACE |
| 4 | ACE | KING | QUEEN | ACE | ACE |
| 5 | ACE | KING | QUEEN | ACE | ACE |
| 6 | ACE | KING | QUEEN | ACE | ACE |
| 7 | ACE | KING | QUEEN | ACE | ACE |
| 8 | ACE | KING | QUEEN | ACE | ACE |
| 9 | PHOENIX | PHOENIX | PHOENIX | ACE | ACE |
| 10 | ACE | KING | QUEEN | ACE | ACE |
| 11 | ACE | KING | QUEEN | PHOENIX | PHOENIX |
| 12 | ACE | KING | QUEEN | KING | KING |
| 13 | ACE | KING | QUEEN | KING | KING |
| 14 | ACE | KING | QUEEN | KING | KING |
| 15 | ACE | KING | QUEEN | KING | KING |
| 16 | ACE | KING | QUEEN | KING | KING |
| 17 | TRIGGER | WILD | 2xWILD | KING | KING |
| 18 | ACE | KING | QUEEN | KING | KING |
| 19 | ACE | KING | QUEEN | PHOENIX | PHOENIX |
| 20 | ACE | KING | QUEEN | QUEEN | QUEEN |
| 21 | ACE | KING | QUEEN | QUEEN | QUEEN |
| 22 | ACE | KING | QUEEN | QUEEN | QUEEN |
| 23 | ACE | KING | QUEEN | QUEEN | QUEEN |
| 24 | ACE | KING | QUEEN | QUEEN | QUEEN |
| 25 | ACE | KING | QUEEN | QUEEN | QUEEN |
| 26 | PHOENIX | PHOENIX | PHOENIX | QUEEN | QUEEN |
| 27 | JACK | TEN | NINE | WILD | PHOENIX |
| 28 | JACK | TEN | NINE | JACK | JACK |
| 29 | JACK | TEN | NINE | JACK | JACK |
| 30 | JACK | TEN | NINE | JACK | JACK |
| 31 | JACK | TEN | NINE | JACK | JACK |
| 32 | JACK | TEN | NINE | JACK | JACK |
| 33 | JACK | TEN | NINE | JACK | JACK |
| 34 | JACK | TEN | NINE | JACK | JACK |
| 35 | PHOENIX | PHOENIX | PHOENIX | PHOENIX | PHOENIX |
| 36 | JACK | TEN | NINE | TEN | TEN |
| 37 | JACK | TEN | NINE | TEN | TEN |
| 38 | JACK | TEN | NINE | TEN | TEN |
| 39 | JACK | TEN | NINE | TEN | TEN |

| NO. | REEL 1 | REEL 2 | REEL 3 | REEL 4 | REEL 5 |
|---|---|---|---|---|---|
| 40 | JACK | TEN | NINE | TEN | TEN |
| 41 | JACK | TEN | NINE | TEN | TEN |
| 42 | JACK | TEN | NINE | TEN | TEN |
| 43 | TRIGGER | TRIGGER | TRIGGER | PHOENIX | PHOENIX |
| 44 | JACK | TEN | NINE | NINE | NINE |
| 45 | JACK | TEN | NINE | NINE | NINE |
| 46 | JACK | TEN | NINE | NINE | NINE |
| 47 | JACK | TEN | NINE | NINE | NINE |
| 48 | JACK | TEN | NINE | NINE | NINE |
| 49 | JACK | TEN | NINE | NINE | NINE |
| 50 | JACK | TEN | NINE | NINE | NINE |
| 51 | JACK | TEN | NINE | | |
| 52 | TRIGGER | TRIGGER | TRIGGER | | |
| 53 | ACE | ACE | ACE | | |
| 54 | ACE | ACE | ACE | | |
| 55 | ACE | ACE | ACE | | |
| 56 | ACE | ACE | ACE | | |
| 57 | PHOENIX | PHOENIX | PHOENIX | | |
| 58 | KING | KING | KING | | |
| 59 | KING | KING | KING | | |
| 60 | KING | KING | KING | | |
| 61 | KING | KING | KING | | |
| 62 | TRIGGER | TRIGGER | TRIGGER | | |
| 63 | QUEEN | QUEEN | QUEEN | | |
| 64 | QUEEN | QUEEN | QUEEN | | |
| 65 | QUEEN | QUEEN | QUEEN | | |
| 66 | QUEEN | JACK | JACK | | |
| 67 | JACK | JACK | JACK | | |
| 68 | JACK | JACK | JACK | | |
| 69 | JACK | JACK | JACK | | |
| 70 | JACK | JACK | JACK | | |
| 71 | TEN | TEN | TEN | | |
| 72 | TEN | TEN | TEN | | |
| 73 | TEN | TEN | TEN | | |
| 74 | TEN | TEN | TEN | | |
| 75 | NINE | NINE | NINE | | |
| 76 | NINE | NINE | NINE | | |
| 77 | NINE | NINE | NINE | | |
| 78 | NINE | NINE | NINE | | |

FIG.58

| | REEL1 | REEL2 | REEL3 | REEL4 | REEL5 |
|---|---|---|---|---|---|
| 0 | TRIGGER | TRIGGER | TRIGGER | TRIGGER | TRIGGER |
| 1 | PHOENIX | PHOENIX | PHOENIX | PHOENIX | PHOENIX |
| 2 | PHOENIX | PHOENIX | ACE | PHOENIX | PHOENIX |
| 3 | PHOENIX | PHOENIX | ACE | TRIGGER | TRIGGER |
| 4 | TRIGGER | ACE | ACE | ACE | ACE |
| 5 | ACE | ACE | ACE | ACE | ACE |
| 6 | ACE | ACE | PHOENIX | ACE | ACE |
| 7 | ACE | ACE | KING | PHOENIX | PHOENIX |
| 8 | ACE | PHOENIX | KING | KING | KING |
| 9 | PHOENIX | KING | KING | KING | KING |
| 10 | KING | KING | KING | KING | KING |
| 11 | KING | KING | PHOENIX | PHOENIX | PHOENIX |
| 12 | KING | KING | 2xWILD | QUEEN | QUEEN |
| 13 | KING | WILD | PHOENIX | QUEEN | QUEEN |
| 14 | PHOENIX | QUEEN | QUEEN | WILD | PHOENIX |
| 15 | QUEEN | QUEEN | QUEEN | JACK | JACK |
| 16 | QUEEN | QUEEN | QUEEN | JACK | JACK |
| 17 | QUEEN | QUEEN | QUEEN | JACK | JACK |
| 18 | QUEEN | PHOENIX | PHOENIX | JACK | JACK |
| 19 | PHOENIX | PHOENIX | PHOENIX | PHOENIX | PHOENIX |
| 20 | JACK | JACK | JACK | PHOENIX | PHOENIX |
| 21 | JACK | JACK | JACK | TEN | TEN |
| 22 | JACK | JACK | JACK | TEN | TEN |
| 23 | JACK | JACK | JACK | TEN | TEN |
| 24 | PHOENIX | PHOENIX | PHOENIX | TEN | TEN |
| 25 | TEN | PHOENIX | PHOENIX | PHOENIX | PHOENIX |
| 26 | TEN | TEN | TEN | NINE | NINE |
| 27 | TEN | TEN | TEN | NINE | NINE |
| 28 | TEN | TEN | TEN | NINE | NINE |
| 29 | PHOENIX | TRIGGER | PHOENIX | | |
| 30 | PHOENIX | NINE | NINE | | |
| 31 | NINE | NINE | NINE | | |
| 32 | NINE | NINE | NINE | | |
| 33 | NINE | NINE | NINE | | |

FIG.59

| NO. | REEL 1 | REEL 2 | REEL 3 | REEL 4 | REEL 5 |
|---|---|---|---|---|---|
| 0 | TRIGGER | TRIGGER | TRIGGER | TRIGGER | TRIGGER |
| 1 | SWALLOW | SWALLOW | SWALLOW | SWALLOW | SWALLOW |
| 2 | ACE | KING | QUEEN | ACE | ACE |
| 3 | ACE | KING | QUEEN | ACE | ACE |
| 4 | ACE | KING | QUEEN | ACE | ACE |
| 5 | SWALLOW | SWALLOW | SWALLOW | ACE | ACE |
| 6 | ACE | KING | QUEEN | ACE | ACE |
| 7 | ACE | KING | QUEEN | ACE | ACE |
| 8 | ACE | KING | QUEEN | ACE | ACE |
| 9 | SWALLOW | SWALLOW | SWALLOW | ACE | ACE |
| 10 | ACE | KING | QUEEN | ACE | ACE |
| 11 | ACE | KING | QUEEN | SWALLOW | SWALLOW |
| 12 | ACE | KING | QUEEN | KING | KING |
| 13 | SWALLOW | SWALLOW | SWALLOW | KING | KING |
| 14 | ACE | KING | QUEEN | KING | KING |
| 15 | ACE | KING | QUEEN | KING | KING |
| 16 | ACE | KING | QUEEN | KING | KING |
| 17 | TRIGGER | WILD | 2WILD | KING | KING |
| 18 | ACE | KING | QUEEN | KING | KING |
| 19 | ACE | KING | QUEEN | SWALLOW | SWALLOW |
| 20 | ACE | KING | QUEEN | QUEEN | QUEEN |
| 21 | SWALLOW | SWALLOW | SWALLOW | QUEEN | QUEEN |
| 22 | ACE | KING | QUEEN | QUEEN | QUEEN |
| 23 | ACE | KING | QUEEN | QUEEN | QUEEN |
| 24 | ACE | KING | QUEEN | QUEEN | QUEEN |
| 25 | ACE | KING | QUEEN | QUEEN | QUEEN |
| 26 | SWALLOW | SWALLOW | SWALLOW | QUEEN | QUEEN |
| 27 | JACK | TEN | NINE | WILD | SWALLOW |
| 28 | JACK | TEN | NINE | JACK | JACK |
| 29 | JACK | TEN | NINE | JACK | JACK |
| 30 | JACK | TEN | NINE | JACK | JACK |
| 31 | SWALLOW | SWALLOW | SWALLOW | JACK | JACK |
| 32 | JACK | TEN | NINE | JACK | JACK |
| 33 | JACK | TEN | NINE | JACK | JACK |
| 34 | JACK | TEN | NINE | JACK | JACK |
| 35 | SWALLOW | SWALLOW | SWALLOW | SWALLOW | SWALLOW |
| 36 | JACK | TEN | NINE | TEN | TEN |
| 37 | JACK | TEN | NINE | TEN | TEN |
| 38 | JACK | TEN | NINE | TEN | TEN |
| 39 | SWALLOW | SWALLOW | SWALLOW | TEN | TEN |

| NO. | REEL 1 | REEL 2 | REEL 3 | REEL 4 | REEL 5 |
|---|---|---|---|---|---|
| 40 | JACK | TEN | NINE | TEN | TEN |
| 41 | JACK | TEN | NINE | TEN | TEN |
| 42 | JACK | TEN | NINE | TEN | TEN |
| 43 | TRIGGER | TRIGGER | TRIGGER | SWALLOW | SWALLOW |
| 44 | JACK | TEN | NINE | NINE | NINE |
| 45 | JACK | TEN | NINE | NINE | NINE |
| 46 | JACK | TEN | NINE | NINE | NINE |
| 47 | SWALLOW | SWALLOW | SWALLOW | NINE | NINE |
| 48 | JACK | TEN | NINE | NINE | NINE |
| 49 | JACK | TEN | NINE | NINE | NINE |
| 50 | JACK | TEN | NINE | NINE | NINE |
| 51 | JACK | TEN | NINE | | |
| 52 | TRIGGER | TRIGGER | TRIGGER | | |
| 53 | ACE | ACE | ACE | | |
| 54 | ACE | ACE | ACE | | |
| 55 | ACE | ACE | ACE | | |
| 56 | ACE | ACE | ACE | | |
| 57 | SWALLOW | SWALLOW | SWALLOW | | |
| 58 | KING | KING | KING | | |
| 59 | KING | KING | KING | | |
| 60 | KING | KING | KING | | |
| 61 | KING | KING | KING | | |
| 62 | TRIGGER | TRIGGER | TRIGGER | | |
| 63 | QUEEN | QUEEN | QUEEN | | |
| 64 | QUEEN | QUEEN | QUEEN | | |
| 65 | QUEEN | QUEEN | JACK | | |
| 66 | QUEEN | JACK | JACK | | |
| 67 | JACK | JACK | JACK | | |
| 68 | JACK | JACK | JACK | | |
| 69 | JACK | JACK | JACK | | |
| 70 | SWALLOW | SWALLOW | SWALLOW | | |
| 71 | TEN | TEN | TEN | | |
| 72 | TEN | TEN | TEN | | |
| 73 | TEN | TEN | TEN | | |
| 74 | SWALLOW | SWALLOW | SWALLOW | | |
| 75 | NINE | NINE | NINE | | |
| 76 | NINE | NINE | NINE | | |
| 77 | NINE | NINE | NINE | | |
| 78 | NINE | NINE | NINE | | |

FIG.60

| | REEL1 | REEL2 | REEL3 | REEL4 | REEL5 |
|---|---|---|---|---|---|
| 0 | TRIGGER | TRIGGER | TRIGGER | TRIGGER | TRIGGER |
| 1 | SWALLOW | SWALLOW | SWALLOW | SWALLOW | SWALLOW |
| 2 | SWALLOW | SWALLOW | ACE | SWALLOW | SWALLOW |
| 3 | SWALLOW | SWALLOW | ACE | TRIGGER | TRIGGER |
| 4 | TRIGGER | ACE | ACE | ACE | ACE |
| 5 | ACE | ACE | SWALLOW | ACE | ACE |
| 6 | ACE | ACE | SWALLOW | ACE | ACE |
| 7 | SWALLOW | SWALLOW | KING | SWALLOW | SWALLOW |
| 8 | SWALLOW | SWALLOW | KING | KING | KING |
| 9 | SWALLOW | SWALLOW | KING | KING | KING |
| 10 | SWALLOW | SWALLOW | SWALLOW | SWALLOW | KING |
| 11 | KING | KING | SWALLOW | SWALLOW | SWALLOW |
| 12 | KING | KING | 2xWILD | QUEEN | QUEEN |
| 13 | SWALLOW | WILD | SWALLOW | QUEEN | QUEEN |
| 14 | SWALLOW | QUEEN | QUEEN | WILD | SWALLOW |
| 15 | SWALLOW | QUEEN | QUEEN | JACK | JACK |
| 16 | QUEEN | QUEEN | QUEEN | JACK | JACK |
| 17 | QUEEN | SWALLOW | SWALLOW | JACK | JACK |
| 18 | SWALLOW | SWALLOW | SWALLOW | JACK | JACK |
| 19 | SWALLOW | SWALLOW | SWALLOW | SWALLOW | SWALLOW |
| 20 | SWALLOW | SWALLOW | SWALLOW | SWALLOW | SWALLOW |
| 21 | JACK | JACK | JACK | TEN | SWALLOW |
| 22 | JACK | JACK | JACK | TEN | TEN |
| 23 | SWALLOW | SWALLOW | SWALLOW | TEN | TEN |
| 24 | SWALLOW | SWALLOW | SWALLOW | SWALLOW | SWALLOW |
| 25 | SWALLOW | SWALLOW | SWALLOW | SWALLOW | SWALLOW |
| 26 | TEN | TEN | TEN | SWALLOW | SWALLOW |
| 27 | TEN | TEN | TEN | NINE | NINE |
| 28 | TEN | TEN | TEN | NINE | NINE |
| 29 | SWALLOW | TRIGGER | SWALLOW | | |
| 30 | SWALLOW | NINE | SWALLOW | | |
| 31 | SWALLOW | NINE | SWALLOW | | |
| 32 | NINE | SWALLOW | NINE | | |
| 33 | NINE | SWALLOW | NINE | | |

FIG.64

WILD SYMBOL RANDOM DETERMINATION TABLE

| | SC01–SC10 | | | | | | |
|---|---|---|---|---|---|---|---|
| | V01 | V02 | V03 | V04 | V05 | V06 | V07 |
| SBB1 | 6562834216302710 | 6562834216302710 | 6630072250928320 | 6630072250928320 | 6630072250928320 | 6630072250928320 | 6630072250928320 |
| SBB2 | 2254310177603230 | 2254310177603230 | 2277614665212410 | 2277614665212410 | 2277614665212410 | 2277614665212410 | 2277614665212410 |
| SBB3 | 2015895522401720 | 2015895522401720 | 2023783309016420 | 2023783309016420 | 2023783309016420 | 2023783309016420 | 2023783309016420 |
| SBB4 | 1176484197628940 | 1176484197628940 | 1183927411016450 | 1183927411016450 | 1183927411016450 | 1183927411016450 | 1183927411016450 |
| SBB5 | 906072534705548 | 906072534705548 | 911471487528664 | 911471487528664 | 911471487528664 | 911471487528664 | 911471487528664 |

| | SC11–SC20, SC41 | | | | | | |
|---|---|---|---|---|---|---|---|
| | V01 | V02 | V03 | V04 | V05 | V06 | V07 |
| SBB1 | 9198037906637910 | 9198037906637910 | 9291838151299650 | 9291838151299650 | 9291838151299650 | 9291838151299650 | 9291838151299650 |
| SBB2 | 3156753116652220 | 3156753116652220 | 3198860531247260 | 3198860531247260 | 3198860531247260 | 3198860531247260 | 3198860531247260 |
| SBB3 | 2822259413170000 | 2822259413170000 | 2833305032622540 | 2833305032622540 | 2833305032622540 | 2833305032622540 | 2833305032622540 |
| SBB4 | 1647077870097720 | 1647077870097720 | 1657763365430350 | 1657763365430350 | 1657763365430350 | 1657763365430350 | 1657763365430350 |
| SBB5 | 1268501648597770 | 1268501648597770 | 1276600625401310 | 1276600625401310 | 1276600625401310 | 1276600625401310 | 1276600625401310 |

| | SC21–SC30, SC42 | | | | | | |
|---|---|---|---|---|---|---|---|
| | V01 | V02 | V03 | V04 | V05 | V06 | V07 |
| SBB1 | 11813191590424900 | 11813191590424900 | 11946642051671000 | 11946642051671000 | 11946642051671000 | 11946642051671000 | 11946642051671000 |
| SBB2 | 4099706397382240 | 4099706397382240 | 4099706397382240 | 4099706397382240 | 4099706397382240 | 4099706397382240 | 4099706397382240 |
| SBB3 | 3642820756225560 | 3642820756225560 | 3642820756225560 | 3642820756225560 | 3642820756225560 | 3642820756225560 | 3642820756225560 |
| SBB4 | 2113671556268490 | 2113671556268490 | 2130983352689160 | 2130983352689160 | 2130983352689160 | 2130983352689160 | 2130983352689160 |
| SBB5 | 1630930524699990 | 1630930524699990 | 1640648677551600 | 1640648677551600 | 1640648677551600 | 1640648677551600 | 1640648677551600 |

| | SC31–SC40, SC47, SC48 | | | | | | |
|---|---|---|---|---|---|---|---|
| | V01 | V02 | V03 | V04 | V05 | V06 | V07 |
| SBB1 | 14433345277186000 | 14433345277186000 | 14601459152042000 | 14601459152042000 | 14601459152042000 | 14601459152042000 | 14601459152042000 |
| SBB2 | 4960583764782210 | 4960583764782210 | 5010752263467800 | 5010752263467800 | 5010752263467800 | 5010752263467800 | 5010752263467800 |
| SBB3 | 4434979916922580 | 4434979916922580 | 4452943647836120 | 4452943647836120 | 4452943647836120 | 4452943647836120 | 4452943647836120 |
| SBB4 | 2588265235439220 | 2588265235439220 | 2604420311996190 | 2604420311996190 | 2604420311996190 | 2604420311996190 | 2604420311996190 |
| SBB5 | 1993355763552210 | 1993355763552210 | 2005243727256300 | 2005243727256300 | 2005243727256300 | 2005243727256300 | 2005243727256300 |

| | SC42–SC45 | | | | | | |
|---|---|---|---|---|---|---|---|
| | V01 | V02 | V03 | V04 | V05 | V06 | V07 |
| SBB1 | 10500614747044300 | 10500614747044300 | 10619243601485300 | 10619243601485300 | 10619243601485300 | 10619243601485300 | 10619243601485300 |
| SBB2 | 4607597277179970 | 4607597277179970 | 4644184643439960 | 4644184643439960 | 4644184643439960 | 4644184643439960 | 4644184643439960 |
| SBB3 | 3925499395851530 | 3925499395851530 | 3963002894467270 | 3963002894467270 | 3963002894467270 | 3963002894467270 | 3963002894467270 |
| SBB4 | 1684247417663100 | 1684247417663100 | 1694126395067260 | 1694126395067260 | 1694126395067260 | 1694126395067260 | 1694126395067260 |
| SBB5 | 1440718055280890 | 1440718055280890 | 1458354380045960 | 1458354380045960 | 1458354380045960 | 1458354380045960 | 1458354380045960 |

FIG.65

TOP SYMBOL RANDOM DETERMINATION TABLE

| | SC00-SC10 | | | | | | |
|---|---|---|---|---|---|---|---|
| | V01 | V02 | V03 | V04 | V05 | V06 | V07 |
| SBB1 | 32832920091435540 | 32832920091435540 | 32832920091435540 | 32832920091435540 | 32832920091435540 | 32832920091435540 | 32832920091435540 |
| SBB2 | 60586609341443439 | 60586609341443439 | 60586609341443439 | 60586609341443439 | 60586609341443439 | 60586609341443439 | 60586609341443439 |
| SBB3 | 67749951857590003 | 67749951857590003 | 67749951857590003 | 67749951857590003 | 67749951857590003 | 67749951857590003 | 67749951857590003 |
| SBB4 | 30752933367401 | 30752933367401 | 30752933367401 | 30752933367401 | 30752933367401 | 30752933367401 | 30752933367401 |
| SBB5 | 22653077490266501 | 22653077490266501 | 22653077490266501 | 22653077490266501 | 22653077490266501 | 22653077490266501 | 22653077490266501 |

| | SC11-SC20, SC21 | | | | | | |
|---|---|---|---|---|---|---|---|
| | V01 | V02 | V03 | V04 | V05 | V06 | V07 |
| SBB1 | 45965248548000950 | 45965248548000950 | 45965248548000950 | 45965248548000950 | 45965248548000950 | 45965248548000950 | 45965248548000950 |
| SBB2 | 84824053078021414 | 84824053078021414 | 84824053078021414 | 84824053078021414 | 84824053078021414 | 84824053078021414 | 84824053078021414 |
| SBB3 | 94849328006264 | 94849328006264 | 94849328006264 | 94849328006264 | 94849328006264 | 94849328006264 | 94849328006264 |
| SBB4 | 55654114091436 | 55654114091436 | 55654114091436 | 55654114091436 | 55654114091436 | 55654114091436 | 55654114091436 |
| SBB5 | 31714308483637310 | 31714308483637310 | 31714308483637310 | 31714308483637310 | 31714308483637310 | 31714308483637310 | 31714308483637310 |

| | SC21-SC30, SC46 | | | | | | |
|---|---|---|---|---|---|---|---|
| | V01 | V02 | V03 | V04 | V05 | V06 | V07 |
| SBB1 | 59098176704583370 | 59098176704583370 | 59098176704583370 | 59098176704583370 | 59098176704583370 | 59098176704583370 | 59098176704583370 |
| SBB2 | 10905494961145990 | 10905494961145990 | 10905494961145990 | 10905494961145990 | 10905494961145990 | 10905494961145990 | 10905494961145990 |
| SBB3 | 12194991343366720 | 12194991343366720 | 12194991343366720 | 12194991343366720 | 12194991343366720 | 12194991343366720 | 12194991343366720 |
| SBB4 | 71555289546 1921 | 71555289546 1921 | 71555289546 1921 | 71555289546 1921 | 71555289546 1921 | 71555289546 1921 | 71555289546 1921 |
| SBB5 | 40775539482479170 | 40775539482479170 | 40775539482479170 | 40775539482479170 | 40775539482479170 | 40775539482479170 | 40775539482479170 |

| | SC31-SC40, SC47, SC48 | | | | | | |
|---|---|---|---|---|---|---|---|
| | V01 | V02 | V03 | V04 | V05 | V06 | V07 |
| SBB1 | 72231104861157790 | 72231104861157790 | 72231104861157790 | 72231104861157790 | 72231104861157790 | 72231104861157790 | 72231104861157790 |
| SBB2 | 13929440551176 0 | 13929440551176 0 | 13929440551176 0 | 13929440551176 0 | 13929440551176 0 | 13929440551176 0 | 13929440551176 0 |
| SBB3 | 14904894408 6990 | 14904894408 6990 | 14904894408 6990 | 14904894408 6990 | 14904894408 6990 | 14904894408 6990 | 14904894408 6990 |
| SBB4 | 87456465000 8281 | 87456465000 8281 | 87456465000 8281 | 87456465000 8281 | 87456465000 8281 | 87456465000 8281 | 87456465000 8281 |
| SBB5 | 49836770478586630 | 49836770478586630 | 49836770478586630 | 49836770478586630 | 49836770478586630 | 49836770478586630 | 49836770478586630 |

| | SC41-SC45 | | | | | | |
|---|---|---|---|---|---|---|---|
| | V01 | V02 | V03 | V04 | V05 | V06 | V07 |
| SBB1 | 52531712626295600 | 52531712626295600 | 52531712626295600 | 52531712626295600 | 52531712626295600 | 52531712626295600 | 52531712626295600 |
| SBB2 | 8894177494463102 | 8894177494463102 | 8894177494463102 | 8894177494463102 | 8894177494463102 | 8894177494463102 | 8894177494463102 |
| SBB3 | 10839992297214 40 | 10839992297214 40 | 10839992297214 40 | 10839992297214 40 | 10839992297214 40 | 10839992297214 40 | 10839992297214 40 |
| SBB4 | 63604701818784 1 | 63604701818784 1 | 63604701818784 1 | 63604701818784 1 | 63604701818784 1 | 63604701818784 1 | 63604701818784 1 |
| SBB5 | 36244923984426640 | 36244923984426640 | 36244923984426640 | 36244923984426640 | 36244923984426640 | 36244923984426640 | 36244923984426640 |

FIG.69

PROGRESSIVE INITIAL VALUE TABLE

| | SC01 | SC02 | SC03 | SC04 | SC05 | SC06 | SC07 |
|---|---|---|---|---|---|---|---|
| GRAND JACKPOT RESET VALUE (CREDITS) | 5000000 | 3500000 | 3000000 | 2500000 | 2000000 | 5000000 | 3000000 |
| MAJOR JACKPOT RESET VALUE (CREDITS) | 80000 | 80000 | 75000 | 80000 | 30000 | 50000 | 30000 |
| MINOR JACKPOT RESET VALUE (CREDITS) | 1500 | 1500 | 1800 | 1500 | 1500 | 1500 | 1800 |
| MINI JACKPOT RESET VALUE (CREDITS) | 1200 | 1100 | 1100 | 1000 | 1000 | 1000 | 1250 |

| | SC08 | SC09 | SC010 | SC011 | SC012 | SC013 | SC014 |
|---|---|---|---|---|---|---|---|
| GRAND JACKPOT RESET VALUE (CREDITS) | 3000000 | 2500000 | 2000000 | 15000000 | 10000000 | 10000000 | 8000000 |
| MAJOR JACKPOT RESET VALUE (CREDITS) | 75000 | 80000 | 80000 | 100000 | 100000 | 100000 | 100000 |
| MINOR JACKPOT RESET VALUE (CREDITS) | 1800 | 2000 | 2000 | 2200 | 2500 | 2200 | 2000 |
| MINI JACKPOT RESET VALUE (CREDITS) | 900 | 1000 | 800 | 1250 | 1000 | 1300 | 1250 |

| | SC15 | SC16 | SC17 | SC18 | SC19 | SC20 | SC21 |
|---|---|---|---|---|---|---|---|
| GRAND JACKPOT RESET VALUE (CREDITS) | 7500000 | 10000000 | 12500000 | 10000000 | 8000000 | 8000000 | 20000000 |
| MAJOR JACKPOT RESET VALUE (CREDITS) | 100000 | 100000 | 75000 | 100000 | 100000 | 100000 | 100000 |
| MINOR JACKPOT RESET VALUE (CREDITS) | 2250 | 2250 | 2000 | 2500 | 2500 | 2500 | 2500 |
| MINI JACKPOT RESET VALUE (CREDITS) | 1500 | 1350 | 1250 | 1000 | 1250 | 1000 | 1600 |

| | SC22 | SC23 | SC24 | SC25 | SC26 | SC27 | SC28 |
|---|---|---|---|---|---|---|---|
| GRAND JACKPOT RESET VALUE (CREDITS) | 15000000 | 12500000 | 10000000 | 9000000 | 15000000 | 12500000 | 10000000 |
| MAJOR JACKPOT RESET VALUE (CREDITS) | 75000 | 125000 | 80000 | 100000 | 75000 | 150000 | 100000 |
| MINOR JACKPOT RESET VALUE (CREDITS) | 2250 | 2500 | 2500 | 3000 | 2500 | 2800 | 2500 |
| MINI JACKPOT RESET VALUE (CREDITS) | 1800 | 1800 | 1750 | 1750 | 1800 | 1800 | 1750 |

| | SC29 | SC30 | SC31 | SC32 | SC33 | SC34 | SC35 |
|---|---|---|---|---|---|---|---|
| GRAND JACKPOT RESET VALUE (CREDITS) | 8000000 | 8000000 | 20000000 | 35000000 | 25000000 | 15000000 | 10000000 |
| MAJOR JACKPOT RESET VALUE (CREDITS) | 100000 | 100000 | 75000 | 100000 | 300000 | 250000 | 250000 |
| MINOR JACKPOT RESET VALUE (CREDITS) | 2500 | 2500 | 2000 | 2250 | 2500 | 3000 | 3000 |
| MINI JACKPOT RESET VALUE (CREDITS) | 1800 | 1500 | 1000 | 1500 | 1500 | 1500 | 1800 |

| | SC36 | SC37 | SC38 | SC39 | SC40 | SC41 | SC42 |
|---|---|---|---|---|---|---|---|
| GRAND JACKPOT RESET VALUE (CREDITS) | 20000000 | 18000000 | 15000000 | 12500000 | 10000000 | 100000 | 200000 |
| MAJOR JACKPOT RESET VALUE (CREDITS) | 100000 | 250000 | 150000 | 150000 | 150000 | 25000 | 50000 |
| MINOR JACKPOT RESET VALUE (CREDITS) | 3000 | 2500 | 3000 | 3000 | 2500 | 4000 | 4000 |
| MINI JACKPOT RESET VALUE (CREDITS) | 2000 | 1500 | 1800 | 2000 | 1800 | 1000 | 2000 |

| | SC43 | SC44 | SC45 | SC46 | SC47 | SC48 |
|---|---|---|---|---|---|---|
| GRAND JACKPOT RESET VALUE (CREDITS) | 500000 | 1000000 | 8888888 | 8888888 | 18888888 | 38888888 |
| MAJOR JACKPOT RESET VALUE (CREDITS) | 50000 | 100000 | 100000 | 100000 | 188888 | 88888 |
| MINOR JACKPOT RESET VALUE (CREDITS) | 4000 | 3000 | 3888 | 3888 | 3888 | 2888 |
| MINI JACKPOT RESET VALUE (CREDITS) | 2000 | 1500 | 1888 | 1888 | 1888 | 1088 |

FIG.70

PROGRESSIVE DEFAULT INCREMENT RATE TABLE

| | SC01 | SC02 | SC03 | SC04 | SC05 | SC06 | SC07 |
|---|---|---|---|---|---|---|---|
| GRAND JACKPOT SET INCREMENT PERCENTAGE | 0.250000% | 0.250000% | 0.250000% | 0.500000% | 0.500000% | 0.500000% | 0.250000% |
| MAJOR JACKPOT SET INCREMENT PERCENTAGE | 0.250000% | 0.250000% | 0.250000% | 0.500000% | 0.300000% | 0.500000% | 0.250000% |
| MINOR JACKPOT SET INCREMENT PERCENTAGE | 0.500000% | 0.750000% | 0.750000% | 0.750000% | 0.250000% | 0.750000% | 0.500000% |
| MINI JACKPOT SET INCREMENT PERCENTAGE | 1.500000% | 1.500000% | 1.500000% | 1.500000% | 1.500000% | 1.500000% | 1.500000% |

| | SC08 | SC09 | SC010 | SC011 | SC012 | SC013 | SC014 |
|---|---|---|---|---|---|---|---|
| GRAND JACKPOT SET INCREMENT PERCENTAGE | 0.500000% | 0.250000% | 0.500000% | 0.250000% | 0.250000% | 0.250000% | 0.300000% |
| MAJOR JACKPOT SET INCREMENT PERCENTAGE | 0.300000% | 0.250000% | 0.500000% | 0.250000% | 0.250000% | 0.250000% | 0.300000% |
| MINOR JACKPOT SET INCREMENT PERCENTAGE | 0.750000% | 0.750000% | 0.750000% | 0.750000% | 0.750000% | 0.750000% | 0.750000% |
| MINI JACKPOT SET INCREMENT PERCENTAGE | 1.500000% | 1.500000% | 1.500000% | 1.500000% | 1.500000% | 1.500000% | 1.500000% |

| | SC15 | SC16 | SC17 | SC18 | SC19 | SC20 | SC21 |
|---|---|---|---|---|---|---|---|
| GRAND JACKPOT SET INCREMENT PERCENTAGE | 0.250000% | 0.250000% | 0.250000% | 0.500000% | 0.250000% | 0.250000% | 0.250000% |
| MAJOR JACKPOT SET INCREMENT PERCENTAGE | 0.250000% | 0.250000% | 0.250000% | 0.300000% | 0.250000% | 0.250000% | 0.250000% |
| MINOR JACKPOT SET INCREMENT PERCENTAGE | 0.750000% | 0.500000% | 0.750000% | 0.750000% | 0.750000% | 1.000000% | 0.500000% |
| MINI JACKPOT SET INCREMENT PERCENTAGE | 1.500000% | 1.500000% | 1.500000% | 1.500000% | 1.500000% | 1.500000% | 1.500000% |

| | SC22 | SC23 | SC24 | SC25 | SC26 | SC27 | SC28 |
|---|---|---|---|---|---|---|---|
| GRAND JACKPOT SET INCREMENT PERCENTAGE | 0.250000% | 0.250000% | 0.250000% | 0.250000% | 0.250000% | 0.250000% | 0.250000% |
| MAJOR JACKPOT SET INCREMENT PERCENTAGE | 0.250000% | 0.250000% | 0.250000% | 0.250000% | 0.250000% | 0.250000% | 0.250000% |
| MINOR JACKPOT SET INCREMENT PERCENTAGE | 0.500000% | 0.500000% | 0.500000% | 0.500000% | 0.500000% | 0.500000% | 0.500000% |
| MINI JACKPOT SET INCREMENT PERCENTAGE | 1.500000% | 1.500000% | 1.500000% | 1.500000% | 1.500000% | 1.500000% | 1.500000% |

| | SC29 | SC30 | SC31 | SC32 | SC33 | SC34 | SC35 |
|---|---|---|---|---|---|---|---|
| GRAND JACKPOT SET INCREMENT PERCENTAGE | 0.250000% | 0.250000% | 0.100000% | 0.100000% | 0.250000% | 0.250000% | 0.250000% |
| MAJOR JACKPOT SET INCREMENT PERCENTAGE | 0.250000% | 0.250000% | 0.100000% | 0.100000% | 0.250000% | 0.250000% | 0.250000% |
| MINOR JACKPOT SET INCREMENT PERCENTAGE | 0.500000% | 0.750000% | 0.250000% | 0.250000% | 0.500000% | 1.000000% | 0.500000% |
| MINI JACKPOT SET INCREMENT PERCENTAGE | 1.500000% | 2.000000% | 0.500000% | 1.000000% | 1.500000% | 1.500000% | 1.500000% |

| | SC36 | SC37 | SC38 | SC39 | SC40 | SC41 | SC42 |
|---|---|---|---|---|---|---|---|
| GRAND JACKPOT SET INCREMENT PERCENTAGE | 0.250000% | 0.250000% | 0.250000% | 0.250000% | 0.250000% | 0.250000% | 0.250000% |
| MAJOR JACKPOT SET INCREMENT PERCENTAGE | 0.250000% | 0.250000% | 0.250000% | 0.250000% | 0.250000% | 0.250000% | 0.250000% |
| MINOR JACKPOT SET INCREMENT PERCENTAGE | 0.500000% | 0.500000% | 0.500000% | 1.000000% | 1.000000% | 0.500000% | 0.500000% |
| MINI JACKPOT SET INCREMENT PERCENTAGE | 1.500000% | 1.500000% | 1.500000% | 1.500000% | 2.000000% | 1.000000% | 1.000000% |

| | SC43 | SC44 | SC45 | SC46 | SC47 | SC48 |
|---|---|---|---|---|---|---|
| GRAND JACKPOT SET INCREMENT PERCENTAGE | 0.250000% | 0.250000% | 0.250000% | 0.250000% | 0.250000% | 0.100000% |
| MAJOR JACKPOT SET INCREMENT PERCENTAGE | 0.250000% | 0.250000% | 0.250000% | 0.250000% | 0.250000% | 0.100000% |
| MINOR JACKPOT SET INCREMENT PERCENTAGE | 0.500000% | 0.500000% | 0.500000% | 0.500000% | 0.500000% | 0.250000% |
| MINI JACKPOT SET INCREMENT PERCENTAGE | 1.000000% | 1.500000% | 1.000000% | 1.000000% | 1.000000% | 0.500000% |

FIG.71

FIRST BONUS GAME RANDOM DETERMINATION TABLE

| | SC01 | SC02 | SC03 | SC04 | SC05 | SC06 | SC07 |
|---|---|---|---|---|---|---|---|
| GRAND JACKPOT HIT WEIGHT | 42517597 | 42517597 | 42517597 | 42517597 | 42517597 | 44260002 | 44260002 |
| MAJOR JACKPOT HIT WEIGHT | 2125018272 | 2125018272 | 2125018272 | 2125018272 | 2125018272 | 2433241342 | 2433241342 |
| MAJOR JACKPOT HIT WEIGHT | 350451808086 | 350451808086 | 350451808086 | 350451808086 | 350451808086 | 257479048654 | 257479048654 |
| MINI JACKPOT HIT WEIGHT | 7698437164603 | 6346444074430 | 7931253553001 | 6744754107320 | 5691323808880 | 8123555679752 | 6581803735572 |

| | SC08 | SC09 | SC10 | SC11 | SC12 | SC13 | SC14 |
|---|---|---|---|---|---|---|---|
| GRAND JACKPOT HIT WEIGHT | 44260002 | 44260002 | 44260002 | 90517602 | 44517602 | 90517602 | 90517602 |
| MAJOR JACKPOT HIT WEIGHT | 2433241342 | 2433241342 | 2433241342 | 2125018264 | 2125018264 | 2125018264 | 2125018264 |
| MAJOR JACKPOT HIT WEIGHT | 257479048654 | 257479048654 | 257479048654 | 350451808080 | 350451808080 | 350451808080 | 350451808080 |
| MINI JACKPOT HIT WEIGHT | 8473191937372 | 7361516449372 | 8658001714502 | 1674453533895 | 9420618322500 | 9208762017835 | 6921118135635 |

| | SC15 | SC16 | SC17 | SC18 | SC19 | SC20 | SC21 |
|---|---|---|---|---|---|---|---|
| GRAND JACKPOT HIT WEIGHT | 90517602 | 90517602 | 90517602 | 90517602 | 90517602 | 44517602 | 180517602 |
| MAJOR JACKPOT HIT WEIGHT | 2125018264 | 2125018264 | 2125018264 | 2125018264 | 2125018264 | 2125018264 | 2125018264 |
| MAJOR JACKPOT HIT WEIGHT | 350451808080 | 350451808080 | 350451808080 | 350451808080 | 350451808080 | 350451808080 | 350451808080 |
| MINI JACKPOT HIT WEIGHT | 8041800865815 | 6104583808008 | 7844207078318 | 7830026262062 | 8521716153032 | 6402435368530 | 24653714381568 |

| | SC22 | SC23 | SC24 | SC25 | SC26 | SC27 | SC28 |
|---|---|---|---|---|---|---|---|
| GRAND JACKPOT HIT WEIGHT | 90517602 | 90517602 | 90517602 | 90517602 | 90517602 | 90517602 | 90517602 |
| MAJOR JACKPOT HIT WEIGHT | 2125018264 | 2125018264 | 2125018264 | 2125018264 | 2125018264 | 2125018264 | 2125018264 |
| MAJOR JACKPOT HIT WEIGHT | 350451808080 | 350451808080 | 350451808080 | 350451808080 | 350451808080 | 350451808080 | 350451808080 |
| MINI JACKPOT HIT WEIGHT | 3726079681165 | 8815467530030 | 5785746555555 | 6990357979964 | 1077100461246 | 1230276937715 | 4796147017218 |

| | SC29 | SC30 | SC31 | SC32 | SC33 | SC34 | SC35 |
|---|---|---|---|---|---|---|---|
| GRAND JACKPOT HIT WEIGHT | 90517602 | 90517602 | 60000000 | 202517602 | 201260002 | 82517602 | 82517602 |
| MAJOR JACKPOT HIT WEIGHT | 2125018264 | 2125018264 | 70000000 | 2125018288 | 2433241341 | 2125018288 | 2125018288 |
| MAJOR JACKPOT HIT WEIGHT | 350451808080 | 350451808080 | 120000000000 | 350451808073 | 210479048652 | 350451808073 | 350451808073 |
| MINI JACKPOT HIT WEIGHT | 8540820298830 | 6306541170245 | 8413961354558 | 2389761325130 | 2663030807321 | 9369989905079 | 9696221955518 |

| | SC36 | SC37 | SC38 | SC39 | SC40 | SC41 | SC42 |
|---|---|---|---|---|---|---|---|
| GRAND JACKPOT HIT WEIGHT | 170517602 | 82517602 | 82517602 | 90517602 | 90517602 | 122517602 | 180517602 |
| MAJOR JACKPOT HIT WEIGHT | 2125018288 | 2125018288 | 2125018288 | 2125018288 | 2125018288 | 610650000 | 2525018288 |
| MAJOR JACKPOT HIT WEIGHT | 350451808073 | 350451808073 | 350451808073 | 350451808073 | 350451808073 | 1579272800000 | 3100451808074 |
| MINI JACKPOT HIT WEIGHT | 2293753589428 | 8144065553073 | 7913327115450 | 1071361044110 | 3026238405445 | 3466809937931 | 8999068376985 |

| | SC43 | SC44 | SC45 | SC46 | SC47 | SC48 |
|---|---|---|---|---|---|---|
| GRAND JACKPOT HIT WEIGHT | 302517602 | 142517602 | 142517602 | 602500002 | 91260002 | 80000000 |
| MAJOR JACKPOT HIT WEIGHT | 2525018288 | 2525018288 | 2525018288 | 2433241341 | 2433241341 | 100000000 |
| MAJOR JACKPOT HIT WEIGHT | 3004518080073 | 3504518080073 | 4504518080073 | 210479048652 | 210479048652 | 1000000000000 |
| MINI JACKPOT HIT WEIGHT | 9119968499745 | 4802415509749 | 11810653933420 | 9477403441175 | 11119719219581 | 8799422788042 |

FIG.72

SECOND BONUS GAME RANDOM DETERMINATION TABLE

| | SC01 | SC02 | SC03 | SC04 | SC05 | SC06 | SC07 |
|---|---|---|---|---|---|---|---|
| MAJOR JACKPOT HIT WEIGHT | 5125018272 | 4125018272 | 5125018272 | 5125018272 | 5125018272 | 6433241342 | 7433241342 |
| MINOR JACKPOT HIT WEIGHT | 350451808086 | 350451808086 | 350451808086 | 350451808086 | 350451808086 | 257479048654 | 257479048654 |
| MINI JACKPOT HIT WEIGHT | 688499034703 | 532365392488 | 833099584980 | 675716235918 | 591529047163 | 525364778812 | 547245802214 |

| | SC08 | SC09 | SC10 | SC11 | SC12 | SC13 | SC14 |
|---|---|---|---|---|---|---|---|
| MAJOR JACKPOT HIT WEIGHT | 5125018272 | 5125018272 | 5125018272 | 12125018264 | 12125018264 | 12125018264 | 12125018264 |
| MINOR JACKPOT HIT WEIGHT | 350451808086 | 350451808086 | 350451808086 | 350451808080 | 350451808080 | 350451808080 | 350451808080 |
| MINI JACKPOT HIT WEIGHT | 620101042039 | 852948376158 | 728283654750 | 113037417000 5 | 991191424836 | 1188342076145 | 1086737724155 |

| | SC15 | SC16 | SC17 | SC18 | SC19 | SC20 | SC21 |
|---|---|---|---|---|---|---|---|
| MAJOR JACKPOT HIT WEIGHT | 10125018264 | 10125018264 | 10125018264 | 12125018264 | 10125018264 | 10125018264 | 10125018264 |
| MINOR JACKPOT HIT WEIGHT | 350451808080 | 350451808080 | 350451808080 | 350451808080 | 350451808080 | 350451808080 | 350451808080 |
| MINI JACKPOT HIT WEIGHT | 1265427244703 | 937437671440 | 624358737587 | 1010031142050 | 1042262504064 | 826205827555 | 551915090663 |

| | SC22 | SC23 | SC24 | SC25 | SC26 | SC27 | SC28 |
|---|---|---|---|---|---|---|---|
| MAJOR JACKPOT HIT WEIGHT | 10125018264 | 10125018264 | 10125018264 | 10125018264 | 10125018264 | 10125018264 | 10125018264 |
| MINOR JACKPOT HIT WEIGHT | 350451808080 | 350451808080 | 350451808080 | 350451808080 | 350451808080 | 350451808080 | 350451808080 |
| MINI JACKPOT HIT WEIGHT | 365770366029 | 845660358125 | 458935045671 | 752314672325 | 436568711095 | 1135164195718 | 616216882780 |

| | SC29 | SC30 | SC31 | SC32 | SC33 | SC34 | SC35 |
|---|---|---|---|---|---|---|---|
| MAJOR JACKPOT HIT WEIGHT | 10125018264 | 10125018264 | 40125018264 | 30125018264 | 8125018264 | 7125018288 | 5125018288 |
| MINOR JACKPOT HIT WEIGHT | 350451808080 | 350451808080 | 350451808080 | 350451808080 | 350451808080 | 250451808073 | 200451808073 |
| MINI JACKPOT HIT WEIGHT | 641114534610 | 762561596225 | 555207549615 | 812462196763 | 896008375865 | 850162402892 | 714334806660 |

| | SC36 | SC37 | SC38 | SC39 | SC40 | SC41 | SC42 |
|---|---|---|---|---|---|---|---|
| MAJOR JACKPOT HIT WEIGHT | 12125018264 | 5125018288 | 7125018288 | 7125018288 | 7125018288 | 6106500000 | 2525018288 |
| MINOR JACKPOT HIT WEIGHT | 350451808080 | 200451808073 | 250451808073 | 250451808073 | 250451808073 | 157977880000 | 310001808073 |
| MINI JACKPOT HIT WEIGHT | 535936223555 | 487826290051 | 451688470355 | 650217618645 | 646088477075 | 239486117561 | 511033722493 |

| | SC43 | SC44 | SC45 | SC46 | SC47 | SC48 |
|---|---|---|---|---|---|---|
| MAJOR JACKPOT HIT WEIGHT | 2525018288 | 3525018288 | 2525018288 | 2525018288 | 5525018288 | 10000000000 |
| MINOR JACKPOT HIT WEIGHT | 300451808073 | 350451808073 | 450451808073 | 450451808073 | 450451808073 | 1000000000000 |
| MINI JACKPOT HIT WEIGHT | 499361500272 | 373433184870 | 903823604470 | 545991551959 | 465233955255 | 1991759205143 |

FIG.74

| NO. | REEL 1 | REEL 2 | REEL 3 | REEL 4 | REEL 5 |
|---|---|---|---|---|---|
| 0 | ACE | FEATURE | FEATURE | FEATURE | FEATURE |
| 1 | ACE | COIN | COIN | COIN | JACK |
| 2 | ACE | COIN | QUEEN | COIN | TEN |
| 3 | FEATURE | COIN | FEATURE | NINE | TEN |
| 4 | COIN | FEATURE | NINE | FEATURE | QUEEN |
| 5 | COIN | KING | QUEEN | COIN | ACE |
| 6 | COIN | KING | QUEEN | KING | NINE |
| 7 | FEATURE | COIN | NINE | NINE | NINE |
| 8 | ACE | KING | QUEEN | NINE | ACE |
| 9 | ACE | KING | KING | QUEEN | JACK |
| 10 | KING | TEN | NINE | NINE | ACE |
| 11 | ACE | WILD | QUEEN | NINE | ACE |
| 12 | ACE | KING | COIN | QUEEN | ACE |
| 13 | JACK | TEN | NINE | TEN | ACE |
| 14 | ACE | QUEEN | QUEEN | NINE | ACE |
| 15 | ACE | TEN | WILD | QUEEN | ACE |
| 16 | ACE | KING | QUEEN | NINE | ACE |
| 17 | JACK | FEATURE | QUEEN | NINE | ACE |
| 18 | ACE | KING | NINE | QUEEN | ACE |
| 19 | ACE | TEN | QUEEN | NINE | TEN |
| 20 | JACK | TEN | QUEEN | NINE | TEN |
| 21 | JACK | KING | NINE | QUEEN | ACE |
| 22 | ACE | TEN | QUEEN | NINE | TEN |
| 23 | ACE | TEN | QUEEN | TEN | ACE |
| 24 | JACK | KING | JACK | QUEEN | TEN |
| 25 | ACE | KING | TEN | NINE | TEN |
| 26 | ACE | TEN | QUEEN | QUEEN | JACK |
| 27 | JACK | TEN | QUEEN | NINE | ACE |
| 28 | ACE | KING | NINE | NINE | TEN |
| 29 | ACE | TEN | NINE | QUEEN | TEN |
| 30 | COIN | TEN | QUEEN | NINE | KING |
| 31 | JACK | NINE | NINE | QUEEN | ACE |
| 32 | JACK | TEN | NINE | NINE | ACE |
| 33 | ACE | KING | QUEEN | NINE | JACK |
| 34 | NINE | TEN | QUEEN | QUEEN | JACK |
| 35 | ACE | TEN | ACE | QUEEN | TEN |
| 36 | JACK | KING | NINE | WILD | JACK |
| 37 | JACK | TEN | NINE | QUEEN | JACK |
| 38 | ACE | KING | QUEEN | QUEEN | ACE |
| 39 | JACK | KING | NINE | NINE | COIN |

| NO. | REEL 1 | REEL 2 | REEL 3 | REEL 4 | REEL 5 |
|---|---|---|---|---|---|
| 40 | JACK | TEN | NINE | QUEEN | JACK |
| 41 | ACE | KING | QUEEN | QUEEN | TEN |
| 42 | JACK | ACE | NINE | NINE | ACE |
| 43 | COIN | KING | NINE | JACK | TEN |
| 44 | ACE | TEN | QUEEN | QUEEN | ACE |
| 45 | JACK | KING | WILD | QUEEN | ACE |
| 46 | ACE | TEN | NINE | NINE | ACE |
| 47 | JACK | TEN | NINE | QUEEN | TEN |
| 48 | JACK | KING | QUEEN | QUEEN | ACE |
| 49 | TEN | JACK | NINE | NINE | ACE |
| 50 | ACE | KING | NINE | QUEEN | ACE |
| 51 | ACE | KING | QUEEN | FEATURE | COIN |
| 52 | JACK | TEN | NINE | QUEEN | ACE |
| 53 | ACE | TEN | NINE | QUEEN | ACE |
| 54 | ACE | KING | FEATURE | NINE | COIN |
| 55 | ACE | TEN | NINE | QUEEN | TEN |
| 56 | JACK | KING | NINE | QUEEN | TEN |
| 57 | GOURD | TEN | FEATURE | NINE | COIN |
| 58 | JACK | KING | NINE | ACE | COIN |
| 59 | ACE | TEN | NINE | TEN | COIN |
| 60 | QUEEN | GOURD | GOURD | GOURD | GOURD |
| 61 | JACK | PIG | PIG | PIG | PIG |
| 62 | ACE | INGOT | INGOT | INGOT | INGOT |
| 63 | ACE | TORTOISE | TORTOISE | TORTOISE | TORTOISE |
| 64 | PIG | KING | | | |
| 65 | INGOT | KING | | | |
| 66 | TORTOISE | TEN | | | |
| 67 | ACE | TEN | | | |
| 68 | ACE | | | | |
| 69 | JACK | | | | |
| 70 | ACE | | | | |
| 71 | ACE | | | | |
| 72 | JACK | | | | |
| 73 | ACE | | | | |
| 74 | ACE | | | | |
| 75 | JACK | | | | |
| 76 | ACE | | | | |
| 77 | ACE | | | | |
| 78 | JACK | | | | |

FIG.75

| NO. | REEL 1 | REEL 2 | REEL 3 | REEL 4 | REEL 5 |
|---|---|---|---|---|---|
| 0 | NINE | COIN | WILD | COIN | JACK |
| 1 | NINE | COIN | WILD | COIN | TEN |
| 2 | ACE | TEN | WILD | ACE | TEN |
| 3 | COIN | KING | | KING | QUEEN |
| 4 | COIN | KING | | NINE | ACE |
| 5 | COIN | TEN | | ACE | NINE |
| 6 | QUEEN | KING | | ACE | ACE |
| 7 | NINE | KING | | QUEEN | ACE |
| 8 | KING | TEN | | ACE | JACK |
| 9 | NINE | WILD | | ACE | ACE |
| 10 | NINE | KING | | QUEEN | ACE |
| 11 | JACK | TEN | | ACE | ACE |
| 12 | NINE | QUEEN | | ACE | ACE |
| 13 | NINE | TEN | | QUEEN | ACE |
| 14 | NINE | KING | | ACE | ACE |
| 15 | JACK | KING | | ACE | ACE |
| 16 | NINE | TEN | | QUEEN | ACE |
| 17 | NINE | TEN | | ACE | ACE |
| 18 | JACK | KING | | ACE | TEN |
| 19 | JACK | TEN | | QUEEN | ACE |
| 20 | NINE | TEN | | ACE | ACE |
| 21 | NINE | KING | | ACE | TEN |
| 22 | JACK | KING | | QUEEN | ACE |
| 23 | NINE | TEN | | ACE | TEN |
| 24 | NINE | TEN | | QUEEN | TEN |
| 25 | JACK | KING | | ACE | JACK |
| 26 | NINE | TEN | | ACE | ACE |
| 27 | NINE | TEN | | QUEEN | TEN |
| 28 | COIN | NINE | | ACE | TEN |
| 29 | JACK | TEN | | QUEEN | KING |
| 30 | JACK | KING | | ACE | ACE |
| 31 | NINE | TEN | | ACE | ACE |
| 32 | NINE | TEN | | QUEEN | JACK |
| 33 | NINE | KING | | QUEEN | JACK |
| 34 | JACK | TEN | | WILD | TEN |
| 35 | JACK | KING | | QUEEN | JACK |
| 36 | NINE | KING | | QUEEN | JACK |
| 37 | JACK | TEN | | ACE | ACE |
| 38 | JACK | KING | | QUEEN | COIN |
| 39 | NINE | ACE | | QUEEN | JACK |

| NO. | REEL 1 | REEL 2 | REEL 3 | REEL 4 | REEL 5 |
|---|---|---|---|---|---|
| 40 | JACK | KING | | ACE | TEN |
| 41 | COIN | KING | | JACK | ACE |
| 42 | NINE | TEN | | QUEEN | TEN |
| 43 | JACK | TEN | | QUEEN | ACE |
| 44 | NINE | KING | | ACE | ACE |
| 45 | JACK | JACK | | QUEEN | ACE |
| 46 | TEN | KING | | QUEEN | TEN |
| 47 | NINE | KING | | ACE | ACE |
| 48 | NINE | TEN | | QUEEN | ACE |
| 49 | JACK | TEN | | QUEEN | ACE |
| 50 | NINE | KING | | QUEEN | COIN |
| 51 | NINE | TEN | | ACE | ACE |
| 52 | NINE | KING | | QUEEN | ACE |
| 53 | JACK | TEN | | QUEEN | COIN |
| 54 | GOURD | KING | | ACE | TEN |
| 55 | JACK | TEN | | ACE | TEN |
| 56 | NINE | GOURD | | TEN | COIN |
| 57 | NINE | PIG | | GOURD | COIN |
| 58 | JACK | INGOT | | PIG | COIN |
| 59 | NINE | TORTOISE | | INGOT | GOURD |
| 60 | NINE | KING | | TORTOISE | PIG |
| 61 | PIG | KING | | | INGOT |
| 62 | INGOT | TEN | | | TORTOISE |
| 63 | TORTOISE | TEN | | | |
| 64 | NINE | KING | | | |
| 65 | NINE | KING | | | |
| 66 | JACK | TEN | | | |
| 67 | NINE | TEN | | | |
| 68 | NINE | KING | | | |
| 69 | JACK | KING | | | |
| 70 | NINE | TEN | | | |
| 71 | NINE | TEN | | | |
| 72 | JACK | KING | | | |
| 73 | NINE | KING | | | |
| 74 | NINE | TEN | | | |
| 75 | JACK | TEN | | | |
| 76 | JACK | KING | | | |
| 77 | NINE | KING | | | |
| 78 | NINE | TEN | | | |
| 79 | JACK | TEN | | | |

FIG.76

| | REEL1 | REEL2 | REEL3 | REEL4 | REEL5 |
|---|---|---|---|---|---|
| 80 | JACK | KING | | | |
| 81 | NINE | KING | | | |
| 82 | NINE | TEN | | | |
| 83 | JACK | TEN | | | |
| 84 | JACK | KING | | | |
| 85 | NINE | KING | | | |
| 86 | NINE | TEN | | | |
| 87 | JACK | KING | | | |
| 88 | JACK | KING | | | |
| 89 | NINE | KING | | | |
| 90 | NINE | TEN | | | |
| 91 | JACK | TEN | | | |
| 92 | JACK | KING | | | |
| 93 | NINE | KING | | | |
| 94 | NINE | TEN | | | |
| 95 | JACK | TEN | | | |
| 96 | JACK | | | | |

FIG.77

| NO. | REEL 1 | REEL 2 | REEL 3 | REEL 4 | REEL 5 |
|---|---|---|---|---|---|
| 0 | PIG | FEATURE | FEATURE | FEATURE | FEATURE |
| 1 | PIG | TORTOISE | TORTOISE | TORTOISE | JACK |
| 2 | KING | TORTOISE | TORTOISE | TORTOISE | TORTOISE |
| 3 | FEATURE | TORTOISE | WILD | ACE | TEN |
| 4 | TORTOISE | FEATURE | NINE | FEATURE | QUEEN |
| 5 | TORTOISE | PIG | PIG | TORTOISE | GOURD |
| 6 | TORTOISE | PIG | COIN | PIG | NINE |
| 7 | FEATURE | PIG | COIN | JACK | ACE |
| 8 | GOURD | GOURD | COIN | NINE | INGOT |
| 9 | TORTOISE | GOURD | GOURD | INGOT | JACK |
| 10 | INGOT | GOURD | GOURD | ACE | ACE |
| 11 | ACE | WILD | GOURD | KING | GOURD |
| 12 | COIN | TORTOISE | INGOT | COIN | TEN |
| 13 | INGOT | JACK | PIG | JACK | QUEEN |
| 14 | GOURD | PIG | COIN | GOURD | COIN |
| 15 | ACE | PIG | WILD | NINE | COIN |
| 16 | INGOT | COIN | KING | JACK | COIN |
| 17 | GOURD | WILD | GOURD | INGOT | NINE |
| 18 | KING | TORTOISE | COIN | NINE | INGOT |
| 19 | COIN | GOURD | COIN | QUEEN | INGOT |
| 20 | GOURD | KING | TEN | PIG | INGOT |
| 21 | TEN | INGOT | GOURD | COIN | TEN |
| 22 | INGOT | INGOT | GOURD | COIN | QUEEN |
| 23 | GOURD | INGOT | PIG | COIN | INGOT |
| 24 | ACE | COIN | PIG | ACE | KING |
| 25 | PIG | COIN | PIG | TEN | GOURD |
| 26 | COIN | COIN | JACK | GOURD | GOURD |
| 27 | GOURD | ACE | INGOT | GOURD | GOURD |
| 28 | GOURD | GOURD | INGOT | GOURD | ACE |
| 29 | GOURD | QUEEN | PIG | JACK | PIG |
| 30 | PIG | COIN | PIG | INGOT | PIG |

| NO. | REEL 1 | REEL 2 | REEL 3 | REEL 4 | REEL 5 |
|---|---|---|---|---|---|
| 31 | COIN | TEN | TEN | KING | PIG |
| 32 | COIN | GOURD | GOURD | COIN | ACE |
| 33 | PIG | QUEEN | KING | COIN | GOURD |
| 34 | JACK | COIN | COIN | COIN | KING |
| 35 | GOURD | TEN | ACE | ACE | PIG |
| 36 | GOURD | GOURD | GOURD | WILD | ACE |
| 37 | GOURD | JACK | NINE | TEN | JACK |
| 38 | QUEEN | PIG | COIN | QUEEN | GOURD |
| 39 | INGOT | KING | ACE | GOURD | TORTOISE |
| 40 | COIN | COIN | INGOT | KING | JACK |
| 41 | COIN | GOURD | COIN | PIG | GOURD |
| 42 | PIG | ACE | COIN | PIG | GOURD |
| 43 | JACK | TORTOISE | COIN | PIG | KING |
| 44 | COIN | WILD | QUEEN | NINE | JACK |
| 45 | NINE | PIG | PIG | GOURD | GOURD |
| 46 | GOURD | PIG | WILD | GOURD | KING |
| 47 | ACE | KING | COIN | TEN | PIG |
| 48 | COIN | GOURD | JACK | ACE | QUEEN |
| 49 | INGOT | NINE | PIG | INGOT | ACE |
| 50 | INGOT | COIN | PIG | NINE | TORTOISE |
| 51 | INGOT | PIG | INGOT | WILD | TORTOISE |
| 52 | TEN | NINE | FEATURE | COIN | QUEEN |
| 53 | PIG | GOURD | TORTOISE | KING | NINE |
| 54 | NINE | ACE | TORTOISE | GOURD | TORTOISE |
| 55 | COIN | PIG | FEATURE | TEN | TEN |
| 56 | COIN | COIN | QUEEN | INGOT | NINE |
| 57 | COIN | COIN | TORTOISE | INGOT | TORTOISE |
| 58 | QUEEN | COIN | ACE | INGOT | TORTOISE |
| 59 | PIG | GOURD | GOURD | NINE | GOURD |

FIG.78

| NO. | REEL 1 | REEL 2 | REEL 3 | REEL 4 | REEL 5 |
|---|---|---|---|---|---|
| 0 | PIG | WILD | WILD | WILD | JACK |
| 1 | PIG | TORTOISE | WILD | GOURD | TORTOISE |
| 2 | KING | TORTOISE | WILD | GOURD | TEN |
| 3 | TORTOISE | TORTOISE | | ACE | QUEEN |
| 4 | TORTOISE | PIG | | TORTOISE | GOURD |
| 5 | TORTOISE | PIG | | PIG | NINE |
| 6 | GOURD | PIG | | JACK | ACE |
| 7 | TORTOISE | GOURD | | NINE | INGOT |
| 8 | INGOT | GOURD | | INGOT | JACK |
| 9 | ACE | GOURD | | ACE | ACE |
| 10 | COIN | WILD | | KING | GOURD |
| 11 | INGOT | TORTOISE | | COIN | TEN |
| 12 | GOURD | JACK | | JACK | QUEEN |
| 13 | ACE | PIG | | GOURD | COIN |
| 14 | INGOT | PIG | | NINE | COIN |
| 15 | GOURD | COIN | | JACK | COIN |
| 16 | KING | WILD | | INGOT | NINE |
| 17 | COIN | TORTOISE | | NINE | INGOT |
| 18 | GOURD | GOURD | | QUEEN | INGOT |
| 19 | TEN | KING | | PIG | INGOT |
| 20 | INGOT | INGOT | | COIN | TEN |
| 21 | GOURD | INGOT | | COIN | QUEEN |
| 22 | ACE | INGOT | | COIN | INGOT |
| 23 | PIG | COIN | | ACE | KING |
| 24 | COIN | COIN | | TEN | GOURD |
| 25 | GOURD | COIN | | GOURD | GOURD |
| 26 | GOURD | ACE | | GOURD | GOURD |
| 27 | GOURD | GOURD | | GOURD | ACE |
| 28 | PIG | QUEEN | | JACK | PIG |
| 29 | COIN | COIN | | INGOT | PIG |
| 30 | COIN | TEN | | KING | PIG |

| NO. | REEL 1 | REEL 2 | REEL 3 | REEL 4 | REEL 5 |
|---|---|---|---|---|---|
| 31 | PIG | GOURD | | COIN | ACE |
| 32 | JACK | QUEEN | | COIN | GOURD |
| 33 | GOURD | COIN | | COIN | KING |
| 34 | GOURD | TEN | | ACE | PIG |
| 35 | GOURD | GOURD | | WILD | ACE |
| 36 | QUEEN | JACK | | TEN | JACK |
| 37 | INGOT | PIG | | QUEEN | GOURD |
| 38 | COIN | KING | | GOURD | TORTOISE |
| 39 | COIN | COIN | | KING | JACK |
| 40 | PIG | GOURD | | PIG | NINE |
| 41 | JACK | ACE | | PIG | GOURD |
| 42 | COIN | TORTOISE | | PIG | KING |
| 43 | NINE | WILD | | NINE | JACK |
| 44 | GOURD | PIG | | TORTOISE | GOURD |
| 45 | ACE | PIG | | TORTOISE | KING |
| 46 | COIN | KING | | TEN | PIG |
| 47 | INGOT | GOURD | | ACE | QUEEN |
| 48 | INGOT | NINE | | INGOT | ACE |
| 49 | INGOT | COIN | | NINE | TORTOISE |
| 50 | TEN | PIG | | WILD | TORTOISE |
| 51 | PIG | NINE | | COIN | QUEEN |
| 52 | NINE | GOURD | | KING | NINE |
| 53 | COIN | ACE | | PIG | TORTOISE |
| 54 | COIN | PIG | | TEN | TEN |
| 55 | COIN | COIN | | INGOT | NINE |
| 56 | QUEEN | COIN | | INGOT | NINE |
| 57 | PIG | COIN | | INGOT | TORTOISE |
| 58 | | GOURD | | NINE | GOURD |

FIG.79

| NO. | REEL 1 | REEL 2 | REEL 3 | REEL 4 | REEL 5 |
|---|---|---|---|---|---|
| 0 | ACE | FEATURE | FEATURE | FEATURE | FEATURE |
| 1 | ACE | PEACH | PEACH | PEACH | JACK |
| 2 | ACE | PEACH | QUEEN | PEACH | TEN |
| 3 | FEATURE | PEACH | FEATURE | NINE | TEN |
| 4 | PEACH | FEATURE | NINE | FEATURE | QUEEN |
| 5 | PEACH | KING | QUEEN | PEACH | ACE |
| 6 | PEACH | KING | QUEEN | KING | NINE |
| 7 | FEATURE | PEACH | NINE | NINE | ACE |
| 8 | ACE | KING | QUEEN | NINE | ACE |
| 9 | ACE | KING | KING | QUEEN | JACK |
| 10 | KING | TEN | NINE | NINE | ACE |
| 11 | ACE | WILD | QUEEN | NINE | ACE |
| 12 | ACE | KING | PEACH | QUEEN | ACE |
| 13 | JACK | TEN | NINE | TEN | ACE |
| 14 | ACE | QUEEN | QUEEN | NINE | ACE |
| 15 | ACE | TEN | WILD | QUEEN | ACE |
| 16 | ACE | KING | QUEEN | NINE | ACE |
| 17 | JACK | FEATURE | QUEEN | NINE | ACE |
| 18 | ACE | KING | NINE | QUEEN | ACE |
| 19 | ACE | TEN | QUEEN | NINE | TEN |
| 20 | JACK | TEN | QUEEN | NINE | ACE |
| 21 | JACK | KING | NINE | QUEEN | ACE |
| 22 | ACE | TEN | QUEEN | NINE | TEN |
| 23 | ACE | TEN | QUEEN | TEN | ACE |
| 24 | JACK | KING | JACK | QUEEN | TEN |
| 25 | ACE | KING | TEN | NINE | TEN |
| 26 | ACE | TEN | QUEEN | QUEEN | JACK |
| 27 | JACK | TEN | QUEEN | NINE | ACE |
| 28 | ACE | KING | NINE | NINE | TEN |
| 29 | ACE | TEN | NINE | QUEEN | TEN |
| 30 | PEACH | TEN | QUEEN | NINE | KING |
| 31 | JACK | NINE | NINE | QUEEN | ACE |
| 32 | JACK | TEN | NINE | NINE | ACE |
| 33 | ACE | KING | QUEEN | NINE | JACK |
| 34 | NINE | TEN | QUEEN | QUEEN | JACK |
| 35 | ACE | TEN | ACE | QUEEN | TEN |
| 36 | JACK | KING | NINE | WILD | JACK |
| 37 | JACK | TEN | NINE | QUEEN | JACK |
| 38 | ACE | KING | QUEEN | QUEEN | ACE |
| 39 | JACK | KING | NINE | NINE | PEACH |

| NO. | REEL 1 | REEL 2 | REEL 3 | REEL 4 | REEL 5 |
|---|---|---|---|---|---|
| 40 | JACK | TEN | NINE | QUEEN | JACK |
| 41 | ACE | KING | QUEEN | QUEEN | TEN |
| 42 | JACK | ACE | NINE | NINE | ACE |
| 43 | PEACH | KING | NINE | JACK | TEN |
| 44 | ACE | TEN | QUEEN | QUEEN | ACE |
| 45 | JACK | KING | WILD | QUEEN | ACE |
| 46 | ACE | TEN | NINE | NINE | ACE |
| 47 | JACK | TEN | NINE | QUEEN | TEN |
| 48 | JACK | KING | QUEEN | QUEEN | ACE |
| 49 | TEN | JACK | NINE | NINE | ACE |
| 50 | ACE | KING | NINE | QUEEN | ACE |
| 51 | ACE | KING | QUEEN | FEATURE | PEACH |
| 52 | JACK | TEN | NINE | QUEEN | ACE |
| 53 | ACE | TEN | NINE | QUEEN | ACE |
| 54 | ACE | KING | FEATURE | NINE | PEACH |
| 55 | ACE | TEN | NINE | QUEEN | TEN |
| 56 | JACK | KING | NINE | QUEEN | TEN |
| 57 | BUTTERFLY | TEN | FEATURE | NINE | PEACH |
| 58 | JACK | KING | NINE | ACE | PEACH |
| 59 | ACE | TEN | NINE | TEN | PEACH |
| 60 | QUEEN | BUTTERFLY | BUTTERFLY | BUTTERFLY | BUTTERFLY |
| 61 | JACK | TURTLE | TURTLE | TURTLE | TURTLE |
| 62 | ACE | DEER | DEER | DEER | DEER |
| 63 | ACE | KYLIN | KYLIN | KYLIN | KYLIN |
| 64 | TURTLE | KING | | | |
| 65 | DEER | KING | | | |
| 66 | KYLIN | TEN | | | |
| 67 | ACE | TEN | | | |
| 68 | ACE | | | | |
| 69 | JACK | | | | |
| 70 | ACE | | | | |
| 71 | ACE | | | | |
| 72 | JACK | | | | |
| 73 | ACE | | | | |
| 74 | ACE | | | | |
| 75 | JACK | | | | |
| 76 | ACE | | | | |
| 77 | ACE | | | | |
| 78 | JACK | | | | |

FIG.80

| NO. | REEL 1 | REEL 2 | REEL 3 | REEL 4 | REEL 5 |
|---|---|---|---|---|---|
| 0 | KILIN | KILIN | KILIN | KILIN | KILIN |
| 1 | DEER | DEER | DEER | DEER | DEER |
| 2 | TURTLE | TURTLE | TURTLE | TURTLE | TURTLE |
| 3 | BUTTERFLY | PEACH | BUTTERFLY | WILD | BUTTERFLY |
| 4 | PEACH | BUTTERFLY | PEACH | WILD | PEACH |
| 5 | PEACH | WILD | TURTLE | WILD | KILIN |
| 6 | PEACH | WILD | TURTLE | DEER | KILIN |
| 7 | PEACH | WILD | TURTLE | DEER | KILIN |
| 8 | PEACH | BUTTERFLY | TURTLE | PEACH | KILIN |
| 9 | PEACH | BUTTERFLY | TURTLE | BUTTERFLY | KILIN |
| 10 | PEACH | BUTTERFLY | TURTLE | DEER | KILIN |
| 11 | PEACH | BUTTERFLY | TURTLE | DEER | KILIN |
| 12 | PEACH | BUTTERFLY | TURTLE | DEER | KILIN |
| 13 | PEACH | BUTTERFLY | TURTLE | DEER | KILIN |
| 14 | PEACH | BUTTERFLY | WILD | DEER | KILIN |
| 15 | PEACH | BUTTERFLY | WILD | DEER | KILIN |
| 16 | PEACH | BUTTERFLY | WILD | DEER | KILIN |
| 17 | PEACH | BUTTERFLY | TURTLE | DEER | KILIN |
| 18 | PEACH | BUTTERFLY | TURTLE | DEER | KILIN |
| 19 | PEACH | BUTTERFLY | TURTLE | DEER | KILIN |
| 20 | PEACH | BUTTERFLY | TURTLE | DEER | KILIN |
| 21 | PEACH | BUTTERFLY | TURTLE | DEER | KILIN |
| 22 | PEACH | BUTTERFLY | TURTLE | DEER | KILIN |
| 23 | PEACH | BUTTERFLY | TURTLE | DEER | KILIN |
| 24 | PEACH | BUTTERFLY | TURTLE | DEER | KILIN |
| 25 | PEACH | BUTTERFLY | TURTLE | DEER | KILIN |
| 26 | PEACH | BUTTERFLY | TURTLE | DEER | KILIN |
| 27 | PEACH | BUTTERFLY | TURTLE | DEER | KILIN |
| 28 | PEACH | BUTTERFLY | TURTLE | DEER | KILIN |
| 29 | PEACH | BUTTERFLY | TURTLE | DEER | KILIN |
| 30 | PEACH | BUTTERFLY | TURTLE | DEER | KILIN |

| NO. | REEL 1 | REEL 2 | REEL 3 | REEL 4 | REEL 5 |
|---|---|---|---|---|---|
| 31 | PEACH | BUTTERFLY | TURTLE | DEER | KILIN |
| 32 | PEACH | BUTTERFLY | TURTLE | DEER | KILIN |
| 33 | PEACH | BUTTERFLY | TURTLE | DEER | KILIN |
| 34 | PEACH | BUTTERFLY | TURTLE | DEER | KILIN |
| 35 | PEACH | BUTTERFLY | TURTLE | DEER | KILIN |
| 36 | PEACH | BUTTERFLY | TURTLE | DEER | KILIN |
| 37 | PEACH | BUTTERFLY | TURTLE | DEER | KILIN |
| 38 | PEACH | BUTTERFLY | TURTLE | DEER | KILIN |
| 39 | PEACH | BUTTERFLY | TURTLE | DEER | KILIN |
| 40 | PEACH | BUTTERFLY | TURTLE | DEER | KILIN |
| 41 | PEACH | BUTTERFLY | TURTLE | DEER | KILIN |
| 42 | PEACH | BUTTERFLY | TURTLE | | |
| 43 | | BUTTERFLY | | | |
| 44 | | BUTTERFLY | | | |
| 45 | | BUTTERFLY | | | |
| 46 | | BUTTERFLY | | | |
| 47 | | BUTTERFLY | | | |
| 48 | | BUTTERFLY | | | |
| 49 | | | | | |
| 50 | | | | | |
| 51 | | | | | |
| 52 | | | | | |
| 53 | | | | | |
| 54 | | | | | |
| 55 | | | | | |
| 56 | | | | | |
| 57 | | | | | |
| 58 | | | | | |
| 59 | | | | | |
| 60 | | | | | |
| 61 | | | | | |

FIG.81

| NO. | REEL 1 | REEL 2 | REEL 3 | REEL 4 | REEL 5 |
|---|---|---|---|---|---|
| 0 | TURTLE | FEATURE | FEATURE | FEATURE | FEATURE |
| 1 | TURTLE | KYLIN | KYLIN | KYLIN | JACK |
| 2 | KING | KYLIN | BUTTERFLY | KYLIN | KYLIN |
| 3 | FEATURE | KYLIN | WILD | ACE | TEN |
| 4 | KYLIN | FEATURE | NINE | FEATURE | QUEEN |
| 5 | KYLIN | TURTLE | TURTLE | KYLIN | BUTTERFLY |
| 6 | KYLIN | TURTLE | PEACH | TURTLE | NINE |
| 7 | FEATURE | TURTLE | PEACH | JACK | ACE |
| 8 | BUTTERFLY | BUTTERFLY | PEACH | NINE | DEER |
| 9 | KYLIN | BUTTERFLY | BUTTERFLY | DEER | JACK |
| 10 | DEER | BUTTERFLY | BUTTERFLY | ACE | ACE |
| 11 | ACE | WILD | BUTTERFLY | KING | BUTTERFLY |
| 12 | PEACH | KYLIN | DEER | PEACH | TEN |
| 13 | DEER | JACK | TURTLE | JACK | QUEEN |
| 14 | BUTTERFLY | TURTLE | PEACH | BUTTERFLY | PEACH |
| 15 | QUEEN | TURTLE | WILD | NINE | PEACH |
| 16 | DEER | PEACH | KING | JACK | PEACH |
| 17 | BUTTERFLY | WILD | BUTTERFLY | DEER | NINE |
| 18 | KING | KYLIN | PEACH | NINE | DEER |
| 19 | PEACH | BUTTERFLY | PEACH | QUEEN | DEER |
| 20 | BUTTERFLY | KING | TEN | TURTLE | DEER |
| 21 | TEN | DEER | BUTTERFLY | PEACH | TEN |
| 22 | DEER | DEER | BUTTERFLY | PEACH | QUEEN |
| 23 | BUTTERFLY | DEER | TURTLE | PEACH | DEER |
| 24 | ACE | PEACH | TURTLE | ACE | KING |
| 25 | TURTLE | PEACH | TURTLE | TEN | BUTTERFLY |
| 26 | PEACH | PEACH | JACK | BUTTERFLY | BUTTERFLY |
| 27 | BUTTERFLY | ACE | DEER | BUTTERFLY | BUTTERFLY |
| 28 | BUTTERFLY | BUTTERFLY | DEER | BUTTERFLY | ACE |
| 29 | BUTTERFLY | QUEEN | TURTLE | JACK | TURTLE |
| 30 | TURTLE | PEACH | TURTLE | DEER | TURTLE |

| NO. | REEL 1 | REEL 2 | REEL 3 | REEL 4 | REEL 5 |
|---|---|---|---|---|---|
| 31 | PEACH | TEN | TEN | KING | TURTLE |
| 32 | PEACH | BUTTERFLY | BUTTERFLY | PEACH | ACE |
| 33 | TURTLE | QUEEN | KING | PEACH | BUTTERFLY |
| 34 | JACK | PEACH | PEACH | PEACH | KING |
| 35 | BUTTERFLY | TEN | ACE | ACE | TURTLE |
| 36 | BUTTERFLY | BUTTERFLY | BUTTERFLY | WILD | ACE |
| 37 | BUTTERFLY | JACK | NINE | TEN | JACK |
| 38 | QUEEN | TURTLE | PEACH | QUEEN | BUTTERFLY |
| 39 | DEER | KING | ACE | BUTTERFLY | KYLIN |
| 40 | PEACH | PEACH | DEER | KING | JACK |
| 41 | PEACH | BUTTERFLY | PEACH | TURTLE | NINE |
| 42 | TURTLE | ACE | PEACH | TURTLE | BUTTERFLY |
| 43 | JACK | KYLIN | PEACH | TURTLE | KING |
| 44 | PEACH | WILD | QUEEN | NINE | JACK |
| 45 | NINE | TURTLE | TURTLE | BUTTERFLY | BUTTERFLY |
| 46 | BUTTERFLY | TURTLE | WILD | BUTTERFLY | KING |
| 47 | TEN | KING | PEACH | TEN | TURTLE |
| 48 | PEACH | BUTTERFLY | JACK | ACE | QUEEN |
| 49 | DEER | NINE | TURTLE | DEER | ACE |
| 50 | DEER | PEACH | TURTLE | NINE | BUTTERFLY |
| 51 | DEER | TURTLE | DEER | WILD | KYLIN |
| 52 | TEN | NINE | FEATURE | PEACH | QUEEN |
| 53 | TURTLE | BUTTERFLY | KYLIN | KING | NINE |
| 54 | NINE | ACE | KYLIN | TURTLE | KYLIN |
| 55 | PEACH | TURTLE | FEATURE | TEN | TEN |
| 56 | PEACH | PEACH | QUEEN | DEER | NINE |
| 57 | PEACH | PEACH | KYLIN | DEER | KYLIN |
| 58 | QUEEN | PEACH | ACE | DEER | KYLIN |
| 59 | TURTLE | BUTTERFLY | BUTTERFLY | NINE | KYLIN |

FIG.82

| NO. | REEL 1 | REEL 2 | REEL 3 | REEL 4 | REEL 5 |
|---|---|---|---|---|---|
| 0 | BUTTERFLY | BUTTERFLY | PEACH | DEER | PEACH |
| 1 | PEACH | DEER | PEACH | PEACH | BUTTERFLY |
| 2 | DEER | TURTLE | BUTTERFLY | KYLIN | TURTLE |
| 3 | BUTTERFLY | BUTTERFLY | WILD | TURTLE | DEER |
| 4 | BUTTERFLY | WILD | WILD | PEACH | BUTTERFLY |
| 5 | BUTTERFLY | WILD | DEER | DEER | TURTLE |
| 6 | KYLIN | BUTTERFLY | BUTTERFLY | DEER | PEACH |
| 7 | KYLIN | DEER | BUTTERFLY | PEACH | BUTTERFLY |
| 8 | BUTTERFLY | KYLIN | TURTLE | TURTLE | KYLIN |
| 9 | BUTTERFLY | TURTLE | DEER | TURTLE | TURTLE |
| 10 | DEER | PEACH | BUTTERFLY | TURTLE | DEER |
| 11 | TURTLE | BUTTERFLY | KYLIN | BUTTERFLY | KYLIN |
| 12 | TURTLE | DEER | DEER | KYLIN | KYLIN |
| 13 | TURTLE | DEER | TURTLE | DEER | PEACH |
| 14 | BUTTERFLY | BUTTERFLY | BUTTERFLY | DEER | DEER |
| 15 | BUTTERFLY | TURTLE | BUTTERFLY | KYLIN | BUTTERFLY |
| 16 | DEER | KYLIN | KYLIN | TURTLE | BUTTERFLY |
| 17 | TURTLE | WILD | KYLIN | PEACH | BUTTERFLY |
| 18 | BUTTERFLY | WILD | TURTLE | PEACH | DEER |
| 19 | KYLIN | WILD | TURTLE | DEER | BUTTERFLY |
| 20 | KYLIN | TURTLE | TURTLE | DEER | BUTTERFLY |
| 21 | KYLIN | TURTLE | BUTTERFLY | BUTTERFLY | PEACH |
| 22 | DEER | TURTLE | KYLIN | KYLIN | DEER |
| 23 | BUTTERFLY | BUTTERFLY | DEER | BUTTERFLY | DEER |
| 24 | TURTLE | BUTTERFLY | PEACH | TURTLE | PEACH |
| 25 | DEER | KYLIN | BUTTERFLY | KYLIN | PEACH |
| 26 | BUTTERFLY | KYLIN | TURTLE | PEACH | PEACH |
| 27 | BUTTERFLY | KYLIN | TURTLE | PEACH | TURTLE |
| 28 | PEACH | DEER | WILD | PEACH | TURTLE |
| 29 | DEER | DEER | WILD | KYLIN | KYLIN |
| 30 | BUTTERFLY | TURTLE | WILD | KYLIN | TURTLE |
| 31 | PEACH | BUTTERFLY | TURTLE | TURTLE | DEER |
| 32 | TURTLE | KYLIN | BUTTERFLY | WILD | KYLIN |
| 33 | KYLIN | PEACH | DEER | WILD | BUTTERFLY |
| 34 | KYLIN | BUTTERFLY | DEER | WILD | BUTTERFLY |

| NO. | REEL 1 | REEL 2 | REEL 3 | REEL 4 | REEL 5 |
|---|---|---|---|---|---|
| 35 | TURTLE | DEER | KYLIN | BUTTERFLY | KYLIN |
| 36 | BUTTERFLY | PEACH | BUTTERFLY | BUTTERFLY | DEER |
| 37 | BUTTERFLY | PEACH | PEACH | TURTLE | BUTTERFLY |
| 38 | BUTTERFLY | PEACH | KYLIN | DEER | TURTLE |
| 39 | KYLIN | BUTTERFLY | KYLIN | KYLIN | DEER |
| 40 | PEACH | DEER | TURTLE | PEACH | KYLIN |
| 41 | BUTTERFLY | TURTLE | DEER | PEACH | PEACH |
| 42 | KYLIN | BUTTERFLY | KYLIN | BUTTERFLY | BUTTERFLY |
| 43 | TURTLE | DEER | KYLIN | BUTTERFLY | KYLIN |
| 44 | BUTTERFLY | DEER | BUTTERFLY | BUTTERFLY | DEER |
| 45 | BUTTERFLY | BUTTERFLY | BUTTERFLY | KYLIN | BUTTERFLY |
| 46 | KYLIN | WILD | DEER | PEACH | PEACH |
| 47 | PEACH | WILD | KYLIN | TURTLE | TURTLE |
| 48 | PEACH | BUTTERFLY | BUTTERFLY | KYLIN | KYLIN |
| 49 | PEACH | BUTTERFLY | BUTTERFLY | KYLIN | PEACH |
| 50 | BUTTERFLY | TURTLE | BUTTERFLY | TURTLE | BUTTERFLY |
| 51 | DEER | DEER | TURTLE | WILD | KYLIN |
| 52 | DEER | BUTTERFLY | PEACH | WILD | DEER |
| 53 | DEER | BUTTERFLY | WILD | DEER | TURTLE |
| 54 | BUTTERFLY | BUTTERFLY | WILD | DEER | TURTLE |
| 55 | TURTLE | KYLIN | KYLIN | DEER | TURTLE |
| 56 | DEER | DEER | BUTTERFLY | BUTTERFLY | PEACH |
| 57 | BUTTERFLY | DEER | PEACH | KYLIN | DEER |
| 58 | | DEER | KYLIN | PEACH | BUTTERFLY |
| 59 | | KYLIN | BUTTERFLY | BUTTERFLY | TURTLE |
| 60 | | | | | DEER |
| 61 | | | | | KYLIN |
| 62 | | | | | BUTTERFLY |
| 63 | | | | | TURTLE |
| 64 | | | | | DEER |
| 65 | | | | | PEACH |
| 66 | | | | | TURTLE |
| 67 | | | | | BUTTERFLY |
| 68 | | | | | KYLIN |

FIG.84

COIN SORTING TABLE

| | (A) | | (B) | | (C) | |
|---|---|---|---|---|---|---|
| | X | Y | X | Y | X | Y |
| CHANGE FROM 1 —> 2 | 25 | 4.00 | 10 | 10.00 | 1 | 100.00 |
| CHANGE FROM 2 —> 3 | 25 | 4.00 | 20 | 5.00 | 5 | 20.00 |
| CHANGE FROM 3 —> 4 | 25 | 4.00 | 30 | 3.33 | 44 | 2.27 |
| CHANGE FROM 4 —> 5 | 25 | 4.00 | 40 | 2.50 | 50 | 2.00 |

GAMING MACHINE

CROSS REFERENCE TO RELATED APPLICATION

The present application claims priority from Japanese Patent Applications No. 2014-161678 filed on Aug. 7, 2014, and No. 2015-033812 filed on Feb. 24, 2015, the disclosures of which are herein incorporated by reference in its entirety.

BACKGROUND OF THE INVENTION

Field of the Invention

The present invention relates to a gaming machine.

As gaming machines, there have traditionally been ones which spins symbol arrays on a display, and rearrange a plurality of symbols in a symbol display region with a plurality of paylines (for example, see the specification of U.S. Unexamined Patent Application Publication No. 2005/0239540). Those gaming machines are typically structured so that playing of a game is possible with a bet of any of stepwisely differentiated bet amounts.

Regarding such a gaming machine that enables betting of stepwisely differentiated bet amounts, there is a chance of improving the gain of the gaming machine administrator if players bet large amounts of bet. For this reason, there has been a demand for a gaming machine in which a game progresses advantageously with a high bet amount.

In view of the above, it is an object of the present invention to provide a gaming machine in which a game progresses advantageously with a bet of a high bet amount.

SUMMARY OF THE INVENTION

An aspect of the present invention is a gaming machine, comprising: a symbol display device configured to variably display a plurality of symbol arrays with a plurality of symbols including normal symbols and specific symbols more advantageous than the normal symbols, and then display a game result by rearranging the symbols in a symbol display region containing a matrix of cells; a bet input device capable of receiving a bet whose amount is designated by a player; and a controller configured to run a normal game which rearranges symbols on the symbol display device on condition that a bet is placed, wherein the controller modifies the symbols arrayed in the plurality of symbol arrays, so that the ratios of the specific symbols to the total number of the symbols in all the symbol arrays increases with an increase in the bet amount entered by the player.

As described, the percentages of the specific symbols which are more advantageous than the normal symbols increase with an increase in the bet amount. This clearly suggests to the player that the game is played more advantageously with an increase in the bet amount, in the form of an increase in the percentage of the specific symbols. This consequently improves the possibility of increasing the gain of the gaming machine administrator.

Further, in the gaming machine of the above aspect of the present invention, the specific symbols may include a plurality of types with stepwisely differentiated advantage levels; and the controller may enable an increase in the percentage of the specific symbol with a high advantage, with an increase in the bet amount placed by the player.

The above structure clarifies to the player that an increase in the bet amount will lead to a higher advantage, in the form of an increase in the percentage of the highly advantageous specific symbols.

Further, in the gaming machine of the above aspect of the present invention, the bet input device may be configured so as to enable betting of stepwise bet amounts corresponding to a plurality of types of the specific symbols; and the controller may enable an increase in the percentage of a specific symbol, with a stepwise increase in the corresponding bet amount placed by the player.

The above structure further clarifies to the player that an increase in the bet amount will lead to a higher advantage, in the form of an increase in the percentage of the specific symbol with the advantage corresponding to the stepwise bet amount.

Further, in the gaming machine of the above aspect of the present invention, the controller may increase the percentage of the specific symbols in the plurality of symbol arrays by increasing the number of specific symbols.

The above structure further clarifies to the player that an increase in the bet amount will lead to a higher advantage, because the number of specific symbols increases relatively to an increase in the bet amount.

Further, in the gaming machine of the above aspect of the present invention, the percentage of the specific symbols in the plurality of symbol arrays may be increased by reducing the number of normal symbols.

The above structure further clarifies to the player that an increase in the bet amount will lead to a higher advantage, because the number of normal symbols decreases relatively to an increase in the bet amount.

Further, in the gaming machine of the above aspect of the present invention, the controller may run a free game requiring no betting, when a predetermined condition is satisfied during the normal game, in the free game, variably display a plurality of symbol arrays different from those in the normal game on the display, and then rearrange symbols in the symbol display region, and modify the symbols in the plurality of symbol arrays so that, the larger the bet amount placed in the normal game satisfying the predetermined condition, the higher the ratios of the specific symbols to the number of the symbols in all the symbol arrays will be as compared with the percentage of the same in the normal game.

With the structure, the higher the bet amount in the normal game having triggered the free game, the higher the percentage of the specific symbols more advantageous than the normal symbols becomes, in the free game triggered by that normal game. This clearly suggests to the player that the free game is also played more advantageously with an increase in the bet amount, in the form of an increase in the percentage of the specific symbols. This consequently improves the possibility of increasing the gain of the gaming machine administrator.

Further, in the gaming machine of the above aspect of the present invention, the controller may be capable of informing an increase in the percentage of the specific symbols to the player.

By informing an increase in the percentage of the specific symbols, the structure facilitates the understanding of the situation even for players with limited experience in the game.

The present invention allows the game to progress advantageously with a high bet amount, and clarify the same to the players.

BRIEF DESCRIPTION OF THE DRAWINGS

FIG. 3 is an explanatory diagram showing an example payout table.

FIG. 4 is a diagram showing an example symbol array for a normal game.

FIG. 5 is a diagram showing an example symbol array for the normal game.

FIG. 6 is a diagram showing an example symbol array for the normal game.

FIG. 7 is a diagram showing an example symbol array for the normal game.

FIG. 8 is a diagram showing an example symbol array for the normal game.

FIG. 9 is a diagram showing an example symbol array for a free game.

FIG. 10 is a diagram showing an example symbol array for the free game.

FIG. 11 is a diagram showing an example symbol array for the free game.

FIG. 12 is a diagram showing an example symbol array for the free game.

FIG. 13 is a diagram showing an example symbol array for the free game.

FIG. 14 is a diagram showing the specific symbols and their percentages in the normal game.

FIG. 15 is a diagram showing the specific symbols and their percentages in the free game.

FIG. 30 is an explanatory diagram of a scenario table.

FIG. 36 is an explanatory diagram of a progressive challenge table.

FIG. 38 is an explanatory diagram of a mystery random determination table.

FIG. 39 is an explanatory diagram of a progressive random determination table.

FIG. 46 is an explanatory diagram of a win rank.

FIG. 57 is a diagram showing an example symbol array for the free game.

FIG. 58 is a diagram showing an example symbol array for the free game.

FIG. 59 is a diagram showing an example symbol array for the free game.

FIG. 60 is a diagram showing an example symbol array for the free game.

FIG. 64 is an explanatory diagram showing a wild symbol random determination table in the modification.

FIG. 65 is an explanatory diagram showing a top symbol random determination table in the modification.

FIG. 69 is an explanatory diagram of a progressive initial value table in the modification.

FIG. 70 is an explanatory diagram of a progressive default increment rate table in the modification.

FIG. 71 is an explanatory diagram showing a first bonus game random determination table in the modification.

FIG. 72 is an explanatory diagram showing a second bonus game random determination table in the modification.

FIG. 74 is a diagram showing an example symbol array for the normal game in the modification.

FIG. 75 is a diagram showing an example symbol array for the free game in the modification.

FIG. 76 is a diagram showing an example symbol array for the free game in the modification.

FIG. 77 is a diagram showing an example symbol array for the normal game in the modification.

FIG. 78 is a diagram showing an example symbol array for the free game in the modification.

FIG. 79 is a diagram showing an example symbol array for the normal game in the modification.

FIG. 80 is a diagram showing an example symbol array for the free game in the modification.

FIG. 81 is a diagram showing an example symbol array for the normal game in the modification.

FIG. 82 is a diagram showing an example symbol array for the free game in the modification.

FIG. 84 is an explanatory diagram of a coin sorting table in the modification.

DESCRIPTION OF THE PREFERRED EMBODIMENTS

The following describes a gaming machine of the present invention with reference to attached drawings.

(Gaming Machine Over View: Increasing the Types and the Number of Specific Symbols for Each Additional Bet)

Figure 1:
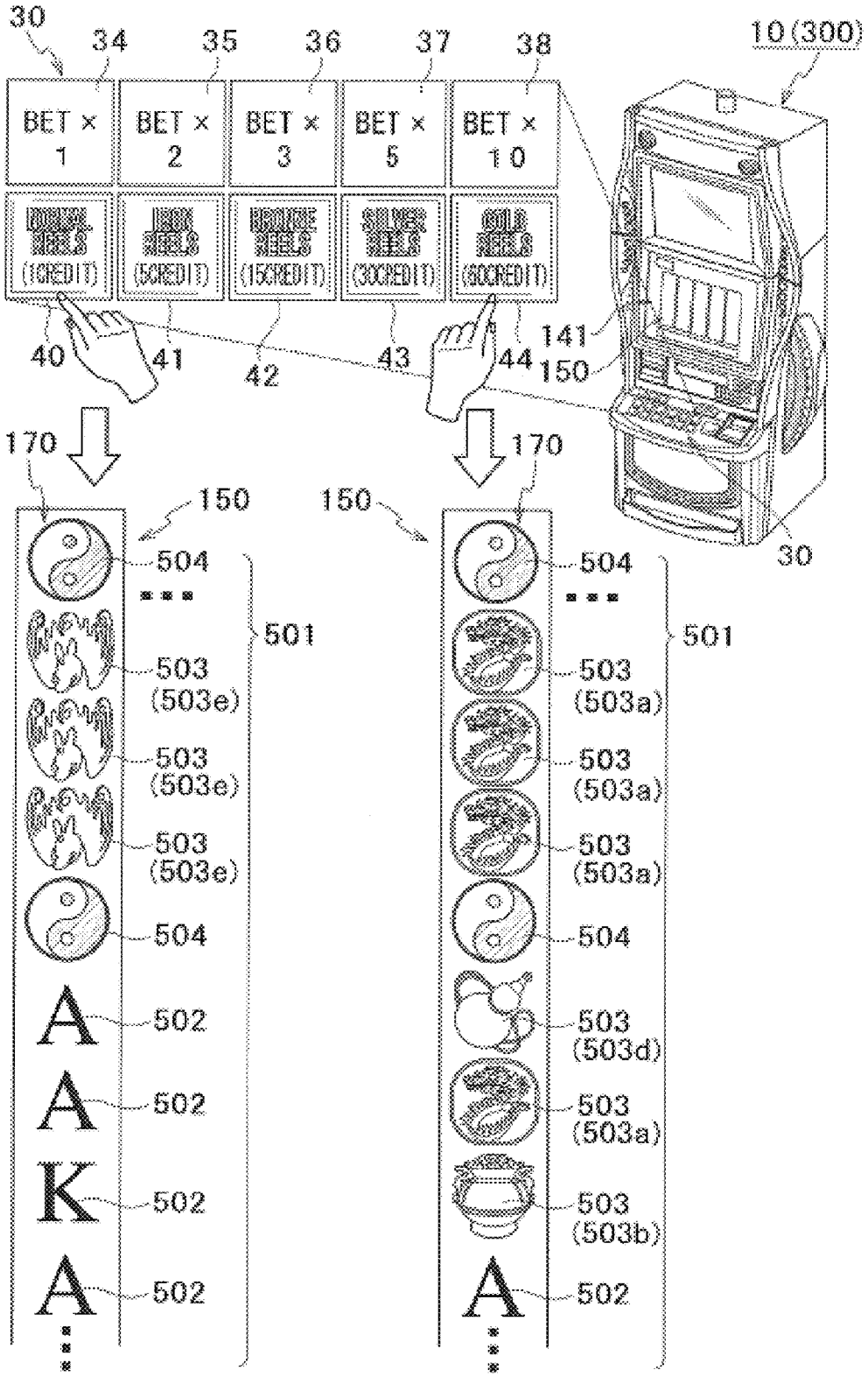
FIG. 1 is an explanatory diagram of a gaming machine.

As shown in FIG. 1, a gaming machine of the present embodiment is configured to variably displaying symbol arrays in which the types and the number of the specific symbols are increased with an additional bet. Specifically, a slot machine 10 (gaming machine 300) has a lower image display panel 141 serving as a symbol display device. On the lower image display panel 141, a plurality of symbol arrays 170 with a plurality of symbols 501 including normal symbols 502 and specific symbols 503 more advantageous than the normal symbols 502 are variably displayed, and then a game result is displayed by rearranging the symbols 501 in a symbol display region 150 containing a matrix of cells 28 (see FIG. 8, also referred to as display blocks 28).

The slot machine 10 further includes a control panel 30 serving as a bet input device capable of receiving a bet whose bet amount is designated by a player. The control panel 30 has credit buttons 40 to 44 (play-1 credit button 40, play-5 credit button 41, play-15 credit button 42, play-30 credit button 43, and play-60 credit button 44), and is configured to enable setting of the bet amount step by step. In the following description, bets based on the credit buttons 40 to 44 are referred to as "symbol bet (SBB) 1, 5, 15, 30, 60". The slot machine 10 runs a normal game which rearranges symbols 501 on the lower image display panel 141 on condition that a bet is placed. Further, the slot machine 10 is configured to modify the symbols 501 arrayed in the plurality of symbol arrays 170, so that the ratios of the specific symbols 503 to the total number of the symbols 501 in all the symbol arrays 170 increases with an increase in the bet amount entered by the player.

As described, the percentages of the specific symbols 503 which are more advantageous than the normal symbols 502 increase with an increase in the bet amount. This clearly suggests to the player that the game is played more advantageously with an increase in the bet amount, in the form of an increase in the percentage of the specific symbols 503. This consequently improves the possibility of increasing the gain of the gaming machine administrator.

It should be noted that, by "specific symbols 503 which are more advantageous than the normal symbols 502", it means rearrangement of a specific symbol 503 in the symbol display region 150 may lead to more advantageous game result than having a normal symbol 502 rearranged. By "more advantageous game result", it means a larger amount of payout is awarded based on the game result. For example, in cases where a prize for symbols 501 is to be determined when a predetermined number or more of the symbols 501 are rearranged, the above expression means that a larger amount of payout is awarded for the specific symbols 503 than that awarded for the normal symbols 502.

Further, the bet operation in the present embodiment is performed as follows. First, the player determines a value (later-detailed "symbol bet") which forms a basis of the bet amount to be entered, by using credit buttons 40 to 44. Then, the player selects the multiplying factor for the payout to be obtained, by using bet buttons 34 to 38 (1-bet button 34, 2-bet button 35, 3-bet button 36, 5-bet button 37, and 10-bet button 38) provided to the control panel 30. As described, the bet amount may be determined based on the base value ("symbol bet") associated with the credit buttons 40 to 44. For example, when the play-60 credit button 44 and the 2-bet button 35 are selected, the bet amount is 60 credits× 2=120 credits, and the payout rate will be a double. It should be noted that the bet buttons 34 to 38 and the credit buttons 40 to 44 can be operated in any order.

The specific symbols 503 includes a plurality of types with stepwisely differentiated advantage levels. As shown in FIG. 3, the specific symbols 503 include: a bat symbol 503*e*, a gourd symbol 503*d* which is more advantageous than the bat symbol 503*e*, a fish symbol 503*c* which is more advantageous than the gourd symbol 503*d*, a pot symbol 503*b* which is more advantageous than the fish symbol 503*c*, and a dragon symbol 503*a* which is more advantageous than the pot symbol 503*b*. With an increase in the bet amount placed by the player, an increase in the percentage of the specific symbol 503 with a high advantage becomes possible.

In the present embodiment, the specific symbols 503*e*, 503*d*, 503*c*, 503*b*, and 503*a* with stepwisely differentiated advantage levels correspond to credit buttons 40 to 44, respectively. Further, increases in the percentages of the specific symbols corresponding to these credit buttons 40 to 44 become possible.

The way of modifying the symbol arrays 170 is not limited as long as the modified symbol arrays are advantageous according to the increase in the bet amount. For example, the normal symbols 502 may be modified to specific symbols 503 according to an increase in the bet amount. Further, the number of specific symbols 503 may be increased according to the increase in the bet amount. Further, the number of normal symbols 502 may be decreased according to the increase in the bet amount. Further, the above described ways of modifications may be implemented in combination.

In the present embodiment, a free game is run when a predetermined condition is satisfied during the normal game. In this free game too, the symbol arrays 170 may be modified to be more advantageous symbol arrays 170 according to an increase in the bet amount. Specifically, in the free game, a plurality of symbol arrays 170 different from those in the normal game are variably displayed on the lower image display panel 141, and then symbols 501 are rearranged in the symbol display region 150. Then, the symbols in the plurality of symbol arrays 170 are modified so that, the larger the bet amount placed in the normal game satisfying the predetermined condition, the higher the ratios of the specific symbols 503 to the number of the symbols 501 in all the symbol arrays 170 will be as compared with the percentage of the same in the normal game.

Exemplary symbol arrays 170 are shown in FIG. 4 to FIG. 13. FIG. 4 to FIG. 8 show exemplary symbol arrays 170 corresponding to the symbol bets (i.e., base values of 1, 5, 15, 30, and 60) in the normal game. FIG. 9 to FIG. 13 show exemplary symbol arrays 170 corresponding to the symbol bets (i.e., base values of 1, 5, 15, 30, and 60) in the free game. Reels 1 to 5 shown in FIG. 4 to FIG. 13 correspond to later-described pseudo reels 151 to 155 and indicate symbol arrays 170*a* to 170*e* variably displayed, respectively. Further, FIG. 14 and FIG. 15 show percentages of the specific symbols 503 in the normal game and the free game in all the symbols.

As shown in FIG. 14, in the normal game, a symbol array 170 with only the bat symbol 503*e* taking many places therein is used for the symbol bet of 1. For the symbol bet of 5, a symbol array 170 with many bat symbols 503*e* and many gourd symbols 503*d* are used. For the symbol bet of 15, a symbol array 170 with many bat symbols 503*e*, many gourd symbols 503*d*, and many fish symbols 503*c* are used. For the symbol bet 30, a symbol array 170 with many bat symbols 503*e*, many gourd symbols 503*d*, many fish symbols 503*c*, and many pot symbols 503*b* are used. For the symbol bet 60, a symbol array 170 with many bat symbols 503*e*, many gourd symbols 503*d*, many fish symbols 503*c*, many pot symbols 503*b*, and many dragon symbols 503*a* are used. As should be understood, there are specific symbols 503 to be permitted for each value of the symbol bet.

When symbol bets are compared with each other, all the specific symbols 503 are increased while the number of entire symbols is decreased, with an increase in the symbol bet. In short, the percentages of all the specific symbols 503 are increased with an increase in the symbol bet. In the present embodiment, all the symbols 501 in a single symbol array 170 are rearranged at the same probability. Since an increase in the symbol bet increases the percentages of the specific symbols 503, the chances of obtaining an advantageous game result will increase. It should be noted that the percentage of the specific symbols 503 may be increased in any way, provided that the level of advantages to the player reflect the increase in the bet amount.

For example, as shown in FIG. 15, in the symbol bet of 1 for the free game, there are specific symbols 503 with higher percentages than those in the other symbol bets. However, in each reel, there is a significant difference in the number of a particular type of specific symbols 503 from the numbers of other types of specific symbols 503 so that the probability of obtaining a game result related to the specific symbols 503 is low. As described, the factors determining how easily a game result related to the specific symbols 503 is obtained is not limited to the numbers or the percentages of the specific symbols 503. That is, the game may be configured to be more advantageous according to the bet amount, in terms of easiness of obtaining a game result related to the specific symbols 503.

(Overview of Gaming Machine: Determining One Bonus Type Out of Plurality of Types of Bonuses with Stepwisely Differentiated Advantage Levels in Bonus Game)

Figure 2:
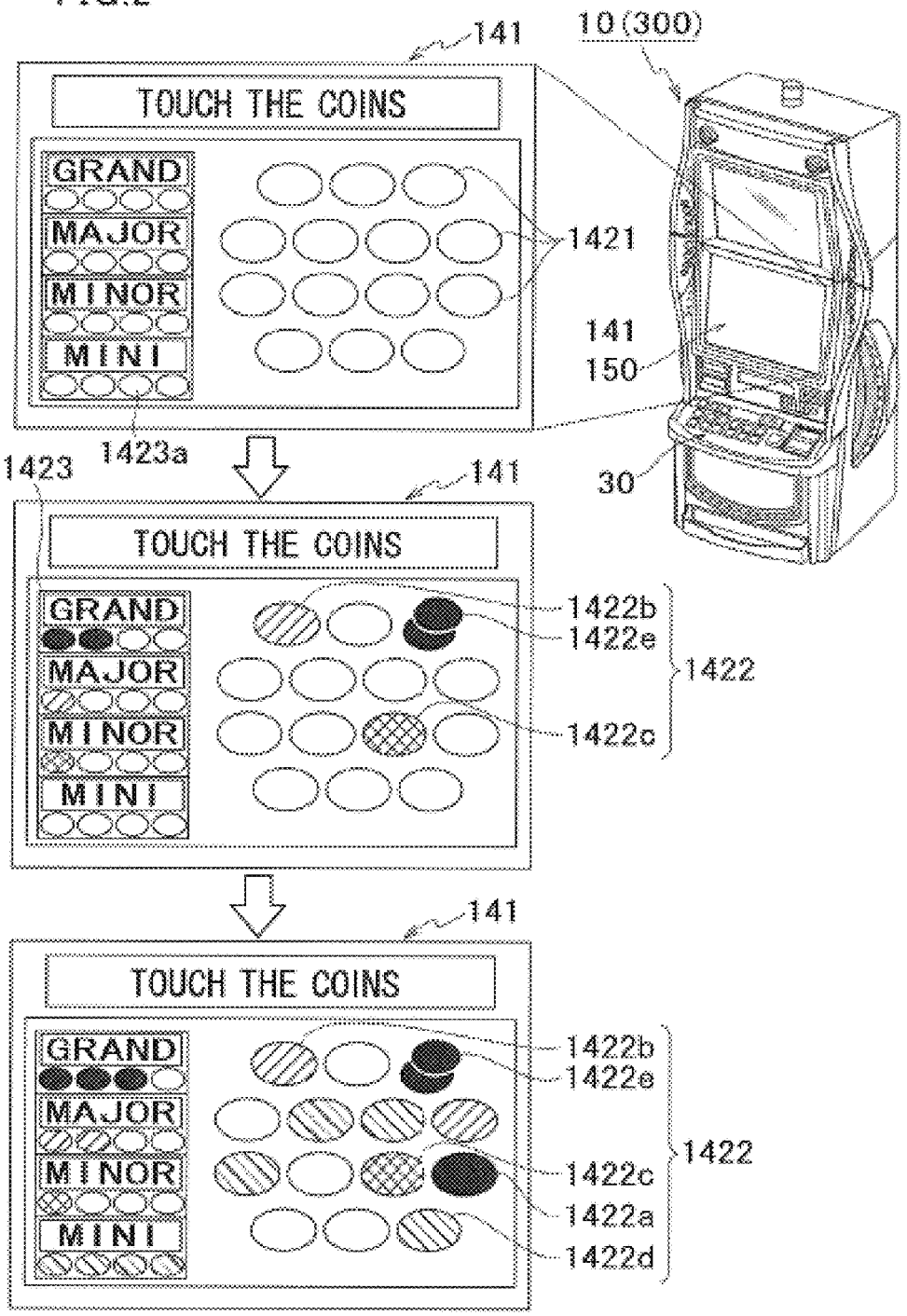
FIG. 2 is an explanatory diagram of the gaming machine.
Figure 16:
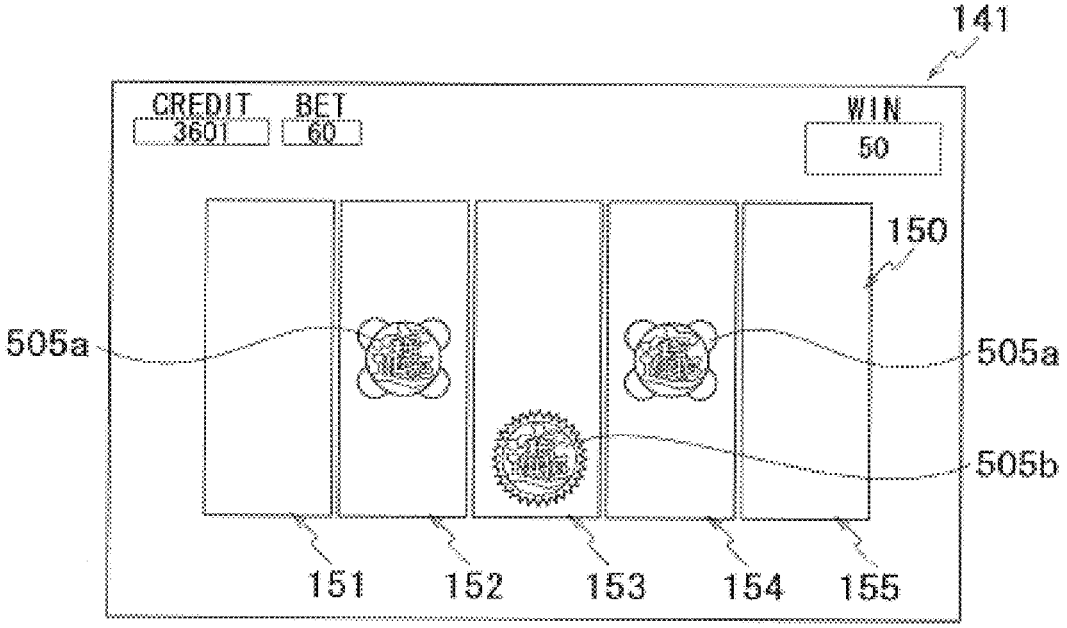
FIG. 16 is an explanatory diagram of a trigger state of the bonus game.

As shown in FIG. 2, the gaming machine of the present embodiment determines a bonus type out of a plurality of types of bonuses respectively associated with stepwisely differentiated advantage levels in the bonus game. Specifically, in the slot machine 10 (gaming machine 300), the lower image display panel 141 displays a plurality of selectable images 1421 in the bonus game in which one type of bonus is determined out of the plurality of types of bonuses with stepwisely differentiated advantage levels (Grand Bonus, Major Bonus, Minor Bonus, Mini Bonus). The slot machine 10 has the control panel 30 serving as a selection input device enabling selection of one of the selectable images 1421 on the lower image display panel 141. Every time a selectable image 1421 is selected with the control panel 30, the selected selectable image 1421 is changed to any one of bonus rank images 1422 (Grand rank image 1422*a*, Major rank image 1422*b*, Minor rank image 1422*c*, and Mini rank image 1422*d*) corresponding to the plurality of bonus types, respectively. It should be noted that the bonus may be hereinafter referred to as "progressive", "jackpot", or "progressive jackpot".

The slot machine 10, in the bonus game, determines one of the bonus types before an effect display related to the bonus game is provided. The slot machine 10 controls the lower image display panel 141 so that the number of the bonus rank images 1422 corresponding to the bonus determined reaches a predetermined number (e.g., four) in the effect display. That is, the player selects the selectable images 1421, and when the number of a type of bonus rank images 1422 reaches the predetermined number, the player is entitled to the bonus type which corresponds to that type of bonus rank image 1422.

Further, a bonus rank image 1422 corresponding to a high rank bonus type out of the plurality of bonus types is displayed in the effect display, before the number of the bonus rank images 1422 corresponding to the bonus determined in advance reaches the predetermined number.

As described, a bonus rank image 1422 corresponding to a high rank bonus type out of the plurality of bonus types is displayed in the effect display, before the number of the bonus rank images 1422 corresponding to the bonus determined reaches the predetermined number. This achieves a new entertainment characteristic such that the player playing the bonus game expects for a high rank bonus, irrespective of the rank of the bonus type determined, until the bonus type is informed.

The high rank bonus type in the present embodiment means the Grand Bonus and the Major Bonus; however, the high rank bonus type is not limited to these. For example, the high rank bonus type may be only the Grand Bonus which is the most advantageous bonus type. Further, in the effect display, the bonus rank image 1422 corresponding to the high rank bonus type does not necessarily have to be displayed.

For example, in the bonus game of the present embodiment, one of a first mode and a second mode in the bonus game is determined in advance. The first mode is a mode in which a part of all the bonus rank images 1422 to be displayed on the lower image display panel 141 are determined in advance (scenario mode). The second mode is a mode in which all the bonus rank images 1422 to be displayed on the lower image display panel 141 are randomly determined (random mode). In the first mode, a bonus rank image 1422 corresponding to a high rank bonus type is displayed, before the number of the bonus rank images 1422 corresponding to the bonus determined in advance as the result of the bonus game reaches the predetermined number. In the second mode on the other hand, all the types of the bonus rank images 1422 are randomly determined. Therefore, there is a possibility that the bonus rank image 1422 corresponding to the high rank bonus type may not be displayed.

Further, the normal game displays the game result by rearranging a plurality of symbols 501 in the symbol display region 150 on the lower image display panel 141, as hereinabove described. Here, the plurality of symbols 501 include wild symbols 505 (see FIG. 3) serving as the specific symbol. When the symbols rearranged in the symbol display region 150 include one or more wild symbols 505, the slot machine 10 randomly determines whether to trigger the bonus game, with a probability corresponding to the number of wild symbols 505 rearranged. This random determination of whether to trigger the bonus game is further influenced by the above described bet amount.

Specifically, as shown in FIG. 3, the wild symbols 505 include normal wild symbols 505*a* (WILD) and a double wild symbols 505*b* (2×WILD). As shown in FIG. 8 to FIG. 13, one normal wild symbol 505*a* is arranged in each of the reels 2 and 4 (pseudo reels 152, 154). As shown in FIG. 8 to FIG. 13, one double wild symbol 505*b* is arranged in the reel 3 (pseudo reels 153). In the present embodiment, the random determination of whether to trigger the bonus game is performed when one or more wild symbols 505 is rearranged in the symbol display region 150

Further, the probability of winning of the bonus game is changed based on the number of wild symbols 505 rearranged. Specifically, the probability of winning the bonus game when two normal wild symbols 505*a* are rearranged is a double of the probability of winning the bonus game when one normal wild symbol 505*a* is rearranged (equivalent to two normal wild symbols 505*a*). Specifically, the probability of winning the bonus game when one double wild symbol 505*b* is rearranged is a double of the probability of winning the bonus game when one normal wild symbol 505*a* is rearranged (equivalent to two normal wild symbols 505*a*). The probability of winning the bonus game when all the wild symbols 505 (two normal wild symbols 505*a*, and one double wild symbol 505*b*) are rearranged is 4 times the probability of winning the bonus game when one normal wild symbol 505*a* is rearranged.

Further, in regard to the effect display, the lower image display panel 141 is provided with a rank count region 1423 which is a region for counting each type of bonus rank images 1422. The rank count region 1423 is provided with a predetermined number of count images 1423*a* for each type of the bonus rank image 1422. Every time the bonus rank image 1422 is displayed, the number of the bonus rank images 1422 is counted for each type, and the count values are indicated on the rank count region 1423. That is, of the predetermined number of count images 1423*a*, a counted number of count images 1423*a* are changed to the same mode as the bonus rank images 1422.

Further, as shown in FIG. 2, one selectable image 1421 is changed to a double bonus rank image 1422*e* indicating two bonuses of a bonus rank. Specifically, in FIG. 2, a double bonus rank image 1422*e* is displayed which showing two bonus rank images of the Grand rank. The double bonus rank image 1422*e* is counted as two bonus rank images 1422. The double bonus rank image 1422*e* is displayed only for high ranks (i.e., Grand rank and Major rank).

Further, in the present embodiment, the above bonus game may be also triggered by the random determination executed every time the normal game is run. That is, when the symbols rearranged in the symbol display region 150 include one or more wild symbols 505, the slot machine 10 executes the first random determination to determine whether to trigger the bonus game, with a probability corresponding to the number of wild symbols 505 rearranged, and further executes the second random determination, apart from the first random determination, to determine whether to trigger the bonus game every time the normal game is run. It should be noted that the bonus game triggered as the result of the second random determination is hereinafter referred to as mystery bonus. The bonus game is detailed later.

Outline of Gaming Machine and Definitions of Terms: Definitions

The slot machine 10 above is a kind of the gaming terminals in the gaming machine 300. Although the present embodiment deals with the slot machine 10 as an example of the gaming terminal, the disclosure is not limited to this and any type of device having a terminal controller that is able to independently run a base game may be used as the gaming terminal.

The base game in the present embodiment is run by the slot machine 10. The base game is a slot game where a plurality of symbols 501 are rearranged. The base game is not limited to the slot game but is any type of games capable of being independently run at a gaming terminal such as the slot machine 10. In other words, the base game is a game in contrast to the common game. For example, a normal game and a bonus game are types of the base game.

The rearrangement of the symbols in the slot game is performed on the lower image display panel 141. The slot game may have a normal game, a bonus game, and a rescue process, and the like. In the normal game, a process is executed in which the symbols are rearranged on the lower image display panel 141, on condition that a gaming value is bet, and in which a normal payout is awarded according to the symbols rearranged. The bonus game is executed when the symbols are rearranged to meet a predetermined condition in the normal game.

The "bonus game" has a same meaning as a "feature game". The bonus game may be any type of games as long as the bonus game is more advantageous than the normal game. Further, as long as the bonus game is advantageous to the player, i.e., more advantageous than the normal game to the player, the bonus game may be adopted in combination with another bonus game. For example, the bonus game may be a game that provides a player with a chance of winning more gaming values than the normal game or a game that provides a player with a higher chance of winning gaming values than the normal game. Alternatively, the bonus game may be a game that consumes fewer amounts of gaming values than the normal game. In the bonus game, these games may be provided alone or in combination.

For example, the bonus game may involve a fixed payout, or may be a free game that requires betting of a gaming value less than that required for playing the normal game (such a gaming value may include 0). Further, a symbol random determination table with higher payout rates than those for the normal game may be adopted. Further, the bonus game may be a pickup bonus which presents a plurality of choices to the player. In cases of the pickup bonus, the choices may include a fixed payout, a free game, and the like. Further, the choices of the pickup bonus may include a trigger for another pickup bonus game which allows the player to make another selection. It should be noted that the choices of the pickup bonus are preferably randomly arranged. Further, the content of the choices of the pickup bonus is preferably not displayed before the player makes the selection. The bonus game of the present embodiment is detailed later. The rescue process is executed when a rescue start condition is established.

A coin, a bill, or electrically valuable information corresponding to these is used as a gaming value. Note that the gaming value in the present invention is not particularly limited. Examples of the gaming value include game media such as medals, tokens, cyber money, tickets, and the like. A ticket is not particularly limited, and a later-mentioned barcoded ticket may be adopted for example. Further, as hereinabove described, the "gaming value" may be an electronic gaming point which corresponds to the game medium.

The "free game" is a game runnable with a bet of fewer gaming values than the normal game. Note that "bet of fewer amounts of gaming values" encompasses a bet of zero gaming value. The "free game" therefore may be a game runnable without a bet of a gaming value, which free game awards an amount of gaming values based on symbols 501 rearranged. In other words, the "free game" may be a game which is started without consumption of a gaming value. To the contrary, the "normal game" is a game runnable on condition that a gaming value is bet, which normal game awards an amount of gaming value based on the symbols 501 rearranged. In other words, the "normal game" is a game which starts with consumption of a gaming value.

The expression "rearrange" in this specification means dismissing an arrangement of symbols 501, and arranging symbols 501 once again. The term "arrangement" indicates a state in which the symbols 501 are visually recognizable by an external player.

The phrase "base payout based on the rearranged symbols 501" means a normal payout corresponding to a rearranged winning combination. The phrase "bonus payout based on the rearranged symbols 501" means a bonus payout corresponding to a rearranged winning combination. Furthermore, the term "winning combination" indicates that a winning is established. Details of the winning combination will be given later.

(Functional Flow of Gaming Machine 300: Slot Machine)

Figure 17:
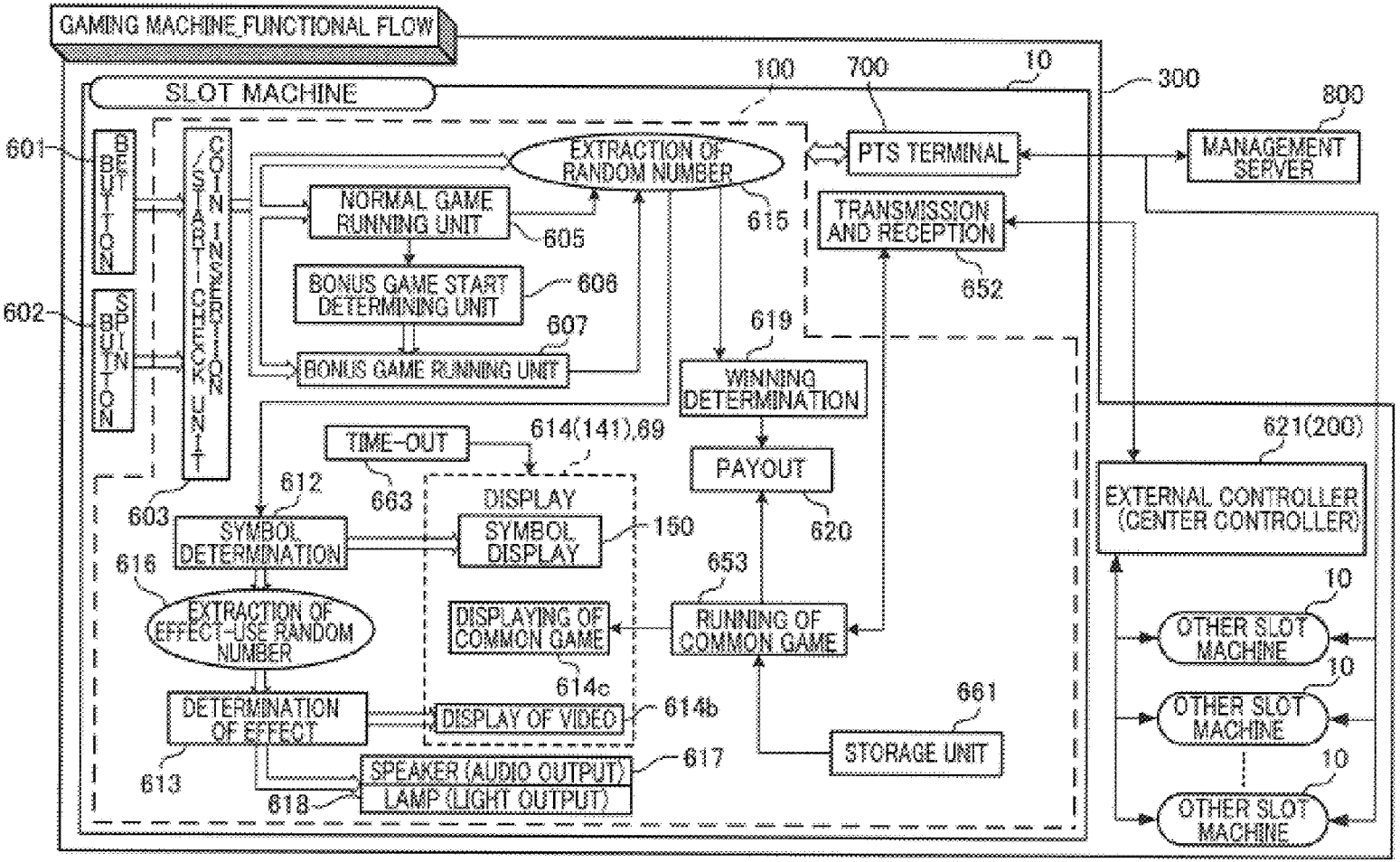
FIG. 17 is an explanatory diagram showing a functional flow of the gaming machine.

The gaming machine 300 arranged as above includes, as shown in FIG. 17, slot machines 10 and an external controller 621 (center controller 200) connected to the slot machines 10 to be able to perform data communications therewith. The external controller 621 is able to perform data communications with the slot machines 10 provided in a hall.

The slot machines 10 each include a bet button 601, a spin button 602, a display 614 (lower image display panel 141 of FIG. 1 and the like), and a game controller 100 which controls these units. The BET button 601 and the spin button 602 are kinds of input devices. The slot machine 10 further includes a transceiver unit 652 that makes it possible to perform data communications with the external controller 621.

The BET button 601 above has a function of receiving a bet amount input by the player. The spin button 602 has a function of receiving an instruction to start a game such as a normal game in response to an operation by the player, i.e., a start operation. The display 614 has a function of displaying still-image information and moving-image information. Examples of the still-image information are various types of symbols 501, numeral values, and signs. Examples of the moving-image information include effect video. Furthermore, the display 614 has a touch panel 69 as an input device, and has a function of receiving various instructions input by a pressing operation by the player. The display 614 has a symbol display region 150, an image display region 614*b*, and a common game display region 614*c*. The symbol display region 150 includes the reel device M1 and displays the symbols 501 shown in FIG. 1. The image display region 614*b* displays various types of effect image information to be displayed during a game, in the form of a moving image or a still image. The common game display region 614*c* displays a common game.

For example, in the video display region 614*b*, the effect display related to the bonus game as described above is performed.

Although in the present embodiment the symbol display region 150, the region for displaying the selectable image 1421 in the bonus game, and the lower image display panel 141 are provided on the same screen, the disclosure is not limited to this arrangement. The common game display region 614*c* may be formed together with the symbol display region 150 and the image display region 614*b*, or may appear as a substitute only when a common game is run.

The game controller 100 includes a coin insertion/start-check unit 603, a normal game running unit 605, a bonus game start determining unit 606, a bonus game execution unit 607, a random number sampling unit 615, a symbol determining unit 612, an effect-use random number sampling unit 616, an effect determining unit 613, a speaker unit 617, a lamp unit 618, a winning determining unit 619, a payout unit 620, and an indication effect unit 651.

The normal game running unit 605 has a function of running a normal game on condition that the bet button unit 601 has been operated. The bonus game start determining unit 606 determines whether to run a bonus game, based on a combination of rearranged symbols 501 resulted from the normal game. That is to say, the bonus game start determining unit 606 has a function of determining that a bonus game is obtained when a trigger symbol 503*b* or the like is rearranged in a predetermined condition, and shifting the process to the bonus game running unit 607 so that a bonus game is run from the next unit game.

It is noted that "unit game" is a series of operations from the start of the receiving of a bet to a state in which an award can be established. For example, a unit game in the normal game includes a single bet time for receiving a bet, a single game time of rearranging stopped symbols 501, and a single payout time of a payout process of awarding a payout. A unit game in the normal game is termed unit normal game. Note that, in the present embodiment, it takes three seconds from the start of variable-displaying the symbols by a player-operation of the spin button to rearrangement of the symbol; however, the present invention is not limited to this.

The bonus game running unit 607 has a function of running the bonus game which repeats a free game for a plurality of times, merely in response to an operation on the spin button 602, and a function of selecting one of selectable images 1421 in the bonus game.

The symbol determining unit 612 has functions of: determining symbols 501 to be rearranged based on a random number given from the random number sampling unit 615; rearranging the determined symbols 501 in the symbol display region 150 of the display 614; outputting information on rearrangement of the rearranged symbols 501 to the winning determining unit 619 and an indication effect unit 651; and outputting an effect specifying signal to the effect-use random number sampling unit 616, based on the rearrangement of the symbols 501.

The winning determining unit 619 has functions of: determining whether a winning is achieved when information on symbols 501 rearranged and displayed on the display 614 is given; calculating a total amount of payout based on a winning combination formed when it is determined that a winning has been achieved; outputting to the payout unit 620 a payout signal which is based on the payout amount. The payout unit 620 has a function of paying out a gaming value to the player, in the form of a coin, a medal, a credit, or the like. Furthermore, the payout unit 620 has a function of adding credit data corresponding to the credit to be paid out to credit data stored in an IC card inserted into the later-described PTS terminal 700.

In addition to the above, the game controller 100 includes a storage unit 661 that stores various types of bet amount data. The storage unit 661 stores data in a rewritable manner, e.g., a hard disk device and a memory.

In addition to the above, the game controller 100 has a common game running unit 653. The common game running unit 653 has functions of: outputting bet amount information based on a bet amount bet on a normal game to the external controller 621 in each unit base game; executing a common game in response to a game start command from the external controller 621; and receiving a bet input through the BET button 601 for a bet amount corresponding to bet amount data for a common game, which is stored in the storage unit 661 and is bettable on a common game.

Further, the game controller 100 is connected to the PTS terminal 700. The PTS terminal 700 is a unit in which an LCD, a microphone, a human body detection camera, etc. are integrated, and has, for example, a function of executing an effect for a game by mutual communications with the game controller 100. In particular, the PTS terminal 700 has a card slot to which an IC card can be inserted. With this, the player is able to insert a IC card into the card slot and use the credits stored in the IC card in the slot machine 10.

In addition to the above, when receiving credit data from the PTS terminal 700, the game controller 100 updates the credit display on the display 614. Furthermore, the game controller 100 outputs settled credit data to the PTS terminal 700 when the credits on a game are settled.

Furthermore, the PTS terminal 700 of each of the slot machines 10 constituting the gaming machine 300 is connected to the management server 800 to be able to communicate each other, and centrally manages the download of images, IC cards and credits.

(Functional Flow of Gaming Machine 300: External Controller)

Figure 18:
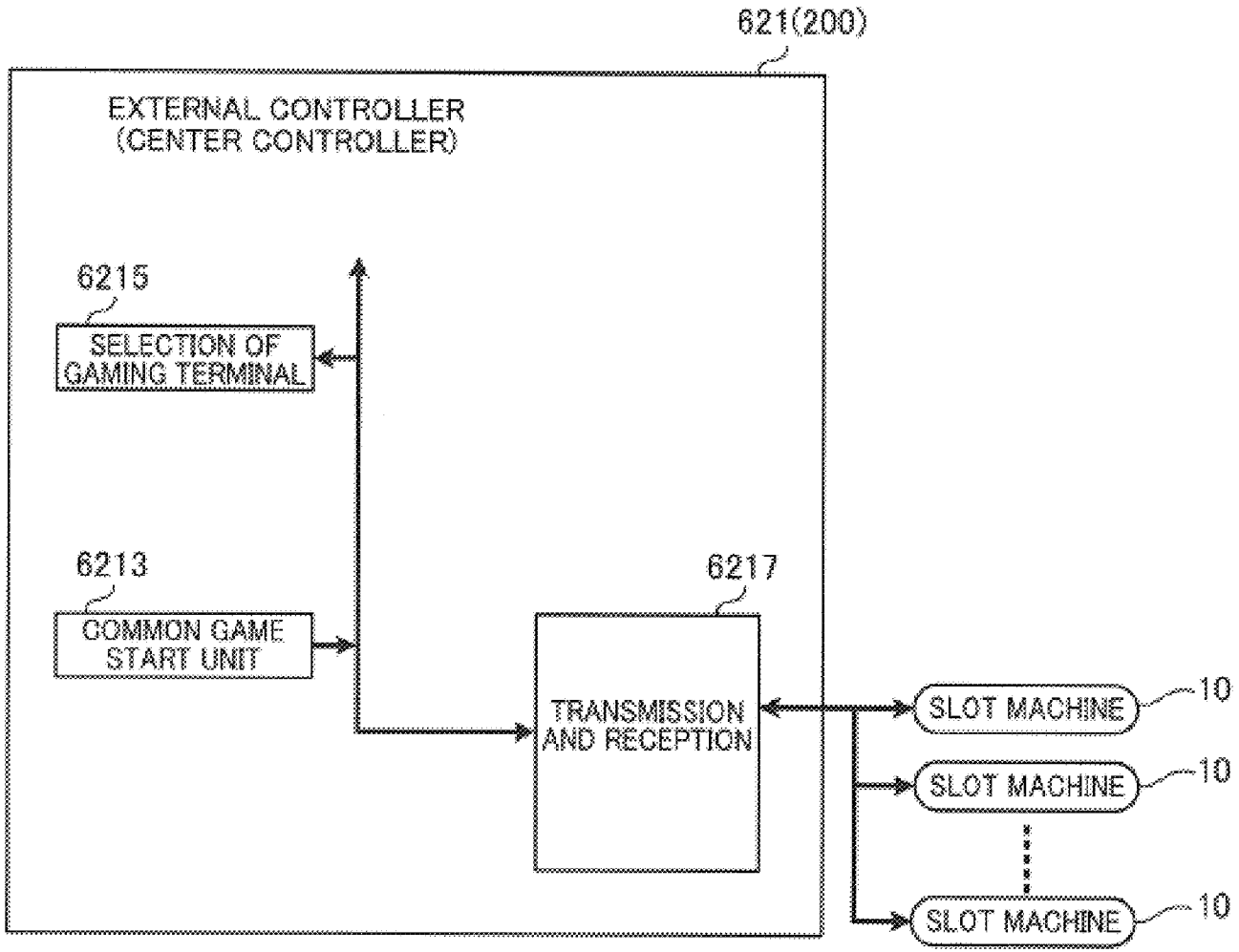
FIG. 18 is an explanatory diagram showing the functional flow of the gaming machine.

The slot machine 10 arranged as above is, as shown in FIG. 18, connected to the external controller 621. The external controller 621 has a function of remotely operating and monitoring the operation state of each slot machine 10 and processes such as changes in game setting values. Furthermore, the external controller 621 has a function of determining a common game start condition for each gaming terminal which is the slot machine 10, and executing a common game at a plurality of slot machines 10 when a determination result at any gaming terminal satisfies the common game start condition.

More specifically, the external controller 621 includes a common game start unit 6213, a gaming terminal selection unit 6215, and a transceiver unit 6217. The common game start unit 6213 has functions of: determining whether the common game start condition is established based on the accumulated bet amount information sent from the slot machine 10 in each unit base game; outputting a game start command to a plurality of slot machines 10; and displaying on the common display device 700 states until the common game start condition is established.

The determination as to whether the common game start condition is established is based on the accumulated bet amount information or based on all accumulated values that increase as the unit base game is repeated. For example, the number of times of running the base game and the game time of the base game may be used as the accumulated values.

In addition to the above, the common game start unit 6213 has a function of outputting a game start command to the slot machine 10 in which an accumulated value that increases as a result of the repetition of the base game satisfies a game running condition. With this, because the right to participate in the common game is not awarded to a slot machine 10 in which the accumulated value is lower than the minimum setting value, the common game start unit 6213 motivates the player to actively repeat the base game.

In addition to the above, the common game start unit 6213 has a function of monitoring a non-input time in which no start operation is performed, and outputting the game start command to the slot machines 10 except to the slot machine 10 in which the non-input time is equal to or longer than a timeout time. With this, the common game start unit 6213 is able to determine that no player is at a slot machine 10 where the base game has not been played at least for the timeout time, and able to avoid the execution of the common game at such a slot machine 10.

The gaming terminal selection unit 6215 has a function of selecting a specific slot machine 10 from the slot machines 10 and outputting a common game start command signal to that specific slot machine 10. The common game start command signal provides the specific slot machine 10 with the right to start the common game. The transceiver unit 6217 has a function of exchanging data with the slot machines 10.

(Operations of Gaming Machine 300)

The operations of the gaming machine 300 having the functional blocks above will be described. While in the present embodiment the "gaming terminal" shown in the flowcharts indicates a slot machine 10 executing a slot game, the disclosure is not limited to this arrangement. (Operations of Gaming Machine 300)

The operations of the gaming machine 300 having the functional blocks above will be described. While in the present embodiment the "gaming terminal" shown in the flowcharts indicates a slot machine 10 executing a slot game, the disclosure is not limited to this arrangement.

(Operations of Slot Machine 10)

A slot machine 10 which is a gaming terminal executes terminal-side processes. More specifically, to begin with, a base game process (e.g., normal game) is executed. That is, a series of operations below are executed.

(Coin-Insertion/Start-Check)

First, the slot machine 10 checks whether or not a bet button 601 has been pressed by a player, and subsequently checks whether or not a spin button unit 602 has been pressed by the player.

(Symbol Determination)

Next, when a spin button unit 602 has been pressed by the player, the slot machine 10 extracts a random number for symbol determination, and determines symbols 501 to be displayed for the player at the time of stopping the scroll of the symbol array 170, for respective video reels displayed on a display unit 614.

(Symbol Display)

Then the slot machine 10 starts the scroll of the symbol array 170 of each video reel, and stops the scroll so that the determined symbols 501 are displayed for the player.

(Winning Determination)

Subsequently, as the scrolling of the symbol array 170 of each video reel is stopped, the slot machine 10 determines whether the combination of the symbols displayed for the player is a combination related to winning.

(Payout)

When the combination of the symbols 501 displayed for the player is a combination related to winning, the slot machine 10 offers, to the player, benefit according to the combination.

For example, when a combination of symbols 501 related to a payout of coins has been displayed, the slot machine 10 pays out coins of the number corresponding to the combination of symbols 501 to the player.

Subsequently, whether to win a bonus combination is determined. When winning the bonus combination, a bonus game process is executed. Specifically, when a predetermined number or more of trigger symbols 504 are rearranged in the symbol display region 150, running of the free game is determined and whether to run the bonus game is randomly determined. On the other hand, when not winning the bonus combination, the normal game is run again. During a period in which the base game including such a normal game and bonus game is being run, execution state information indicating the start and end of the unit game such as the normal game and the bet amount on the unit game is transmitted to the external controller 621. With this, the external controller 621 centrally manages the execution state information of each slot machine 10.

(Operation of External Controller 621)

When the slot machines 10 operate as above, the external controller 621 executes the following center-side processes in synchronization with the slot machines 10.

To begin with, the external controller 621 receives the execution state information from each slot machine 10 and obtains the execution state of the base game. Thereafter, based on the number of the repetition of the base game, the accumulated bet amount, or the like, whether the common game start condition is established at any slot machine 10 is determined. When the common game start condition is not established, the acquisition of the execution state of the base game at each slot machine 10 is continued.

In the meanwhile, when the common game start condition is established, the game start command is simultaneously output to the slot machines 10 that satisfy the game running condition. Thereafter, a specific slot machine 10 is selected from the slot machines 10 satisfying the game running condition, and a common game start right instruction is output to the specific slot machine 10.

Thereafter, the external controller 621 waits for the common game start command to be supplied from the specific slot machine 10. Upon receiving the common game start command as the trigger, the result of the common game is determined as a game result. The game result is, for example, win, lose, or draw. When the game result is not draw, at least a part of a draw game result is skipped among a series of temporarily-stored game results, and the remaining game results are serially output to the slot machines 10, as game result information.

Thereafter, based on the winning or losing game result, whether to win in the common game is determined. When lost, the execution state of the base game at each slot machine 10 is newly obtained. On the other hand, when won, a payout amount is calculated based on the bet amount bet on the common game at each slot machine 10, and the payout amount is sent to each slot machine 10 as payout information.

(Entire Structure of Game System)

A game system 350 including the gaming machine 300 having the functions above will be described.

Figure 19:
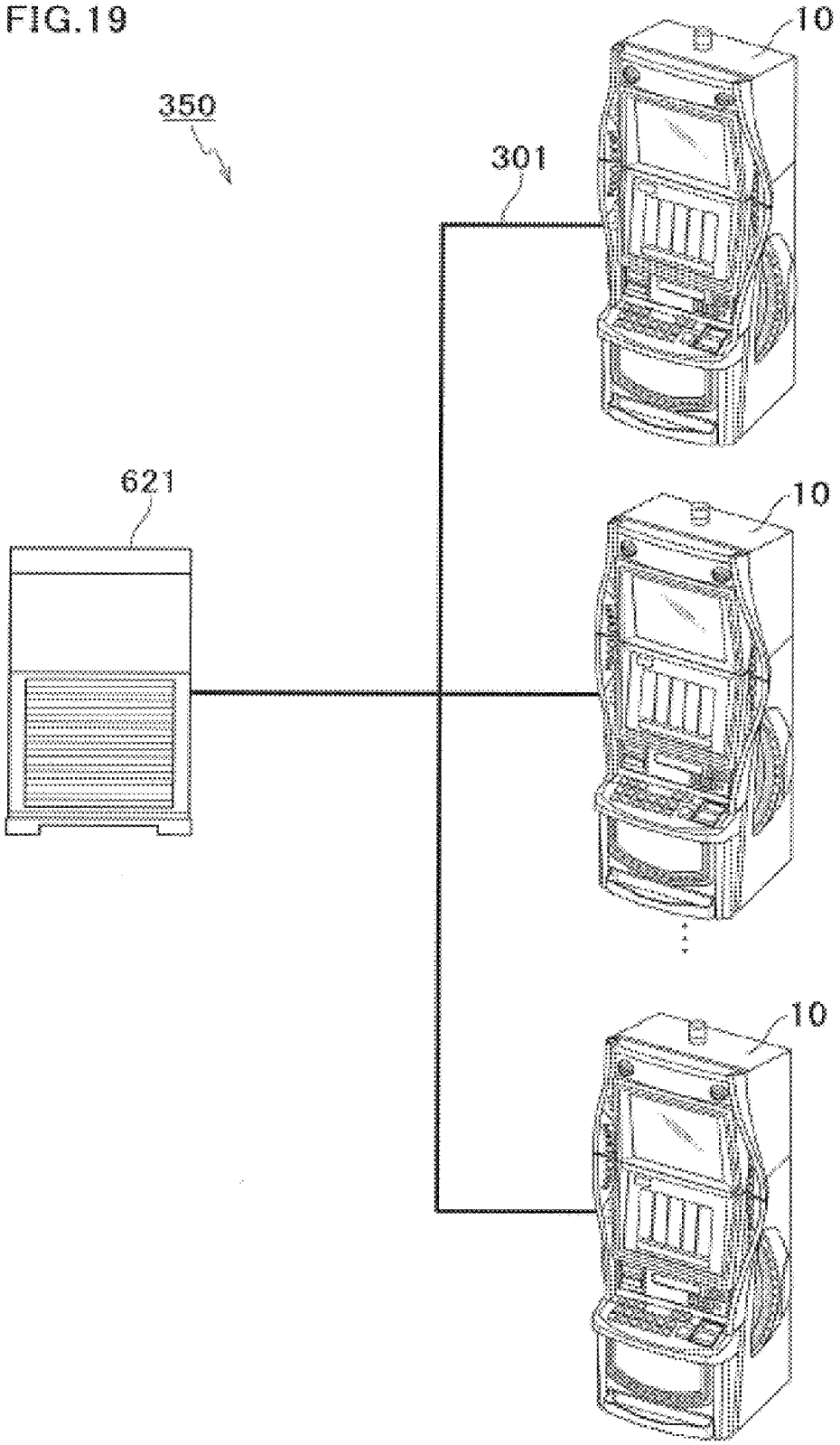
FIG. 19 is an explanatory diagram showing a connection structure of a game system.

As shown in FIG. 19, the game system 350 includes the slot machines 10 and the external controller 621 connected to the slot machines 10 over a communication line 301.

The external controller 621 is configured to control the slot machines 10. In the present embodiment, the external controller 621 is a so-called hall server provided in a gaming facility where a plurality of slot machines 10 are provided. Each slot machine 10 has a unique identification number, and the external controller 621 determines the source of data sent from the slot machines 10 based on the identification number. Furthermore, the identification number is used to specify the transmission target, when data is sent from the external controller 621 to a slot machine 10.

The game system 350 may be constructed in a single gaming facility where various games such as casino games are playable or constructed for a plurality of gaming facilities. When constructed in a single gaming facility, the game system 350 may be constructed in each floor or section of the gaming facility. The communication line 301 may be wires or wireless, and is constructed by a dedicated line, a switched line, or the like.

Figure 20:
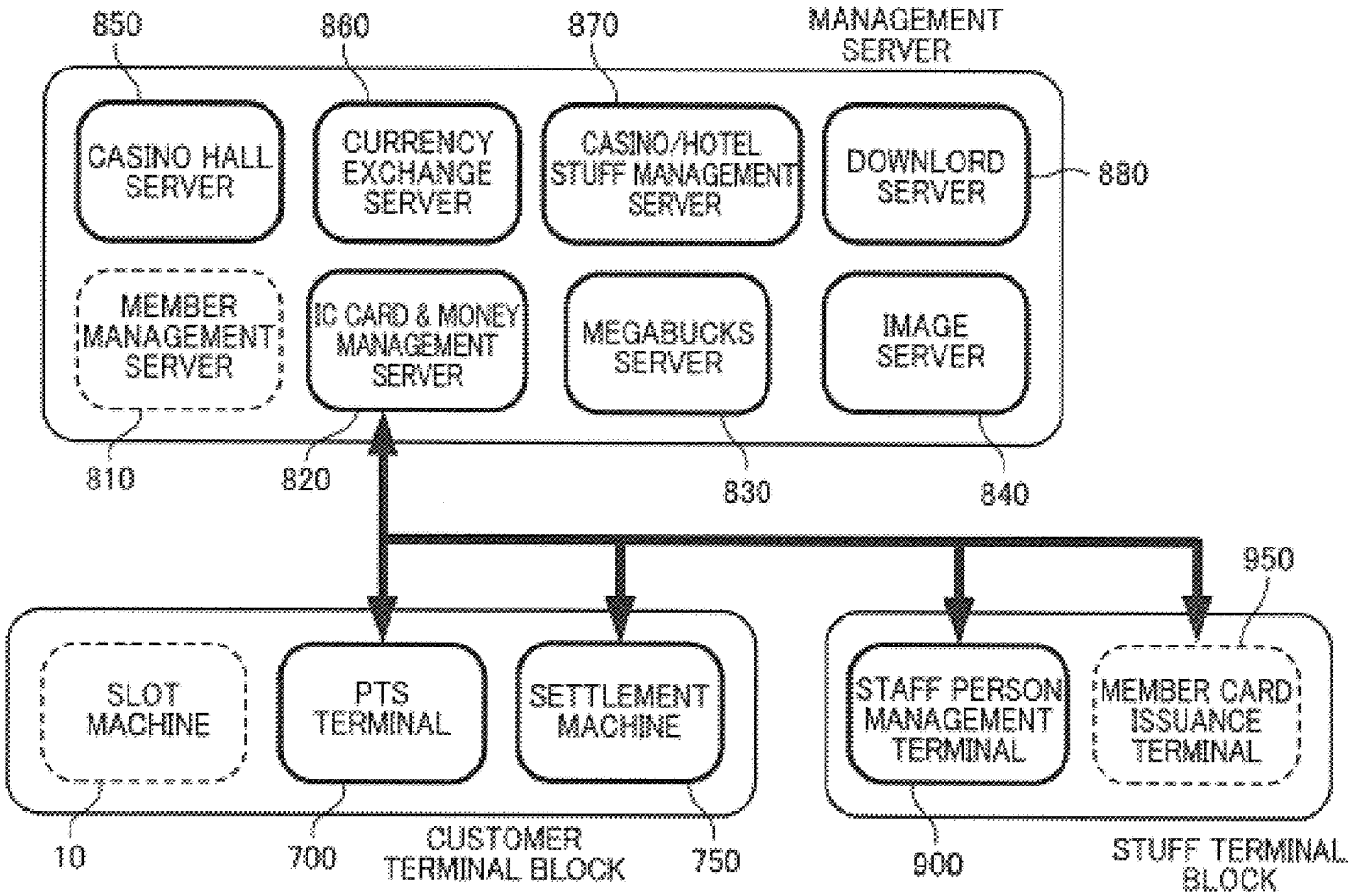
FIG. 20 is a block diagram of the game system.

As shown in FIG. 20, the game system is roughly divided into a management server block, a customer terminal block, and a staff terminal block. The management server block includes a casino hall server 850, an currency exchange server 860, a casino/hotel staff management server 870, and a download server 880.

The casino hall server 850 is a server for managing the entire casino hall where the slot machines 10 are provided. The currency exchange server 860 is a server for generating exchange rate data based on currency exchange information or the like. The casino/hotel staff management server 870 is a server for managing the staff members of the casino hall or a hotel related to the casino hall. The download server 880 is a server for, for example, downloading latest information such as game-related information and news and forwarding the information to players via the PTS terminal 700 of each slot machine 10.

The management server block includes a member management server 810, an IC card & money management server 820, a megabucks server 830, and an image server 840.

The member management server 810 is a server for managing member information or the like of the players of the slot machines 10. The IC card & money management server 820 is a server for managing IC cards used in the slot machines 10. More specifically, the IC card & money management server 820 is a server that stores fractional money data in association with an identification code and outputs the fractional money data to the PTS terminal 700. Furthermore, the IC card & money management server 820 generates and manages denomination rate data or the like. The megabucks server 830 is a server for, for example, managing Mega bucks which is a game in which the sum total of amounts bet on a plurality of slot machines 10 in a plurality of casino halls is dealt with as a payout. The image server 840 is, for example, a server that downloads latest images such as game-related images and news images and forwards the images to the player via the PTS terminal 700 of each slot machine 10 and present it to the player.

The customer terminal block includes the slot machine 10, a PTS terminal 700, and a settlement machine 750. The PTS terminal 700 is attachable to the slot machine 10 and capable of mutually communicating with the management server 800. The settlement machine 750 exchanges money data stored in a player's IC card to real money and stores coins and bills in an IC card as cash data.

The staff terminal block includes a staff person management terminal 900 and a member card issuance terminal 950. The staff person management terminal 900 is a terminal by which the staff of the casino hall manages the slot machines 10. In particular, in the present embodiment, the staff of the casino hall checks if the number of IC cards in the PTS terminal 700 is too large or too small. The member card issuance terminal 950 is for a player who plays games at the casino hall to obtain a member card.

(PTS Terminal 700)

Figure 21:
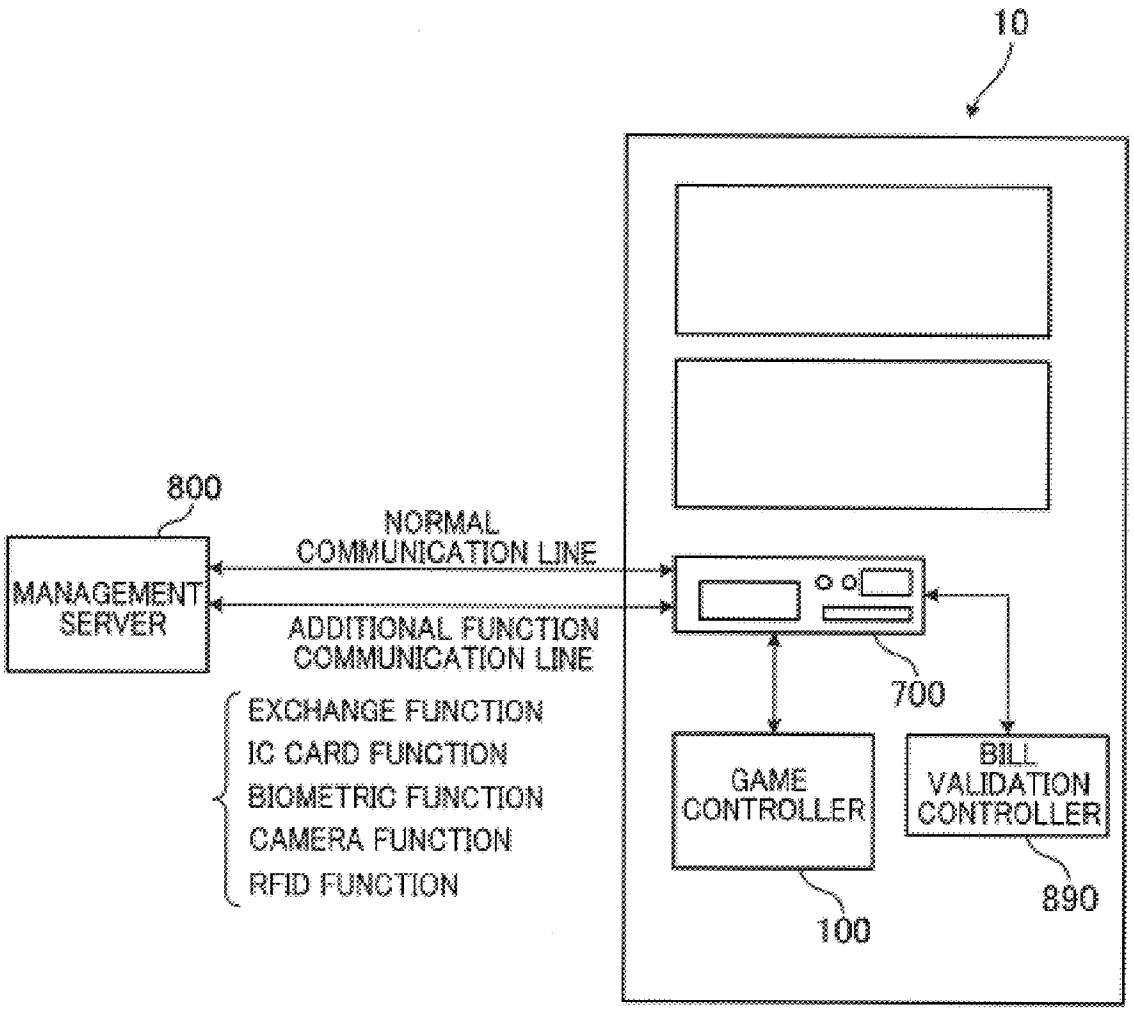
FIG. 21 is a block diagram of a PTS system.
Figure 22:
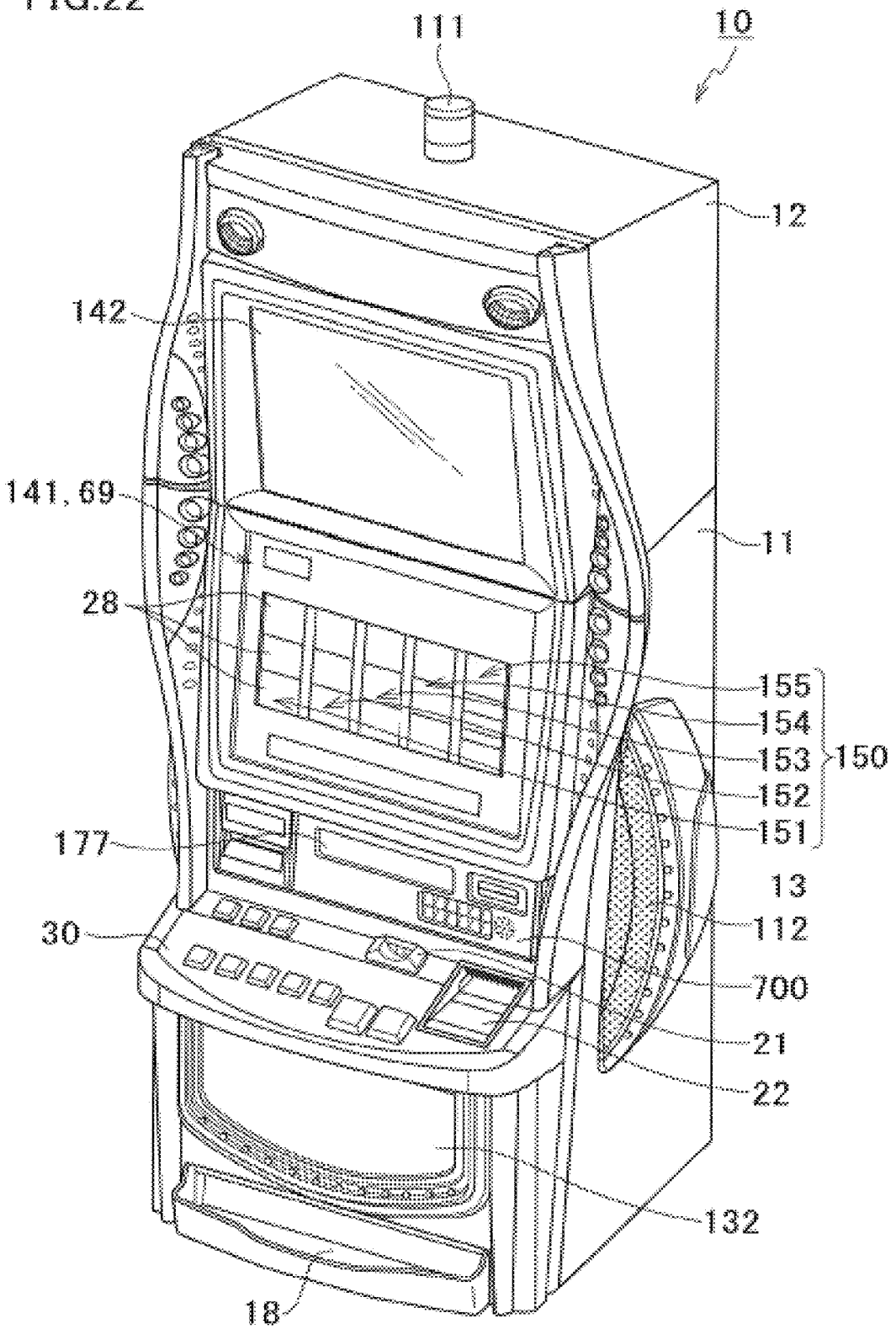
FIG. 22 is a perspective view of a slot machine in the gaming machine.
Figure 23:
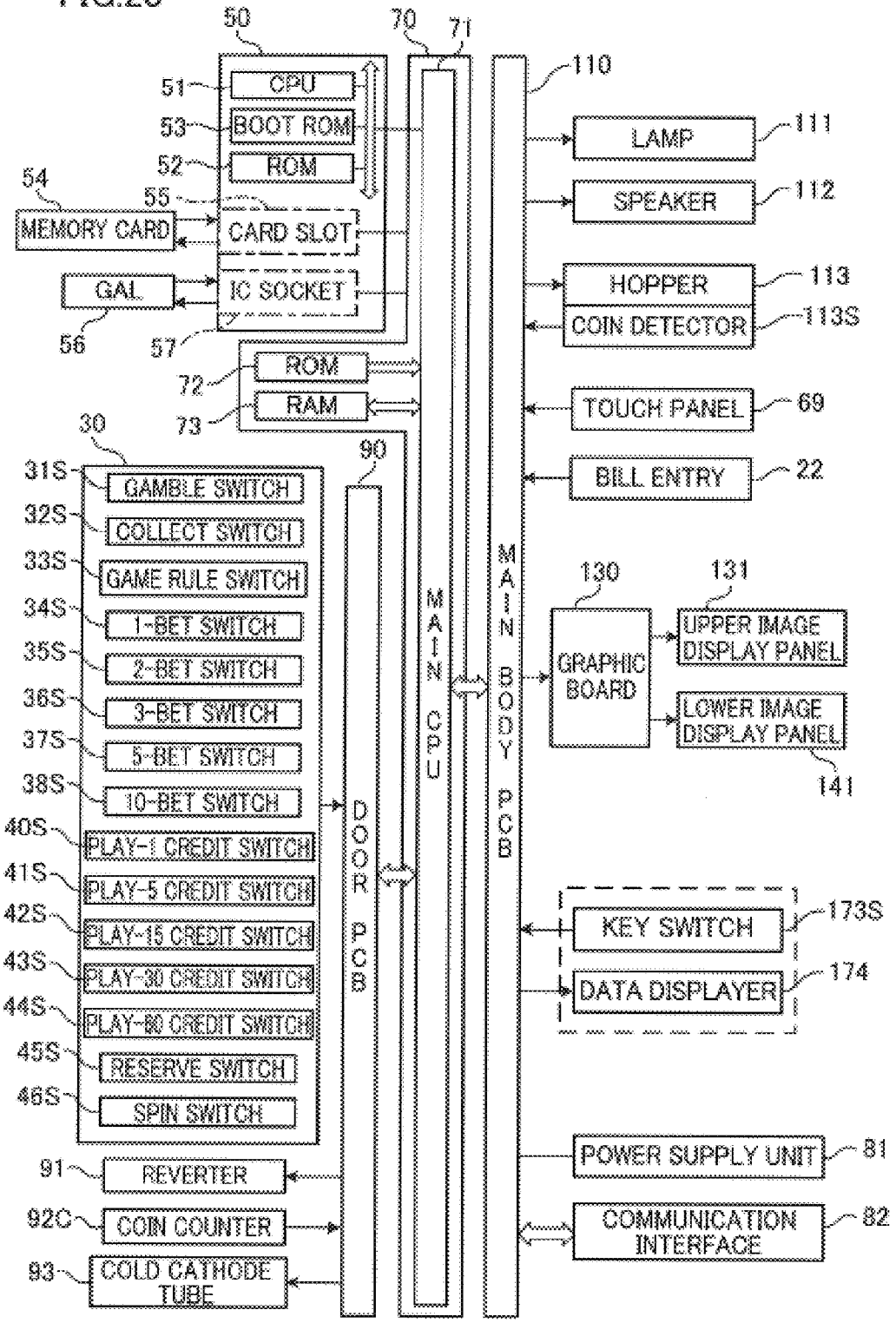
FIG. 23 is an electrical block diagram of the gaming machine.

The PTS terminal 700 is incorporated in a PTS system, as shown in FIG. 21. The PTS terminal 700 attached to the slot machine 10 is arranged to be able to communicate with the game controller 100 of the slot machine 10 and the bill validation controller 890.

The PTS terminal 700 conducts sound and image effects in games and updates the credit data, based on the communications with the game controller 100. Furthermore, the PTS terminal 700 sends credit data to the bill validation controller 890, which is required at the time of the settlement.

In addition to the above, the PTS terminal 700 is connected to the management server 800 to be able to communicate therewith. The PTS terminal 700 and the management server 800 are connected with each other by two lines, namely, a normal communication line and an additional function communication line.

The PTS terminal 700 exchanges, by the normal communication line, data such as cash data, identification code data, member information of a player. On the other hand, by the additional function communication line, the PTS terminal 700 conducts communications concerning newly-added functions. In the present embodiment, the PTS terminal 700 conducts, by the additional function communication line, communications concerning an exchange function, an IC card function, a biometric identification function, a camera function, and an RFID (Radio Frequency Identification) function of individual identification by radio waves.

(Mechanical Structure of Slot Machine)

Referring to FIG. 8, the overall structure of the slot machine 10 will be described.

A coin, a bill, or electrically valuable information corresponding to these is used as a game medium in the slot machine 10. In the present embodiment, in particular, credit-related data such as cash data stored in an IC card is used.

The slot machine 10 includes a cabinet 11, a top box 12 installed on the upper side of the cabinet 11, and a main door 13 provided at the front surface of the cabinet 11.

On the main door 13, a symbol display device termed lower image display panel 141 is provided. The symbol display device is formed by a transparent liquid crystal panel. The screen displayed on the lower image display panel 141 has a symbol display region 150 at the central portion. The symbol display region 150 is constituted by 15 display blocks 28 forming a matrix of 5 columns and 3 rows. The three display blocks 28 of each column form pseudo reels 151 to 155. On each of the pseudo reels 151 to 155, three display blocks 28 move downward with changes in speed, so that the symbols 501 on the display blocks 28 are vertically rotated (variably displayed) and then stopped, in other words, the symbols are rearranged. The details of the display screen on the lower image display panel 141 will be given later.

While the present embodiment the slot machines 10 are so-called video slot machines, some or all mechanical reels in the slot machines 10 of the present invention may be replaced by the pseudo reels 151 to 155.

On the front surface of the symbol display device is provided a touch panel 69. The touch panel 69 allows a player to input various instructions by touching the display screen of the lower image display panel 141. The input signal is transmitted from the touch panel 69 to the main CPU 71.

Below the lower image display panel 141 is provided a control panel 30. The control panel 30 is provided with buttons, a coin entry 21 for inserting coins into the cabinet 11, and a bill entry 22. The control panel 30 has a take-win/collect button 32, the reserve button 45, and the game rule button 33 ([GAME RULES] button) on the left side area of its upper stage, and a 1-bet button 34, a 2-bet button 35, a 3-bet button 36, a 5-bet button 37, a 10-bet button 38 on the left side area of its central stage. Furthermore, on the control panel 30, a play-1 credit button 40, a play-5 credit button 41, a play-15 credit button 42, a play-30 credit button 43, and a play-60 credit button 44 are provided in the lower stage of the left area. The control panel 30 has the gamble button 31 and the spin button 46 in the lower right side area. Although illustration is not provided, these buttons 31 to 38, 40 to 46 each have therein an LED in such a manner that the ON/OFF state of the LED is controllable. The control panel 30 is detailed later.

On the lower front surface of the main door 13, i.e., below the control panel 30, a belly glass 132 on which a character of the slot machine 10 or the like is depicted are provided. Between the lower image display panel 141 and the control panel 30, the PTS terminal 700 is attached. In the PTS terminal 700, devices having a microphone function, a camera function, a speaker function, a display function and the like form a single unit. More specifically, the PTS terminal 700 includes an LCD, a human body detection camera, a microphone, a bass reflex speaker, or the like. The human body detection camera makes it possible to detect the presence of a player by the camera function. The microphone is used for the player's participation in a game by voice and the authentication of a player by voice recognition. The speaker produces sound effects in games and outputs notification sound when an IC card is left inserted. Furthermore, the speaker outputs notification sound when an inserted IC card is not authenticated.

In addition to the above, the PTS terminal 700 is provided with an LED and a card slot. The LED emits light with plural colors to notify the remaining number of IC cards in a card stacker. The card slot has a mechanism of allowing IC cards to be inserted and ejected. The IC card has a display region. The IC card is completely inside the machine when the player is playing games, and is ejected to expose the display region at the time of the settlement. This allows the player to recognize the credit-related data such as updated cash data. Alternatively, the IC card may be arranged to expose the display region not to be completely inserted, even when the player is playing games. This allows the player to always recognize the update of the credits during games.

When it is confirmed by the human body detection camera that no player is present at the time of the settlement of the credits, the IC card is drawn into and stored in the card stacker. With this arrangement, for example, the IC card is not left inserted for a long time, even if the player left the machine without taking the IC card after recognizing that the remaining credits on the display region are small.

Further, as described above, the PTS terminal 700 is provided with the VFD 177. As shown in FIG. 9, the VFD 177 has at its center the game status area 1620 which displays the status of the game. In the game status area 1620 is displayed the bonus state 1621, the winning content 1622, and obtained credit 1623 and the like. In addition to these, credits, total bet amount, denomination, lines, bet, win meter are displayed.

Further, the cabinet 11 has speakers 112 (output mechanism) which are symmetrically arranged on the left and the right. The slot machine 10 executes the effect by outputting images, sound, and light, by means of the speakers 112 and the effect mechanism 131.

(Electrical Structure of Slot Machine)

Now, referring to FIG. 10 the configuration of a circuit in the slot machine 10 will be described.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a involatile memory, and stores a game program and a game system program. The game program includes a program related to game progression and a program for producing effects by images and sounds. The game program further includes a symbol determination program. The symbol determination program is a program for determining symbols to be rearranged on the display block 28.

The game program further includes sets of data such as: normal game symbol table data indicating a normal game symbol table that shows the relationship of each symbol in each symbol array of the display block, a code number, and a random number; bonus game symbol table data indicating a bonus game symbol table that shows the relationship of each symbol of each symbol array of the display block, a code number, and a random number; symbol number determination table data indicating a symbol array determination table; code number determination table data indicating a code number determination table; wild symbol increase amount determination table data indicating a wild symbol increase amount determination table; trigger symbol increase number determination table data indicating a trigger symbol increase number determination table; odds data indicating the relationship between the types and the number of symbols rearranged on an active line and a payout amount.

Further, the card slot 55 is configured so that the memory card 54 can be inserted thereinto and removed therefrom, and is connected to a motherboard 70 by an IDE bus. The type and contents of the game to be played on the slot machine 10 can be changed by drawing out the memory card 54 from the card slot 53S, writing another game program into the memory card 54, and inserting the memory card 54 into the card slot 53S.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents of the game to be played on the slot machine 10 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the preliminary authentication program, and the like.

The authentication program is a program (falsification check program) for authenticating the game program and the game system program. The preliminary authentication program is a program for authenticating the aforementioned authentication program. The authentication program and the preliminary authentication program are written along a procedure (authentication procedure) for proving that the program to be the subject has not been falsified.

The motherboard 70 is constituted by a commercial general-purpose mother board (printed circuit board on which basic components for personal computers are mounted) and is provided with a main CPU 71, a ROM (Read Only Memory) 72, a RAM (Random Access Memory) 73, and a communication interface 82. This motherboard 70 is equivalent to the game controller 100 of the present embodiment.

The ROM 72 includes a memory device such as a flash memory, and stores a program such as BIOS (Basic Input/Output System) to be executed by the main CPU 71, and permanent data. When the BIOS is executed by the main CPU 71, processing for initializing predetermined peripheral devices is conducted. Further, through the gaming board 50, processing of loading the game program and the game system program stored in the memory card 54 is started. In the present invention, the ROM 72 may be or may not be rewritable.

The RAM 73 stores data used for the operation of the main CPU 71 and programs such as the symbol determination program. For example, when the processing of loading the aforementioned game program, game system program or authentication program is conducted, the RAM 73 can store the program. The RAM 73 is provided with working areas used for operations in execution of these programs. Examples of the areas include: an area that stores counters for the number of games, the bet amount, the payout amount, the credit amount and the like; and an area that stores symbols (code numbers) randomly determined.

The communication interface 82 is for communicating with the external controller 621 such as a server, through the communication line 301. Further, the motherboard 70 is connected with a later-described door PCB (Printed Circuit Board) 90 and a main body PCB 110 by respective USBs. Further, the motherboard 70 is connected to the power supply unit 81. Furthermore, the motherboard 70 is connected with the PTS terminal 700 by USB.

When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the main body PCB 110 are connected with input devices such as a switch and a sensor, and peripheral devices the operations of which are controlled by the main CPU 71.

The door PCB 90 is connected with a control panel 30, a reverter 91, a coin counter 92C and a cold cathode tube 93.

The control panel 30 is provided with a reserve switch 31S, a gamble switch 32S, a game rule switch 33S, a 1-bet switch 34S, a 2-bet switch 35S, a 3-bet switch 36S, a 5-bet switch 37S, a 10-bet switch 38S, a play-1 credit switch 40S, a play-5 credit switch 41S, a play-15 credit switch 42S, a play-30 credit switch 43S, a play-60 credit switch 44S, an information switch 45S, and a spin switch 46S, which correspond to the above-described buttons. Each of the switches outputs a signal to the main CPU 71 upon detection of press of the button corresponding thereto by the player.

Inside the coin entry 39 are provided a reverter 91 and a coin counter 92C. The reverter 91 verifies validates a coin inserted into the coin entry 39, and discharges coins other than genuine coins through a coin outlet. The coin counter 92C detects the received genuine coins and counts the number of the coins.

The reverter 91 operates based on a control signal output from the main CPU 71, and distributes valid coins validated by the coin counter 92C into a hopper 113 or a cash box. That is, coins are distributed into the hopper 113 when the hopper 113 is not filled with coins, while coins are distributed into the cash box when the hopper 113 is filled with coins.

The cold cathode tube 93 functions as a backlight installed on the rear face sides of the effect mechanism 131 and the lower image display panel 141, and lights up based on a control signal output from the main CPU 71.

The main body PCB 110 is connected with the effect mechanism 131, the speakers 112, the hopper 113, a coin detector 113S, the touch panel 69, the bill entry 22, a graphic board 130, a key switch 173S, and the data displayer 174. The speakers 112 output BGM sound or the like in accordance with a control signal output from the main CPU 71.

The hopper 113 operates based on a control signal output from the main CPU 71, and pays out coins of the specified number of payouts from the coin outlet to an unillustrated coin tray. The coin detector 113S outputs a signal to the main CPU 71 upon detection of coins paid out by the hopper 113.

The touch panel 69 detects a position on the lower image display panel 141 touched by a finger or the like of the player, and outputs a signal corresponding to the detected position to the main CPU 71.

The bill entry 22 authenticates the bills and receives genuine bills into the cabinet 11. The bills received by the cabinet 11 are converted onto the number of coins, and the credits equivalent to the converted coins are added as the credits owned by the player.

The graphic board 130 controls display of images conducted by the effect mechanism 131 and lower image display panel 141, based on a control signal output from the main CPU 71. The graphic board 130 is provided with the VDP (Video Display Processor) generating image data, the video RAM storing the image data generated by the VDP, and the like. It is to be noted that the image data used in generation of image data by the VDP is included in the game program that has been read from the memory card 54 and stored into the RAM 73.

The key switch 173S is provided in the keypad 173, and outputs a predetermined signal to the main CPU 71 when the keypad 173 has been operated by the player. The data displayer 174 displays data read by the card reader 172 and data inputted by the player through the keypad 173, based on a control signal outputted from the main CPU 71.

(Symbols, Combinations, or the Like)

The symbols 501 displayed on the pseudo reels 151 to 155 of the slot machine 10 form a symbol array 170 in which a plurality of the normal symbols 502, specific symbols 503, the trigger symbols 504, and the wild symbols 505 are arranged. Specifically, the pseudo reels 151 to 155 are configured so that symbol arrays 170*a*, 170*b*, 170*c*, 170*d*, 170*e* shown in FIG. 4 to FIG. 13 are scroll displayed thereon. The probability of having each symbol 501 rearranged is the same. Therefore, the probabilities of rearrangement are set by the number of symbols for each type in the symbol arrays 170.

The way of setting the probabilities of rearrangement of symbols 501 is not limited to the above, and the probabilities of rearrangement may be set for each symbol. For example, a symbol random determination table may be used for determining symbols 501 used as the rearrangement target in the normal game. In the symbol random determination table, the normal symbol 501 for each of the display blocks 28 in each symbol array are associated with a code No. A range of random numbers are divided by the number of symbols in each symbol array to make a plurality of number ranges, the code No. is associated with a number range out of the number ranges. It should be noted that the above numbers may be divided into ranges equally, or in equally. For example, in the latter case, it is possible to adjust the probability of winning by a random number, based on the type of the symbol 501. It is possible to adopt a plurality of symbol random determination tables, according to the gaming status. For example, a different symbol random determination tables may be used for the normal game and the free game, respectively.

The normal symbols 502 include six types: "9", "10", "JACK", "QUEEN", "KING", and "ACE". Further, as the specific symbols 503*a*, there are a bat symbol 503*e*, a gourd symbol 503*d*, a fish symbol 503*c*, a pot symbol 503*b*, and a dragon symbol 503*a*, as described hereinabove. Further, the wild symbols 505 include two types: normal wild symbols 505*a* and a double wild symbols 505*b*. The wild symbol 505 triggers the random determination of the bonus game, and could serve as a substitute for the normal symbol 502, the specific symbol 503, and the trigger symbol 504. It should be noted that when the double wild symbol 505*b* is rearranged, the payout and the probability of the bonus game is doubled. Note further that the normal wild symbols 505*a* only exist in the symbol array 170*b* and the symbol array 170*d* of the pseudo reel 152 and the pseudo reel 154. The double wild symbol 505*b* is only in the symbol array 170*c* of the pseudo reel 153. Each of the trigger symbols 504 is a symbol which triggers a free game.

Figure 24:
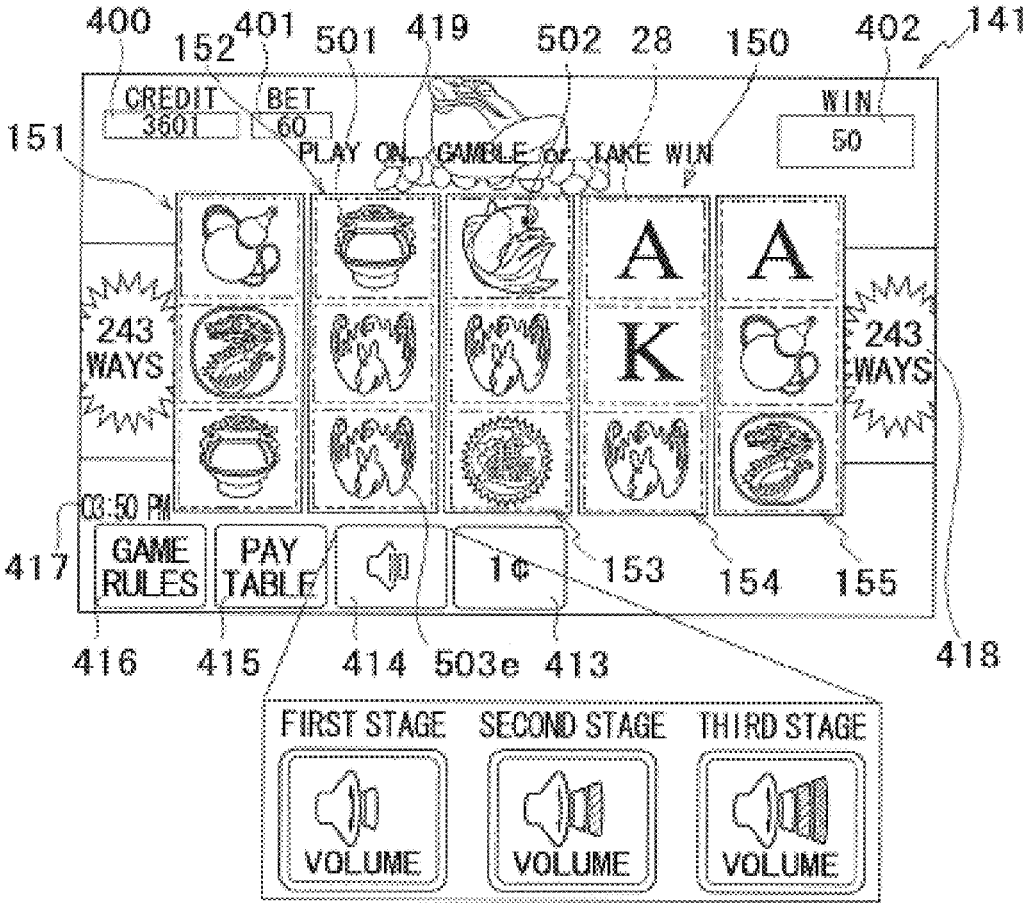
FIG. 24 is an explanatory diagram showing an example normal game screen on a lower image display panel.

As shown in FIG. 24, three successive symbols 501 in a symbol array are displayed (arranged) in the upper stage, the central stage, and the lower stage of the display area of the pseudo reels 151 to 155 thereby forming a symbol matrix of five columns and three rows, in the symbol display region 150. The symbols 501 forming the symbol matrix are start being scrolled when at least the spin button 46 is pressed and the game is started. After a predetermined period from the start of scrolling, scrolling of the symbols 501 stops (rearrangement).

Further, for each of the symbols 501, various winning combinations are determined in advance. Note that the winning combination means that a prize is established. The winning combination is a combination of the symbols 501 stopped on an activated line, which brings about an advantageous state to the player. For example, the advantageous state is a state in which coins are paid out according to the winning combination, a state in which the number of coins paid out is added to the number of credits, and a state in which a bonus game is started.

The winning combinations in the present embodiment include a winning combination which generates the scatter win, a winning combination which generates the line win. Specifically, the scatter win is attributed to the trigger symbol 504 which triggers running of the free game, and triggers execution of the random determination for the bonus game. When one or more trigger symbols 504 are rearranged in the symbol display region 150, a payout is awarded according to the number of the trigger symbols 504 rearranged.

Further, the line win is attributed to the normal symbols 502, the specific symbols 503, and the wild symbols 505. In the present embodiment, there are no paylines, and all the possible patterns (243 patterns) on the pseudo reel 151 to pseudo reel 155 are the paylines. That is, the line win is established if the pseudo reels 151 to 155 each has the same symbol 501 in its upper stage, middle stage, or lower stage in the symbol display region 150. In an example shown in FIG. 24, the bat symbol 503*e* is rearranged in each of the pseudo reels 152 to 154, thus forming a three of a kind combination of the bat symbol 503*e*. It should be however noted that a payline for establishment of a line win may be set.

The symbols 501 to be rearranged in the normal game are randomly determined upon pressing down the spin button 46. The symbols 501 to be rearranged in the free game are randomly determined immediately before variable displaying of the pseudo reels 151 to 155 is started. Further, whether to run the bonus game is randomly determined when the wild symbol 505 is rearranged in the symbol display region 150. Further, in the bonus game, the bonus type is randomly determined when the effect image (an animation of a frog spitting out a coin) provided upon rearrangement of the wild symbol 505 in the symbol display region 150 is switched to a bonus game screen. Further, random determination for a mystery bonus is executed at a time point of starting variable displaying of pseudo reels 151 to 155.

(Display Screen: Payout Table)

Figure 25:
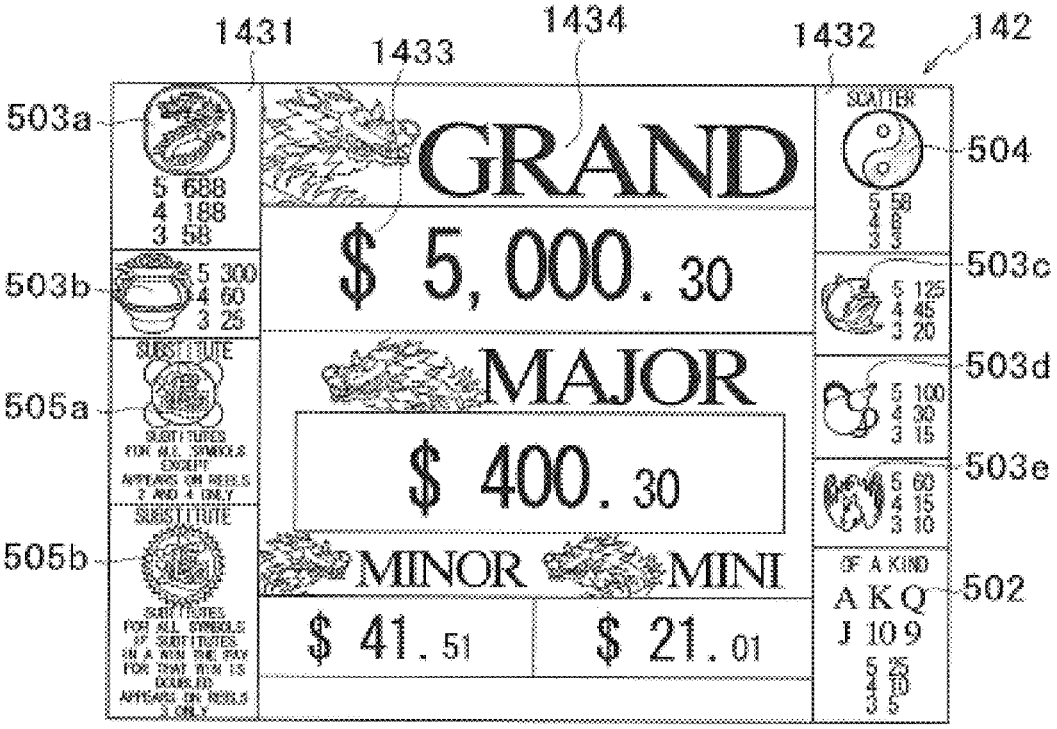
FIG. 25 is a diagram of a screen showing a payout table which is displayed on the upper image display panel.

As shown in FIG. 25, on the upper image display panel 142 is displayed a payout table of winnings shown in FIG. 3. Specifically, on the upper image display panel 142, a first payout table 1431 is displayed on the left end portion, a second payout table 1432 is displayed in the right end portion, and a jackpot amount 1433 and a jackpot name 1434 are displayed in the middle portion. The first payout table 1431 and the second payout table 1432 each indicates the obtainable credit amount at the payout rate of ×1 from each winning combination. In the first payout table 1431 are indicated payouts for the dragon symbol 503*a* and the pot symbol 503*b*. The payouts for winning combinations of the dragon symbol 503*a* are: 58 credits for a 3 of the kind, 188 credits for a 4 of the kind, and 688 credits for a 5 of the kind. The payouts for winning combinations of the pot symbol 503*b* are: 25 credits for a 3 of the kind, 60 credits for a 4 of the kind, and 300 credits for a 5 of the kind.

The first payout table 1431 further indicates explanations for the wild symbols 505. Specifically, regarding the double wild symbol 505*b*, the first payout table 1431 indicates that the double wild symbol 505*b* can replace any symbol except the wild symbol 505; that the payout becomes a double when a winning combination includes the double wild symbol 505*b*; and that the double wild symbol 505*b* could only appear in the third reel (pseudo reel 153). Further, regarding the normal wild symbol 505*a*, the first payout table 1431 indicates that the normal wild symbol wild symbol 505*a* can replace any symbol except the wild symbol 505; and that the normal wild symbol 505*a* could only appear in the second reel and the fourth reel (pseudo reels 152 and 154).

In the second payout table are indicated payouts for the trigger symbol 504, the fish symbol 503*c*, the gourd symbol 503*d*, and the bat symbol 503*e*. The payouts for the trigger symbols 504 of a scattering type are: 3 credits for a 3 of the kind, 8 credits for a 4 of the kind, and 58 credits for a 5 of the kind. The payouts for winning combinations of the fish symbol 503*c* are: 20 credits for a 3 of the kind, 45 credits for a 4 of the kind, and 125 credits for a 5 of the kind. The payouts for winning combinations of the gourd symbol 503*d* are: 15 credits for a 3 of the kind, 30 credits for a 4 of the kind, and 100 credits for a 5 of the kind. The payouts for winning combinations of the bat symbol 503*e* are: 10 credits for a 3 of the kind, 15 credits for a 4 of the kind, and 60 credits for a 5 of the kind.

The jackpot amount 1433 indicates payout amounts for four types of bonuses, and a jackpot name 1434 (GRAND, MAJOR, MINOR, MINI) indicating the name of the bonus type is associated. The displayed content of the jackpot amount 1433 is variable according to the conditions. It should be noted that, in the lower image display panel 141 and the upper image display panel 142, number fonts of different widths are used according to the number of digits of the value displayed.

(Free Game)

Figure 26:
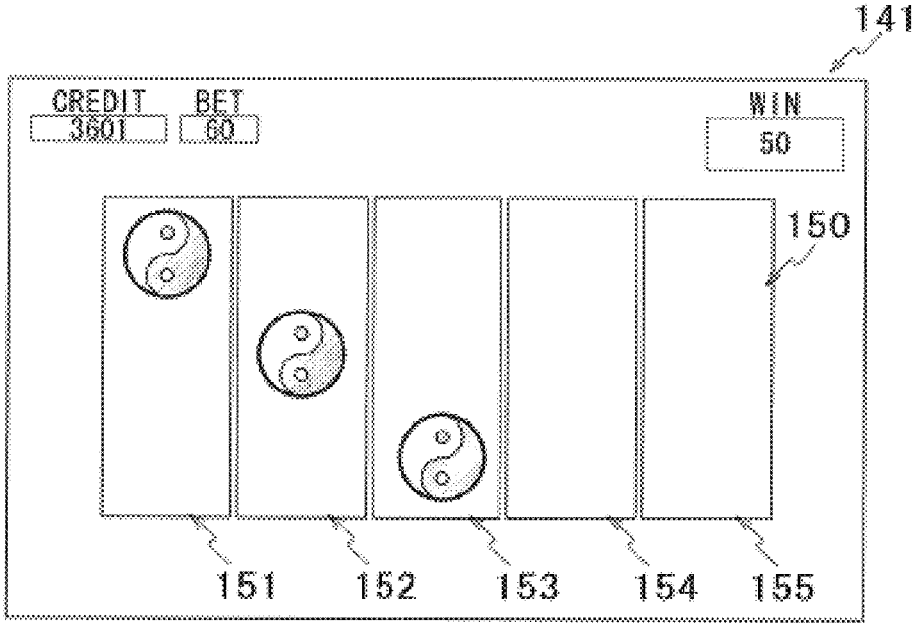
FIG. 26 is an explanatory diagram of a trigger state of the free game.

Next, the following will describe the free game. The initial count of free games is 10. As shown in FIG. 26, the free game is run, when a predetermined number (e.g., 3) or more trigger symbols 504 are rearranged. In the free game, symbol arrays 170 (see FIG. 9 to FIG. 13) different from those used in the normal game are used. When a predetermined number (e.g., 3) or more of trigger symbols 504 are rearranged, a retrigger which adds 10 to the remaining count of free games occurs. The number of times the retrigger occurs is not limited in the present embodiment; however, the present invention is not limited to this.

Figure 27:
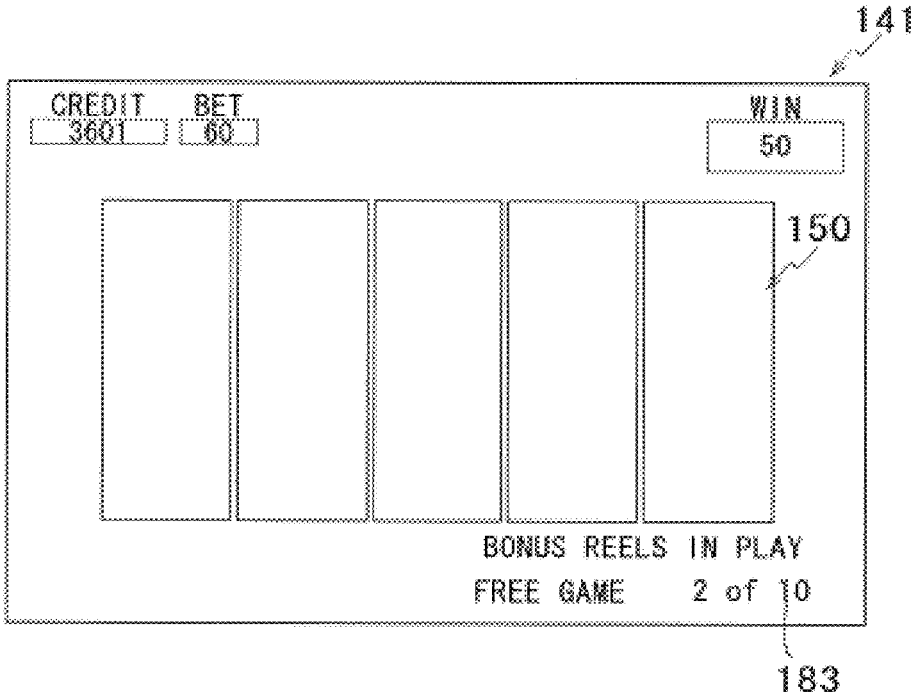
FIG. 27 is an explanatory diagram of a display screen in the free game.

When a predetermined number or more of trigger symbols 504 are rearranged, the lower image display panel 141 displays "10 FREE GAMES". After darkening, the symbol arrays 170 of the pseudo reels 151 to 155 are changed to those for free games corresponding to the bet amount placed in the immediately previous normal game. Further, as shown in FIG. 27, in the lower right part of the lower image display panel 141 is displayed a free game counter 183. The free game counter 183 displays the total number of the free games and a counted number. For example, when the free game counter 183 displays "2 OF 10", it means that the free game is executed ten times, and currently the free game has counted up to two. That is, the counter is capable of informing the player that the free games are progressing one game at a time. It should be noted that the count value before the start of free games is 0, and the count value is incremented by 1, upon starting of the variable displaying of the pseudo reels 151 to 155. The incremented count value is enlarged as a visual effect, at the same time as an audio effect. Further, the free game counter 183 indicates that the game is played with the bonus reels, and the free games are being played. Then, variable displaying of the symbol array 170 in the symbol display region 150 is automatically started. When a winning occurs in the free game, a later-described win screen is displayed.

When the remaining number of free games are consumed and the free games are all ended, the lower image display panel 141 displays the total credit, and then the process returns to the normal game. Further, when a predetermined number or more of trigger symbols 504 are rearranged, the value of the free game counter 183 is incremented by 10, after an effect by a sound "jilililili . . . " (bell ring like sound), as hereinabove mentioned. For example, the free game counter 183 changes its indication from "3 of 10" to "3 of 20". Further, with establishment of trigger symbols 504, the later-described win-effect is executed.

When no winning occurs in a free game, there will be a standby period of 2 seconds, between the completion of rearrangement on the pseudo reels 151 to 155 and the start of variable displaying in the following free game. It should be noted that the standby period may be skippable by the spin button 46 and the like. It should be noted that in the present embodiment, skipping of reel spinning by the spin button 46 and the like is disabled.

Figure 28:
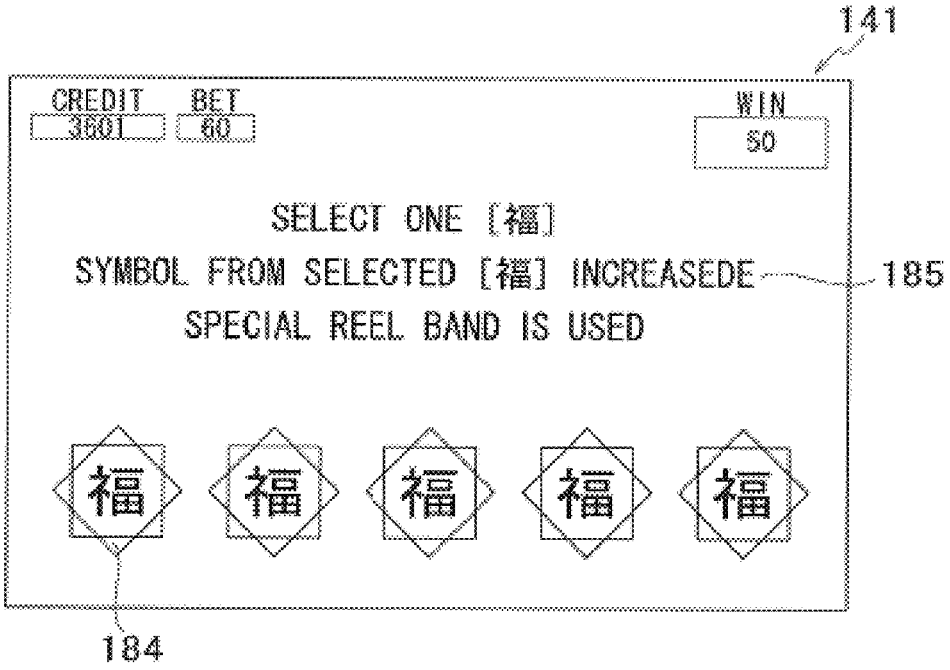
FIG. 28 is an explanatory diagram of a display screen in a selection game.
Figure 29:
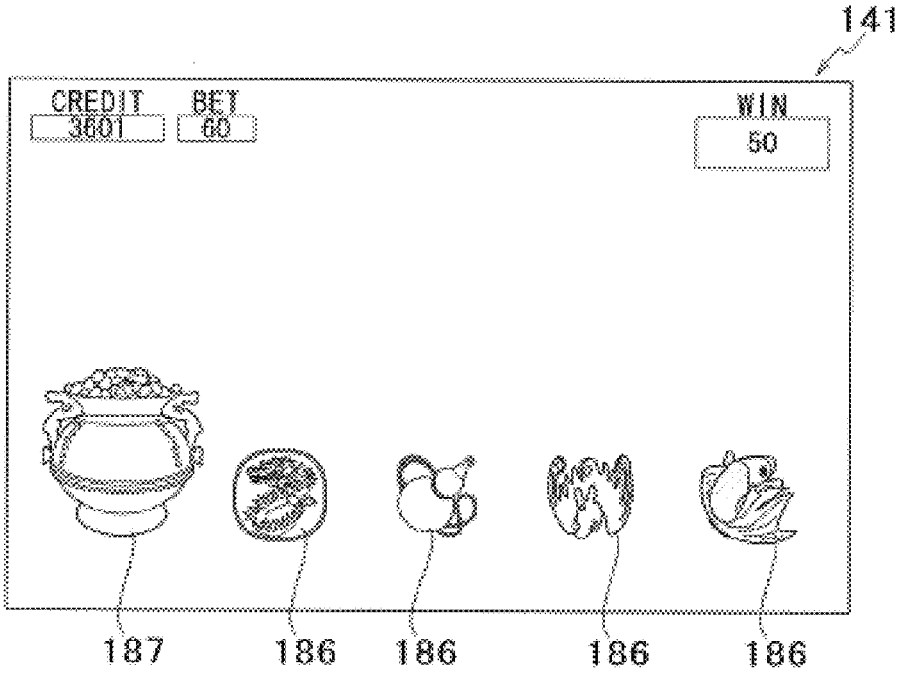
FIG. 29 is an explanatory diagram of a display screen in the selection game.

It should be noted that in the free game, a selection game for increasing the number of specific symbols 503 may be run. As shown in FIG. 28, when the free game is started, a selection game screen is first displayed on the lower image display panel 141. In the selection game screen, five selectable images 184 are arrayed at the lower part of the lower image display panel 141. Further, a message 185 prompting selection of one of the selectable images 184 is displayed in the middle of the lower image display panel 141. When a control panel 30 is used to make selection out of the selectable images 184, the selected selectable image 184 is changed to a selected symbol image 187. The selected symbol image 187 is any one of the five types of specific symbols 503. Further, the non-selected selectable images 184 (four symbols) are changed to non-selected symbol images 186. The four non-selected symbol images 186 are the remaining four out of the five types of specific symbols 503, other than the type indicated by the selected symbol image 187.

Only the specific symbol 503 indicated by the selected symbol image 187 selected in the selection game screen as described above could be displayed in the symbol arrays 170 of the free game. That is, the symbol arrays 170 of the free game could display one type of specific symbol 503 selected in the selection game, the normal symbols 502, the trigger symbols 504, and the wild symbols 505. Accordingly, the four types of specific symbols 503 not selected in the selection game are not displayed in the free game. Further, the number of the type of specific symbols 503 that is selected in the selection game and that could be displayed on the symbol arrays 170 in the free game varies according to the value of symbol bet in the normal game having triggered the free game. That is, the percentage of selected type of specific symbols arranged in the symbol arrays increases with an increase in the value of the symbol bet.

Exemplary symbol arrays of the free game in which the above described selection game has been run are shown in FIG. 57 to FIG. 60. FIG. 57 and FIG. 58 shows an example where the specific symbol of "PHOENIX" is selected in the selection game. FIG. 57 shows the symbol arrays when the value of symbol bet is 1 in the normal game having triggered the free game. FIG. 58 shows the symbol arrays when the value of symbol bet is 60 in the normal game having triggered the free game. FIG. 59 and FIG. 60 show an example where the specific symbol of "SWALLOW" is selected in the selection game. FIG. 59 shows the symbol arrays when the value of symbol bet is 1 in the normal game having triggered the free game. FIG. 60 shows the symbol arrays when the value of symbol bet is 60 in the normal game having triggered the free game.

As shown in FIG. 57 to FIG. 58, it is only the "PHOENIX" selected in the selection game which is displayed as the specific symbol 503. Further, the number of the specific symbols of "PHOENIX" in the symbol arrays increases with an increase in the value of the symbol bet. Further, the number of symbols in the symbol arrays are reduced, raising the percentage of the specific symbol of "PHOENIX". As shown in FIG. 59 to FIG. 60, it is only the "SWALLOW" selected in the selection game which is displayed as the specific symbol 503. Further, the number of the specific symbols of "SWALLOW" in the symbol arrays increases with an increase in the value of the symbol bet. Further, the number of symbols in the symbol arrays are reduced, raising the percentage of the specific symbol of "SWALLOW". As should be understood, only the type of the specific symbol selected in the selection game is displayed in the symbol arrays of the free game, and the percentage of that type of the specific symbol increases with an increase in the value of the symbol bet in the normal game having triggered the free game. Therefore, for each type of (5 types of) the specific symbols, five sets of symbol arrays for each symbol bet (25 sets altogether) are prepared in advance.

(Bonus Game)

When one or more wild symbols 505 are rearranged in any of the pseudo reels 151 to 155 in the normal game and the free game, the random determination (first random determination) of whether to run the bonus game is executed. When the bonus game is run in the middle of the free game, the free game is interrupted and the bonus game as shown in FIG. 2 is started. Further, in each normal game, the random determination for the mystery bonus (second random determination) is executed, and the bonus game is run when the random determination results in a wining. That is, when the both first random determination and the second random determination result in a winning in a normal game, the bonus game will be run twice. The first random determination and the second random determination are described later.

As shown in FIG. 2, there are 14 selectable images 1421 in the bonus game. The selectable images 1421 include two double bonus rank images 1422*e*. When a double bonus rank image 1422*e* is displayed, a message reading "Lucky! You won a double!" is displayed below the double bonus rank image 1422*e*, and the count value of the corresponding rank count region 1423 is incremented by 2.

When running of the bonus game is determined, random determination for determining the mode of effect, i.e., the first mode (scenario mode) or the second mode (random mode) is executed. The weighting for both effect modes is 1 and therefore the probability of each effect mode being selected is 1/2 in the present embodiment; however, the present invention is not limited to this. In the scenario mode, there is a predetermined sequence of displaying the bonus rank images 1422 up to a certain number of times, and the bonus rank images 1422 are displayed according to the predetermined sequence. After that, the bonus rank images 1422 to be displayed and the sequence of displaying the bonus rank images 1422 are determined based on the bonus determined in advance. In the random mode, the bonus rank images 1422 and the sequence of displaying the bonus rank images 1422 are determined entirely based on the bonus determined in advance. Namely, the bonus rank images 1422 corresponding to the bonus determined in advance is set to occur four times, and the last bonus rank image 1422 corresponding to the bonus is set to occur at the end. This way, the effect display is performed until the bonus rank image 1422 corresponding to the bonus determined in advance occurs four times. The second mode allows selection of the selectable images 1421 from the minimum of 3 times to the maximum of 10 times.

Figure 31:
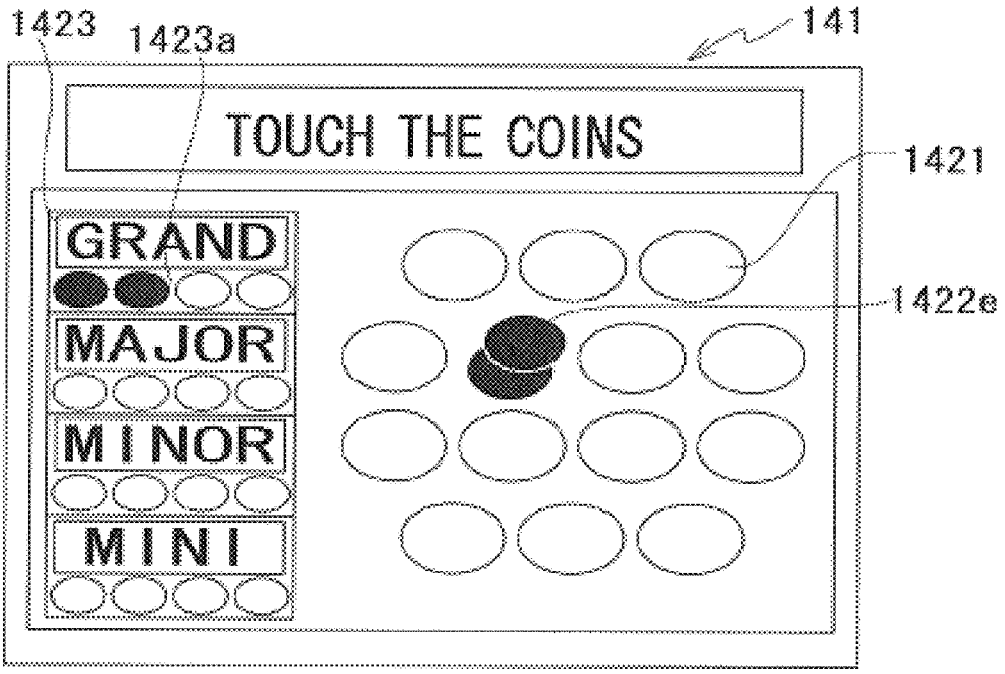
FIG. 31 is an explanatory diagram of an example display screen in the bonus game.
Figure 32:
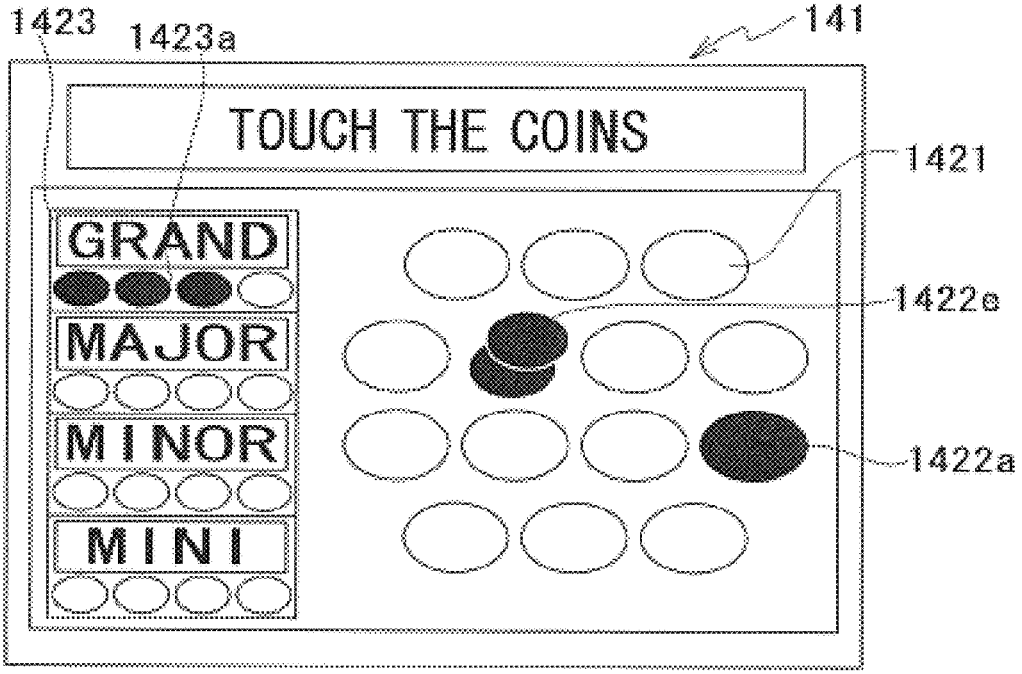
FIG. 32 is an explanatory diagram of an example display screen in the bonus game.

The scenario mode is further detailed below. In the scenario mode, one of a plurality of scenarios is selected. Each scenario determines the bonus rank images 1422 to be displayed by selection of the selectable images 1421, from the first pick to the fourth pick, as shown in the scenario table in FIG. 30. There are 24 types of scenarios, and each scenario is weighted 1. However, the scenarios may be weighted differently. It should be noted that in all the scenarios, only the bonus rank images 1422 corresponding to high rank bonus types are set. Therefore, in the scenario mode, the bonus rank images 1422 displayed are always those corresponding to a high rank bonus type, up to fourth selection. In a single bonus game, a single scenario is randomly determined. For example, when a scenario 1 is selected in a bonus game, a double bonus rank image 1422*e* for a Grand rank bonus is displayed for the first time, no matter which one of the selectable images 1421 the player picks, as shown in FIG. 31. Then, there will be counting of two in the count images 1423*a* for the Grand rank in the rank count region 1423. Then, as shown in FIG. 32, the Grand rank image 1422*a* is displayed for the second time, no matter which one of the selectable images 1421 the player picks. Then, the count is further incremented by 1 up to 3 in the count images 1423*a* for the Grand rank in the rank count region 1423.

Figure 33:
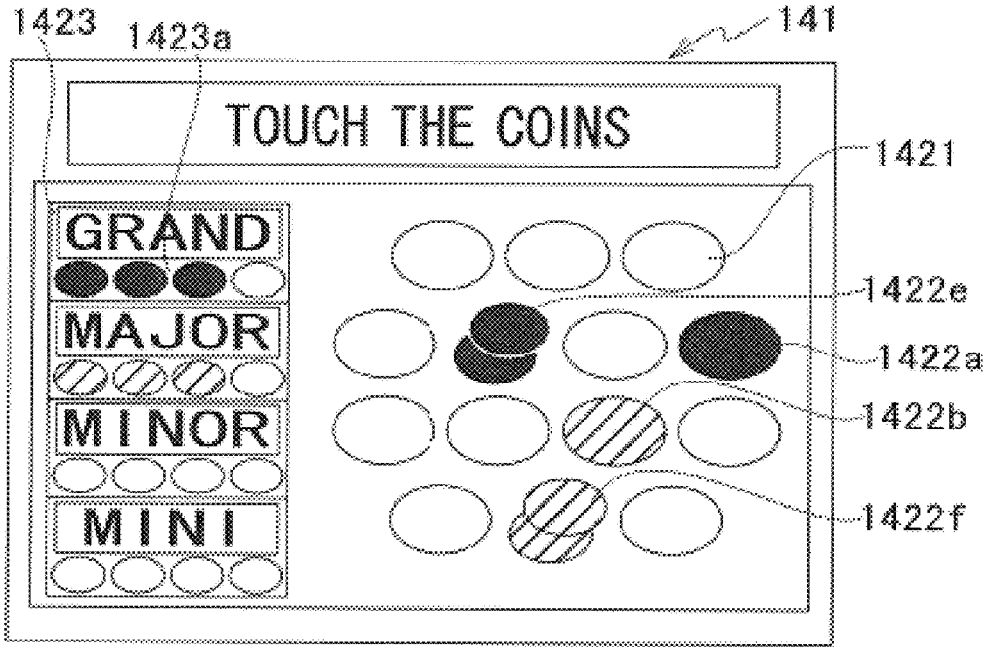
FIG. 33 is an explanatory diagram of an example display screen in the bonus game.

As shown in FIG. 33, the double bonus rank image 1422*f* for the Major rank is displayed for the third time, and the Major rank is counted up by 2. In the fourth time, a Major rank image 1422*b* is displayed again, and the Major rank is further counted up. In the fifth time pick and thereafter, the bonus rank image 1422 for the bonus type determined in advance is displayed. It should be noted that, the bonus to be won is determined in advance, and the bonus rank images 1422 to be displayed in the fifth time pick and thereafter are determined so that the counts of the bonus rank images 1422 for the other bonus types never reaches 4. The bonus rank images 1422 for the fifth time pick and thereafter are displayed, in response to an operation of the control panel 30 by the player.

Figure 34:
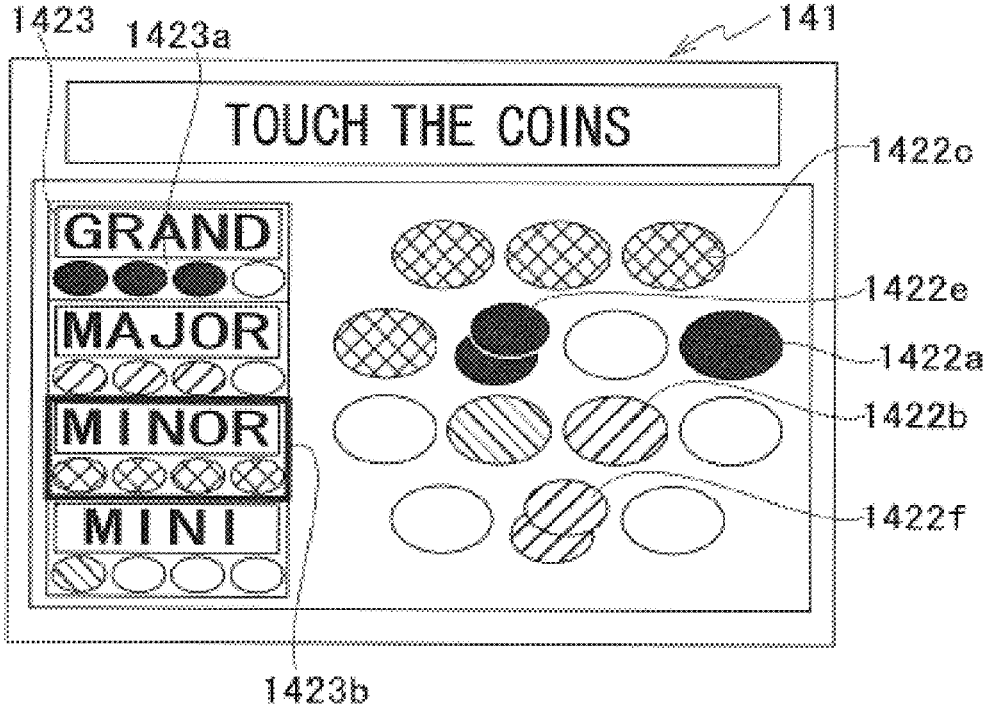
FIG. 34 is an explanatory diagram of an example display screen in the bonus game.
Figure 35:
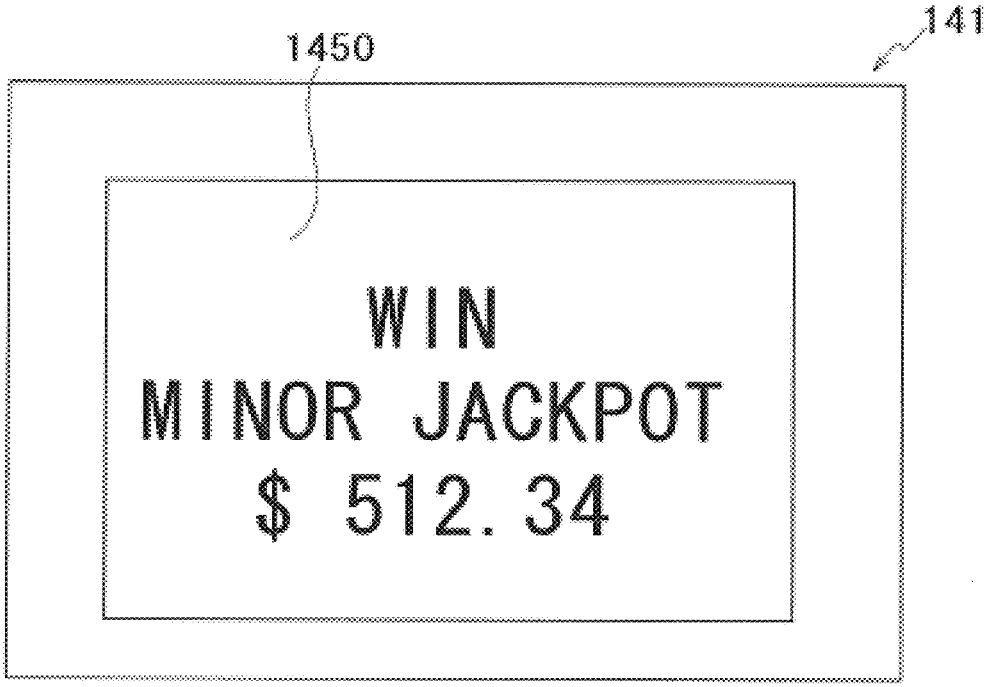
FIG. 35 is an explanatory diagram of an example display screen in the bonus game.

When the value of any count reaches 4 in the rank count region 1423, a frame image 1423*b* is displayed as shown in FIG. 34, surrounding the rank count region 1423 of the bonus determined. This way, the type of bonus won is clearly displayed. Then, as shown in FIG. 35, a result display screen is displayed on the lower image display panel 141 as shown in FIG. 35. The result display screen shows a bonus result 1450 indicative of the type of bonus determined, and the amount of credit won. Then, the process returns to the state where the bonus game is triggered.

(Random Determination Related to Bonus Game)

The following describes random determination related to the bonus game. As described above, in the bonus game, one bonus type out of four bonus types (Grand Bonus, Major Bonus, Minor Bonus, Mini Bonus) is determined. The initial values of the Grand Bonus, the Major Bonus, the Minor Bonus, and the Mini Bonus are 500000 credits, 40000 credits, 4000 credits, and 2000 credits, respectively. The bonus value is the product of the above initial value multiplied by an amount of money pre-set as a denomination. Further, the default increment rates of the bonus values are as follows. Namely, the default increment rates of the Grand Bonus, the Major Bonus, the Minor Bonus, and the Mini Bonus are 0.1%, 0.1%, 0.5%, and 1%, respectively.

The following describes the random determination (also referred to as first random determination or progressive challenge) of whether to run the bonus game, which is executed when the wild symbol 505 is rearranged in the normal game or the free game. The probability of winning the bonus game in the progressive challenge is increased according to the type of symbol bet and the number of wild symbols 505 rearranged. Specifically, as shown in FIG. 36, in a progressive challenge table, a numerical value is associated with each symbol bet for each variation of the game. This progressive challenge table is given for each setting combination. To improve the accuracy, the numerical value is multiplied by 1000000, and the resulting product is used as the denominator for the probability of winning. Further, in the normal game or the free game having triggered the progressive challenge, the number of normal wild symbols rearranged is multiplied by 1000000, and the resulting product is used as the numerator for the probability of winning. It should be noted the double wild symbol 505*b* is calculated as two wild symbols.

Figure 37:
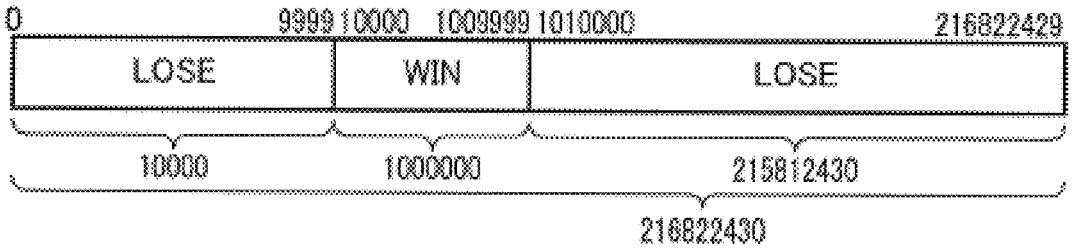
FIG. 37 is an explanatory diagram of a random determination method in a progressive challenge table.

For example, when the value in the progressive challenge table is 216.822430, this value is multiplied by 1000000, and the denominator is 216822430. Further, when the number of wild symbols 505 is 1, the value of 1 is multiplied by 1000000, and the numerator is 1000000. In the progressive challenge, a random number is extracted to determine whether or not the result is a winning. Specifically, as shown in FIG. 37, winning ranges and losing ranges are designated within the range of random numbers from 0 to 216822429. In the example of FIG. 37, the ranges of 0 to 9999, 1010000 to 216822429 are set as the ranges of losing, and a range of 10000 to 1009999 is set as the range of winning. The winning range is expanded when, for example, the number of wild symbols 505 is two or more. A random number ranging from 0 to 216822429 is extracted, and the winning or losing is determined by the range in which the extracted number falls within.

Next, the following describes the random determination (also referred to as second random determination, mystery random determination) which is executed in every normal game. The probability of winning the bonus game in the mystery random determination is determined based on the bet amount and the mystery random determination table shown in FIG. 38. The mystery random determination table is commonly used for any variation of the game. In the mystery random determination table, a numerical value is associated with each setting combination, and that numerical value serves as the denominator. The numerator is the bet amount in the normal game, and the winning or losing is determined based on the numerical ranges shown in FIG. 37.

When the bonus game is determined as to be run as the result of progressive challenge and the mystery random determination, which one of the four types of bonuses will be awarded as the payout is randomly determined (this process is also referred to as progressive random determination). Specifically, as shown in FIG. 39, the weighting value of each bonus type is determined in advance in a progressive random determination table. That is, the probability of winning of each bonus type is a value deriving from a fractional expression where the total of weighting values is the denominator and the weighting value of each bonus type is the numerator. It should be noted that the Minor Bonus is set as the default in case of an abnormality.

(Operations of Slot Machine 10: Normal Game Running Process)

Figure 40:
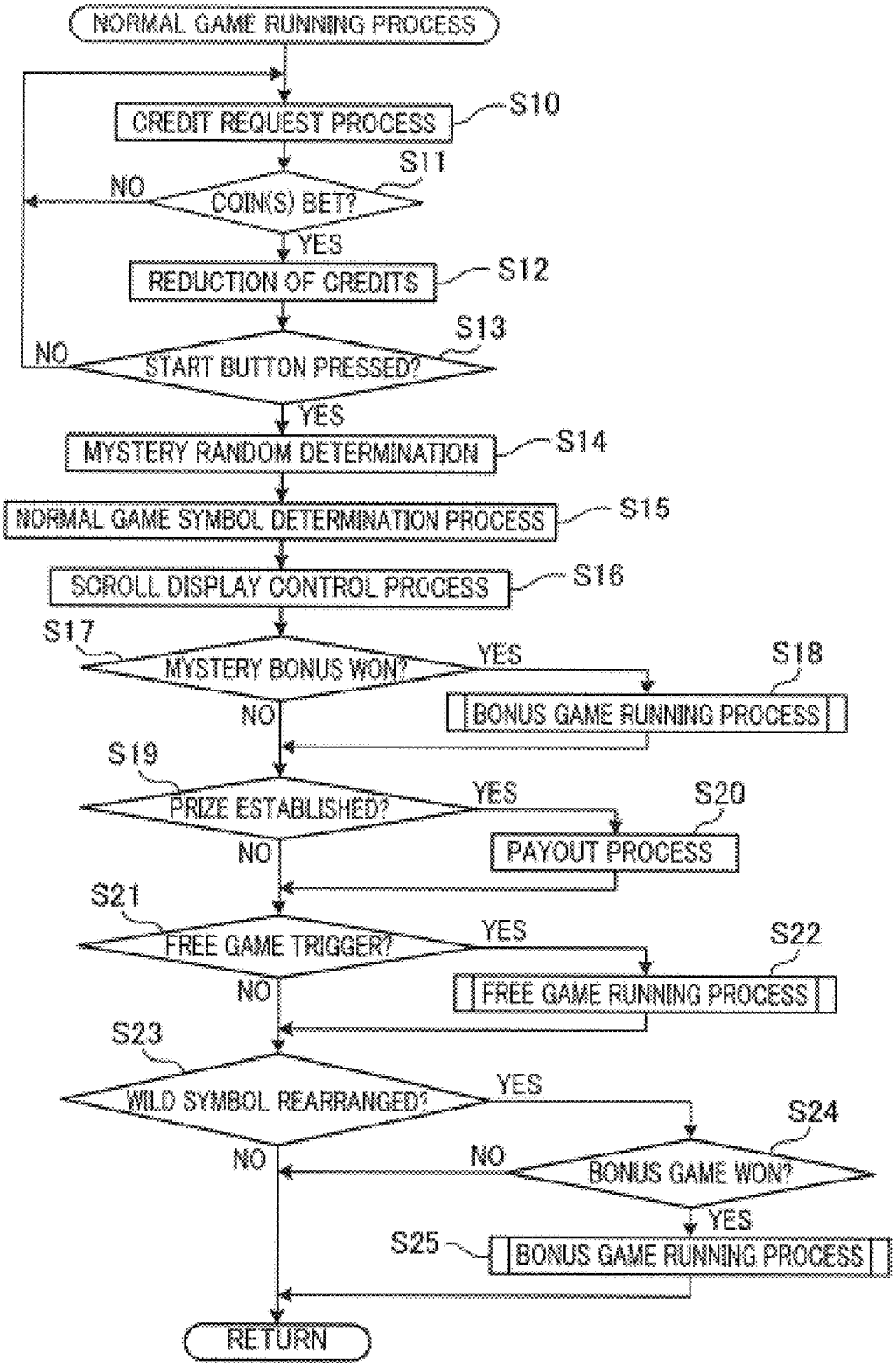
FIG. 40 is a flowchart of a normal game running process.

The operation of the slot machine 10 arranged as above will be described. The normal game running process shown in FIG. 40 is executed by the main CPU 71 of the slot machine 10. The slot machine 10 has been activated in advance.

To begin with, the main CPU 71 executes a credit request process (S10). In this process, the player determines how many credits are used from the credits stored in the IC card.

Then whether a coin is bet is determined (S11). In this process, the main CPU 71 determines whether an input signal output from the 1-BET switch 34S when the 1-BET button 34 is pressed and an input signal output from the 10-BET switch 39S when the 10-BET button 38 is pressed are received. When it is determined that no coin is bet, the process goes back to S10.

In the meanwhile, if it is determined in S11 that a coin is bet, the main CPU 71 executes a process of decreasing the credit amount stored in the RAM 73 in accordance with the number of coins bet (S12). When the number of coins bet is larger than the number of credits stored in the RAM 73, the step of decreasing the credit amount stored in the RAM 73 is not carried out and the process goes back to S11. When the number of coins bet is larger than the maximum number of coins on one game, the step of decreasing the credit amount stored in the RAM 73 is not carried out and the process proceeds to S13.

Then the main CPU 71 determines whether the spin button 46 is pressed (S13). In this step, the main CPU 71 determines whether an input signal output from the spin switch 46S when the spin button 46 is pressed is received. When it is determined that the spin button 46 is not pressed, the process goes back to S11. It is noted that, when the spin button 46 is not pressed (e.g., when an instruction to end a game is input while the spin button 46 is not pressed), the main CPU 71 cancels the reduction result in S12.

In the meanwhile, if it is determined in S13 that the spin button 46 is pressed, the main CPU 71 executes the mystery random determination, and determines whether to run the bonus game by the mystery bonus (S14). When the mystery random determination results in a winning, the result is stored in the storage device, e.g., turning on the flag of the mystery bonus. Then, the normal game symbol determination process is executed (S15). In the normal game symbol determination process, code numbers when the symbols are stopped are determined. Specifically, the code No. of each display block 28, at the time of stopping the symbol arrays is determined based on the random number obtained.

Thereafter, in S16, the main CPU 71 executes a scroll display control process. In this process, the display control is conducted so that, after the start of the scroll of the symbols 501, the symbols 501 are rearranged in accordance with S15.

Next, the main CPU 71 in step S14 determines whether or not the mystery bonus has been won (S17). If the mystery bonus is won, the bonus game is run (S18). After the bonus game by the mystery bonus is run, or when the mystery bonus was not won, whether or not a winning is established is determined with the rearrangement of symbols determined in step S15 (S17). In S17, the main CPU 71 counts, regarding the symbols 501 rearranged in accordance with S16, the number of symbols 501 of each type rearranged on each active line, and whether or not the rearrangement of symbols falls within any type of winning is determined.

When it is determined that a prize is established, the main CPU 71 executes a step concerning the payout of coins (S20). In this step, the main CPU 71 determines a payout rate with reference to odds data stored in the RAM 73 and based on the number of symbols 501 rearranged on an active line. The odds data indicates the relationship between the number of symbols 501 rearranged on an active line and a payout rate. It should be noted that the payout is doubled when a double wild symbol 505*b* is rearranged, and a winning related to this is established.

When a prize is not established in S19, or after the process of S20, the main CPU 71 determines whether or not the free game is triggered (S21). When the free game is triggered, the free game is started (S22). When the free game is not triggered, or after the free game is run, whether or not a wild symbol is rearranged is determined (S23). When the wild symbol is rearranged, the random determination for the bonus game is executed according to the number of wild symbols, and whether or not the bonus game is won is determined (S24). Then, if the bonus game is won, the bonus game is run (S25). When the wild symbol is not rearranged, or after the bonus game triggered by the rearrangement of the wild symbol is run, the present routine is ended.

As described, the bonus game is triggered by the mystery random determination, and the progressive challenge executed by the rearrangement of the wild symbol also determines whether to trigger the bonus game. Therefore, there is a chance of obtaining the bonus game at one time in the mystery random determination and the progressive challenge. To change the probabilities of the progressive challenge dependent on the symbol arrays, it is necessary to modify the symbol arrays; however, since there is a bonus game by the mystery random determination, there is no need of changing the symbol arrays for changing the probabilities of random determination of the bonus game. In other words, by changing the probabilities of the mystery random determination, it is possible to change the probabilities of random determinations for the bonus game without a need of changing the arrangement of the symbols in the symbol arrays.

(Operations of Slot Machine: Free Game Running Process)

Figure 41:
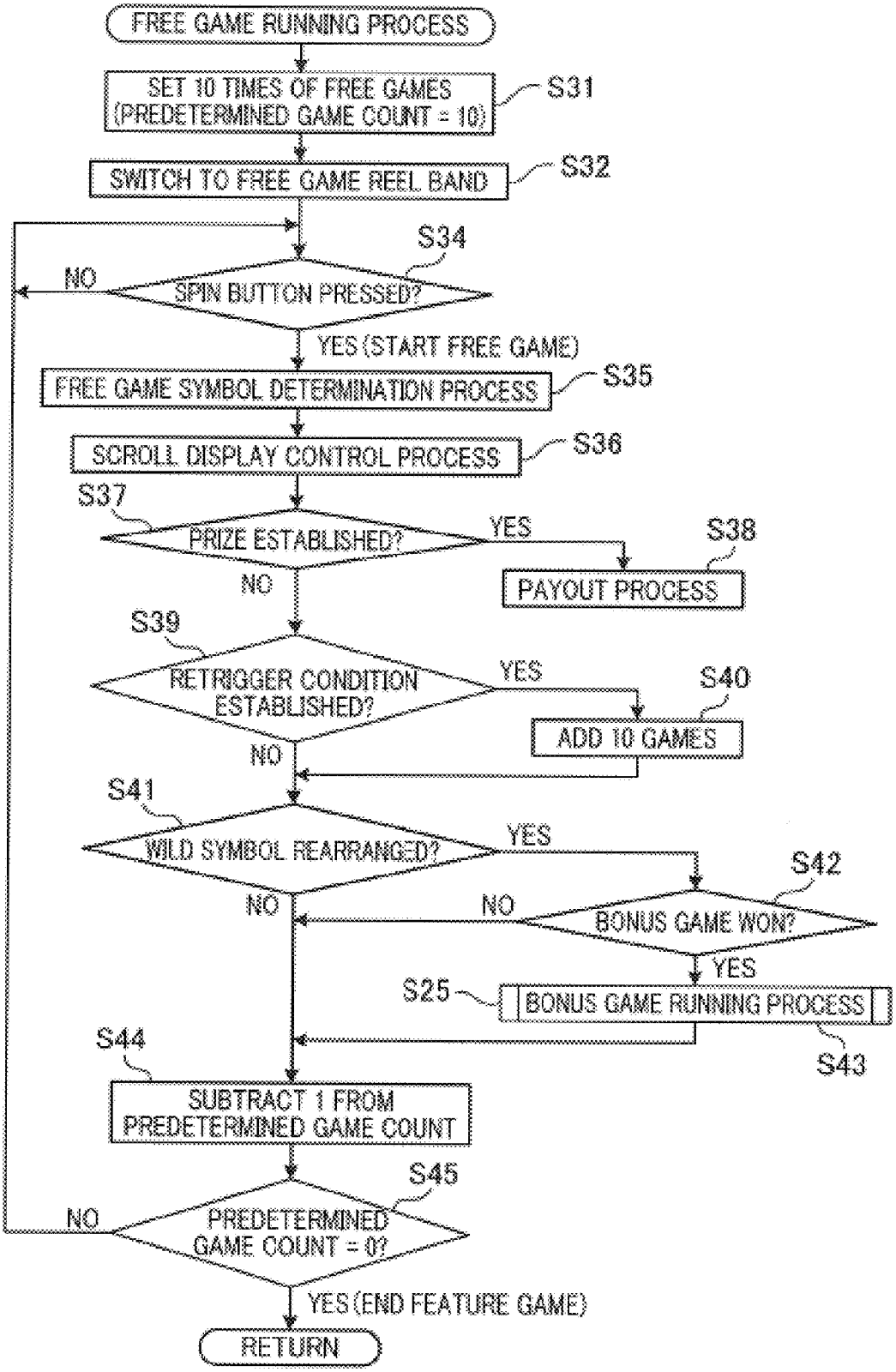
FIG. 41 is a flowchart of a free game running process.

As shown in FIG. 41, in the free game running process, 10 times of free games are first set. That is, the predetermined number of games=10 (S31). The reel bands are switched to those for the free game (S32). That is, the type of symbol bet in the normal game triggered the free game is determined, and the symbol arrays for the free game according to the type of symbol bet is selected.

Subsequently, whether the spin button 46 is pressed to be turned on is determined (S34). When the spin button 46 is not pressed (S34: NO), S34 is executed again. In the meanwhile, when the spin button 46 is pressed (S34: YES), after a free game symbol determination process is executed (S35), a scroll display control process is executed (S36). Then whether the re-trigger condition (free game addition condition) is established is determined (S37). When a prize is established (S37: YES), S39 is executed after the payout process (S38). In the meanwhile, when a prize is not established (S37: NO), S39 is executed.

In S39, whether the retrigger condition (free game addition condition) is established is determined (S39). When the retrigger condition is not established (S39: NO), 1 is subtracted from a predetermined number of times of execution of the game (S41). On the other hand, when the retrigger condition is established (S39: YES), 10 free games are added (S40).

When the free game is not triggered, or after the 10 free games are added, whether or not a wild symbol is rearranged is determined (S41). When the wild symbol is rearranged, the random determination for the bonus game is executed according to the number of wild symbols, and whether or not the bonus game is won is determined (S42). Then, if the bonus game is won, the bonus game is run (S43). In step S41, if the wild symbol is determined as not to be rearranged, or after the bonus game running process in step S43, 1 is subtracted from the predetermined number of games (S44).

Then whether the predetermined number of times of execution of the game is 0 is determined (S45). When the predetermined number of times of execution of the game is not 0 (S45: NO), it is determined that the free game is being executed, and the process is executed again from S34. On the other hand, when the predetermined number of times of execution of the game is 0 (S45: YES), it is determined that the feature game is finished, and the present routine is terminated.

(Operations of Slot Machine: Bonus Game Running Process)

Figure 42:
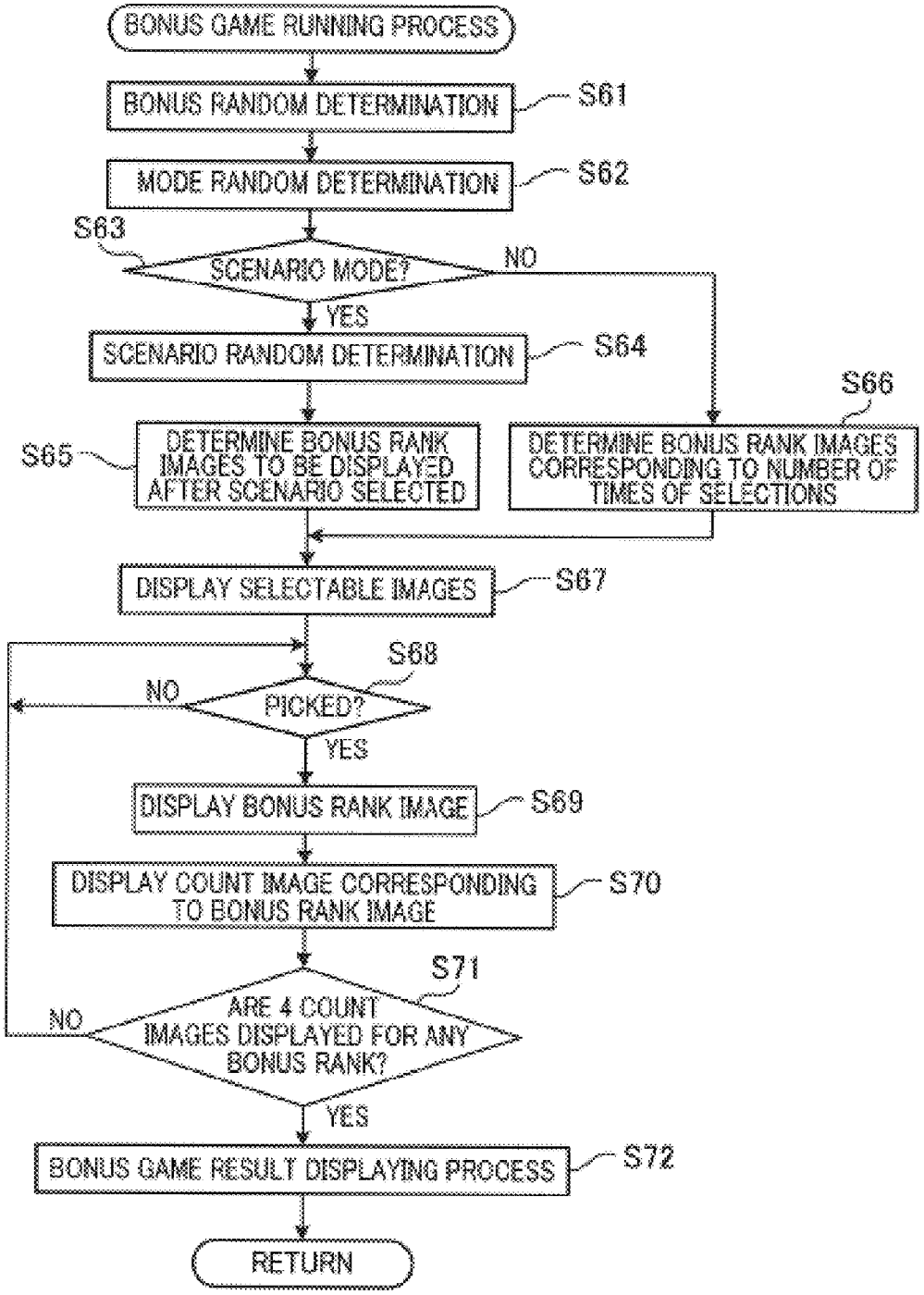
FIG. 42 is a flowchart of a bonus game running process.

As shown in FIG. 42, the bonus random determination (S61) is first executed in the bonus game running process, and the bonus to be awarded is determined. Then, the mode random determination is executed (S62). In the mode random determination, the scenario mode or the random mode is selected. Next, whether the mode determined in step S62 is the scenario mode is determined (S63). When the mode is the scenario mode (S63: YES), scenario random determination for selecting the scenario is executed (S64). Then, the bonus rank images to be displayed after the scenario selected are determined (S65). On the other hand, when the mode selected is not the scenario mode (S63: NO), the bonus rank image 1422 is randomly determined for each pick (first pick to fourth pick) (S66). In step S65 and S66, 14 bonus rank images 1422 (two Grand Rank images 1422*a*, two Major Rank images 1422*b*, 4 Minor Rank images 1422*c*, 4 Mini Rank images 1422*d*, 1 double bonus rank image 1422*e* of Grand Rank, 1 double bonus rank image 1422*f* of Major Rank) which could be displayed are associated with the first pick to the fourth pick. In step S65, the images are determined for the fifth pick and the picks thereafter, which exclude the first to pick and fourth pick for which the images are already determined by the scenario. It should be noted that the 14 bonus rank images 1422 are associated so that the image for the bonus rank determined in step S61 will be counted 4 before the other bonus ranks. Therefore, the actual number of picks by the player will be eleventh pick at the most.

In step S65 or after step S66, 14 selectable images 1421 are displayed, and the input of the player selection is waited (S67). There is determined whether or not a selection of the selectable image 1421 is input via the control panel 30 (S68). If there is no input, the step S68 is repeated. If there is an input, the selectable image 1421 picked is changed to the bonus rank image 1422 determined in step S65 or step S66 (S69). Then, a count image 1423*a* corresponding to the bonus rank image 1422 is displayed in the rank count region 1423 (S70). When the bonus rank image 1422 is the double bonus rank image 1422*e*, two count images 1423*a* are displayed. After that, there is determined if there is any bonus rank for which four count images 1423*a* have been displayed (S71). If there is no bonus rank for which four count images have been displayed, step S68 is repeated.

When all the bonus rank images 1422 are displayed, a bonus game result displaying process is executed (S72). Specifically, a frame image 1423*b* is displayed for the rank count region 1423 corresponding to the bonus won, and a bonus result 1450 is displayed. Then, the present routine is terminated.

(Display Screen: Normal Game Screen)

As shown in FIG. 24, above the symbol display region 150, a credit meter 400, a bet meter 401, a win meter 402, and a status indicator 419. The credit meter 400 and the bet meter 401 are displayed at the left end portion when viewed from the player. In the meanwhile, the win meter 402 is provided at the right end portion when viewed from the player. The status indicator 419 are provided in the middle portion.

The credit meter 400 displays the total amount of credits (remaining credit amount). The default value is 0. The value is increased and decreased as follows: When "take WIN", which indicates winning in a game, is achieved, the credit won in the game is added to the credit meter. When a game is played, the bet number is subtracted from the credit meter. The bet number is also subtracted when the collect ends. The positions of displaying the system font of the credit meter 400 are as follows. That is, the credit meter (Definition: F_CREDIT) is in a position where the x-coordinate is 98.0 and the y-coordinate is 45.0. Further, the credit amount (Definition: F_CREDIT_MONEY) is indicated in a position where the x-coordinate is 98.5 and the y-coordinate is 75.0. The TOKENIZE (Definition: F_TOKENIZE) is in a position where the x-coordinate is 105.5 and the y-coordinate is 97.0.

The bet meter 401 displays "Total Bets". When a bet is place for each of the activated lines, the total bet is a bet×the number of lines. The value is re-calculated in each game play. The positions of displaying the system font of the bet meter 401 are as follows. That is, the bet meter (Definition: F_WAGER) is in a position where the x-coordinate is 232.0 and the y-coordinate is 45.0. Further, the bet amount (Definition: F_WAGER_MONEY) is indicated in a position where the x-coordinate is 230.0 and the y-coordinate is 75.0.

The win meter 402 displays the total obtained credits in an increment manner. The default value is 0. The positions of displaying the system font of the win meter 402 are as follows. That is, the win meter (Definition:F_WIN) is displayed in a position where the x-coordinate is 673.0 and the y-coordinate is 45.0. Further, the amount won (Definition: F_WIN_MONEY) is indicated in a position where the x-coordinate is 673.0 and the y-coordinate is 108.0. Each win (Definition: F_SYS_LINE_NO) is indicated in a position where the x-coordinate is 673.0 and the y-coordinate is 71.0. The total win (Definition: F_SYS_LINE_TOTAL_WIN) is indicated in a position where the x-coordinate is 673.0 and the y-coordinate is 86.0.

For example, the indication on the win meter 402 is as follows, when a simple 3 of a kind combination occurs, without appearance of a double wild symbol 505*b* and the like. Namely, when the gourd symbol 503*d* is rearranged, one each, on the pseudo reels 151 to 153, there is an indication of "3 PICT_D=15", and "TOTAL WIN=15" is indicated as the total amount. Further, a value resulting from a multiplication of this total amount by the denomination is indicated.

Further, the indication on the win meter 402 is as follows, when a simple 3 of a kind combination occurs, with appearance of a double wild symbol 505*b*. Namely, when the gourd symbol 503*d* is rearranged, one each, on the pseudo reels 151 to 152 and the double wild symbol 505*b* is rearranged on the pseudo reel 153, there is an indication of "3 PICT_D×2WILD=30", and "TOTAL WIN=30" is indicated as the total amount. Further, a value resulting from a multiplication of this total amount by the denomination is indicated.

Further, the indication on the win meter 402 is as follows, when a 3 of a kind combination including the double wild symbol 505*b* and a simple 3 of a kind combination occur. Namely, when the fish symbol 503*c* is rearranged, one each, on the pseudo reels 151 to 153 and the double wild symbol 505*b* is rearranged on the pseudo reel 153, there are indications of "3 PICT_C=30" and "3 PICT_C×2 WILD=40", and "TOTAL WIN=60" is indicated as the total amount. Further, a value resulting from a multiplication of this total amount by the denomination is indicated.

Further, the indication on the win meter 402 is as follows, when a plurality of 3 of a kind combinations occur, with appearance of a double wild symbol 505*b*. Namely, when a "10" symbol, one pot symbol 503*b*, and one fish symbol 503*c* are rearranged on the pseudo reel 151, a normal wild symbol 505*a* and two fish symbols 503*c* on the pseudo reel 152, and the double wild symbol 505*b* on the pseudo reel 153, there are alternated indications of "3 PICT_B×2 WILD=50", "3 PICT_C×3×2 WILD=120", and "3 TEN×2 WILD=10", and "TOTAL WIN=180" is indicated as the total amount. Further, a value resulting from a multiplication of this total amount by the denomination is indicated.

Further, the indication on the win meter 402 is as follows, when a plurality of winning combinations higher than the 3 of a kind combination occur, with appearance of a double wild symbol 505*b*. Namely, when one pot symbol 503*b* and one bat symbol 503*e* are rearranged on the pseudo reel 151, one pot symbol 503*b* and two bat symbols 503*e* on the pseudo reel 152, one bat symbol 503*e* and the double wild symbol 505*b* on the pseudo reel 153, and one pot symbol 503*b* on the pseudo reel 154, there are alternated indications of details reading "4 PICT_B×2 WILD=120", "3 PICT_E×2=20", and "3 PICT_E×2 WILD=40", and "TOTAL WIN=180" is indicated as the total amount. Further, a value resulting from a multiplication of this total amount by the denomination is indicated.

The status indicator 419 indicates bet information of the current game, and the gaming status. The status indicator 419 has an area for indicating BET MULTIPLIER at the upper stage, and an area for indicating the gaming status at the lower stage. The bet information is the bet amount placed. For example, when the bet amount is 1, the indication will be "BET MULTIPLIER 1" and when the bet amount is 2, the indication will be "BET MULTIPLIER 2". The gaming status is hidden while the game is running for example. When the game is over, there will be an indication reading "GAME OVER", and while an input regarding whether to run a gamble game is waited, there will be an indication reading "PLAY ON, GAMBLE or TAKE WIN". The positions for indicating system font of the status indicator 419 are as follows. Namely, Bet Per Line (Definition: F#SYS#BET) is in a position where the x-coordinate is 442.0 and the y-coordinate is 550.0; Play Line (Definition: F#SYS#LINE) is in a position where the x-coordinate is 442.0 and the y-coordinate is 564.0.

Specifically, immediately after the RAM is cleared, the bet information area of the status indicator 419 indicates "BET MULTIPLIER n" (where n is the set minimum value of the bet pattern). After pressing "BET× XX", the indication will be "BET MULTIPLIER n" with the value of n changed for each pressing of the bet button. In other cases, the immediately preceding display content is kept displayed.

Further, immediately after the RAM is cleared, the gaming status area of the status indicator 419 indicates "GAME OVER". Further, when the spin button 46 is pressed, the indication is hidden while the reels are scrolling, and the indication will be "GAME OVER" in the other occasions. When the state is WIN and GAMBLE is enabled, the indication will be "PLAY ON, GAMBLE or TAKE WIN" immediately after the reels are stopped, and the indication will be "GAME OVER" in other occasions. The indication will be hidden when the bonus game is triggered. When the status is WIN and GAMBLE is enabled, the indication will be "PLAY ON, GAMBLE or TAKE WIN" immediately after bonus game ends, and the indication will be "GAME OVER" in other occasions. Immediately after the end of the jackpot, the indication will be "GAME OVER". When the state is WIN and GAMBLE is enabled, the indication will be "PLAY ON, GAMBLE or TAKE WIN" when the help button is pressed and the help screen is displayed, and the indication will be "GAME OVER" in other occasions. When the help button is pressed to return to the game screen, the state before the help screen is displayed comes back. After the BET× XX is pressed and at the time of TAKE WIN, "GAME OVER" is indicated.

In the meanwhile, below the symbol display region 150 are provided a game rule button 416, a payout table button 415, and an audio button 414, and a denomination button 413. These buttons 413, 414, 415, and 416 are arranged from the right end to the left end when viewed from the player. Further, above the game rule button 416 are displayed time indicator 417 indicating the current time.

The denomination button 413 displays the current denomination set in the AUDIT. This button is displayed when screens other than the AUDIT are displayed. The audio button 414 is used for adjusting the audio volume output from the slot machine 10. As shown in FIG. 24, there are three levels in the audio volume, and the volume is successively switched every time the button is touched (minimum volume (30%)→medium volume (70%)→maximum volume (100%)→minimum volume→ . . . ). The default setting is the minimum volume. Further, after the game is booted, and when the AUDIT screen (setting screen) is hidden, the audio volume is reset to the default setting. It should be noted that, while the help screen is displayed, the audio button 414 is hidden. Therefore, the volume cannot be changed. However, the button is active in other occasions. An operation invalidating period of the audio button 414 is set to 0.15 seconds (150 msec) from the pressing of the button. The default sound volume setting value in the AUDIT is 12. The value is 5 when there is no sound volume adjustment touch panel. The volume of VOL setting changing sound in the AUDIT is set to the default of the audio button 414 (the volume reflecting the figure of minimum volume (30%)). The payout table button 415, upon being touched, displays the payout table in the help pages. The game rule button 416, upon being touched, displays the first page of the help pages. It should be noted that the game rule button 416 is inactive and is grayed out, while the reels are rotating and the like.

On both sides of the symbol display region 150, a logo 418 indicating that there is no limitation by paylines (i.e., every way).

(Display Screen: Help Screen)

Figure 43:
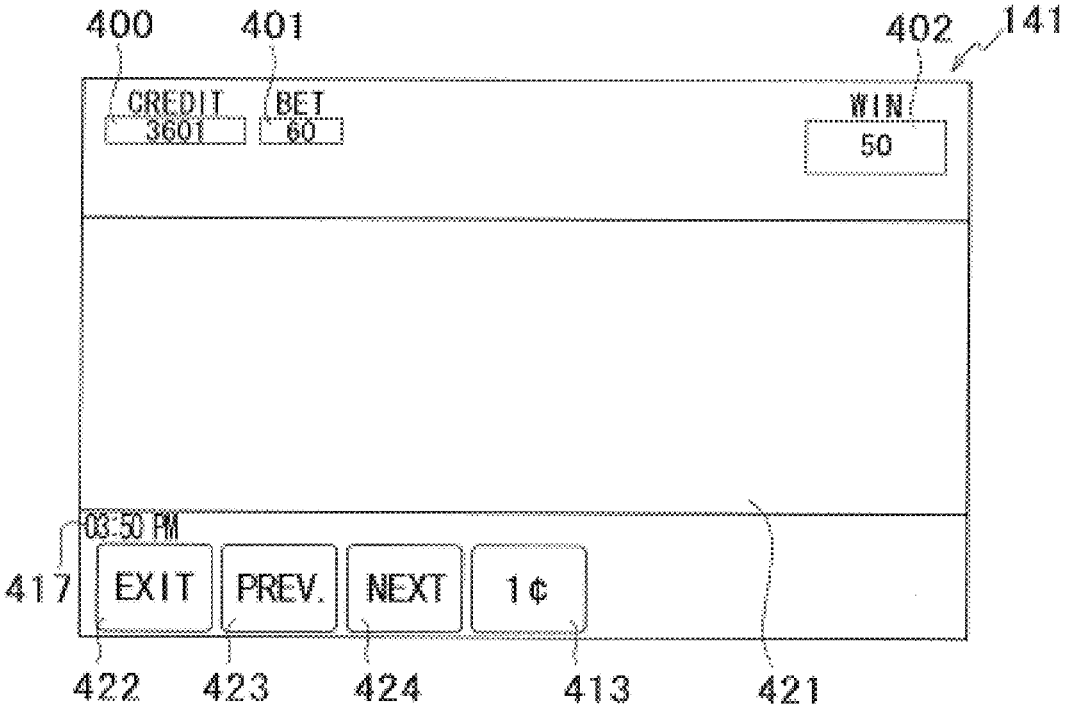
FIG. 43 is an explanatory diagram showing a help screen.

The following describes the help screen displayed by touching the game rule button 416 or the payout table button 415. As shown in FIG. 43, the help screen has a help display region 421 in the middle portion of the lower image display panel 141. Below the help display region 421 are displayed an EXIT touch button 422 for closing the help screen and returning to the normal game screen, a PREV touch button 423 for causing the help display region 421 to go 1 page back, a NEXT touch button 424 for causing the help display region 421 to go 1 page forward, a denomination button 413 similar to that described hereinabove, and a time indicator 417 similar to the one described hereinabove.

In the help display region 421 of the help screen, the following contents are displayed. The first page shows "●Select bet multiplier. ●Select number of credits to play to start the game. ●All wins left to right in any position only. ●Each symbol appearing on a reel is counted once per winning combination. ●All wins shown in credits, except progressives. ●Highest win only on each way. ●All wins are multiplied by bet multiplier except scatters. ●All wins are multiplied by bet multiplier except scatters. ●Wins on different ways are added. ●Scatter wins are added to EVERY WAY wins. ●Malfunction voids all pays and plays. ●The player is responsible for checking that correct credit has been registered before commencing play."

The second page shows "INCREASED SYMBOLS PER PLAY Different reels are used according to the selected number of credits played as displayed below. PLAY 60 CREDITS Reels have an increased number of [BAT], [GOURD], [FISH], [JAR] and [DRAGON]. PLAY 30 CREDITS Reels have an increased number of [BAT], [GOURD], [FISH] and [JAR]. PLAY 15 CREDITS Reels have an increased number of [BAT], [GOURD] and [FISH]. PLAY 5 CREDITS Reels have an increased number of [BAT] and [GOURD]. PLAY 1 CREDIT NORMAL REELS The increase in the number of each symbol is respective to the number of each symbol on normal reels.

The third page shows "EVERY WAY ●EVERY WAY provides for 243 ways to win. ●EVERY WAY wins are the winning combinations that appear left to right in any position. ●Only one symbol from each reel comprises each winning combination. The increase in the number of each symbol is respective to the number of each symbol on normal reels."

The fourth page shows "FREE GAMES free game ●3 or more [FEATURE], [WILD] or [×2WILD] appearing left to right trigger 10 FREE GAMES. ●Different reels are used during the FREE GAMES. ●FREE GAMES can be triggered again during the FREE GAMES. ●Credits bet and increased symbols played during the FREE GAMES are the same as the game that triggered the FREE GAMES."

The fifth page shows the payout table shown in the first payout Table 1431 of FIG. 25, and further shows "PAY-TABLE SUBSTITUTES [WILD] substitutes for all symbols except [×2WILD]. [WILD] appears on reels 2 and 4 only. [×2WILD] substitutes for all symbols. If [×2WILD] substitutes in a win the pay for that win is doubled. [WILD] appears on reels 3 and 4 only. 招財進寶" written in combined form on [WILD] and [×2WILD] means "Bringing fortune and treasure. SCATTER CREDIT"

The sixth page shows the payout table shown in the second payout 1432 in FIG. 25, and further shows "PROGRESSIVE FEATURE ●There is a chance the PROGRESSIVE FEATURE may be triggered when [WILD] or [×2WILD] appear. ●IN the PROGRESSIVE FEATURE, 4 types of dragons are hidden behind 12 coins. ●Select a coin until 3 matching dragons corresponding to a PROGRESSIVE are revealed. ●When 3 matching dragons have been revealed, the corresponding PROGRESSIVE is won and the feature ends. ●PROGRESSIVE award amounts for each bet condition are displayed on the top screen. ●The chances of revealing each dragon are not equal. ●All wins cannot be gambled if the PROGRESSIVE is won, even if gamble game is available. DRAGONS/PROGRESSIVE [RED DRAGON]/GRAND PROGRESSIVE [PURPLE DRAGON]/MAJOR PROGRESSIVE [GREEN DRAGON]/MINOR PROGRESSIVE [BLUE DRAGON]/MINI PROGRESSIVE".

The eighth page shows "●PLAY 0000 TO 0000 CREDITS ●ALL WINS PAID BY MACHINE OR ATTENDANT".

As should be seen, the help screen shows the payout tables indicating all the winning combinations, and describes basic rules, win lines, features (bonus game, free game, and the like), the range of bet amount, and the like. The payout tables are shown in the descending order from the highest payout. Further, regarding the basic rules, how the games are played, and the basic plays as the gamble game are described. As the win line, adoption of the every way mode having no limitation by the paylines is described. As the feature, a plurality of features are described in separate pages. When a different payout table from that of the normal game is adopted in the feature, the payout table is shown after the description of the rules of the feature. Further, if there is a feature unique to the game such as High, POWER, Max, Bet, Special, and the like, the rules for the feature is described. As the bet amount, a range of bettable amount in the game is indicated.

The following describes a process related to the help screen. When the game rule button 33 is pressed while the game rule button 33 is active, only the lower image display panel 141 switches to the help screen, while the basic screen on the upper image display panel 142 remains in the idling state. While an error takes place or during AUDIT, the LED of the game rule button 33 is turned off, and the game rule button 33 is turned inactive. On the help screen, the following process takes place. When an error or door open occurs, the help screen is hidden (i.e., the game screen is reinstated) and ERROR/DOOR OPEN is displayed. When a bill or a coin is inserted, the help screen is hidden and the credit is received. When an AUDIT key is rotated, the help screen is hidden and AUDIT is displayed. After that, when the idling state occurs if AUDIT is hidden. After power interruption, the help screen is not displayed when the power is turned on and the machine becomes in the idle state. If 3 minutes elapses without any input while the help screen is displayed, the help screen is closed.

(Display Screen: Win Effect Screen)

Figure 44:
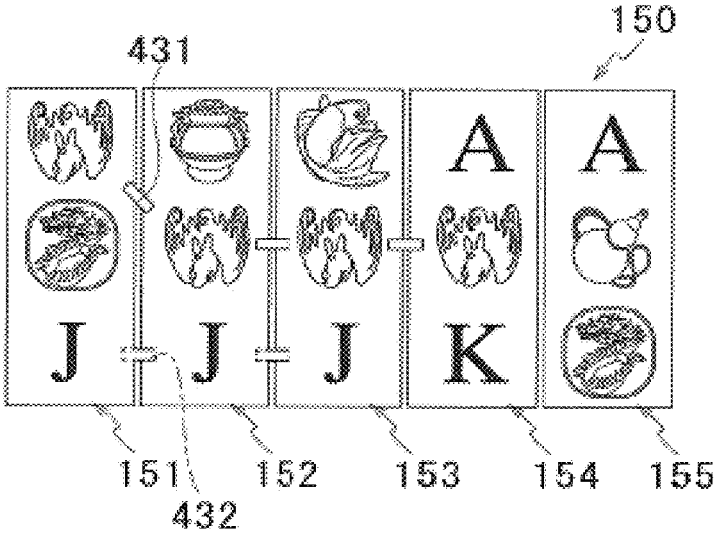
FIG. 44 is an explanatory diagram of a win effect screen.
Figure 45:
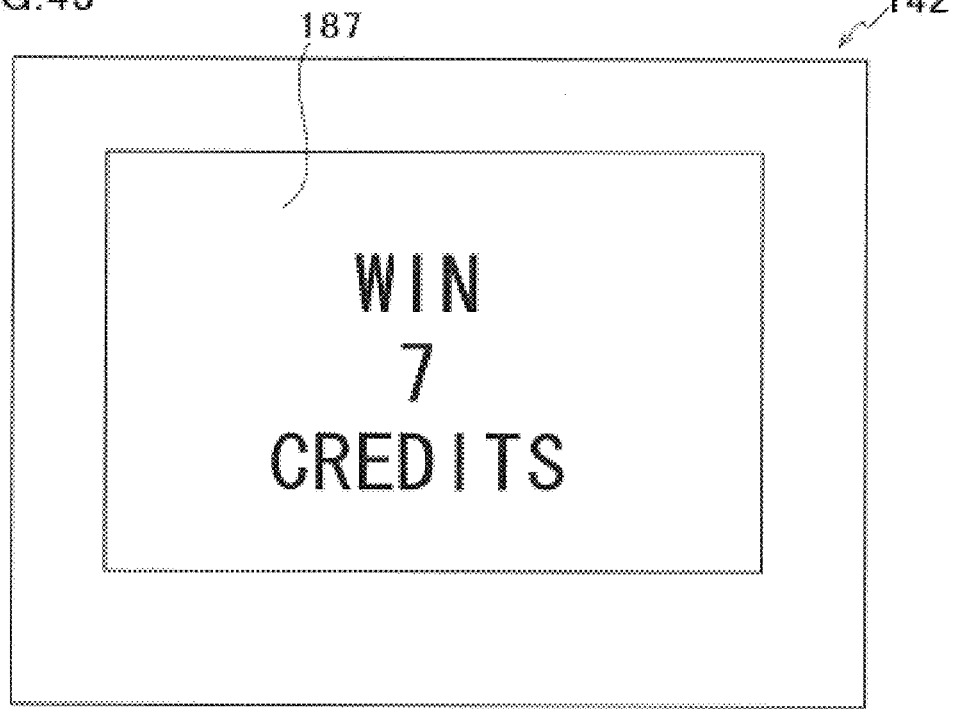
FIG. 45 is an explanatory diagram of a win effect screen.

When a winning occurs in the normal game or in the free game, the following effect display is performed. As shown in FIG. 44, when two line winnings occur in the symbol display region 150 of the lower image display panel 141, the winning combinations established are indicated by line indications 431 and 432. The line indications 431 and 432 are alternated. At this time, on the upper image display panel 142, a win image 187 such as the one with text reading "WIN 7 CREDITS" as shown in FIG. 45 is displayed. In the win image 187, incrementing of the credit by the credit won is displayed (linked to the win meter 402 of the lower image display panel 141). It is possible to use a plurality of types of win images 187. For example, it is possible to use different types of win images 187 for a case where the total amount won is less than ×25 of the bet amount, or a case where the total amount won is ×25 or more but less than ×50 of the bet amount, and a case where the total amount won is ×50 or more of the bet amount. Further, when the total amount won is ×20 or more of the bet amount, there may be a period equivalent to 20 frames between the point of stopping all the pseudo reels 151 to 155 and displaying of the win effect screen.

The increment speed is such that, 24 ranks of credit won (winnings) are identified, and the increment speed is set for each rank. Further, a win sound associated with the increment speed is used. Specifically, as shown in FIG. 46, the increment speed is determined for each win which is variable depending on the total bet amount. That is, for each of win_1 to win_22, the speed for 1 increment is the result of dividing the credit won by the assigned seconds. This way, the increment is completed at a certain number of seconds. Further, for win_23 to win_24, the increment is carried out so that the credits are incremented by a ½ of the total bet amount in 1 second, until the amount of credit reaches ×20 of the bet amount. When the amount of incremented amount reaches the ×20 of the bet amount, the speed for 1 increment is the result of dividing the credit won by the remaining number of seconds. This way, the increment is completed at a certain number of seconds.

Further, when three or more trigger symbols 504 are rearranged, an audio effect is provided. Specifically, upon elapse of 20 frames from the point where all the pseudo reels 151 to 155 stop, a sound "jilililili . . . " (bell ring like sound) is reproduced. After that, the above described win effect screen is displayed.

(Details of Display Screen: Win Meter 402)

Figure 47:
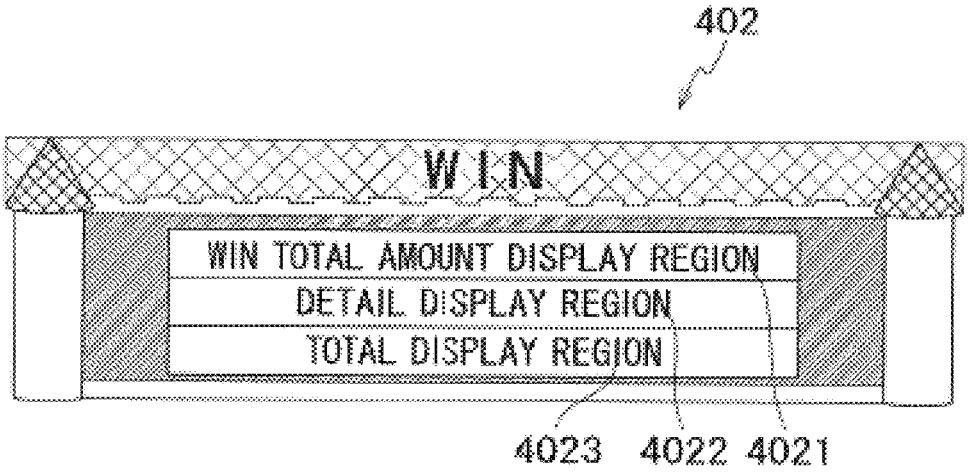
FIG. 47 is an explanatory diagram of a win meter.

As shown in FIG. 47, the win meter 402 displays an obtained credit and the details thereof in an integrated meter, when a winning is achieved. The win meter 402 includes a WIN total amount display region 4021, a detail display region 4022, and a total display region 4023.

(Details of Display Screen: Win Meter 402: WIN Totally Amount Display Region 4021)

The WIN total amount display region 4021 displays the obtained credit and money. Details of the image displays will be given below. In the idle state, the total amount of winning displayed is "0" immediately after the winning, and "0" is continuously displayed thereafter. When the spin button 46 is pressed, "0" is displayed. The increment display is executed during the WIN increment. "0" is displayed during a bonus pick trigger (because no winning is achieved during the trigger).

At the introduction of the free game, the total amount of immediately preceding winning is displayed. The total amount of immediately preceding winning is displayed during the rotation of the reels in the free game. At the moment immediately after the rotation of the reels and immediately after the winning in the free game, the winning achieved in the free game is added to the total amount of the preceding winning, and the increment display is carried out. In other cases, the total amount of the winning in the immediately preceding game is displayed. At the introduction of a bonus, the total amount of the immediately preceding winning is displayed. Immediately after the end of the bonus, the credits obtained in a bonus or jackpot are added to the total amount of immediately preceding winning, and the increment display is carried out.

For example, credit display such as "12345678" is displayed on the upper stage, and money display such as "$123, 456, 78" is displayed in the lower stage.

(Details of Display Screen: Win Meter 402: Detail Display Region 4022)

The detail display region 4022 displays the number of the winning line and the WIN credit after the stop of the fifth reel, when winning is achieved in the normal game or the free game. When more than one line payout simultaneously occurs, the line payouts are displayed one by one at intervals of 0.5 second. The line payouts are serially displayed from the winning line having the smallest number, and the one having the smallest number is displayed again after the one having the largest number is displayed. The detail display region 4022 displays a text string "bonus WIN" and WIN credits in case of winning with a bonus and credit payout. Furthermore, the detail display region 4022 displays a text string "jackpot WIN" and WIN credits in case of obtaining a bonus in the jackpot.

Details of the image displays will be given below. In case of immediately after a normal winning in the idle state, the detail of the payout is displayed. When there are more than one payout, the details of the payouts are switched at intervals of 0.5 second. Nothing is displayed in other cases. Nothing is displayed when the spin button 46 is pressed. Detail of the payout is displayed during the WIN increment. When there are more than one WIN increment, the WIN increments are switched at intervals of 0.5 second. Nothing is displayed at the time of a bonus pick trigger. Furthermore, nothing is displayed at the time of the introduction of a free game. Furthermore, nothing is displayed during the rotation of the reels in a free game. When a line winning exists immediately after the stop of the reels in a free game, the detail of the payout is displayed. When there are more than one payout, the details of the payouts are switched at intervals of 0.5 second. Nothing is displayed in other cases.

Nothing is displayed at the time of the introduction of a bonus. When a bonus (excluding jackpot) exists immediately after the end of the bonus, a bonus WIN is displayed, and a jackpot WIN is displayed when the jackpot is achieved. The bonus WIN is displayed immediately after achieving a credit payout. Nothing is displayed at the end of a bonus game (i.e., when returning to the game screen).

An example of the displayed image is "line symbol WIN=12345678". This image display indicates a winning in a normal game or in a free game. An example of the displayed image for winning by the trigger symbol is "FEATURE WIN=12345678".

(Details of Display Screen: Win Meter 402: Total Display Region 4023)

The total display region 4023 displays the sum total of the amounts in the detail display region. Details of the image displays will be given below. The total winning is displayed in case of immediately after a normal winning in the idle state. Nothing is displayed in other cases. Nothing is displayed when the spin button 46 is pressed. The total winning is displayed during the WIN increment. Nothing is displayed at the time of a bonus pick trigger. Furthermore, nothing is displayed at the time of the introduction of a free game. Furthermore, nothing is displayed during the rotation of the reels in a free game. When a line winning exists immediately after the stop of the rotation of the reels in a free game, the total winning is displayed. Nothing is displayed in other cases. Nothing is displayed at the time of the introduction of a bonus. The total winning is displayed immediately after the end of a bonus. The total winning is displayed immediately after winning a credit payout. Nothing is displayed at the end of a bonus game (i.e., when returning to the game screen). An example of the displayed image is "total WIN=12345678".

(Control Panel 30)

Figure 48:
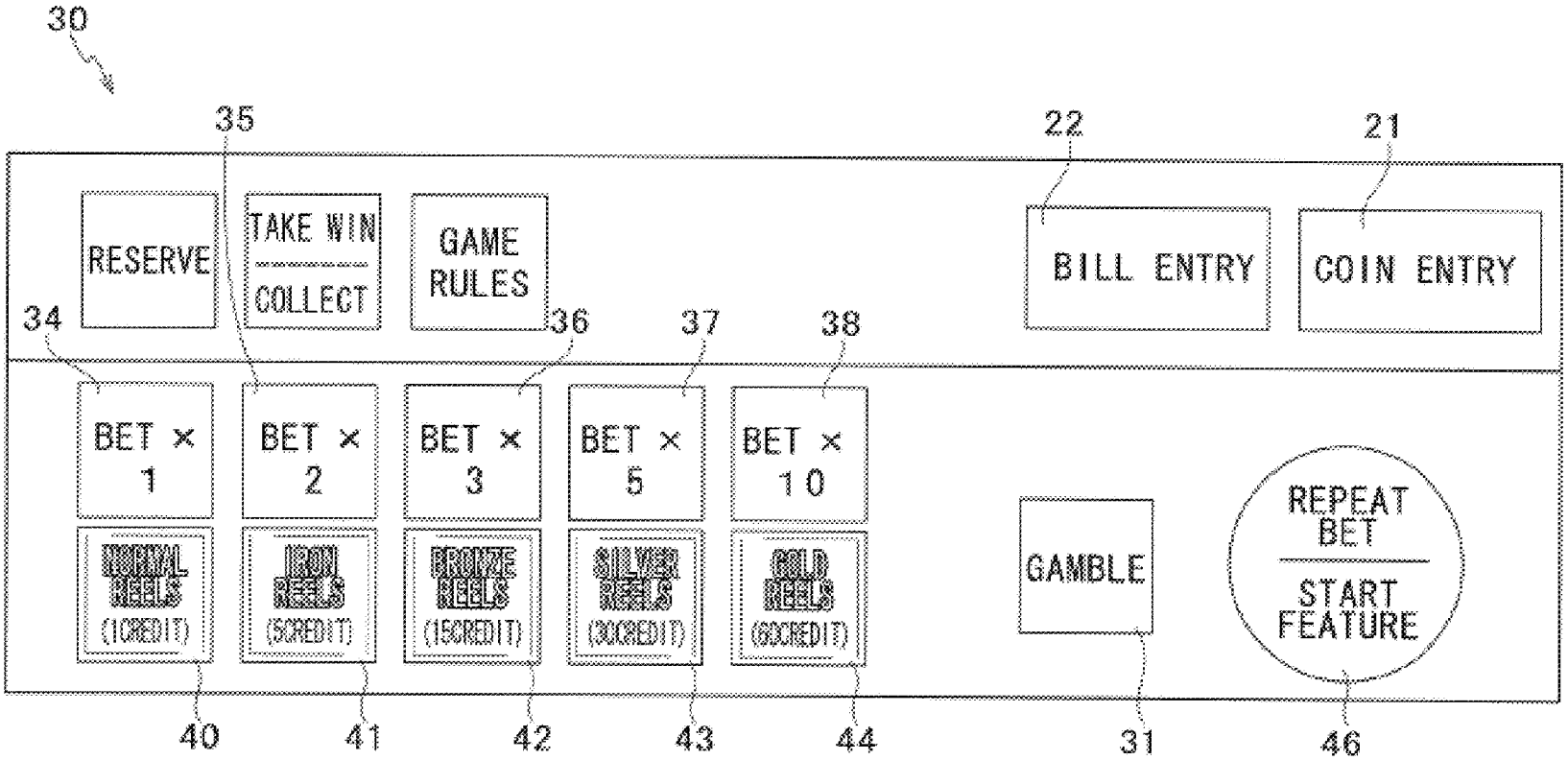
FIG. 48 is an explanatory diagram of a control panel.

Below the lower image display panel 141, as shown in FIG. 48, a control panel 30 is provided. The control panel 30 is provided with buttons, a coin entry 21 for inserting coins into the cabinet 11, and a bill entry 22.

Specifically, the control panel 30 has a take-win/collect button 32, the reserve button 45, and the game rule button 33 ([GAME RULES] button) on the left side area of its upper stage, and a 1-bet button 34, a 2-bet button 35, a 3-bet button 36, a 5-bet button 37, a 10-bet button 38 on the left side area of its central stage. Furthermore, on the control panel 30, a play-1 credit button 40, a play-5 credit button 41, a play-15 credit button 42, a play-30 credit button 43, and a play-60 credit button 44 are provided in the lower stage of the left area. The control panel 30 has the gamble button 31 and the spin button (repeat bet/start feature button) 46 in the lower right side area.

Further, as shown in FIG. 48, a name labels are provided to the credit buttons 40 to 44. Specifically, the play-1 credit button 40 is labeled "NORMAL REELS", and is colored in white. Further, the play-5 credit button 41 is labeled "IRON REELS", and is colored in gray. Further, the play-15 credit button 42 is labeled "BRONZE REELS", and is colored in bronze. Further, the play-30 credit button 43 is labeled "SILVER REELS", and is colored in silver. Further, the play-60 credit button 44 is labeled "GOLD REELS", and is colored in gold. When these credit buttons 40 to 44 are operated, the external appearance of the credit buttons 40 to 44 are displayed on the lower image display panel 141.

Figure 49:
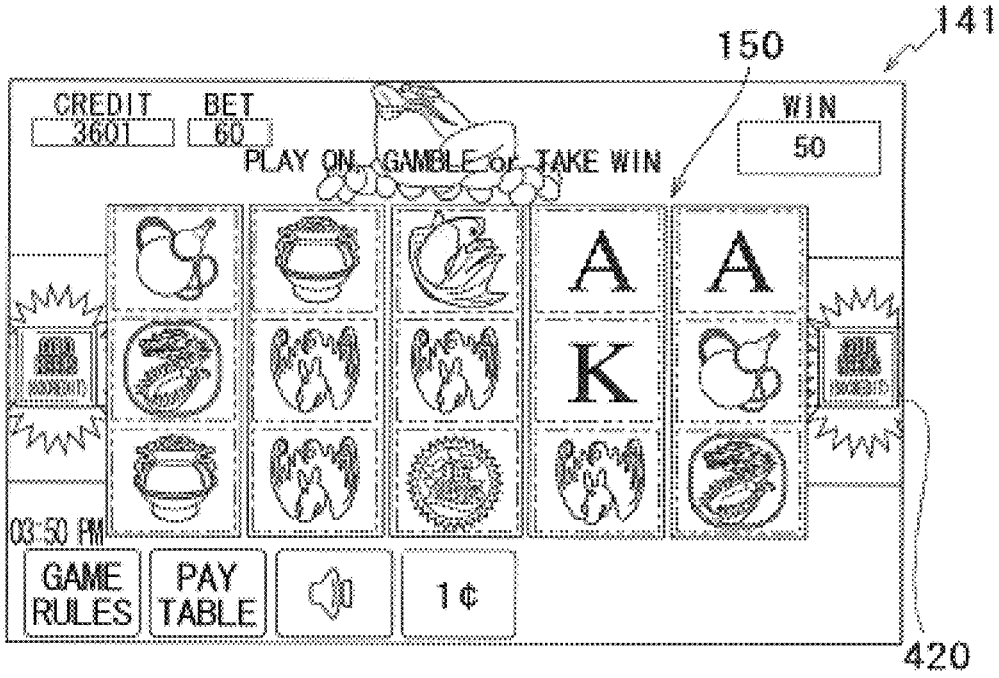
FIG. 49 is an explanatory diagram showing an example display screen on a lower image display panel.

Specifically, when a game started, selecting any of the credit buttons 40 to 44 as the symbol bet, a button image 420 having the external appearance of the credit button corresponding to the selected symbol bet is displayed in the areas (on both sides of the symbol display region 150) of the lower image display panel 141 where the logo 418 (see FIG. 24) is arranged, as shown in FIG. 49. FIG. 49 shows an example case where the play-60 credit button 44 as the symbol bet is operated, and the button image 420 of "GOLD REELS" is displayed.

The control panel 30 makes it possible to conduct selections in the same manner as those by the touch panel, on various types of selection screens. For example, the cursor is moved leftward as the 1-BET button 34 is touched, and the cursor is moved rightward as the 10-BET button 38 is touched. When the operation is carried out, the light source in each button is preferably turned on.

Figure 50:
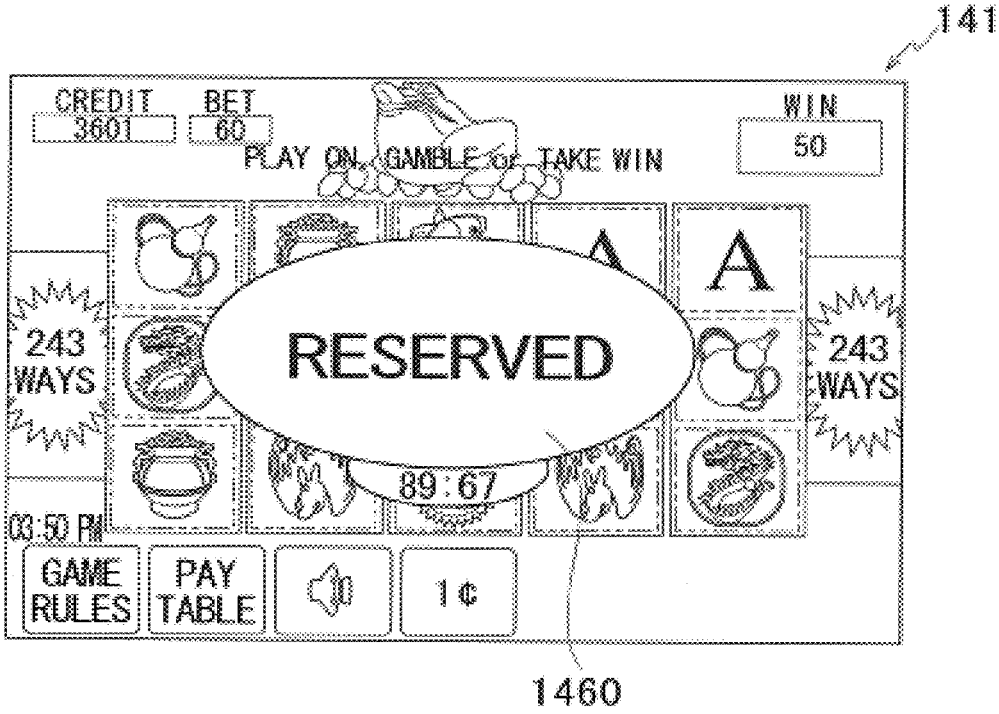
FIG. 50 is an explanatory diagram showing an example display screen on a lower image display panel.

The reserve button 45 is used when a player leaves the machine or when the player asks a staff person of the gaming facility to exchange money. When the reserve button 45 is pressed, a reserve symbol 1460 counting down 3 minutes is displayed on the lower image display panel 141, as shown in FIG. 50, and a 3 minute standby period is started. It should be noted that the reserve button 45 is active when the status is Game Over. Further, the reserve button 45 is turned off and inactive, while the reels are spinning, during an win increment (not Game Over state), while the help screen is displayed, when an error takes place, while an effect screen that can be cancelled is displayed, and during RS accounting. Reserve symbol 1460 disappears after elapse of 3 minutes, or when the reserve button 45 is pressed while the reserve symbol 1460 is displayed. The gamble button 31 is an operation button used for, for example, shifting to the gamble game after the end of the bonus game or the like. The gamble game is a game played with the consumption of an obtained credit. The take-win/collect button 32 is a so-called settlement button by which credit data concerning credits obtained in games is added to the credit data stored in an IC card inserted into the PTS terminal 700. The game rule button 33 is pressed when, for example, it is unclear how to play a game. As the game rule button 33 is pressed, various help information is displayed on a later-described effect mechanism 131 and lower image display panel 141.

Each time the 1-BET button 34 is pressed, one of the credits currently owned by the player is bet on each active line. The 2-BET button 35 is used to start a game with two credits bet on each active line. The 3-BET button 36 is used to start a game with three credits bet on each active line. The 5-BET button 37 is used to start a game with five credits bet on each active line. The 10-BET button 38 is used to start a game with ten credits bet on each active line. As such, the bet amount on each active line determined by pressing the 1-BET button 34, the 2-BET button 35, the 3-BET button 36, the 5-BET button 37, and the 10-BET button 38. It should be noted that the designs of the buttons for betting may be modified according to the modification of the bet amount that can be bet. For example, it is possible to provide bet buttons which enable betting of credits "1", "2", "3", "4", and "5". In this case, the designs of the bet buttons may be "BET×1", "BET×2", "BET×3", "BET×4", and "BET×5", respectively. Further, for example, it is possible to provide bet buttons which enables betting of credits "1", "2", "5", "10", and "15". In this case, the designs of the bet buttons may be "BET×1", "BET×2", "BET×5", "BET×10", and "BET×15", respectively. Further, for example, it is possible to provide bet buttons which enables betting of credits "1", "2", "5", "10", and "20". In this case, the designs of the bet buttons may be "BET×1", "BET×2", "BET×5", "BET×10", and "BET×20", respectively.

The spin button 46 is a button used for starting the scroll of the symbol array having the symbols 501. It is for starting the spin with the similar bet. This spin button 46 also functions as a button for starting a bonus game and for adding a payout awarded in a bonus game to the credits. It should be noted that, if game start with the same betting conditions as the previous game (bet amount, activated line number) is possible by the spin button 46, the design of the spin button 46 may be "REPEAT BET".

The coin entry 21 is used for receiving coins into the cabinet 11. The bill entry 22 validate bills and receives genuine bills into the cabinet 11.

(Operations of Slot Machine 10: Gamble Game)

Figure 51:
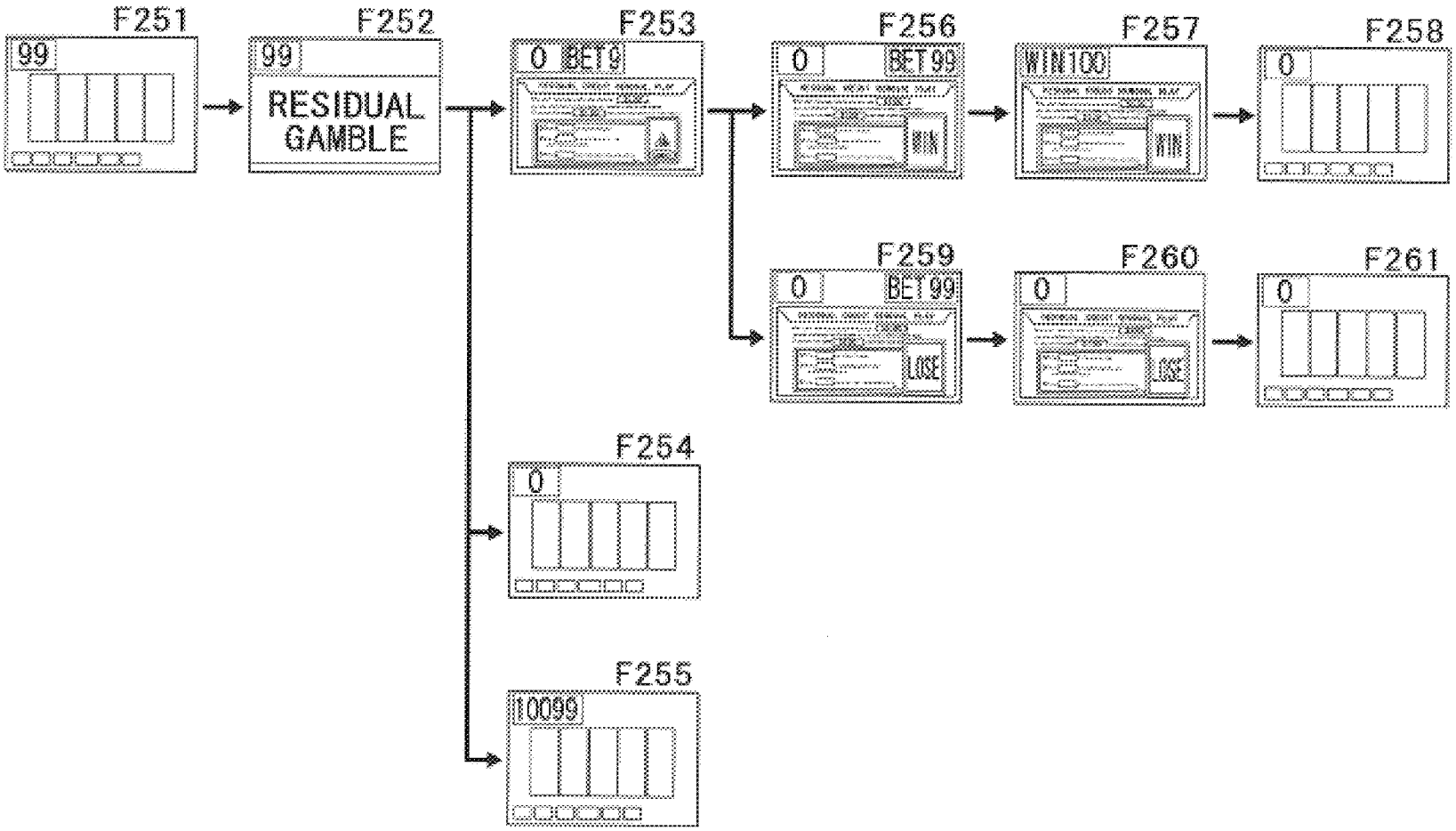
FIG. 51 is a flowchart of a gamble game running process.

As shown in FIG. 51, when the money is lower than the processable value such as one dollar, a "RESIDUAL GAMBLE" screen is displayed if a gamble start condition such as the pressing of a collect button is satisfied (F253). When the gamble button is pressed, Gamble starts. On the other hand, when the collect button is pressed, Call Attendant is displayed (F254). When the spin button 46 is pressed, the screen of the normal game comes back (F255).

When "WIN" is achieved in Gamble (F256), a predetermined amount of money such as one cent is awarded and a token is paid out through the hopper. In addition to the above, the addition to the credit meter is executed (F257). Thereafter, after a predetermined time such as two seconds elapses, the screen of the normal game comes back (F258). On the other hand, when "LOSE" appears in Gamble (F259), a LOSE screen is displayed (F260). Thereafter, after a predetermined time such as two seconds elapses, the screen of the normal game comes back (F261).

The roles of the buttons in the progress of the gamble game will be described. In the take-win/collect button 32, GAMBLE ON corresponds to "TAKE WIN" and GAMBLE OFF corresponds to "TAKE WIN". In the gamble button 31, GAMBLE ON corresponds to "Gamble Start" and GAMBLE OFF corresponds to "-". In the BET button, GAMBLE ON corresponds to "Invalidated" and GAMBLE OFF corresponds to "Gamble Start". In the spin button 46, GAMBLE ON corresponds to "To Normal Game" and GAMBLE OFF corresponds to "To Normal Game".

Figure 52:
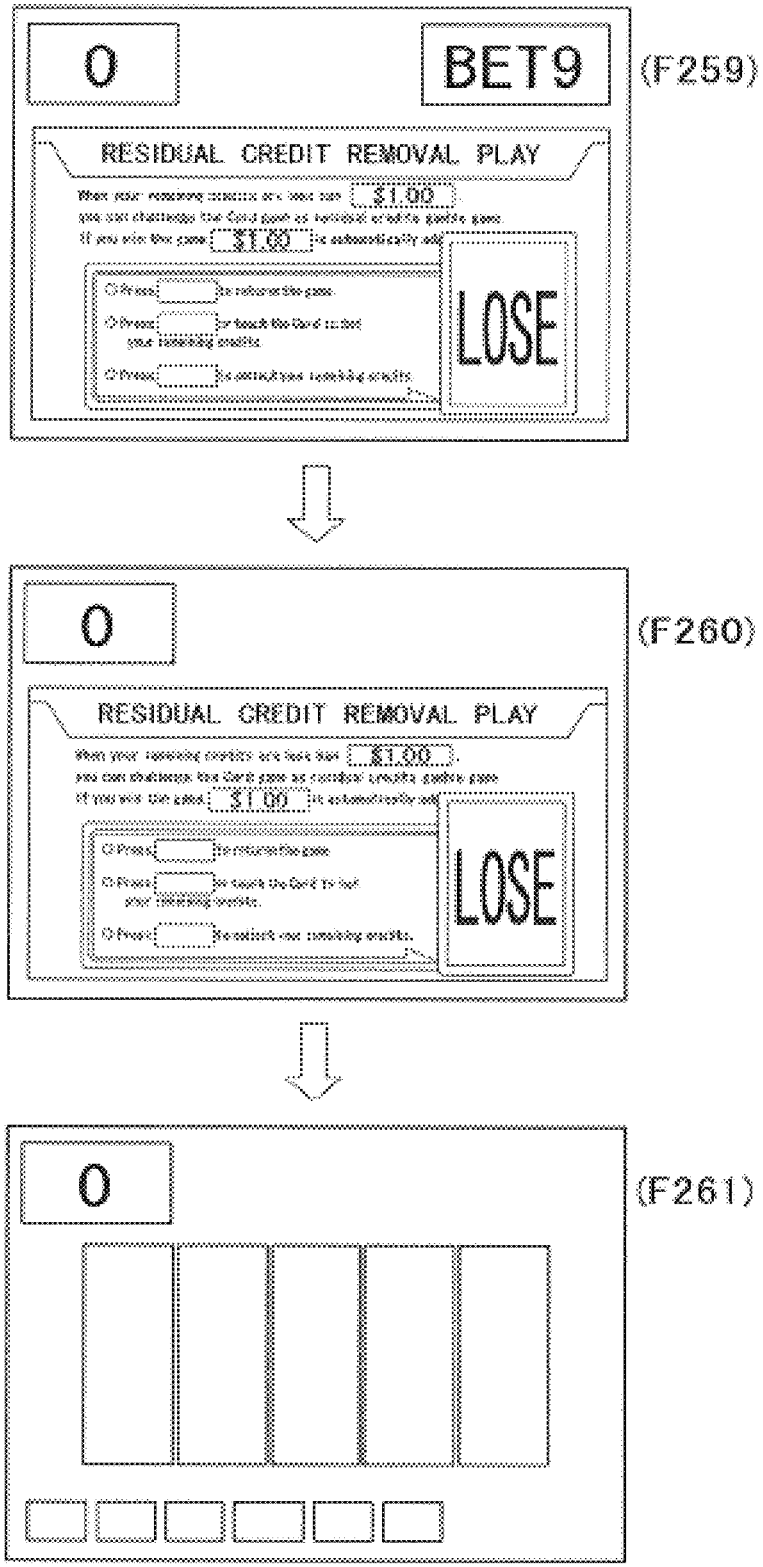
FIG. 52 is an explanatory diagram of screens in a gamble game.

As shown in FIG. 52, the "RESIDUAL GAMBLE" screen has a card display area, a navigation area, and a meter area. In the card area is displayed a card image. The entirety of the card area has a touch sensor function. On the navigation area, various navigation texts are displayed.

The limit of the value winnable in Gamble is set in the AUDIT. The maximum number of times of Gamble is also set in the AUDIT. For example, the maximum number of times is set at five and the number of times of Gamble is set so as to be five or lower. Whether the touch panel can be used is switchable in some countries.

Figure 53:
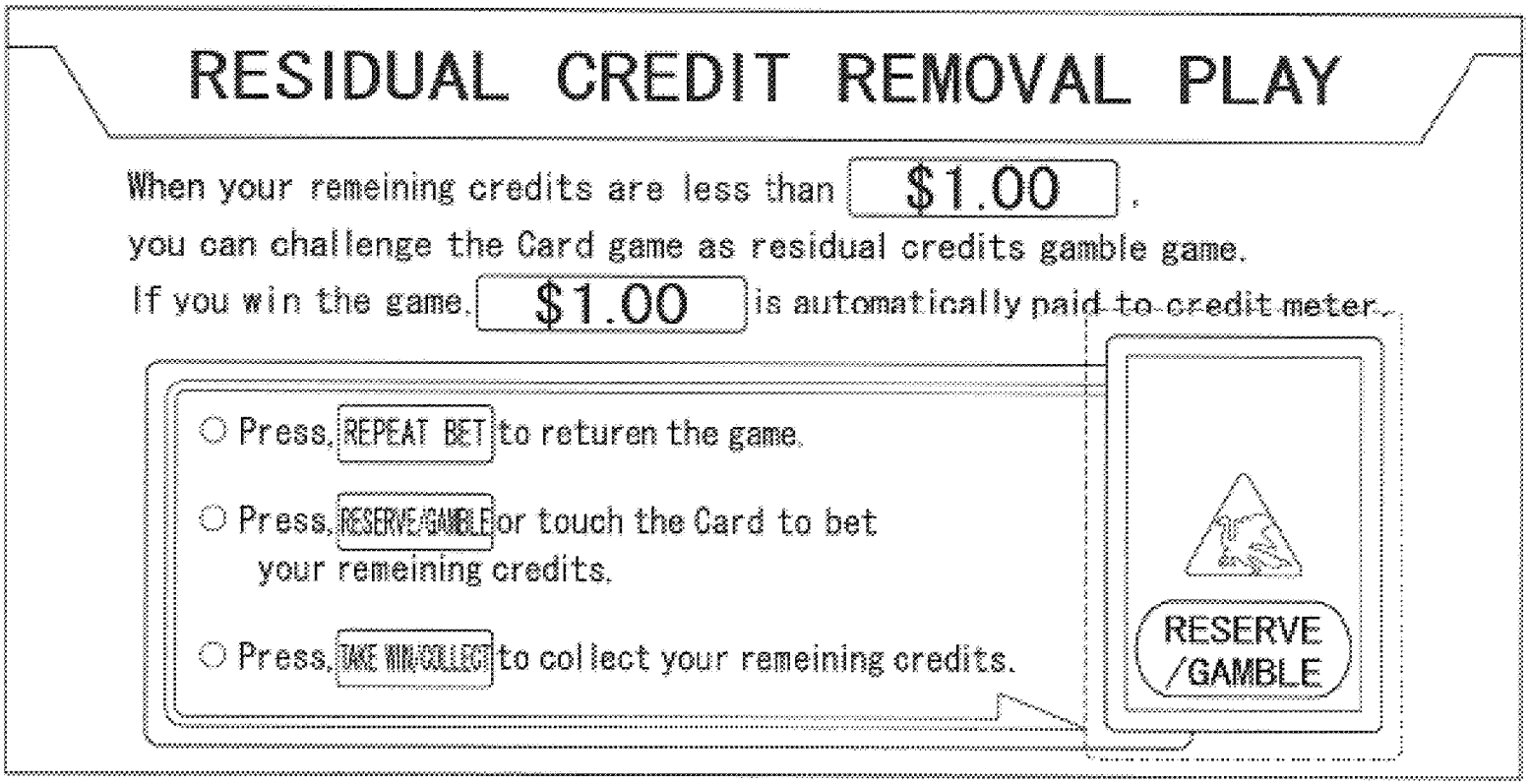
FIG. 53 is an explanatory diagram of an operation sequence in a gamble game.

As shown in FIG. 53, when the shifting to the gamble game occurs, the message "PLAY ON, GAMBLE or TAKE WIN RED" disappears. Immediately after the clearance of the RAM, the card history is empty until the gamble game is played. A message "SELECT RED OR BLACK OR TAKE WIN" is displayed.

In the gamble screen, a heart-shaped red button and a spade-shaped black button are turned on and a TAKE WIN button at the center is turned on. The other buttons are turned off.

Figure 54:
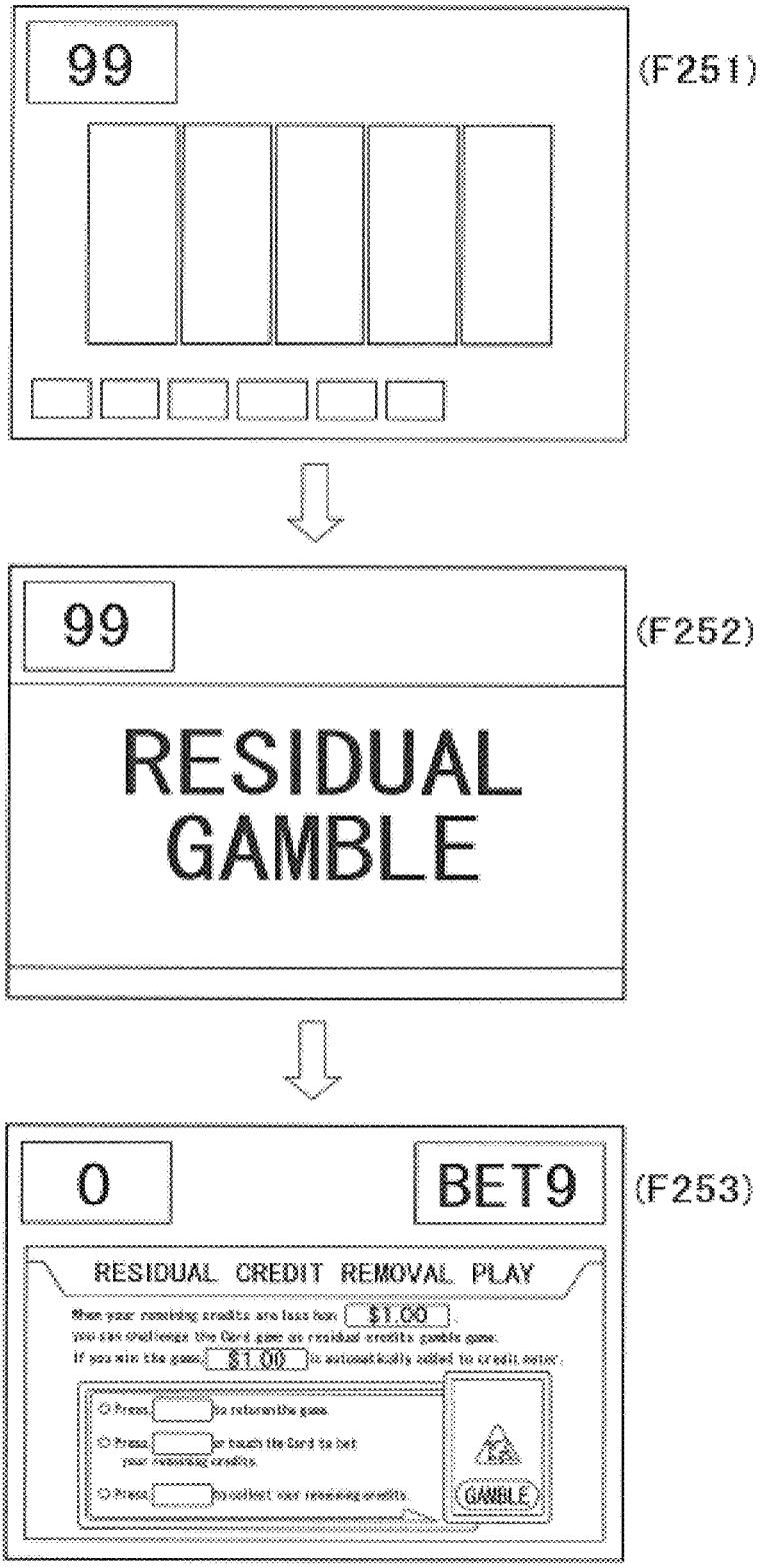
FIG. 54 is an explanatory diagram of an operation sequence in a gamble game.

Subsequently, as shown in FIG. 54, the amount bet on "GAMBLE AMOUNT" is displayed. Then one of the heart-shaped red button, the spade-shaped black button, and the TAKE WIN button at the center on the gamble screen is selected. When the TAKE WIN button is selected, the amount of WIN is added to the credits at once and the idle state comes back.

Figure 55:
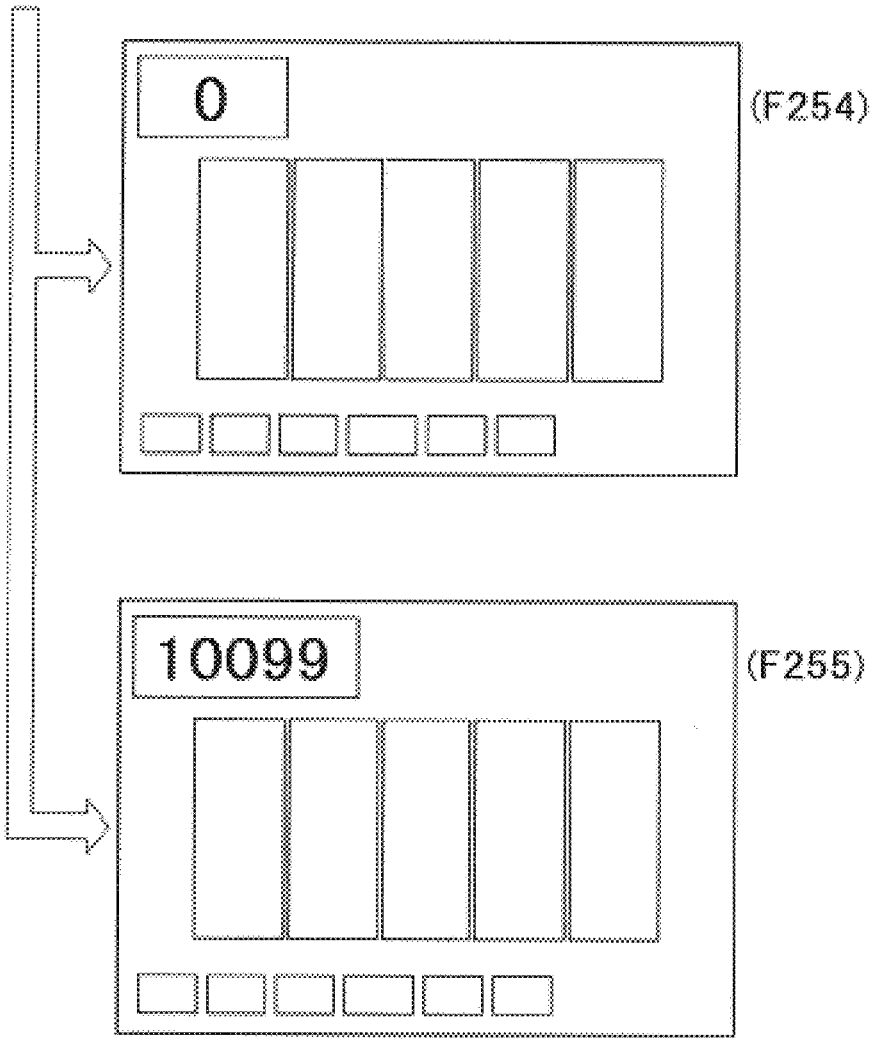
FIG. 55 is an explanatory diagram of an operation sequence in a gamble game.

In case of failure in Gamble, as shown in FIG. 55, non-selected options are darkened. At the left end of the gamble history field, the card history is displayed at once. The preceding card history moves right. The trace of the movement is not illustrated in animation, and hence the history is rewritten at once. The central card result is displayed at once. At this stage, there are no changes in the win meter and the gamble meter. Sound indicating hard luck is output and the shifting to the normal game occurs after several seconds.

Figure 56:
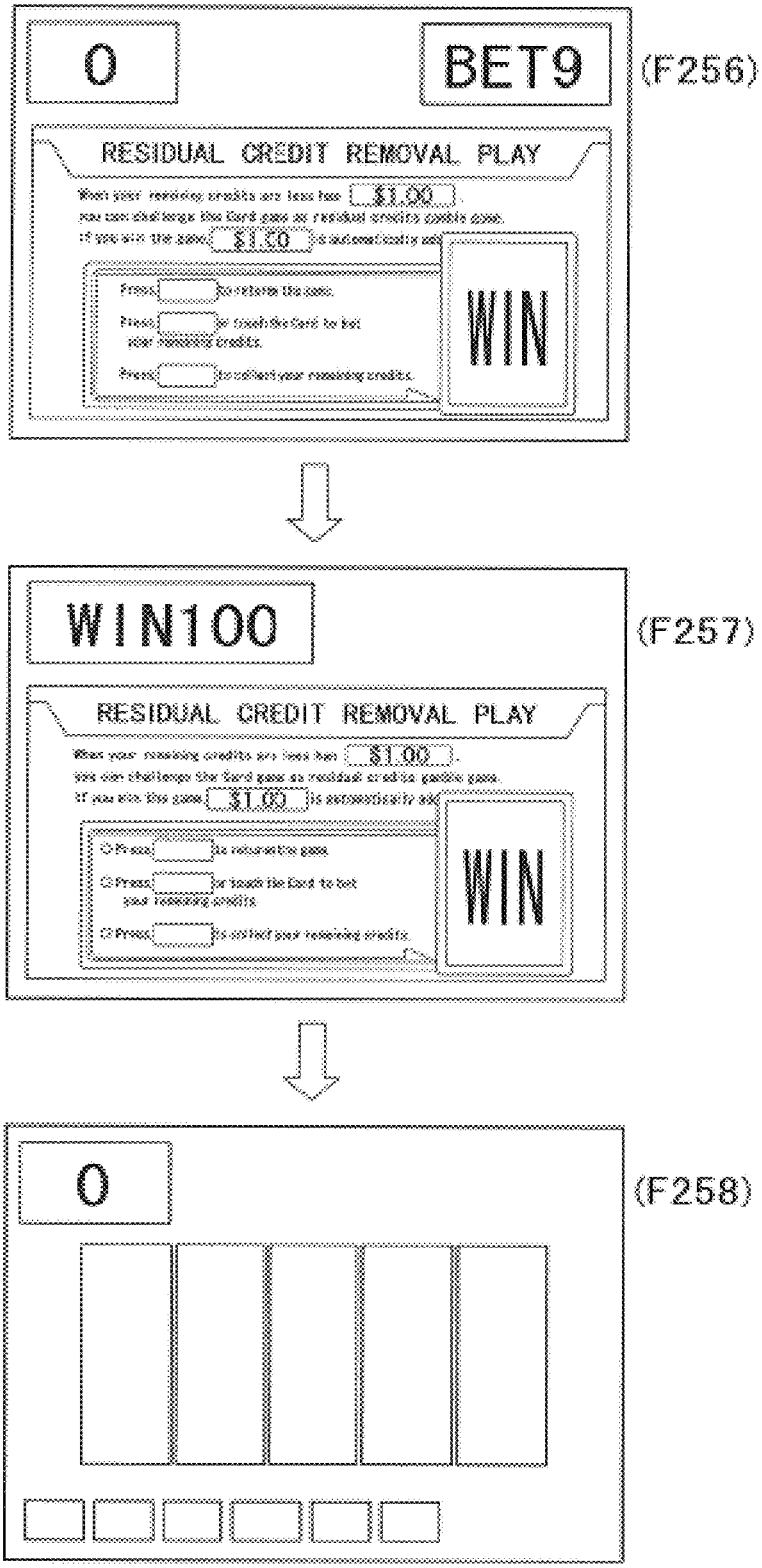
FIG. 56 is an explanatory diagram of an operation sequence in a gamble game.

In case of Success in Gamble, as shown in FIG. 56, non-selected options are darkened. At the left end of the gamble history field, the card history is displayed at once. The preceding card history moves right. The trace of the movement is not illustrated in animation, and hence the history is rewritten at once. On the central card, a normal card and a card with a WIN text are alternately displayed at intervals of one frame, and success sound is output for a predetermined time. To the win meter, the value increase as a result of Gamble is added at once. When the player plays the gamble game until reaching the maximum number to times, the value won is added to the credits at once and the idle state comes back. As shown in FIG. 56, when the player has not played the gamble game until reaching the maximum number to times, a card is turned inside out and the gamble game is continued.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

(Modification)

The following describes a modification. It should be noted that descriptions for structures similar to the above embodiment are omitted.

(Informing Specific Symbol with Increased Percentage)

For example, the lower image display panel 141 or the upper image display panel 142 may be configured to display the specific symbol 503 with an increased percentage.

Figure 61:
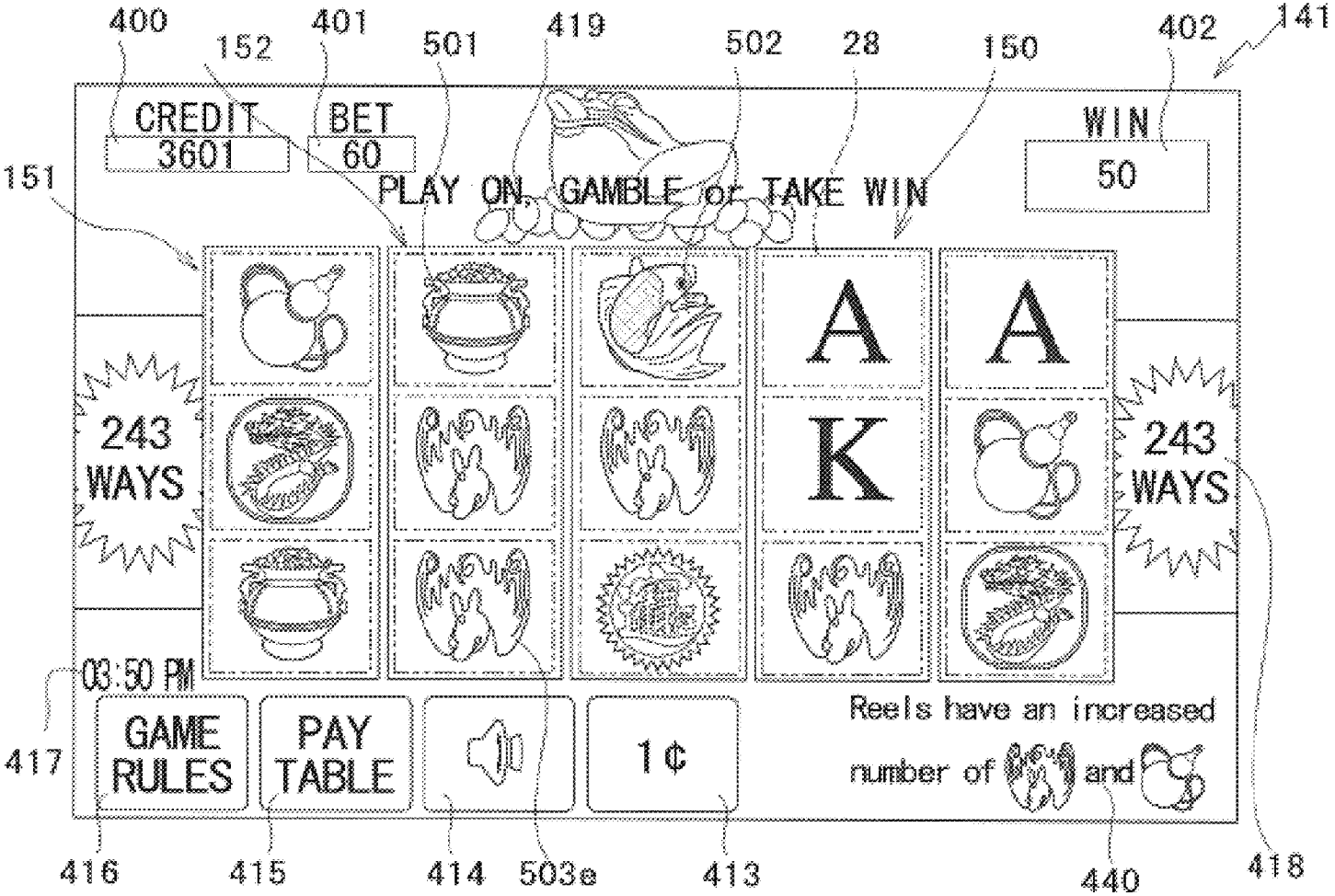
FIG. 61 is an explanatory diagram showing an example display screen on a lower image display panel in a modification.

FIG. 61 is an explanatory diagram illustrating an example modification of the display screen of the lower image display panel 141. As described in the above embodiment, the number of specific symbols 503 with respect to the number of all the symbols 501 in all the symbol arrays 170 increases with an increase in the bet amount by the player. For example, when the credit button 41 is selected, the number of bat symbols 503*e* and the number of gourd symbols 503*d* in the symbol arrays 170 are more than those when the credit button 40 is selected. In the present modification, as shown in FIG. 61, an information image 440 which informs the specific symbol 503 with an increased percentage is informed is displayed at the lower right part of the lower image display panel 141. The increased symbol image 440 presents, in the form of an image, the specific symbol 503 whose percentage in the symbol arrays 170 is increased in the current game, and indicates that the percentage of the specific symbol 503 in the symbol arrays 170 is increased. In the example of FIG. 61, the increases in the percentages of the bat symbol 503*e* and the gourd symbol 503*d* in the symbol arrays 170 are informed.

Figure 62:
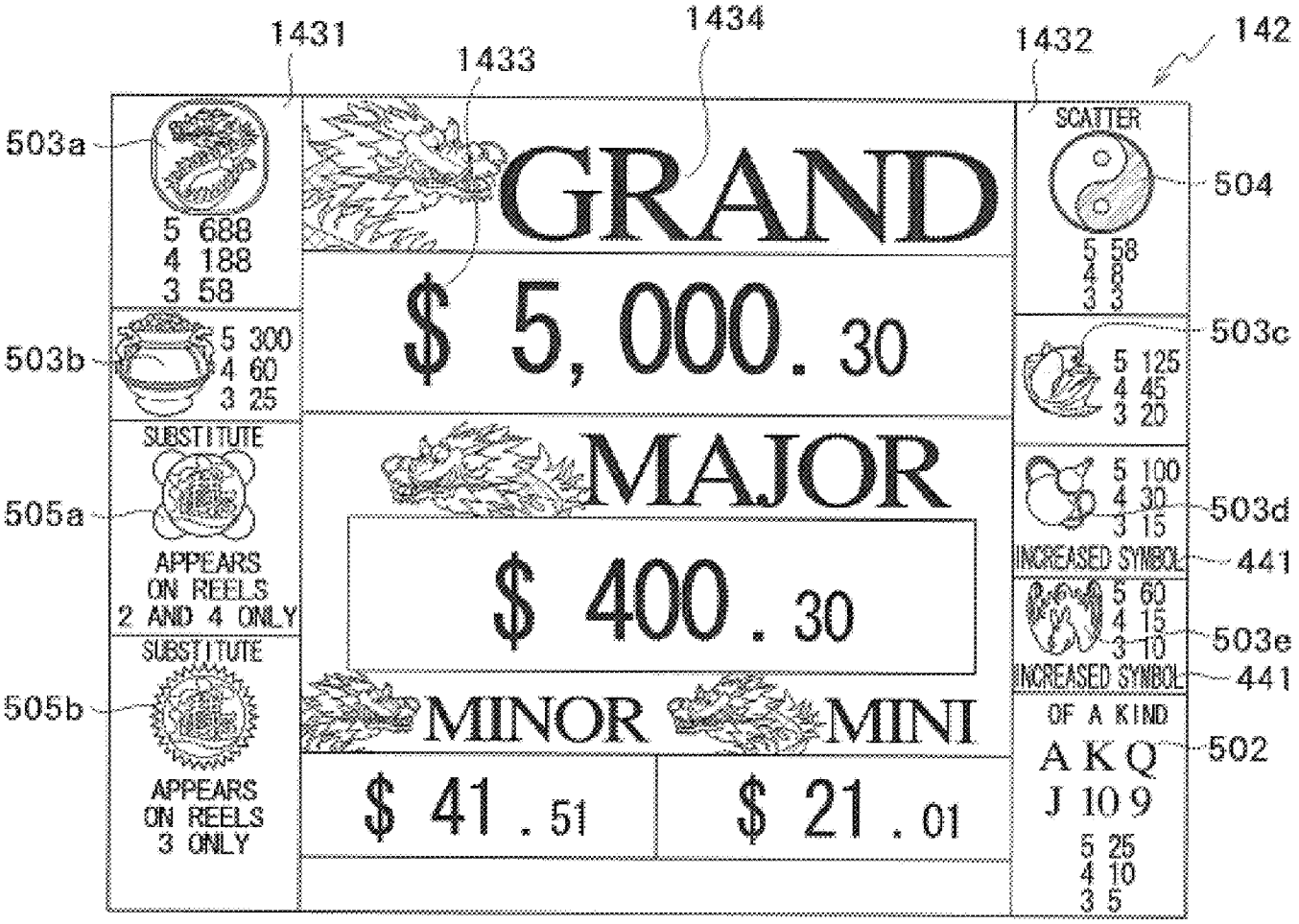
FIG. 62 is an explanatory diagram showing an example display screen on an upper image display panel in the modification.

FIG. 62 is an explanatory diagram illustrating an example modification of the display screen of the upper image display panel 142. As shown in FIG. 62, during a game with an increased percentage of the specific symbol 503 in the symbol arrays 170, the increase in the percentage of the specific symbol 503 may be indicated in the payout table. In the example of FIG. 62, the information image 441 indicating the increase in the percentage is displayed for the bat symbol 503*e* and the gourd symbol 503*d* in the payout table.

Figure 63:
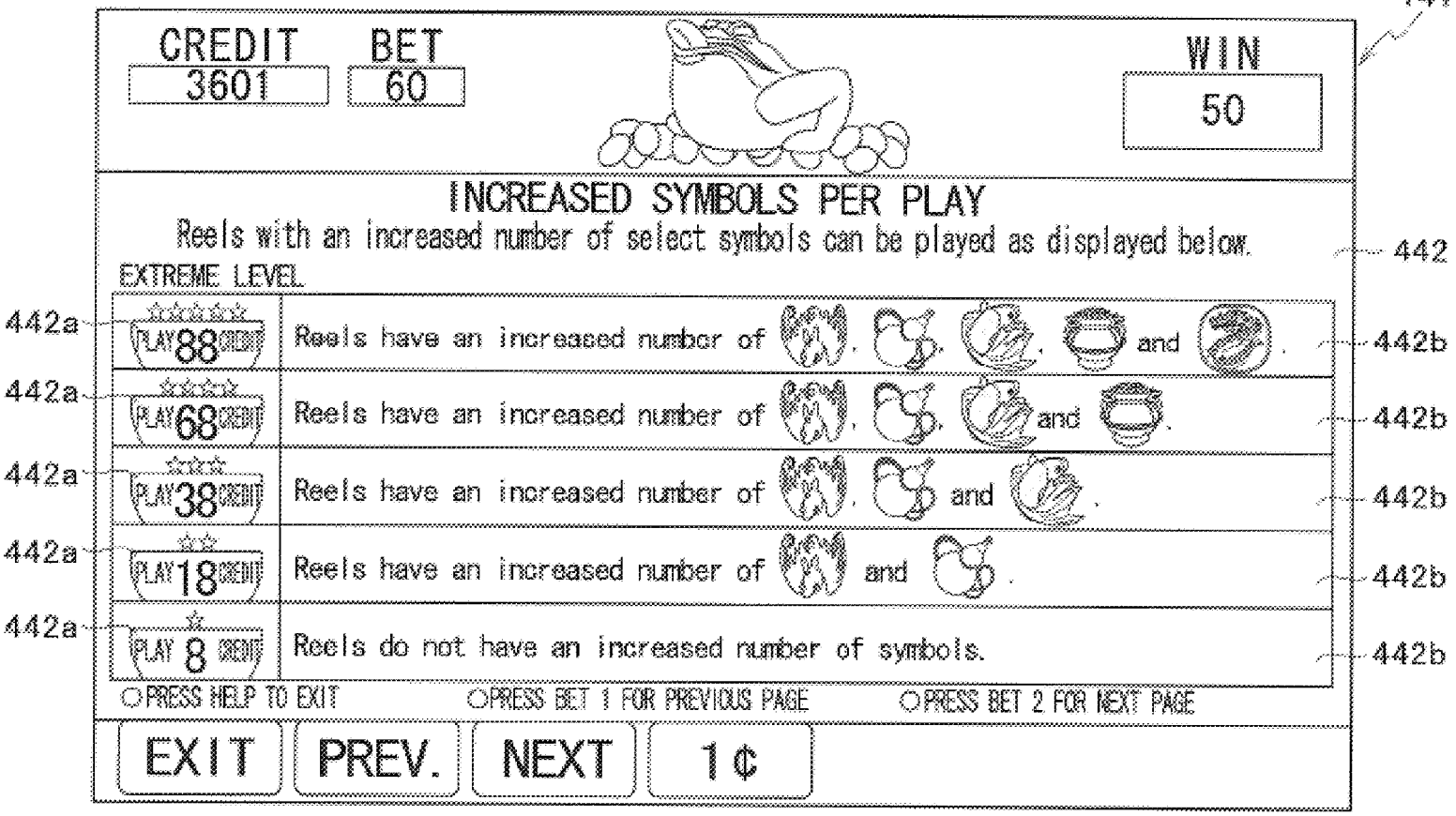
FIG. 63 is an explanatory diagram showing an example help screen in the modification.

FIG. 63 is an explanatory diagram showing a modification of the help screen. As shown in FIG. 63, an increased symbol description page 442 may be provided in the first page of the help screen, which describes the specific symbols 503 which stepwisely increase for every increase in the bet amount. Specifically, the increased symbol description page 442 displays five symbol bet images 442*a* each of which indicates possible bet amounts in multiple steps, in the form of a number of stars and a value; and for each symbol bet image 442*a*, displays a corresponding increased symbol image 442*b* indicating in the form of text and images the types of specific symbols 503 whose percentages in the symbol arrays 170 are increased. The five symbol bet images 442*a* correspond to the credit buttons 40 to 44, respectively, and clarifies which types of specific symbols 503 are increased for using which types of credit buttons 40 to 44. It should be noted that in the present modification, the credit buttons 40 to 44 place a credit amounts of 8, 18, 38, 68, and 88, respectively.

(Trigger for Bonus Game)

The above embodiment executes the first random determination to determine whether to trigger the bonus game, with a probability corresponding to the number of wild symbols 505 rearranged, and further executes the second random determination, apart from the first random determination, to determine whether to trigger the bonus game every time the normal game is run. However, the present invention is not limited to this. In the present modification, the above described second random determination is not executed, and executes a third random determination for determining whether to trigger the bonus game, when there is a payout based on a dragon symbol 503*a* which is the specific symbol 503*a* yielding the highest payout (top symbol). By the payout based on the dragon symbol 503*a*, it means a payout resulting from rearrangement of three or more dragon symbols 503*a*, or a payout resulting from rearrangement of three or more dragon symbols 503*a* and the wild symbols 505. As described, in the present modification, the bonus game is triggered by the first random determination and the third random determination It should be noted that the third random determination is executed only in the normal game.

As shown in FIG. 64, the wild symbol random determination table stores values used in the first random determination. These values are different depending on the type of symbol bets (SBB1 to SBB5), and are selected according to the setting values (V1 to V7). Further, as shown in FIG. 64, the wild symbol random determination table is selected out of five different tables according to the setting values (SC01 to SC48) set by AUDIT.

The first random determination is executed with probabilities where the denominator is the value selected from the wild symbol random determination table, and the numerator is the value resulting from multiplication of a product of the number of wild symbols 505 appeared and 10000000000000, further multiplied by a set magnification factor of bet buttons 34 to 38.

As shown in FIG. 65, a top symbol random determination table stores values used in the third random determination. These values are different depending on the type of symbol bets (SBB1 to SBB5), and are selected according to the setting values (V1 to V7). Further, as shown in FIG. 65, the top symbol random determination table is selected out of five different tables according to the setting values (SC01 to SC48) set by AUDIT.

The third random determination is executed with probabilities where the denominator is the value selected from the top symbol random determination table, and the numerator is the value resulting from multiplication of a product of the number of wild symbols 505 appeared and 10000000000000, further multiplied by a set magnification factor of bet buttons 34 to 38.

Figure 66:
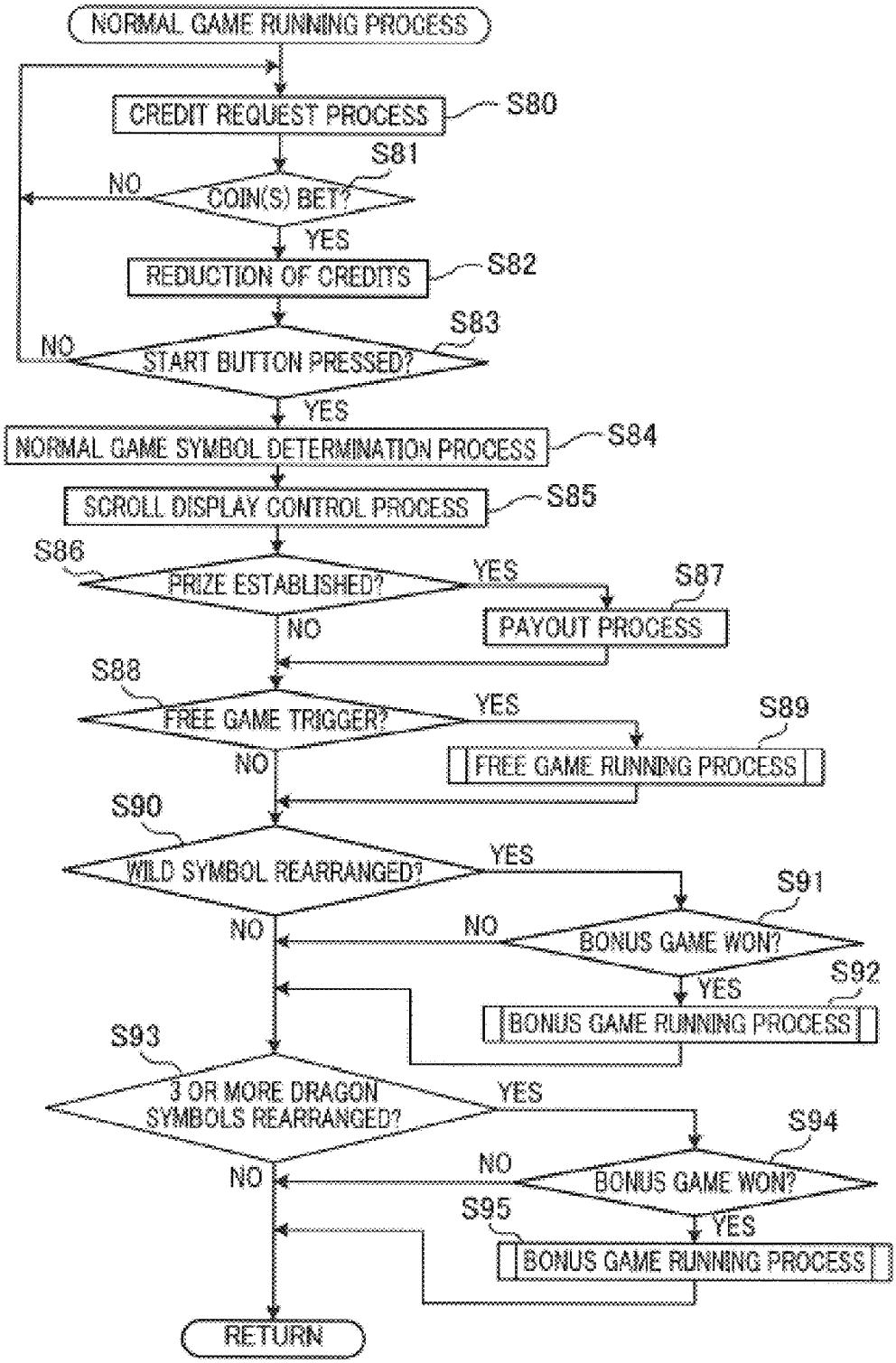
FIG. 66 is a flowchart of a normal game running process in the modification.

FIG. 66 is a flowchart of a modification of the normal game running process. Step S80 to S83 are the same as step S11 to S13 of the normal game running process shown in FIG. 40. In the present modification, the mystery random determination of step S14 is not executed, and the normal game symbol determination process as in step S15 is executed (S84), and then the scroll display control process as in step S16 is executed (S85). After that, step S86 to S92 are executed similarly to step S19 to S25.

Next, the main CPU 71 determines whether or not three or more dragon symbols 503*a* are rearranged (S93). When three or more dragon symbols 503*a* are rearranged (S93: YES), the random determination for the bonus game is executed according to the number of wild symbols, and whether or not the bonus game is won is determined (S94). Then, if the bonus game is won, the bonus game is run (S95). When three or more dragon symbols 503*a* are not rearranged (S93:NO), when the bonus game is not won (S94: NO), or after the bonus game triggered by rearrangement of three or more dragon symbols 503*a*, the present routine is terminated.

As described, the bonus game is triggered by the first random determination and the third random determination Therefore, when a wild symbol 505 and three or more dragon symbols 503*a* are rearranged in the symbol display region 150 and the both first random determination and the third random determination result in a win, the bonus game will be run twice.

(Bonus Game)

In the above embodiment, the bonus game is run with the same conditions no matter which one of the credit buttons 40 to 44 is selected in the normal game triggering the bonus game. However, the present invention is not limited to this. For example, the obtainable bonus type may be limited from the plurality of bonus types with stepwisely set advantage levels (i.e., Grand Bonus, Major Bonus, Minor Bonus, Mini Bonus), based on the credit buttons 40 to 44 used.

Specifically, in the present modification, the Grand Bonus, Major Bonus, Minor Bonus, and Mini Bonus are obtainable from a bonus game triggered by a normal game in which the credit button 43 or 44 is selected (hereinafter, first bonus game). Further, the Major Bonus, Minor Bonus, and Mini Bonus are obtainable from the bonus game triggered by the normal game in which any one of the credit buttons 40 to 42 is selected (hereinafter, second bonus game). The first bonus game is the same as that in the above embodiment, and therefore no further description is provided below. The following describes the second bonus game.

Figure 67:
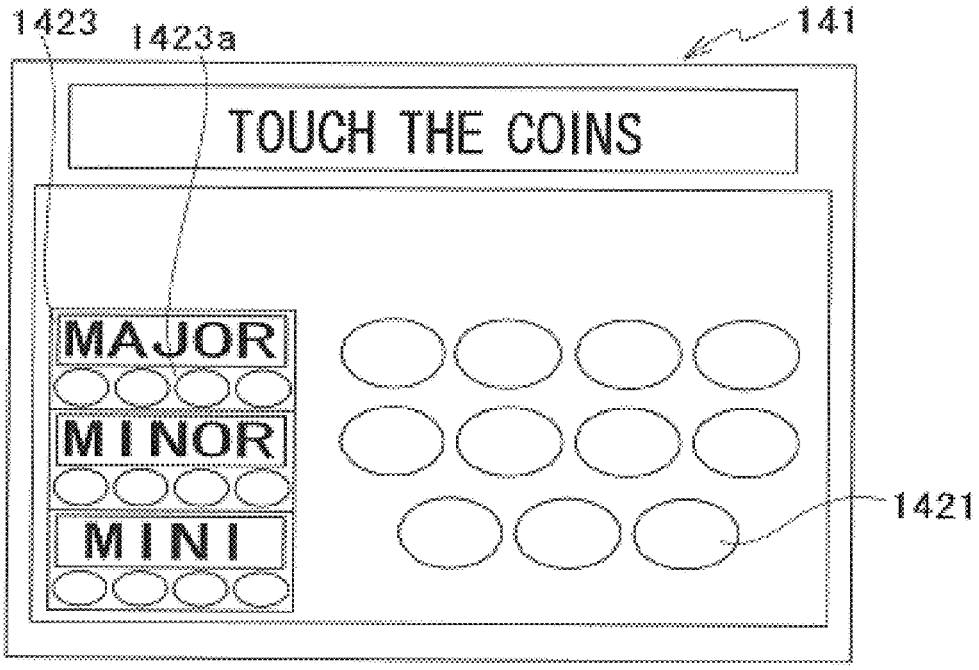
FIG. 67 is an explanatory diagram showing an example display screen on a lower image display panel in a modification.

As shown in FIG. 67, when the second bonus game is started, a plurality of selectable images 1421 are displayed on the lower image display panel 141. While the first bonus game displays 14 selectable images 1421, the second bonus game displays 11 selectable images 1421. Since two bonus rank images 1422 for Grand Bonus and one double bonus rank image 1422*e* for Grand Bonus are excluded, the number of selectable images 1421 as a whole is reduced. Therefore, in the second bonus game, any one of the Major Bonus, Minor Bonus, and Mini Bonus is selectable.

Further, the lower image display panel 141 is provided with a rank count region 1423 which displays the count of each type of the bonus rank images 1422. Since three types of bonuses, i.e., Major Bonus, Minor Bonus, and Mini Bonus are selectable in the second bonus game, there are rank count regions 1423 corresponding to these three types of bonuses. The rank count region 1423 is provided with a predetermined number (four) of count images 1423*a* for each type of the bonus rank image 1422. Every time the bonus rank image 1422 is displayed, the number of the bonus rank images 1422 is counted for each type, and the count values are indicated on the rank count region 1423. That is, the predetermined number of count images 1423*a* are changed so as to be the same as the bonus rank images 1422.

The slot machine 10, in the second bonus game, determines one bonus type out of the Major Bonus, Minor Bonus, and Mini Bonus before an effect display related to the second bonus game is provided. The slot machine 10 controls the lower image display panel 141 so that the number of the bonus rank images 1422 corresponding to the bonus determined reaches a predetermined number (e.g., four) in the effect display. That is, the player selects the selectable images 1421, and when the number of a type of bonus rank images 1422 reaches the predetermined number, the player is entitled to the bonus type which corresponds to that type of bonus rank image 1422.

Figure 68:
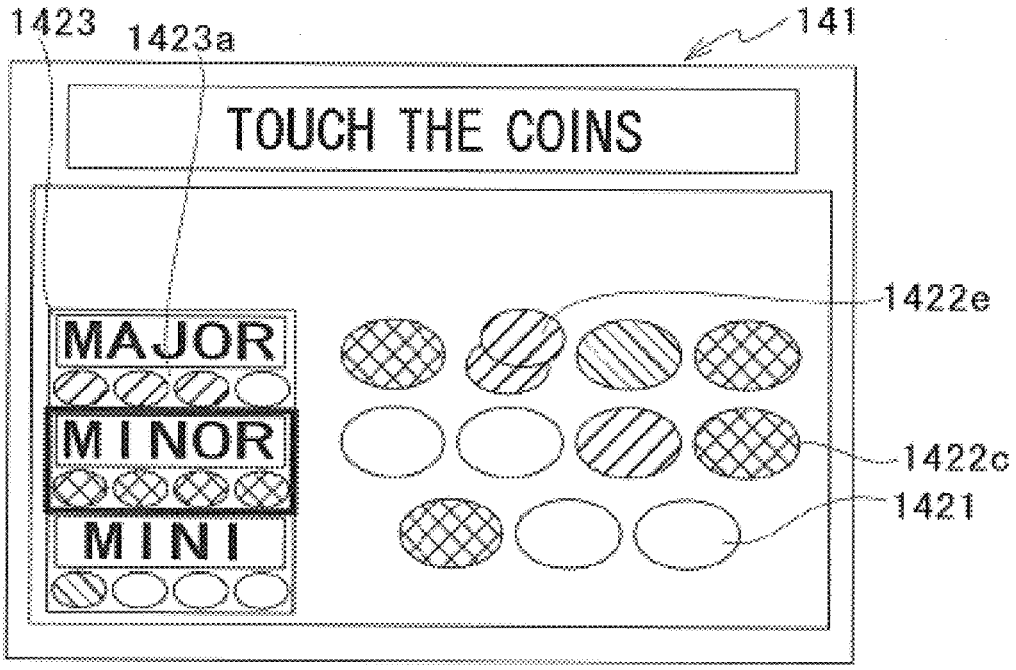
FIG. 68 is an explanatory diagram showing an example display screen on a lower image display panel in the modification.

FIG. 68 shows an example situation where the Minor Bonus is won in the second bonus game. Specifically, as the result of the player picking the selectable images 1421, four Minor Rank images 1422*c* are displayed, achieving the predetermined number (four). As to the double bonus rank image 1422*e*, the selection includes only that counted as the Major Bonus.

In the first bonus game and the second bonus game, the following tables are used for random determination and the like. It should be noted that the values in each table are modifiable by setting the setting values (SC01 to SC48) through AUDIT and the like.

As shown in FIG. 69, a progressive initial value table stores initial values of the first bonus game and the second bonus game. The slot machine 10 determines the initial value of the progressive awarded as the payout in the bonus game, by referring to the progressive initial value table.

As shown in FIG. 70, a progressive default increment rate table stores the default increment rates of the first bonus game and the second bonus game. The slot machine 10 determines the variation rate of the progressive by referring to the progressive default increment rate table.

It should be noted that limits are provided to the progressive values, and the limits are 999999999.99 dollars for Grand Bonus, 9999999.99 dollars for Major Bonus, 999999.99 dollars for Minor Bonus, and 999999.99 dollars for Mini Bonus.

Further, as shown in FIG. 71, a first bonus game random determination table stores weighting values for randomly determining any of the Grand Bonus, Major Bonus, Minor Bonus, and Mini Bonus in the first bonus game. That is, values deriving from fractions with a total of these weighting values as the denominator, and the respective weighting values as the numerators are the probabilities of winning bonuses in the first bonus game.

Further, as shown in FIG. 72, a second bonus game random determination table stores weighting values for randomly determining any of the Major Bonus, Minor Bonus, and Mini Bonus in the second bonus game. That is, values deriving from fractions with a total of these weighting values as the denominator, and the respective weighting values as the numerators are the probabilities of winning bonuses in the second bonus game.

As described, with an increase in the bet amount by the player, the upper limit of the obtainable bonus may be set higher in the bonus game triggered when predetermined condition is met by the result of the normal game run by the bet.

Figure 73:
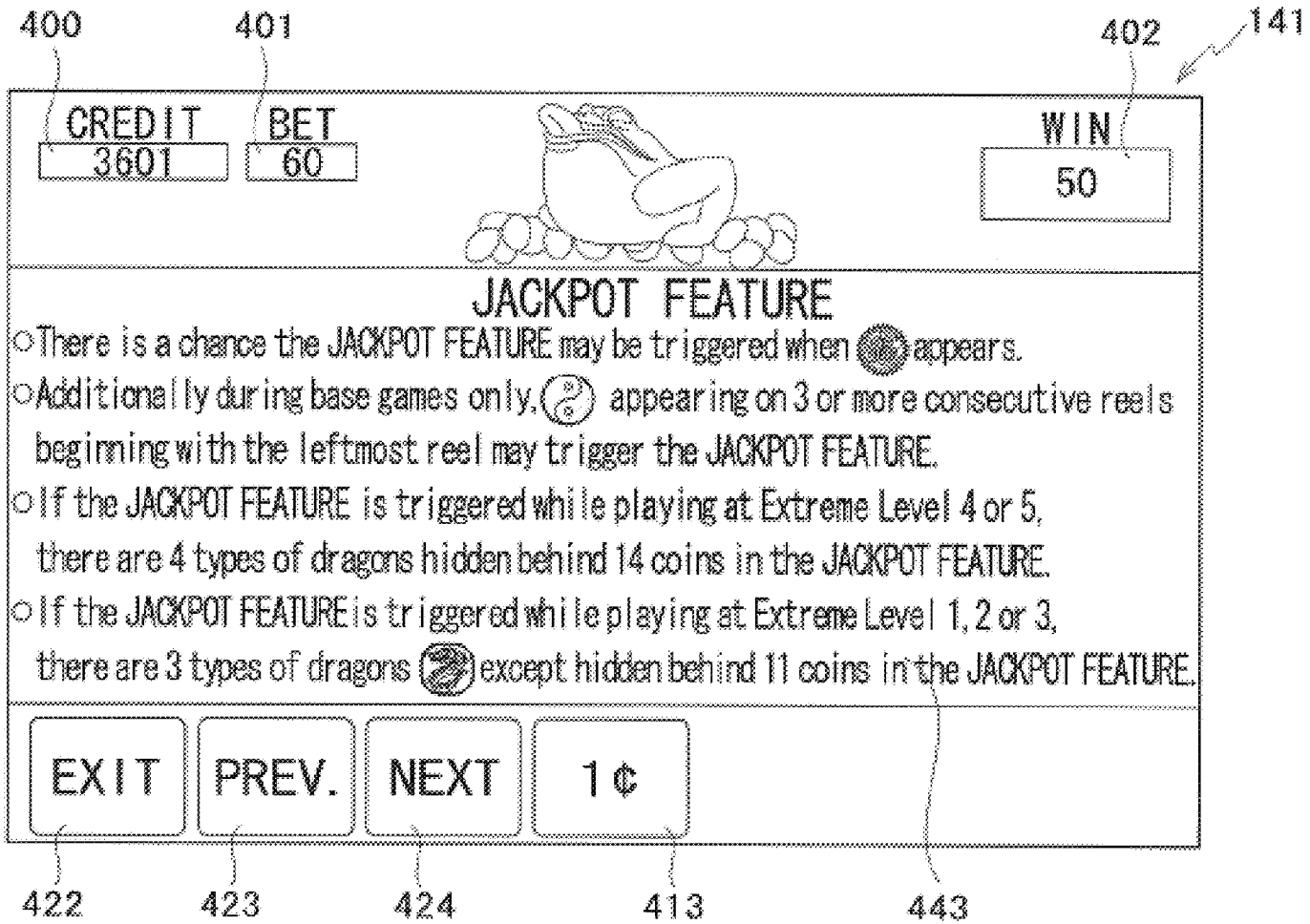
FIG. 73 is an explanatory diagram showing an example help screen in the modification.

As shown in FIG. 73, the bonus description page 443 on the help screen describing the bonus game explains that the obtainable types of bonuses out of the plurality of bonus types with stepwisely set advantage levels are limited according to which credit buttons out of credit buttons 40 to 44 are used. In the present modification, there are five levels (extreme levels) which are selected according to the credit buttons 40 to 44. The bonus description page 443 explains that four types of bonuses (Grand Bonus, Major Bonus, Minor Bonus, and Mini Bonus) are obtainable from a bonus game triggered by a normal game of level 4 or level 5 which is started by selecting the credit button 43 or 44. Further, the bonus description page 443 explains that three types of bonuses (Major Bonus, Minor Bonus, and Mini Bonus) are obtainable from a bonus game triggered by a normal game of level 1 to level 3 which is started by selecting the credit button 40 to 42.

(First Modification of Symbol Arrays for Normal Game and Free Game)

In the above embodiment, the number of the wild symbols 505 is the same both in the normal game and the free game. However, the present invention is not limited to this. Further, the above embodiment involves the normal wild symbols 505*a* and the double wild symbols 505*b*; however, the present invention is not limited to this and it is possible to involve only the normal wild symbols 505*a*.

FIG. 74 shows symbol arrays in the normal game with the symbol bet of 1. As shown in FIG. 74, the wild symbol 505 is arranged in the positions of "11" of the second reel, "15" and "45" of the third reel, and "36" of fourth reel. That is, the probability of having the wild symbol 505 rearranged on the second reel in the symbol display region 150 is 3/68; the probability of having the wild symbol 505 rearranged on the third reel in the symbol display region 150 is 6/64; and the probability of having the wild symbol 505 rearranged on the fourth reel in the symbol display region 150 is 3/64.

FIG. 75 and FIG. 76 show symbol arrays in the free game triggered by the normal game with the symbol bet of 1. As shown in FIG. 75 and FIG. 76, the wild symbol 505 is arranged in the positions of "9" of the second reel, "0", "1" and "2" of the third reel, and "34" of fourth reel. That is, the probability of having the wild symbol 505 rearranged on the second reel in the symbol display region 150 is 3/96; the probability of having the wild symbol 505 rearranged on the third reel in the symbol display region 150 is 100%; and the probability of having the wild symbol 505 rearranged on the fourth reel in the symbol display region 150 is 3/61.

As described, as compared with the normal game with the symbol bet of 1, the wild symbol 505 is set to stop throughout the third reel in the free game of symbol bet of 1. Therefore, the first random determination for the bonus game, which is executed when the wild symbol 505 stops, is always executed every time rearrangement takes place in the free game.

FIG. 77 shows symbol arrays in the normal game with the symbol bet of 5. As shown in FIG. 77, the wild symbol 505 is arranged in the positions of "11", "17", and "44" of the second reel, "3", "15", and "46" of the third reel, and "36" and "51" of fourth reel. That is, the probability of having the wild symbol 505 rearranged on the second reel in the symbol display region 150 is 9/60; the probability of having the wild symbol 505 rearranged on the third reel in the symbol display region 150 is 9/60; and the probability of having the wild symbol 505 rearranged on the fourth reel in the symbol display region 150 is 6/60.

As described, as compared with the normal game with the symbol bet of 1, the symbol arrays are modified so that the wild symbol 505 is rearranged at a higher probability in the normal game with the symbol bet of 5.

FIG. 78 shows symbol arrays in the free game triggered by the normal game with the symbol bet of 5. As shown in FIG. 75 and FIG. 76, the wild symbol 505 is arranged in the positions of "0", "10", "16", and "43" of the second reel, "0", "1" and "2" of the third reel, and "0", "35", and "50" of the fourth reel. That is, the probability of having the wild symbol 505 rearranged on the second reel in the symbol display region 150 is 12/59; the probability of having the wild symbol 505 rearranged on the third reel in the symbol display region 150 is 100%; and the probability of having the wild symbol 505 rearranged on the fourth reel in the symbol display region 150 is 9/59.

As described, as compared with the normal game with the symbol bet of 5, the wild symbol 505 is set to stop throughout the third reel in the free game of symbol bet of 5. Therefore, the first random determination for the bonus game, which is executed when the wild symbol 505 stops, is always executed every time rearrangement takes place in the free game. Further, as compared with the free game with the symbol bet of 1, the symbol arrays are modified so that the wild symbol 505 is rearranged at a higher probability in the free game with the symbol bet of 5.

As described, the symbol arrays are modified so that the wild symbol 505 is rearranged at a higher probability in the free game than the normal game. Further, the symbol arrays are modified so that the larger the bet amount, the higher the probabilities of having the wild symbol 505 rearranged, in either the normal game or the free game. Further, in the free game, a reel with a symbol array entirely constituted of wild symbol 505 is provided so that the wild symbol 505 is always stopped.

(Second Modification of Symbol Arrays for Normal Game and Free Game)

FIG. 79 shows symbol arrays in the normal game with the symbol bet of 1. As shown in FIG. 79, the wild symbol 505 is arranged in the positions of "11" of the second reel, "15" and "45" of the third reel, and "36" of fourth reel. That is, the probability of having the wild symbol 505 rearranged on the second reel in the symbol display region 150 is 3/68; the probability of having the wild symbol 505 rearranged on the third reel in the symbol display region 150 is 6/64; and the probability of having the wild symbol 505 rearranged on the fourth reel in the symbol display region 150 is 3/64.

FIG. 80 shows symbol arrays in the free game triggered by the normal game with the symbol bet of 1. As shown in FIG. 75 and FIG. 76, the wild symbol 505 is arranged in the positions of "5", "6", and "7" of the second reel, "14", "15" and "16" of the third reel, and "3", "4", and "5" of the fourth reel. That is, the probability of having the wild symbol 505 rearranged on the second reel in the symbol display region 150 is 5/49; the probability of having the wild symbol 505 rearranged on the third reel in the symbol display region 150 is 5/43; and the probability of having the wild symbol 505 rearranged on the fourth reel in the symbol display region 150 is 5/42.

As described, as compared with the normal game with the symbol bet of 1, the symbol arrays are modified so that the wild symbol 505 stops at a higher probability in the free game with the symbol bet of 1. Further, the wild symbol 505 is arranged continuously in the symbol array, the wild symbol 505 could stop one after another on the same reel. Therefore, it is likely to win a high payout or increase the probabilities of winning in the first random determination for the bonus game.

FIG. 81 shows symbol arrays in the normal game with the symbol bet of 5. As shown in FIG. 81, the wild symbol 505 is arranged in the positions of "11", "17", and "44" of the second reel, "3", "15", and "46" of the third reel, and "36", and "51" of the fourth reel. That is, the probability of having the wild symbol 505 rearranged on the second reel in the symbol display region 150 is 9/60; the probability of having the wild symbol 505 rearranged on the third reel in the symbol display region 150 is 9/60; and the probability of having the wild symbol 505 rearranged on the fourth reel in the symbol display region 150 is 6/60.

As described, as compared with the normal game with the symbol bet of 1, the symbol arrays are modified so that the wild symbol 505 is rearranged at a higher probability in the normal game with the symbol bet of 5.

FIG. 82 shows symbol arrays in the free game triggered by the normal game with the symbol bet of 5. As shown in FIG. 75 and FIG. 76, the wild symbol 505 is arranged in the positions of "4", "5", "17", "18", "19", "46", and "47" of the second reel, "3", "4", "28", "29", "30", "53" and "54" of the third reel, and "32", "33", "34", "51", and "52" of the fourth reel. That is, the probability of having the wild symbol 505 rearranged on the second reel in the symbol display region 150 is 13/60; the probability of having the wild symbol 505 rearranged on the third reel in the symbol display region 150 is 13/60; and the probability of having the wild symbol 505 rearranged on the fourth reel in the symbol display region 150 is 9/60.

As described, as compared with the normal game with the symbol bet of 5, the symbol arrays are modified so that the wild symbol 505 stops at a higher probability in the free game with the symbol bet of 5. Further, the wild symbol 505 is arranged continuously in a plurality of positions in the symbol array, the wild symbol 505 could stop one after another on the same reel. Therefore, it is likely to win a high payout or increase the probabilities of winning in the first random determination for the bonus game. Further, as compared with the free game with the symbol bet of 1, the symbol arrays are modified so that the wild symbol 505 is rearranged at a higher probability in the free game with the symbol bet of 5.

As described, the symbol arrays are modified so that the wild symbol 505 is rearranged at a higher probability in the free game than the normal game. Further, the symbol arrays are modified so that the larger the bet amount, the higher the probabilities of having the wild symbol 505 rearranged, in either the normal game or the free game. Further, in the free game, the wild symbol 505 is arranged continuously on the symbol array so that the wild symbol 505 stops in a plurality of positions of the single reel.

(Coin Effect)

Figure 83:
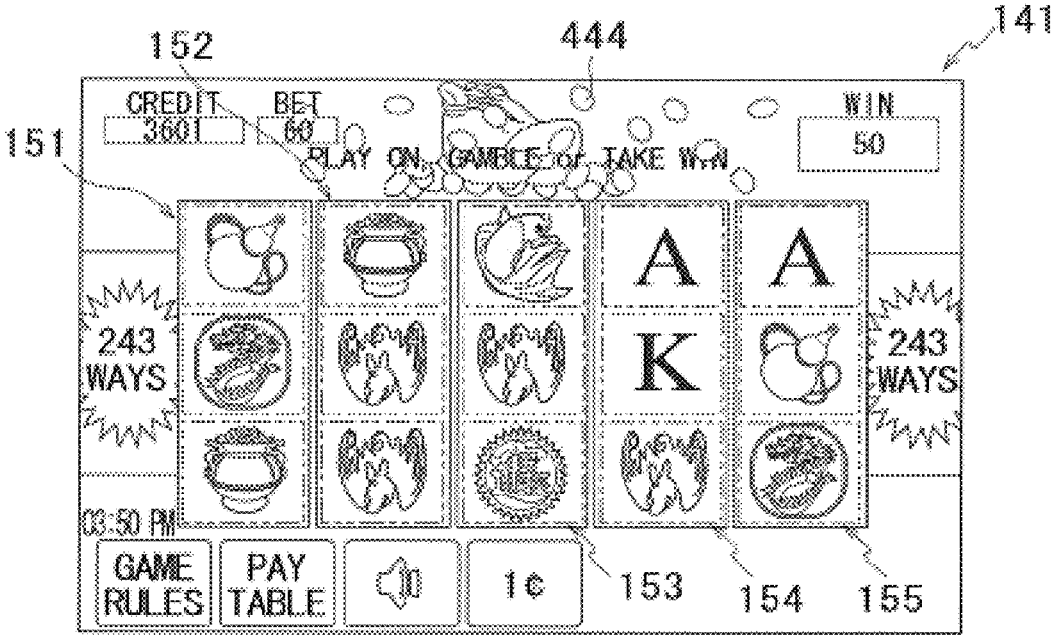
FIG. 83 is an explanatory diagram showing an example display screen on a lower image display panel in the modification.

As shown in FIG. 83, after rearrangement takes place for all the pseudo reels 151 to 155, a coin effect may be provided such that coins 444 fall from the top and the amount of piled up coins 444 at the bottom changes. The coin effect is executed four times and the display on the screen changes in five steps. Specifically, four times of changes take place to reach the ultimate screen display; i.e., changes from the first stage which is the initial display to the second stage, from the second stage to the third stage, from the third stage to the fourth stage, and from the fourth stage to the fifth stage.

FIG. 84 shows a coin sorting table. Each change occurs when the game count reaches a predetermined count based on the coin sorting table and the probability of winning the bonus game. Specifically, the following describes how the game count for executing the coin effect is calculated, using the coin sorting table. First, any one of (A) to (C) is randomly selected. The probabilities of having (A) to (C) selected are the same. In the coin sorting table, the X field stores approximately at what percentage the coin effect is executed. For example in case of (A), the coin effect is executed at every 25% of a theoretical game count (100%) which is calculated from the probability of winning the bonus game. For example, where the probability of winning the bonus game is 1/400, the count of games before the bonus game is 400.

In the coin sorting table, the Y field stores values each deriving from dividing the total of the values in the X fields (i.e., 100) by a value in the corresponding X field. A value resulting from dividing the game count by the Y field value is the number of games before the coin effect. For example in (A), the coin effect takes place at the 100th game from the occurrence of the bonus game. Subsequently, the coin effect takes place at the 200th game, 300th game, and 400th game. That is, the game count reset by occurrence of the bonus game is stored in the memory.

It should be noted that if the bonus game does not occur after the coin effect of the fifth stage, the random determination may be executed every time the wild symbol 505 stops and may further execute the coin effect. For example, it is possible to execute the random determination for winning the coin effect at a probability of 20%. Further, the amount of coins 444 piled up at the bottom does not have to be changed. Repeating the coin effect until the bonus game occurs causes the expectation of the player for the bonus game.

(Effect of Concurrent Winning)

As described above, the bonus game is triggered by the wild symbol random determination and a top symbol random determination. Since the normal game may involve the both wild symbol random determination and the top symbol random determination, there is a possibility that the both random determinations may result in a winning. In cases of the concurrent winnings, the bonus game is run twice, and an effect for concurrent winnings is provided between the bonus game of the first time and that of the second time. This effect for concurrent winnings is described below.

As shown in FIG. 35, the bonus game of the first time is run, and the result is displayed. Subsequently, the display on the lower image display panel 141 returns to the state showing rearrangement of symbols 501 in the symbol display region 150 in the normal game having triggered the bonus game. At this time, the amount of coins 444 piled up by the coin effect is reset to the first stage, i.e., to the initial display.

Figure 85:
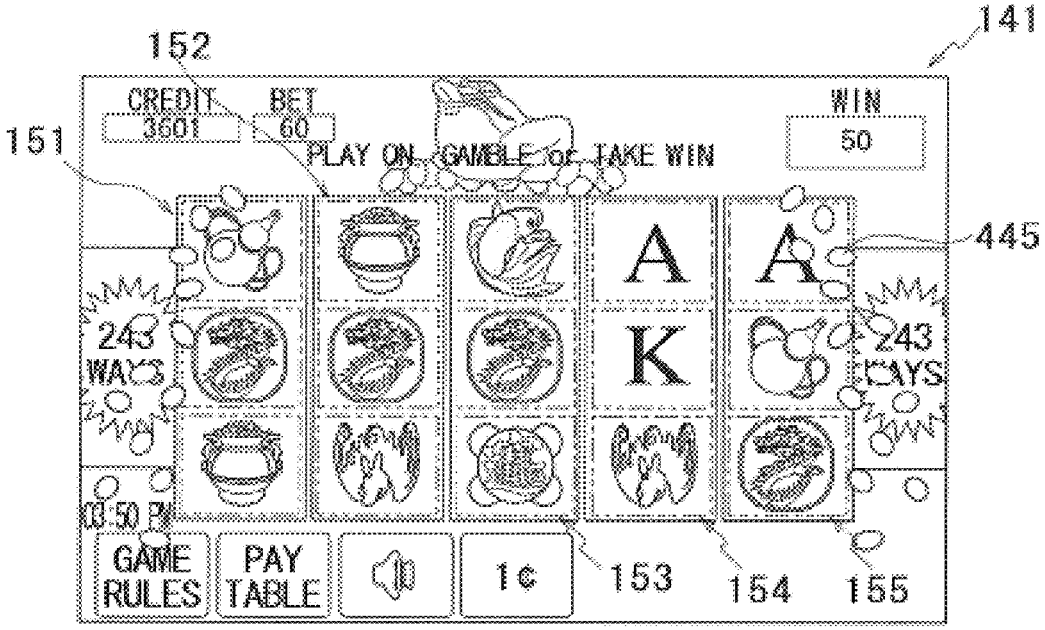
FIG. 85 is an explanatory diagram showing an example display screen on a lower image display panel in the modification.

Then, as shown in FIG. 85, there will be an animation showing the coins 445 falls down from the top to the left and right directions of the symbol display region 150 on the lower image display panel 141.

Figure 86:
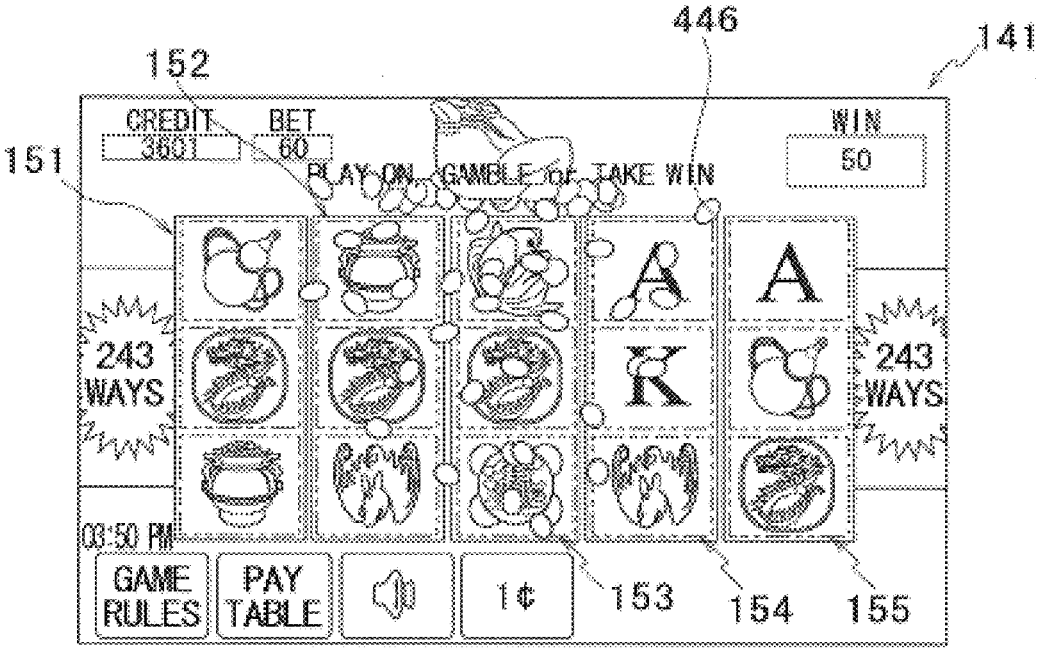
FIG. 86 is an explanatory diagram showing an example display screen on a lower image display panel in the modification.

Further, as shown in FIG. 86, there will be an animation showing the coins 446 falls down from the top to the middle portion of the symbol display region 150 on the lower image display panel 141. After this, the bonus game of the second time is run.

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in this specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A wagering-type gaming machine, comprising:

a value addition mechanism by which a medium of exchange may be added to the wagering-type gaming machine, the value addition mechanism configured to receive and authenticate a currency bill and at least one of a coin, a token, a ticket, or an IC card;

a payout mechanism by which a value corresponding to the medium of exchange may be paid out, the payout mechanism configured to dispense a coin and at least one of a token, a bill, a ticket, or an IC card;

a symbol display device configured to variably display a plurality of symbol arrays with a plurality of symbols including normal symbols and specific symbols more advantageous than the normal symbols, and then display a game result by rearranging the symbols in a symbol display region containing a matrix of cells;

a bet input device capable of receiving a bet whose amount is designatable by a player; and a controller configured to run a normal game which rearranges symbols on the symbol display device on condition that a bet is placed, wherein the controller selects a set of symbol arrays from a plurality of sets of predetermined symbol arrays so that the ratios of the specific symbols to the total number of the symbols in all the symbol arrays increases in the selected set of symbol arrays with an increase in the bet amount, and variably displays and rearranges the selected set of symbol arrays in the symbol display region after completion of reception of the bet.

2. The wagering-type gaming machine according to claim 1, wherein the specific symbols include a plurality of types with stepwisely differentiated advantage levels; and the controller selects a set of symbol arrays so that the percentage of the specific symbol with a high advantage increases with an increase in the bet amount.

3. The wagering-type gaming machine according to claim 2, wherein the bet input device is configured so as to enable betting of stepwise bet amounts corresponding to a plurality of types of the specific symbols; and the controller selects a set of symbol arrays corresponding to a bet amount selected from among the plurality of sets of predetermined symbol arrays such that:

the plurality of sets of the symbol arrays correspond to the plurality of types of specific symbols; and, as the amount bet is increased, the percentage of specific symbols corresponding to each of the sets of symbol arrays is increased in a stepwise manner.

4. The wagering-type gaming machine according to claim 1, wherein the controller increases the percentage of the specific symbols in each of the sets of the plurality of symbol arrays by increasing the number of specific symbols.

5. The wagering-type gaming machine according to claim 1, wherein the controller increases the percentage of the specific symbols in each of the sets of the plurality of symbol arrays by reducing the number of normal symbols.

6. The wagering-type gaming machine according to claim 1, wherein the controller runs a free game requiring no betting, when a predetermined condition is satisfied during the normal game, in the free game, variably displays a plurality of symbol arrays different from those in the normal game on the symbol display device, and then rearranges symbols in the symbol display region, and selects a set of symbol arrays from the plurality of sets of predetermined symbol arrays so that, the larger the bet amount placed in the normal game satisfying the predetermined condition, the higher the ratios of the specific symbols to the number of the symbols in all the symbol arrays is as compared with the percentage of the same in the normal game, and variably displays and rearranges the selected set of symbol arrays in the symbol display region.

7. The wagering-type gaming machine according to claim 1, wherein the controller may be capable of informing an increase in the percentage of the specific symbols to the player.

8. A wagering-type gaming machine, comprising:

a value addition mechanism by which a medium of exchange may be added to the wagering-type gaming machine, the value addition mechanism configured to receive and authenticate a currency bill and at least one of a coin, a token, a ticket, or an IC card;

a payout mechanism by which a value corresponding to the medium of exchange may be paid out, the payout mechanism configured to dispense a coin and at least one of a token, a bill, a ticket, or an IC card;

a symbol display device configured to variably display a plurality of symbol arrays with a plurality of symbols including normal symbols and specific symbols more advantageous than the normal symbols, and then display a game result by rearranging the symbols in a symbol display region containing a matrix of cells;

a bet input device including a plurality of input buttons that enables reception of a bet whose amount is designatable by a player, the input buttons respectively corresponding to a plurality of types of specific symbols having advantage levels that are differentiated in a stepwise manner, the bet input device configured such that as an advantage level of a type of specific symbols corresponding to one of the plurality of input button increases, the bet amount required for each of the one of the plurality of input buttons increases; and a controller that runs a normal game that rearranges symbols on the symbol display device on condition that that a bet is placed, wherein the controller modifies the symbols arrayed in the symbol arrays so that, in the normal game, the ratios of the specific symbols of a type selected through one of the input buttons and the specific symbols, the advantage level of each of which is lower than that of the selected type of specific symbols, to the total number of the symbols in all the symbol arrays is increased; and wherein, the controller modifies the symbols arrayed in the symbol arrays so that, in the normal game, an increase in the ratio of the specific symbols, the advantage level of each of which is higher than that of the selected type of specific symbols, to the total number of the symbols in all symbol arrays, is restricted.

* * * * *